US011187223B2

(12) United States Patent
Ward et al.

(10) Patent No.: US 11,187,223 B2
(45) Date of Patent: Nov. 30, 2021

(54) HOME FLOOD PREVENTION APPLIANCE SYSTEM

(71) Applicant: Logical Concepts, Inc., Indianapolis, IN (US)

(72) Inventors: Thomas Owen Ward, Greenwood, IN (US); David Lee Brown, Greenwood, IN (US); Casey Wayne Hampton, Martinsville, IN (US); Gage Herbert Wilkinson, Indianapolis, IN (US)

(73) Assignee: LOGICAL CONCEPTS, INC., Indianapolis, IN (US)

( * ) Notice: Subject to any disclaimer, the term of this patent is extended or adjusted under 35 U.S.C. 154(b) by 131 days.

(21) Appl. No.: 16/526,254

(22) Filed: Jul. 30, 2019

(65) Prior Publication Data

US 2019/0353156 A1 Nov. 21, 2019

Related U.S. Application Data

(63) Continuation-in-part of application No. 15/949,895, filed on Apr. 10, 2018, now Pat. No. 11,022,124.
(Continued)

(51) Int. Cl.
*F04D 15/02* (2006.01)
*F04B 41/06* (2006.01)
(Continued)

(52) U.S. Cl.
CPC ..... *F04B 41/06* (2013.01); *F04B 49/065* (2013.01); *F04B 49/08* (2013.01); *F04D 13/08* (2013.01);
(Continued)

(58) Field of Classification Search
CPC .. F04D 15/0218; F04D 15/0281; F04D 13/08; F04D 13/10; F04D 13/12; F04B 49/02; F04B 49/025; F04B 23/021
See application file for complete search history.

(56) References Cited

U.S. PATENT DOCUMENTS 3,963,376 A 6/1976 Miskin
4,309,157 A 1/1982 Niedermeyer
(Continued)

OTHER PUBLICATIONS

Notice of Allowance for related U.S. Appl. No. 15/949,895, dated Feb. 11, 2021, 10 pgs.
(Continued)

*Primary Examiner* — Devon C Kramer
*Assistant Examiner* — Thomas Fink
(74) *Attorney, Agent, or Firm* — Crowell & Moring LLP

(57) ABSTRACT

A home flood prevention appliance system includes controller circuitry disposed in a shroud above a cover of a sump basin, and a plurality of electrically operated sump pumps disposed in a lower portion of a structural frame positionable below the cover in the sump basin. The system also includes a water control actuator operable as a water main control device for a domestic water distribution network and a flow meter to measure the flow of municipal water supplied to the network. The controller circuitry configured to selectively energize the pumps to extract liquid from a sump basin based on a liquid level in the sump basin. The water control actuator controlled by the controller circuitry to shut off a municipal water supply to the domestic water distribution network in response to detection of a leak. Communication circuitry included in the home flood prevention appliance may wirelessly communicate.

18 Claims, 63 Drawing Sheets

Related U.S. Application Data

(60) Provisional application No. 62/483,915, filed on Apr. 10, 2017, provisional application No. 62/712,186, filed on Jul. 30, 2018, provisional application No. 62/722,719, filed on Aug. 24, 2018, provisional application No. 62/807,599, filed on Feb. 19, 2019.

(51) Int. Cl.

| | |
|---|---|
| ***F04B 49/08*** | (2006.01) |
| ***F04B 49/06*** | (2006.01) |
| ***F04D 13/08*** | (2006.01) |
| ***F04D 13/12*** | (2006.01) |
| ***F04D 15/00*** | (2006.01) |

(52) U.S. Cl.

CPC ..... *F04D 13/12* (2013.01); *F04D 15/0088* (2013.01); *F04D 15/0281* (2013.01); *F04B 2205/03* (2013.01)

(56) References Cited

U.S. PATENT DOCUMENTS

| | | | | |
|---|---|---|---|---|
| 4,456,432 | A * | 6/1984 | Mannino | F04D 13/068 417/2 |
| 4,949,626 | A | 8/1990 | Townsend et al. | |
| 5,793,294 | A | 8/1998 | Schepka | |
| 8,474,477 | B1 | 7/2013 | Melisz, Jr. | |
| 8,529,228 | B1 * | 9/2013 | Thompson | F04D 15/0218 417/423.3 |
| 8,591,198 | B2 | 11/2013 | Kochan, Jr. et al. | |
| 8,875,729 | B1 * | 11/2014 | Bramble | F04D 13/14 137/362 |
| 8,907,789 | B2 | 12/2014 | Kochan, Jr. et al. | |
| 9,033,686 | B2 | 5/2015 | Kochan, Jr. et al. | |
| D740,698 | S | 10/2015 | Cummings | |
| D741,815 | S | 10/2015 | Cummings | |
| 9,200,630 | B1 | 12/2015 | Huff et al. | |
| 9,404,501 | B2 | 8/2016 | Cummings | |
| 9,523,366 | B2 | 12/2016 | Cummings et al. | |
| 9,525,309 | B2 | 12/2016 | Cummings | |
| 9,528,512 | B2 | 12/2016 | Cummings | |
| 9,528,520 | B2 | 12/2016 | Cummings | |
| 9,528,522 | B2 | 12/2016 | Cummings | |
| 9,528,523 | B2 | 12/2016 | Cummings | |
| 9,528,873 | B2 | 12/2016 | Cummings | |
| 9,534,593 | B2 | 1/2017 | Cummings et al. | |
| 9,534,606 | B2 | 1/2017 | Cummings | |
| 9,534,929 | B1 | 1/2017 | Stamatakis et al. | |
| 9,680,401 | B2 | 6/2017 | Kochan et al. | |
| 9,696,360 | B2 | 7/2017 | Rothbart | |
| 9,709,431 | B1 | 7/2017 | Kinney et al. | |
| 9,912,492 | B2 | 3/2018 | McCarthy, III et al. | |
| 9,958,878 | B2 | 5/2018 | Kochan, Jr. et al. | |
| 9,967,145 | B2 | 5/2018 | Kim | |
| 10,073,428 | B2 | 9/2018 | Bruhn et al. | |
| 10,102,585 | B1 | 10/2018 | Bryant et al. | |
| 10,501,925 | B1 * | 12/2019 | Lavenson | C02F 1/008 |
| 2004/0035471 | A1 | 2/2004 | Harwood | |
| 2006/0045105 | A1 | 3/2006 | Dobosz et al. | |
| 2006/0093492 | A1 | 5/2006 | Janesky | |
| 2006/0275136 | A1 * | 12/2006 | Liu | F04D 15/0218 417/40 |
| 2007/0258827 | A1 | 11/2007 | Gierke | |
| 2008/0150750 | A1 | 6/2008 | Parris | |
| 2009/0058088 | A1 | 3/2009 | Pitchford et al. | |
| 2010/0024541 | A1 | 2/2010 | Schindler | |
| 2011/0085919 | A1 | 4/2011 | Williams et al. | |
| 2011/0311370 | A1 | 12/2011 | Sloss et al. | |
| 2012/0085688 | A1 | 4/2012 | Schmidt et al. | |
| 2012/0193559 | A1 | 8/2012 | Benson et al. | |
| 2012/0325923 | A1 | 12/2012 | Hartfelder et al. | |
| 2013/0113631 | A1 | 5/2013 | Pitchford et al. | |
| 2015/0143892 | A1 * | 5/2015 | Cummings | F04B 49/22 73/168 |
| 2015/0143897 | A1 | 5/2015 | Cummings | |
| 2015/0144818 | A1 | 5/2015 | Cummings | |
| 2015/0147190 | A1 * | 5/2015 | Cummings | F04D 15/0088 417/36 |
| 2015/0240803 | A1 * | 8/2015 | Knight | F04B 51/00 73/168 |
| 2015/0292501 | A1 * | 10/2015 | Knight | H02J 9/062 324/511 |
| 2016/0041565 | A1 | 2/2016 | Edwards | |
| 2016/0161940 | A1 | 6/2016 | Max | |
| 2016/0163177 | A1 | 6/2016 | Klicpera | |
| 2016/0356026 | A1 | 12/2016 | Engler | |
| 2017/0030528 | A1 | 2/2017 | Dietzen et al. | |
| 2017/0175746 | A1 | 6/2017 | Mayleben | |
| 2017/0184417 | A1 | 6/2017 | Pedreiro et al. | |
| 2017/0335550 | A1 | 11/2017 | Sterling et al. | |
| 2017/0356779 | A1 | 12/2017 | Stuyvenberg et al. | |
| 2018/0163730 | A1 | 6/2018 | Wilds et al. | |
| 2018/0168119 | A1 | 6/2018 | Hartfelder | |
| 2018/0292248 | A1 | 10/2018 | Heizenroeder | |
| 2019/0234786 | A1 | 8/2019 | Klicpera | |
| 2019/0281371 | A1 | 9/2019 | Klicpera | |
| 2020/0003217 | A1 | 1/2020 | Wilds | |

OTHER PUBLICATIONS

"Ion+ Connect, Digital Level Controller with Ion Sensor and Text Notifications," indicated as revised on Feb. 1, 2018, pp. 1-2, Metropolitan Industries, Inc., Romeoville, IL.

"Ion Genesis, Smart Controller and Sensors," indicated as revised on Mar. 4, 2019, pp. 1-2, Metropolitan Industries, Inc., Romeoville, IL.

Prindle, D., "Does Cold Weather Have You Worried About Bursting Pipes? Water Hero Has Your Back," dated Nov. 22, 2014, pp. 1-3, Digital Trends, available at URL: https://web.archive.org/web/20160811110129/http://www.digitaltrends.com.

"Water Hero Quick Start Guide," dated Feb. 13, 2018, pp. 1-2, Water Hero, Inc., Beverly, MA.

* cited by examiner

HOME FLOOD PREVENTION APPLIANCE SYSTEM

CROSS-REFERENCE TO RELATED APPLICATIONS

The present application is a continuation-in-part of U.S. patent application Ser. No. 15/949,895, filed Apr. 10, 2018, which claims priority under 35 U.S.C. § 119(e) to U.S. Provisional Application No. 62/483,915, filed Apr. 10, 2017, both of which are incorporated herein by reference. The present application also claims priority under 35 U.S.C. § 119(e) to U.S. Provisional Application No. 62/712,186, filed Jul. 30, 2018; U.S. Provisional Application No. 62/722,719, filed Aug. 24, 2018, and U.S. Provisional Application No. 62/807,599, filed Feb. 19, 2019, all of which are hereby entirely incorporated by reference.

TECHNICAL FIELD

This disclosure relates to an appliance and more particularly to a home flood prevention appliance system.

BACKGROUND

Water damage to homes and businesses can be significant. For example, water damage to insured homes of large insurer's customer base, such as a national insurance company, results in multimillion dollar/year claimed losses. According to the National Flood Insurance program, this is a 3 billion dollar/year problem in the United States. Some examples of causes of water damage include frozen water pipes, water line breaks due to non-freeze situations, and sump pump failures.

SUMMARY

In the presently described examples of a home flood prevention appliance (HFPA) system, water damage avoidance/protection is provided throughout an entire water distribution system of a building structure, such as a home, from a single appliance positioned in a sump pit. The system utilizes a triplex pump system with a dual, redundant pump control system, and sends remote notifications via phone app, push notification, text message, or email. The system is capable of pumping one, two, or three pumps simultaneously. In addition, the system may function as a domestic drinking water protection and monitoring system, utilizing a sensitive water pressure and flow meter plus an automatic home water shutoff valve. If a leak is detected anywhere in the home, whether it be a toilet, faucet, frozen water line, or anywhere else, the system can notify a user and stop the flood. This is accomplished by automatically shutting down the main home water supply line and notifying the user via alert message The home flood prevention appliance system is a self-contained unitary structure, which provides continuous monitoring, automated scheduled testing/recalibration and automated control using a controller/controller circuitry and cooperatively but independently and all three low voltage submersible variable speed pumps are operable as primary and backup pumping systems, and wireless communication, all contained within the structural frame of the appliance. The flow monitoring is maintained in a separate module that can be located remotely from the system housing in situations where the main water supply line does not feed the system.

Interesting features of the system include:

Functions as your basement ground water protection system utilizing triple redundant pumps, with a dual, redundant pump control system. All with remote notification via cellular and wifi alert messages.

Functions as your domestic drinking water protection and monitoring system utilizing a sensitive water pressure and flow meter, and an automatic home water shutoff valve. If a leak is detected anywhere in your home, a toilet, faucet, frozen water line, or anywhere else, the home flood prevention appliance system can notify you anywhere in the world, and automatically stop the flood by shutting down your home water supply. All with remote notification via cellular or wifi alert message.

In the past, the cellar in a home was typically used only for storing excess supplies. The basement in a modern home is no longer a cellar. A basement, today, is commonly the lowest cost way for a builder or homeowner to add a large square footage space to a home, and as such, can become a main gathering room for a family because of its size. Today, a basement can also hold expensive furniture and equipment, things that were in the past reserved for the living room in a home. However, basements typically come with a stigma of getting wet or smelling musty, because of constant groundwater seepage in high water table terrains, and poor basement ventilation.

The home flood prevention appliance system removes the stigma of the musty, or flooding, basement by providing the peace-of-mind that basement flooding and musty smells are being adequately monitored and controlled. Generally speaking, this one piece appliance is installed in a standard existing sump pump pit, utility connections are made, and this single appliance provides 1) a plurality of cooperatively operating electric pumps, 2) a domestic water meter and shut off valve to monitor domestic water use throughout the entire home, and if a leak or abnormal water use is detected anywhere in the home, the water shutoff valve can shut off the domestic water flow, and 3) User selectable Wi-Fi, cellular, Bluetooth™, or satellite telemetry to notify the homeowner of critical water events, and domestic water usage patterns, via text messaging and/or a smart phone app. Thus, this one-piece appliance protects the entire home from the most common water damage problems.

Today, the basement, may be a large family gathering place which can hold thousands of dollars in expensive furniture, pool tables, bars, entertainment centers, exercise equipment, home theatre rooms, and more, are frequently protected from ground water seepage by a single, low cost, submersible sump pump. Many first-time home owners don't know where their sump pump is located, or what it does until typically the pump fails for the first time, and water is backed up in their basement, causing water damage that can cost thousands of dollars to repair. At this point, many homeowners are educated after the fact about how the sump pump removes basement seepage water, and rain water, from the basement or crawlspace foundation, and pumps it to a safe outdoor location. The sump pump is literally the last line of defense to prevent basement flooding from exterior groundwater. Nevertheless, the basement or crawlspace sump pump is considered an "out of sight, out of mind" product that is not typically considered or maintained until it fails.

The limitations of some systems are primarily in the area that they have not kept up with the changes in basement use. Whereas, flooding groundwater into a basement which is only an unfinished concrete holding room for home repair supplies is frankly not a big deal. Nothing valuable has been damaged, and the concrete floor is simply dried out. However, flooding a basement covered in carpet, drywall, expensive cabinetry, etc. can be an extremely expensive restoration and repair, costing in the thousands of dollars, and many times not covered by the homeowner's insurance policy. Basement flooding is so common, and there are so many "finished" basements today, that many insurance companies will apply limits to what they will repair because frankly it's been a losing proposition for them to insure a fully furnished basement from water damage. Because of how most basements are protected, today, it's simply a matter of time before it floods.

Today, single, submersible sump pumps suffer from the fact that they are the single line, last line of protection preventing a basement from flooding. A single leak into the pump can short-out the winding. This leak can happen through the float-ball control switch, the power cord entry area, or any other place on the pump that is submerged under water.

Single point local water detectors can annunciate with a local siren, however, these devices can detect water only at a single location, and if the homeowner or business owner is not present to hear the siren, then the water/flood condition may continue unabated. Water detectors can provide single point detection and can be connected to a home Wifi system to alert the homeowner when not home. Such systems, however, can typically only detect a single point of water leak, and many owners are not tech savvy enough to successfully connect their water detector to their Wifi router. Additionally, routers can frequently "lock up" and need to be power cycled, and are non-functional during power outage conditions.

Additionally, multipoint local water leak detection systems can alert either via local siren, Wifi text message alert and/or both. Regardless of the number of employed single point sensors, such single point sensors can only detect a water leak in the exact location of the sensor(s). Leaks can occur anywhere; in walls, crawl spaces, inside appliances, and many other locations which are simply not reachable via a single point sensor. It would take a large number of such single point sensors to cover a whole home or other building structure that includes a domestic water distribution network system. Additionally, these single point sensors are typically battery powered. Many times when the sensor is needed the most, such as during a flood event, the sensor battery is dead, and again the event is not detected. Also, a typical homeowner is not a wireless expert, and may not be able to correct wireless reception problems from a battery powered single point sensor as the battery voltage degrades over time. Further, simply moving an object, such as a couch, in front of a single point battery sensor can disable its ability to transmit to a receiver.

In sharp contrast to a monitoring-only system, the home flood prevention appliance system described herein can include the capability to shut down the main water supply and thus stop a drinking water leak. The home flood prevention appliance can include one or more water control actuators, such as electrically actuated water shutoff valves, and one or more sump pumps so that the system can not only detect a leak occurring anywhere in a building structure to protect the entire building structure, such as a home, and thus minimize damage and insurance claims, but also the system may operate from a reliable power source, such as a micro-hydropower generator, so as to not be affected by dead batteries and wireless point sensor connectivity issues.

Thus, the home flood prevention appliance system can provide a leak protection system that overcomes disadvantages associated with using single and multipoint water sensors. The home flood prevention appliance can include as internal components, such as an electrically actuated shut off valve, and a sensitive water meter in communication with the cellular and wifi radio transmitters; multiple sump pumps, and a micro generator (among other components) all preassembled into the appliance. The electrically actuated shut off valve and water meter system can be included in a shroud of the appliance or may be located remotely from shroud and still cooperatively operate with the other system components within the appliance. The home flood prevention appliance can detect excessive water use and alert the user, anywhere in the world, using reliable wireless technology, and substantially simultaneously shut down the water supply to stop the leak by automatically and dynamically actuating the one or more water control actuators. Instead of a single point water detector that merely alerts the homeowner locally on premise, the home flood prevention appliance may alert locally and remotely, and also substantially simultaneously and automatically shuts down the water source, stopping additional water damage. Additionally, the home flood prevention appliance can monitor the sump status and level. If automated diagnostics performed by the system reveal an issue, or the water meter detects excess water usage, for any reason, the home owner/user is alerted to take action via wirelessly transmitted messages.

The home flood prevention appliance system includes a multiple redundant sump pump system that protects a home from ground water infiltration, and also protects a home from water damage that can happen when a drinking water line freezes and breaks, or a leak develops anywhere in a home domestic water line. Further, redundancy is provided by multiple pumps included in the home flood prevention appliance system, which are independently controlled. In addition to the mechanical pumping redundancy, the home flood prevention appliance system is equipped with a sophisticated electronic, wireless monitoring system that can alert the home owner via the homeowner's mobile device to "take action" on system issues before a big flood occurs. This is something today's simple sump pumps cannot do.

Features of the Home Flood Prevention Appliance System

Some of the interesting features of the home flood prevention appliance system include:

Single appliance with all elements of the system preconfigured, mounted and interconnected within the appliance system to eliminate the need for complex field installation.

The structural frame is sized, and the elements of the system are operationally arranged within the structural frame, for installation in an existing sump pit with all elements of the system interconnected and positioned (or adjustably positionable) with respect to the liquid in the sump pit for immediate and effective operation.

The pumps may run in parallel to increase water pumping rate during high flow times. The pumps may be electric pumps supplied DC power converted from 120 Vac or 240 Vac or a DC power source, such as a battery. In alternative examples, at least some of the pumps may be driven by a prime mover provided by an alternative source different from the energy source and/or prime mover used by other of the pumps. For example, at least some of the pumps may be driven by a prime mover, such as for example an AC or DC motor, supplied by an alternative power source. The alternative power source may be a self-recharging system with energy storage capacity, or a just in time system that when activated or energized may provide the prime mover for the pump(s). In the example of the prime mover of one or more pumps being a motor, the alternative power source may be an electric power source such as a battery system, a fuel cell system, a generator system, a solar panel system or any other renewable or one-time use system/source of electric power suitable for energizing a motor. Alternatively, or additionally, the one or more pumps may be driven by another type of prime mover, such as an engine, compressed air, wind power, or other prime mover that is not an electric motor and provides the operational capability of the one or more pumps to provide backup redundancy of operation of the system. The engine may be, for example, a gasoline, diesel, natural gas or any other form of engine.

The pumps may be sized, calibrated and balanced to cooperatively operate to provide optimum pumping, and eliminate field guesswork of trying to match independent pumps, which are unmatched or otherwise not configured for coordinated cooperative operation.

Emergency pump bypass discharge line monitoring and alarming—the home flood prevention appliance may include or be coupled with a single common outlet pumping discharge line, that receives a flow of liquid from all of the pumps, or multiple of the pumps. However, immediately after this common outlet discharge line exits the home or structure, to discharge outdoors (outside the structure) to a safe location, this single common outlet discharge line includes a water overflow outlet. The water overflow outlet is an emergency bypass line that enables discharged water to "dump" outside the home if the discharge line downstream of the water overflow outlet is clogged for any reason (i.e. freezing, collapsed pipe, obstruction, etc.). For example, if the common outlet discharge line buried in the homeowner's yard becomes clogged for any reason whatsoever, then the backpressure on the clogged common output discharge line causes the water to reroute through water overflow outlet to the emergency bypass line, in an "emergency mode", and discharge the water at the location of the water overflow outlet, such as directly at the exterior foundation of the home. The advantage of this common discharge line emergency overflow outlet is that multiple pumps can use the same emergency overflow outlet thereby saving on construction and maintenance costs. In addition, even if there may be only one discharge line for multiple pumps, due to the emergency overflow, the issue of the discharge becoming unusable by the pumps is minimized.

The water overflow outlet(s) may each include or be associated with an emergency bypass sensor. The emergency bypass sensor may be a pressure sensor, a conductivity sensor, a flow switch, float switch, a flow meter, a differential pressure sensor, or any other form of sensor capable of identifying a flow of liquid through the water overflow outlet. The emergency bypass sensor may be in communication with the controller circuitry. Communication may be wireless or wired and provide a signal indicative of the presence, or absence of liquid flowing through the water overflow outlet.

At the time the water is re-routed to the emergency bypass line, the controller circuitry senses the flow of liquid in the water overflow outlet and generates an emergency bypass alarm. The controller circuitry may further execute the communication circuitry to wirelessly communicate the alarm message to a mobile device, such as, for example, via a text message or alert via a phone app. This bypass discharge technique, which works on the principal of back pressure in the discharge line to reroute to the backup emergency discharge, has many advantages over "dedicated" backup pump discharge lines. The pumps may be running separately, or together, and still use this proposed emergency bypass discharge line, whereas with a traditional "dedicated" emergency bypass line, only a backup pump can use the emergency bypass line (i.e. and the backup pump may not be operational). The home flood prevention appliance system continuously monitors for the flow of water out of the water overflow outlet(s). In addition, the controller circuitry performs routine tests to confirm the pump outlet(s) are unobstructed by monitoring the flow of water out of each of the water overflow outlet(s).

Communication circuitry may provide wireless telemetry used as part of the controller circuitry for automatically testing the entire system during non-use times. The wireless telemetry may be used by the controller circuitry to notify a user that the systems are functional. Most home sump pumps are rarely, if ever, tested by the homeowner. The controller circuitry included in the home flood prevention appliance may automatically test the Triplex pumps, and the domestic water shutoff valve on a predetermined, user configurable schedule, such as automatically testing on a monthly basis, so the homeowner knows his systems are working, and action can be taken to correct issues identified during routine testing before a flood occurs. Accordingly, the HFPA can monitor a local or national local weather channel via internet connection, and if a severe storm is predicted for a locale, the system can auto initiate a full system pumping test, and then alert the homeowner, via their smartphone(s), for example "A strong storm is predicted for your area in the next 12 hours. A complete system test of your basement water protection system was performed. Your basement is protected!" Alternatively, if the HFPA did not pass the system test, then the homeowner is alerted accordingly so he can take action before the storm hits. Additionally, or alternatively, the HFPA may be sent an instruction in the form of a text message, or command from phone app, to perform a self-test and report results that inform of the weather event and the test results. The instruction may be by an entity monitoring the weather that has identified the HFPA as being in the path of an upcoming weather event that pushes a self-test instruction to the identified HFPA. The diagnostic test instruction may be an individual message or a group message to a number of HFPA systems in the area or path of the weather event.

An example of the testing routine includes the controller circuitry automatically filling the sump pit with water from the municipal utility water source, in order to exercise all the pumps. In addition, the controller circuitry may perform water draw-down testing to confirm operation and performance of the pumps both individually and during cooperative operation. In an example, the controller circuitry may independently and/or in combination time the associated water draw-down time of one or more of the pumps, and compare the timed draw-downs to predetermined draw-down times (such as rated pump capacities) for the one or more pumps to determine that all systems are pumping at a normal capacity, such as rated capacity. In addition, the domestic water shut-off valve may be exercised, and the water flow meter monitored, to ensure the valve close/open is functional, and associated water flow is stopped. Once the pumps are fully tested, other systems variables are also tested, such as battery backup, cellular radio, home wifi connection, memory, real time clock, and other variables for a complete system test. In this way, the system is self-diagnosing, and if any aspect of the entire system is not operating correctly, the homeowner is notified via smartphone(s) so they can take corrective action. A full test report of systems may be sent, such as in a text, or push notification message, automatically, to the homeowners phone app, and if an abnormality occurs, the homeowner is alerted via an alarm, such as a text message, on the homeowner's phone, and audible sound on the appliance. In alternative examples, the system may send a short message, such as a "system self-test passed" message if the diagnostic tests are successful.

A rechargeable battery may supply power to the pumps and the electronic components in the system, such as the controller circuitry and the communication circuitry in the event of supply power loss. The system may also include a low battery alarm. The low battery alarm may be a visual and/or audible indicator included in the user interface of the home flood prevention appliance. Alternatively, or in addition, the low battery alarm may be provided in an alert message.

The controller circuitry may automatically start and stop the pumps, as needed, based on the level measurement(s), eliminating the need to continuously monitor a traditional float switch that hangs in the well, and is traditionally a point of failure due to switch failure. Examples of sump pit liquid level sensing system may also include as level sensors dual back-up float switches. The dual back-up float switches may be adjustably positioned on the structural frame above (i.e. at a higher elevation) the normal liquid level to provide a backup or redundant hall-effect style dual float switch that can signal the controller circuitry if the liquid level would ever rise to this point, indicating that there is a malfunction in the sump pit liquid level sensing system. These backup floats are redundant, and bypass the system microcontroller so that if the first low level float is triggered, the pumps are automatically started, even if the system microcontroller was compromised, and the homeowner is alerted that the system is operating on backup float control via alert message and local siren annunciator. If the liquid level continues to rise to the second float level, the system may generate an alarm message to notify the homeowner with a critical alarm message indicating a possible flood condition, and this float will also hardware bypass all pumps to run at full speed even if the system microcontroller is compromised.

The sump pit liquid level sensing system may also include as level sensors one or more hydraulic float switches. In examples, the pumps may be hardwired through a contactor controlled by the hydraulic float switch to close/open to start/stop the pumps based solely on, for example, the hydraulic float switch. Thus, the controller circuitry is unnecessary for sensing signals from the hydraulic float switch(es) and/or for starting the pumps since the hydraulic float switch(s) may provide completely mechanical means to drive the pumps. With internet hacking and security issues, this mechanical pumping control system can operate to keep the basement dry even if the primary electronics, such as the controller circuitry, are completely compromised. The hydraulic float switch may be a hydraulic float ball adjustably positioned in the structural frame above sump pit at an elevation that is higher than the operating range of the dual float switches. If the water level in the sump pit rises to the elevation of the hydraulic float switch, then the pumps may be energized without the need for AC power or battery backup to the controller circuitry. Additionally, during high flow periods, the pumps may cooperatively run together in triplex or tandem operation to provide a "boost mode" of increased water flow. The pumps in the system have been selected and sized for this purpose, and do not "buck" each other due to incompatible pump curve characteristics.

A wireless transmitter included in the communication circuitry of the home flood prevention appliance system may use an internal battery backup included in the home flood prevention appliance, and can alert the homeowner of a power loss event. In addition, the one or more electrically actuated shutoff valves may be operated with the internal battery backup. Many times water damage occurs during power loss events when pipes can freeze due to a non-functioning furnace, and the sump pit overflows because the sump pump cannot operate. The battery backed reliable cellular technology coupled with the water control actuators, such as an electrically actuated water shutoff valve, provides the ability for detection of even the tiniest of leaks anywhere in the building structure domestic water piping network, eliminating the need for multiple battery power remote single point sensors. The home flood prevention appliance, including the water meter and shutoff valve may be powered by reliable AC power during operation, and the internal backup battery automatically powers the home flood prevention appliance, including the cellular transmitter included in the communication circuitry and the water control actuator, during AC power loss.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Moreover, the examples described herein described different hardware and functionality. In the interest of brevity, such descriptions are not repeatedly discussed throughout. Instead, it should be recognized and understood that the different hardware and functionality configurations described may be interchangeably applied to any of the various examples provided. In addition, such hardware and functionality configurations can be arranged to cooperatively operate in the same example, even in the case where no such cooperation is explicitly described herein.

Figure 1:
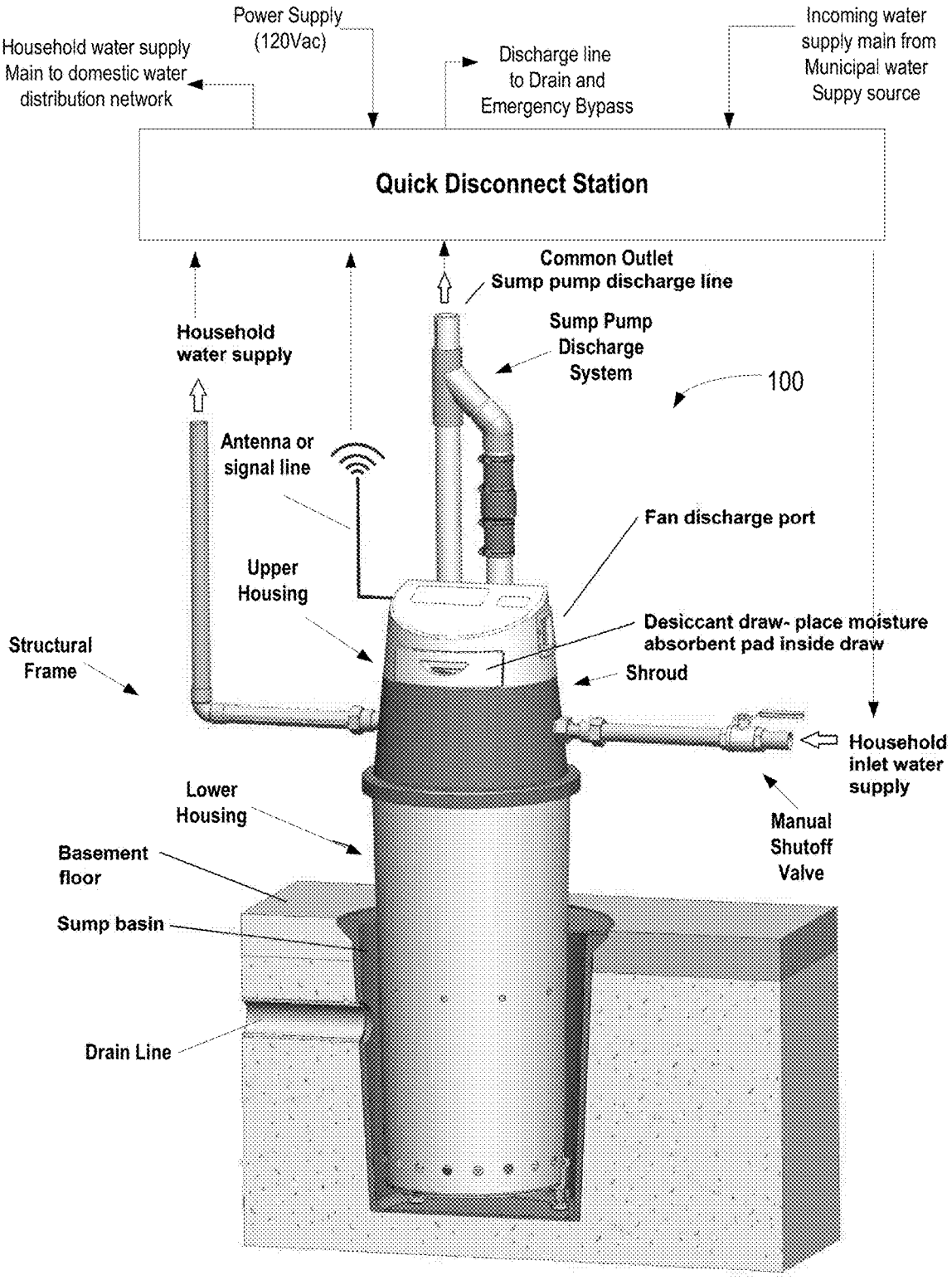
FIG. 1 is a perspective view of an example home flood prevention appliance system.

FIG. 1 is a perspective view of an example home flood prevention appliance system 100. The home flood prevention appliance is illustrated as structural frame in the form of a housing installed in a sump basin or sump pit. In this example, the structural frame includes an upper housing or shroud position above the sump pit and a lower housing positioned in the sump pit. The sump pit may be, for example, formed as a recess in a basement floor to include at least one drain line supplying liquid, such as water to the sump basin. In other examples, the home flood prevention appliance may be installed in other locations and/or applications so as to receive a flow of drainage liquid, such as water. Although hereinafter described as operative with water, it should be understood that the home flood prevention appliance may operate with any other flowing liquid. As used herein, the terms "water" and "liquid" are interchangeable when describing the contents in the sump pit. In addition, although described with respect to a residential home or house or household, the whole home water protection application may also be applied in any other form of enclosure, such as a barn, a warehouse, commercial building, a garage or any other structure where water may be present.

The home flood prevention appliance system 100 may be configured to interface with a quick disconnect station. The quick disconnect station may receive an incoming water supply main line, a power supply line, a discharge to drain line, and an outgoing household water supply main line as permanently installed lines. Interfacing between the home flood prevention appliance and the quick disconnect station may be via flexible lines with couplings, such as quick disconnect fluid lines and electrical plugs. In this way, construction of the home may be substantially completed, with the permanently installed lines coupled with the quick disconnect station prior to installation of the home flood prevention appliance. Upon installation of the home flood prevention appliance in the sump, connectors included on the home flood prevention appliance may be coupled with the quick disconnect station to complete the install. The individual connectors may be coded and sized such that only the correct line may be coupled with the quick disconnect inlets and outlets on the quick disconnect station. In FIG. 1, the household inlet water supply line to the home flood prevention appliance is illustrated as including a manual shutoff valve, however, in other examples, the manual shutoff valve may be included in the quick disconnect station with a manual bypass valve, or in the incoming water supply main prior to the quick disconnect station.

The home flood prevention appliance may also include a sump pump discharge system. The sump pump discharge system may receive a discharge of sump water from two or more different independently operational sump pumps included in the home flood prevention appliance. The sump discharge system is configured to allow the cooperative operation of these different sump pumps so that the sump pumps may operate independently, or additively to evacuate the sump basin. The output flow of water from the sump pump discharge system may flow through the common outlet sump pump discharge line and a quick disconnect into the quick disconnect station, and then to the permanently installed common outlet discharge line to a drain located exterior to the structure. Although the sump pump discharge system is illustrated as being external to the structural frame of the home flood prevention appliance system, in other examples, both the sump pumps and the sump pump discharge system may be included within the structural frame.

The structural frame extends down into the sump basin such that a lower housing portion of the structural frame may be submerged in liquid in the sump basin and an upper portion of the housing extends above the sump basin to remain separated away from the water in the sump basin. The lower portion of the housing may include any form of egress that allows the flow of liquid present in the sump basin into the lower portion of the housing. In FIG. 1, the lower portion is illustrated with a series of holes in the housing to allow the ingress of liquid, however, in other examples, slots, a screen, one or more openings, or any other form of water penetrable ingress may be used to flow liquid present in the sump basin into the lower housing.

The upper housing, or shroud may also include a desiccant drawer access for receipt of air freshening/moisture reducing material, and a fan discharge port to create a positive air flow across the air freshening/moisture reducing material. The upper housing may also include an antenna to provide wireless communication with the home flood prevention appliance. Alternatively, or in addition, the upper housing may include a quick disconnect signal cable such as a CAT5 cable or a coax cable capable of coupling with a connector included in the quick disconnect station. An antenna cable routed to the quick disconnect station from an external antenna located elsewhere in or on the home, and/or a network cable routed to a home network such as a local area network, a repeater or a router may be permanently connected to the quick disconnect station so that the quick disconnect electrical cable upon being coupled with the quick disconnect station is coupled thereto.

Figure 2:
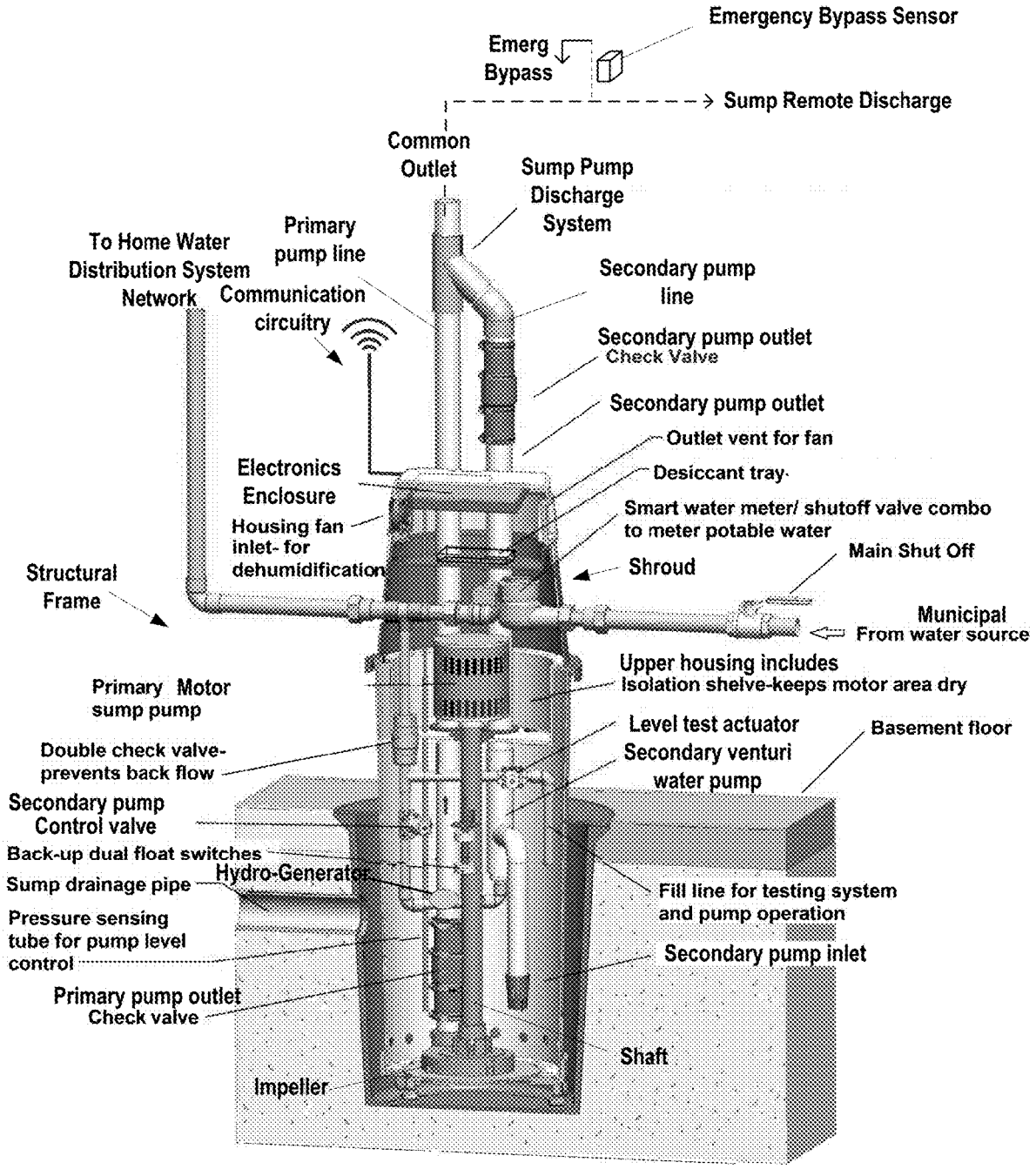
FIG. 2 is a cutaway perspective view of the example home flood prevention appliance system illustrated in FIG. 1.

FIG. 2 is a cutaway perspective view of the example home flood prevention appliance illustrated in FIG. 1. The home flood prevention appliance includes a primary sump pump extending from the lower housing into the upper housing, and a secondary sump pump included in the upper housing and extending a suction tube into the lower housing. The primary sump pump may be a pedestal style pump with a shaft extending between an electric motor, such as an AC (alternating current), or DC (direct current) motor positioned in the upper housing, and an impeller positioned in the lower housing at the base of the sump basin. The primary sump pump may be energized and de-energized by a relay or contactor, or other form of electrically operated switch, positioned in the upper housing based on a sensed level of liquid in the sump basin. The secondary sump pump may be a venturi water pump, which may be energized and deenergized with a prime mover which is a flow of pressurized water from the incoming water supply main controlled with a secondary pump motorized ball valve or hydraulically operated diaphragm valve. In alternative examples, the secondary pump may be driven by a prime mover provided by an alternative source different from the energy source and/or prime mover used by primary pump and other than water or hydraulic power. Accordingly, the pumps may operate independently and autonomously from two different power sources to provide pumping redundancy in the system. The primary pump may be energized by AC power provided by an external supply and/or a rechargeable DC supply, such as batteries.

The primary and second sump pumps may be operated with a controller circuitry included in the electronic enclosure to provide pump level control. In other examples, the controller circuitry may control operation of the primary pump, and the secondary pump may be controlled by mechanical switching, such as by a hydraulic level switch, which is independent of the controller circuitry. The controller circuitry may be hardware such as a processor and/or other device(s) capable of executing logic and directing operational functionality of the home flood prevention appliance system. The controller circuitry may also include a memory storing commands executable by the controller circuitry and system data. The controller circuitry may also control the overall operation/functionality of the system. In addition, the controller circuitry may operate/control communication circuitry, which includes telemetry. Further, the controller circuitry may initiate and manage automated diagnostic testing of the system. Also, the controller circuitry may control and manage alarming and calibration of the system. In addition, the controller circuitry may manage communication with the user via SMS and/or via voice, or data to push information to the user (such as a homeowner)/maintainer (such as a plumber) of the system, as well as respond to requests from users/maintainers. Also, the controller circuitry may manage data storage and archiving, data analysis of trends, generation of trend graphs and other operational information, report generation to a user, and programming updates received via the communication circuitry. Further, the controller circuitry may sense parameters such as motor current, primary and secondary pressures and/or flow rates, levels and any other parameters and dynamically react accordingly. In addition, the controller circuitry may derive operational parameters from sensed parameters, such as sensing a current flow of the primary AC motor and deriving or extrapolating water flow rates therefrom.

In an example configuration, the controller circuitry may operate the home flood prevention appliance to evacuate water from the sump basin in any one of three modes in accordance with a sump basin level. The controller circuitry may operate the home flood prevention appliance in a first mode by activating the primary sump pump based on a level of liquid sensed with the pressure sensing tube and the pressure sensor or laser pump controls. As the liquid level rises, the pressure in the pressure sensing tube increases or the float rises. Upon the pressure or the vertical position of the float reaching a first predetermined threshold corresponding to a level of water in the sump basin, the controller circuitry may electrically energize the primary sump pump to evacuate the sump basin at a first evacuation rate. If the liquid level continues to increase to a second predetermined threshold, the system may enter a "boost mode" in which the secondary sump pump is energized by water as the prime mover to cooperatively operate with the primary sump pump to increase the rate of liquid evacuation from the sump pit at the first evacuation rate to a second evacuation rate greater than the first evacuation rate. In other examples, other forms of level sensing may be used.

The system may also include a backup sump basin level detection in the form of, for example, a hall-effect style dual back-up float switches. The backup sump basin level may be triggered at a level of water in the sump basin that is above the first and second predetermined threshold levels. In an example, the backup sump basin level may be multiple float switches such that a first float switch being triggered energizes the first sump pump, and a second float switch being triggered energizes the secondary sump pump in the boost mode. A detected failure of the primary sump pump may also initiate energization of the secondary sump pump.

In addition, or alternatively, the choice of energizing the primary sump pump or the secondary sump pump, or both, may be performed by the controller circuitry based on operational factors. Such operational factors may include: 1) the rate at which the water level in the sump basin is increasing/decreasing; 2) the availability of the power sources (electricity for the primary sump pump and municipal water pressure/flow for the secondary sump pump); 3) the financial cost of operation of the primary and the secondary sump pumps (electric vs. municipal water utility costs); 4) the effective flow rates of the primary and secondary sump pumps; and/or 5) external factors such as the weather (predicted rainfall) provided to the controller circuitry, a user input, or some other factor outside the operation of the home flood prevention appliance that may affect sump basin water level, evacuation rate, and or fill rate. External factors may be user entered, such as cost per KWH of electricity and cost per gallon for municipal water, or may be sensed, or retrieved by the controller circuitry.

The system may include a miniature hydro-power generator or micro generator to provide backup power. The hydro-power generator may be positioned in the housing in the water supply line to the secondary pump, after the secondary pump motorized ball valve that runs the venturi pump. In this way, electricity may be generated by the hydro-power generator when the ball valve is opened to run the venturi pump. Thus, the flow of water not only runs the secondary pump, but also generates electricity from the micro generator. In this way, when external power is unavailable, the secondary sump pump may operate and the functionality of the whole house water appliance, including the controller circuitry, sensors, and ball valves may remain powered and operational. In addition, the micro generator may charge batteries or other energy storage devices in the system.

The outlet of the primary sump pump from the impeller flows through a primary pump outlet check valve to the common outlet and the sump pump discharge system via a primary output line. In addition, the outlet of the secondary sump pump flows through a secondary pump outlet check valve to common outlet and the sump pump discharge system via a secondary output line. From the common outlet, the liquid may flow through the sump discharge line to a remote drain location. The sump discharge line may include an emergency bypass line monitored by an emergency bypass sensor to indicate when the sump discharge line is clogged.

Flow rate of the primary sump pump may be based on the revolutions per minute of the impeller/AC motor and/or the unobstructed water flow to the impeller, and is sufficient to open the primary pump outlet check valve. The secondary sump pump flow rate may be based on the flow rate and pressure of the municipal water source, since the venturi principal relies on drawing a vacuum at the secondary pump inlet based on the flow rate and pressure of the municipal water source. The secondary sump pump flow rate is sufficient to open the secondary pump outlet check valve.

The sump pump discharge system receives a flow of water from one or both of the outputs from the primary and secondary sump pumps. In FIG. 2, the sump pump discharge system is illustrated as being external to the housing, however, in other example configurations, the sump pump discharge system may be integrated into the housing with the primary and secondary sump pumps and the telemetry, etc. The flow received by the sump pump discharge system from the primary sump pump may have a relatively high volume flow with a relatively low head pressure, and the flow received from the secondary sump pump may have a relatively low volume flow with relative higher head pressure. In an example, since both the primary and secondary sump pumps are in a single structural frame or enclosure, a pump curve of each of the pumps may be matched so that the pumps cooperatively operate, rather than inadvertently closing either the primary pump outlet check valve or the secondary pump outlet check valve due to the respective flow rates and pressures. In other words, the discharge head of the primary and secondary sump pumps may be calibrated to operate at the same time without either pump being shut down due to closure of a respective check valve, or dead head operation. In an example configuration, the highest and lowest possible head discharge pressures of the primary sump pump and the secondary sump pump may be used to develop ranges of cooperative operation where the primary and the secondary sump pumps may operate simultaneously to provide additive flow output.

In another example configuration, the system may include a secondary pump motorized ball valve, or some other style of valve, which may be dynamically adjusted by the controller circuitry to control the flow and pressure of the municipal water source, in order to align or match the pressure of the primary sump pump output flow to the secondary sump pump output flow. As the flow rate and/or pressure of the primary sump pump changes during operation, the secondary pump motorized ball valve may be dynamically actuated by the controller circuitry to effectively match the pressure. In an example configuration, the secondary pump motorized ball valve may be a "V" cut ball valve to control the flow. In this example configuration, the granularity of control of the secondary pump motorized ball valve may be significantly greater than in a ball valve without the "V" cut. Thus, the controller circuitry may be relatively more precise with controlling the flow of the municipal water supply into the system.

Figure 3:
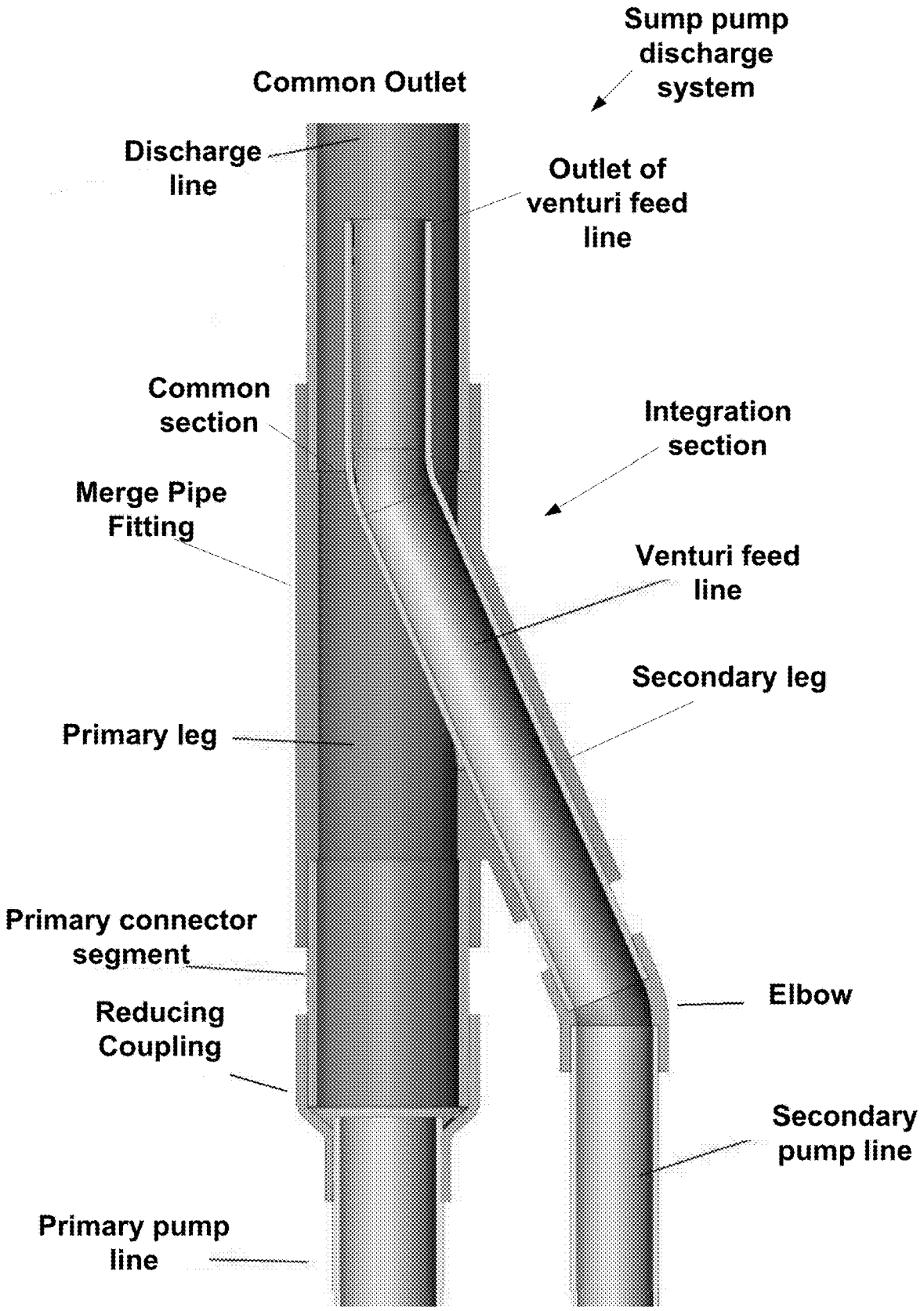
FIG. 3 is a cutaway of an example outlet system useable in the home flood prevention appliance.

FIG. 3 is an example of a sump pump discharge system. The system may receive a flow of water from one or both of the primary pump line and the secondary pump line. In an example configuration, the primary pump line may be a 2" PVC line resulting in 3.36 square inches of flow area, and the secondary pump line may be 1.5" PVC line resulting in 2.04 square inches of flow area. In the illustrated example, the primary pump line may be coupled with reducing coupling, such as a 2"×3" PVC coupling, in order to increase the line size to 3" and couple with a primary connector segment, which may be, for example, a 3" PVC line. In other examples, other sizes of lines, and materials of construction may be used, such that, for example, the reducing coupling and connector segment may be omitted.

The connector line may couple with a first leg of a merge pipe fitting included in an integration section of the sump pump discharge system. In addition, the secondary pump line may be coupled with an elbow have an angle with a predetermined number of degrees of offset, such as a 1.5" PVC elbow with a 23 degree angle. The elbow may be coupled with a venturi feed line, which is coupled with a second leg of the merge pipe fitting included in the integration section. The venturi feed line may be made of a rigid material such as plastic or stainless steel and may include a first straight section, an elbow section and a second straight section. The venturi line may extend through the integration section such that the first straight section is concentrically positioned in the second leg of the merge pipe fitting, the elbow section may be positioned in a common section of the merge pipe fitting, and the second straight section may be concentrically positioned in the common section and extend into a discharge line of the integration section. The merge pipe fitting may, for example, be formed as two separate halves that may be coupled together to surround a portion of the primary connector segment, the discharge line, and the venturi feed line. With regard to the venturi feed line, the merge pipe fitting may fully surround the elbow segment, and partially surround the first straight section and the second straight section as illustrated in FIG. 3. In an example, the elbow section may include a 23 degree angle such that a central axis of the second straight section is positioned concentrically with a central axis of the primary pump line, and in parallel with a central axis of the secondary pump line. In an example, the common output discharge line may be a 3" PVC pipe providing a flow area of 7.4" square inches. Alternatively, the primary and secondary pumps can be connected with another form of merge pipe fitting.

The integration section may allow cumulative addition of the flow of water from each of the primary pump line and the secondary pump line by introducing or mixing the flow of water from the secondary sump pump into the flow of water from the primary sump pump within the discharge section. Since the flow of water from the primary sump pump surrounds the second straight section prior to the mixing of flows, both flows become laminar in a common flow path prior to the outlet of the venturi feed line positioned within the discharge line. Thus, when the flows from the primary and secondary pumps are cumulatively added neither the flow from the primary or the secondary sump pump is ended. The flows are not ended due to the absence of back pressure at either the primary pump outlet check valve or the secondary pump outlet check valve. Instead, due to the laminar introduction or merge of the two different flows, the combination of the flows from the primary sump pump and the secondary sump pump are cumulatively additive to increase the flow of water being evacuated from the sump basin by at least 1.5 times the flow of water evacuated by with the primary pump or the secondary pump operating alone.

Figure 4:
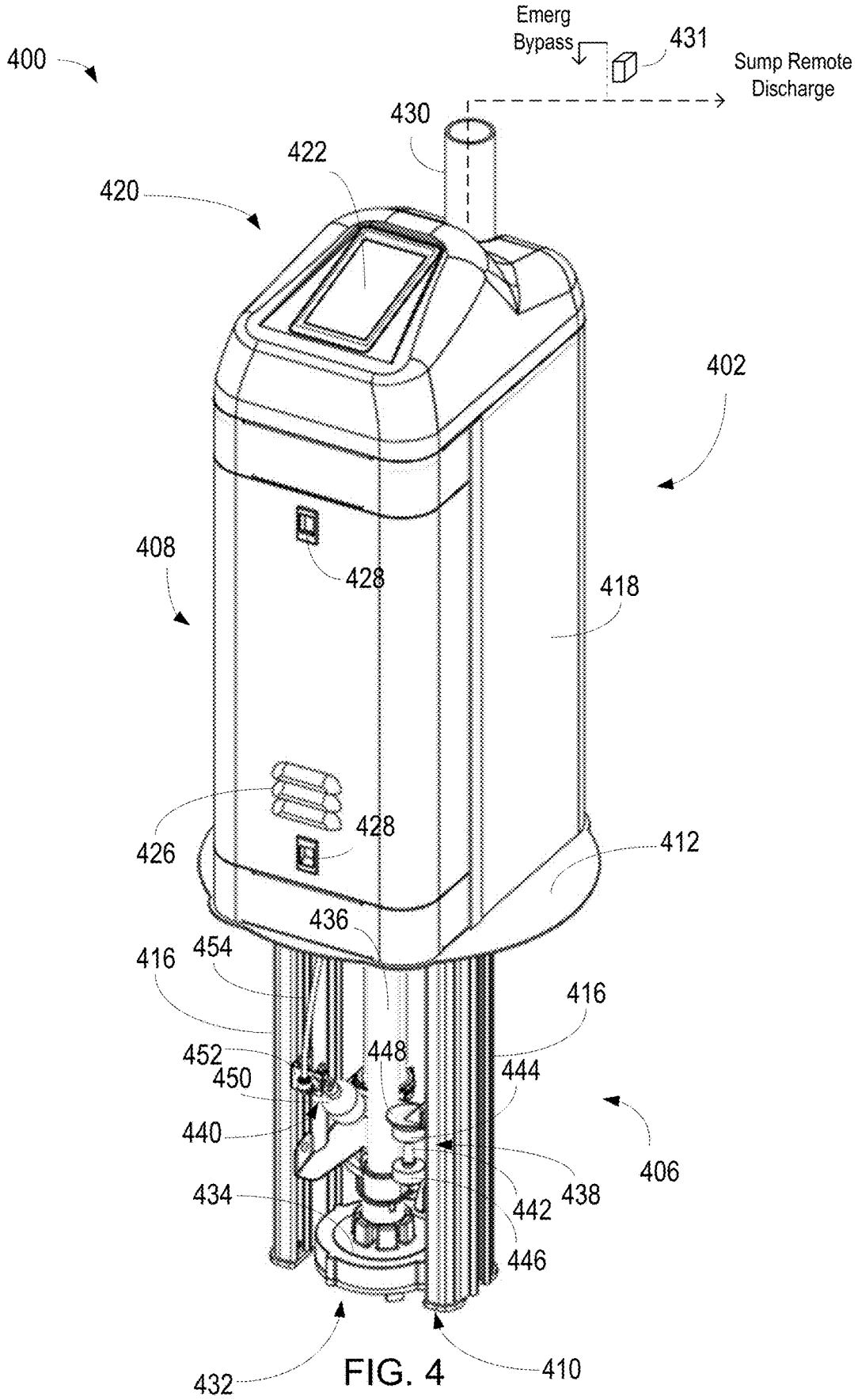
FIG. 4 is a perspective front view of an example home flood prevention appliance system.

FIG. 4 is an example of a home flood prevention appliance system 400. The home flood prevention appliance system 400 includes a structural frame 402 within which the elements of the system are positioned. Elements of the home flood prevention appliance system 400 include a primary pump and a secondary pump. The prime mover of the primary pump may be different than the prime mover of the secondary pump. In an example configuration, prime mover of the primary pump may be an electric motor, and the prime mover of the backup pump may be pressurized water. home flood prevention appliance system 400. In alternative examples of the home flood prevention appliance system 400, the secondary pump may be driven by a prime mover provided by an alternative source different from the energy source and/or prime mover used by primary pump and other than water or hydraulic power.

The structural frame 402 includes a lower portion 406 and an upper portion 408. In this example, the lower portion 408 is sized for receipt in a sump pit such that a distal end 410 of the structural frame 402 rests on a bottom surface of the sump pit, and a cover 412, sized to cover the sump pit and serve as a divider between the lower portion 406 and the upper portion 408 is positioned above the sump pit. The structural frame 402 includes columns 416 positioned on opposing sides and forming the distal end 410 of the structural frame 402. In the illustrated example, the columns 416 are a pair of columns aligned in parallel on opposing sides of the home flood prevention appliance system 400 and extending between the distal end 410 and a proximate end near the top of the home flood prevention appliance system 400.

A shroud 418 is disposed to surround the upper portion 408 of the structural frame 402 and is coupled thereto. An electronics enclosure 420 is included within the upper portion 408 of the structural frame 402 and surrounded by the shroud 418. In an example, the electronics enclosure 420 may be included as part of the shroud 418. In this example, circuitry included in the electronics enclosure 420 may be interfaced through connectors, such as quick disconnect connectors, to wiring internal and external to the structural frame 402 of the home flood prevention appliance system 400 so that the shroud is removable from the structural frame 402.

The electronic enclosure 420 includes user interface functionality, a portion of which is a graphical user interface 422, the controller circuitry, memory, communication circuitry, and other electronic circuitry related functionality within the home flood prevention appliance system 400. The electronics and/or circuitry included in the home flood prevention appliance system 400 are not limited to being disposed only in the electronic enclosure, and may also be disposed anywhere within the structural frame 402. Also, electronics circuitry included in the electronic enclosure 420 may extend or be accessible from outside the electronics enclosure 420. In the illustrated example, the graphical user interface 422 extends through an opening in the shroud 418 so as to be readily accessible to a user. The graphical user interface 422 may be a display screen 422, such as a color touch screen, that includes functionality similar to a mobile device such as a smartphone. In other examples, visual indicators, such as light emitting diodes (LEDs), push buttons, rotary knobs, switches and other such user interface mechanisms may extend through or otherwise be accessible from outside the shroud 418.

The shroud 418 also includes a vent 426, which may provide a source of cooling air, or an intake or exhaust for a fan, such as the fan included in the dehumidification system, for deodorizing or desiccant air flow or both. The vent 426 may also allow light from light emitting diodes LEDs included in the shroud to be emitted, or spill out, from inside the appliance. The LEDS may be energized, for example, upon detection of motion from a motion detector, such as a microwave motion detector to provide light to a user entering the vicinity of the appliance. In other examples, the one or more vents may be formed in the shroud in other locations. The shroud 418 may also include one or more latches 428 to enable removal of all, or a portion of, the shroud 418 for maintenance or inspection.

In the illustrated example, a common outlet 430 may be coupled with the structural frame 402 and extending through the shroud 418. In other examples, the common outlet 430 may be external to the structural frame 402 and/or the shroud 418. The common outlet 430 is coupled to a sump discharge line to carry liquid extracted from the sump pit to a sump remote discharge location, which is outside the structure. The sump discharge line may include an emergency bypass overflow line, which is monitored with an emergency bypass overflow sensor 431. The emergency bypass overflow sensor 431 may generate a signal indicating liquid is flowing in the emergency bypass overflow line.

A primary pump 432 may be included in the structural frame 402 such that an impeller 434 included at the end of a shaft 436 is positioned between the columns 416 at the distal end 410 so as to be immersed in liquid in the sump pit. Also illustrated in FIG. 4 is an example of level sensors includes in the sump pit liquid level sensing system. In FIG. 4, dual back-up float switches 438 and a hydraulic level sensor 440 are shown, which are slidably positioned using respective brackets coupled to the columns 416 within the structural frame 402.

The dual back-up float switches 438 of the illustrated example include a post 442, a first float 444, a second float 446, and a hall effect sensor 448. Each of the first float 444 and the second float 446 include a magnet, and the hall effect sensor 448 operates to provide a digital signal indicating a predetermined level of liquid has been reached. In another example, the dual back-up float switches 438 may include an analog transducer to provide a signal indicative of a distance between the sensor 448 and the first and second floats 444 and 446. The second float 446 is a redundancy backup for the first float 444, in the case of failure or malfunction of either one of the first float 444 or the second float 446, the hall effect sensor 448 will still sense the non-malfunctioning float upon the float dynamically moving vertically away and toward the sensor 448. The digital signal generated by the sensor 448 may be supplied to the controller circuitry. The controller circuitry may execute communication circuitry to wirelessly transmit alarm messages, such as text messages, indicative of a high liquid level in the sump pit. In addition, the controller circuitry may, upon sensing a malfunction, wirelessly transmit an alarm message, such as a text message, indicative of a float malfunction.

The digital signal provided by the hall effect sensor 442 to the controller circuitry represents a position of the respective float based on the corresponding magnetic field of each of the first float 444 and the second float 446 along the vertical length of the post 442. The digital signal may be provided to the controller circuitry for each float 444 and 446 or as a single signal. Thus, as the level of liquid in the sump pit varies, the first and second floats 444 and 446 travel vertically up and down the post 442 and the sensor 448 dynamically provides one or more digital level signals to the controller circuitry. The controller circuitry may monitor the first float 444 and the second float 446 for accuracy and proper function by dynamic comparison of the float digital signal(s) provided by the hall effect sensor 448. In an example, digital signals provided from the respective first and second floats 444 and 446 may be compared to a predetermined threshold deviation value such as +/_5%. In addition, or alternatively, the controller circuitry may, for example, compare the float position signal(s) to level signals provided by, for example, the pressure sensor level signals or the TOF sensor signals.

The hydraulic level sensor 440 includes a hydraulic float 450 and a hydraulic valve 452. The hydraulic float 450 may travel vertically in a range between a maximum and a minimum height based on an upper mechanical stop and a lower mechanical stop, provided by, for example, the hydraulic valve 452. When the hydraulic float 450 is near the lower stop—near the bottom of vertical travel, the level of liquid in the sump pit is below the hydraulic float 450, and the hydraulic valve 452 is closed. When the hydraulic float 450 is near the upper stop—near the top of vertical travel, the level of liquid in the sump pit has floated the hydraulic float 450 vertically since the level is at or above the upper stop, and the hydraulic valve 452 is opened. When the hydraulic valve 452 is open, pressure in a pressure signal line 454 is released and the secondary pump is activated to being extracting a flow of liquid from the sump pit.

The dual backup float switches 450 and the hydraulic level sensor 440 may be adjustably coupled to the dual columns 416 by respective brackets that allow vertical positioning at a desired height. The desired height at which the sensors are positioned may be dependent on the expected height of the liquid in the sump pit. For example, a normal water table from one home to the next could be quite different, and the floats can be vertically adjusted to eliminate excess and unnecessary pump runtime. In example configurations of the HFPA, the dual back up float switches 450 may provide a backup function to main level sensors. Accordingly, in this example, the height of the dual back up float switches 450 would be set above an expected maximum liquid height in the sump pit when the primary pump 432 is operational and fully functional. Thus, the liquid would only reach the backup float switches 450 under conditions where the primary pump 432 was unable to keep up with the liquid being added to the sump pit due to a malfunction, lack of operation, or an overwhelming flow of liquid into the sump pit. In the case where the controller circuitry failed to turn on the primary pump 432 due to a malfunction in the main level sensors, the controller circuitry, upon receiving the level signal change from the dual backup float switches 450 could activate the primary pump 432. The vertical height of the hydraulic level sensor 440 of this example configuration may be vertically higher than the dual backup float switches 450, such that the hydraulic valve 452 would only be actuated upon the level signal supplied to the controller circuitry by the dual backup float switches 450 not resulting in drawdown of the level of liquid in the sump.

Figure 5:
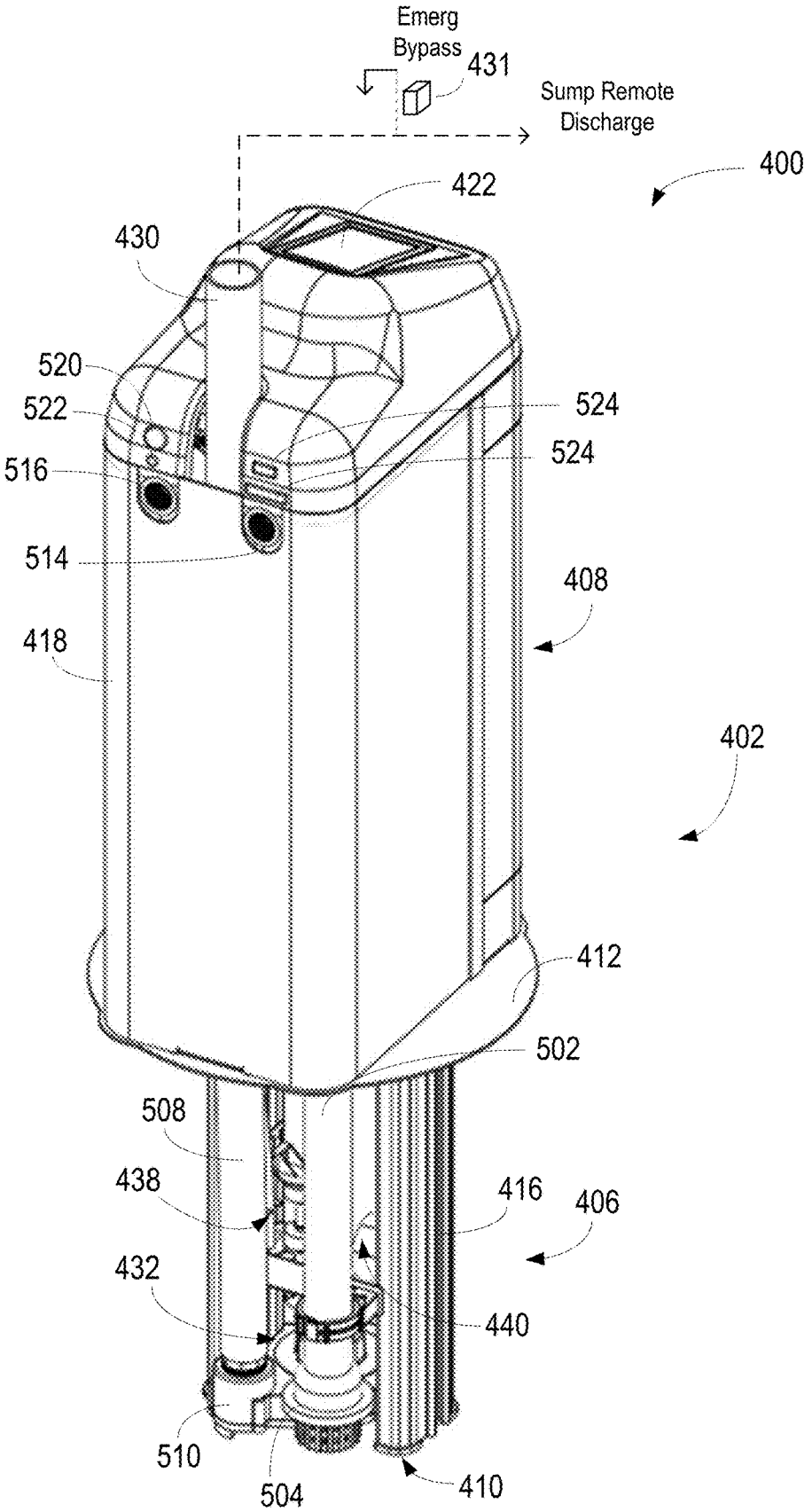
FIG. 5 is a perspective rear view of an example home flood prevention appliance system.

FIG. 5 is a perspective rear view of an example home flood prevention appliance system 400. A primary intake line 508 for the primary pump 432 includes an intake 510 positioned in the structural frame 402 near the distal end 410. During operation of the primary pump 432, the impeller 434 rotates to create a suction at the intake 510 and a corresponding flow of liquid out of the sump pit and into the primary intake line 508. A secondary intake line 502 for the secondary pump has an intake 504 that includes a foot valve at the distal end 410 of the structural frame 402. The foot valve at the intake 504 may include a strainer screen to restrict debris from entering the secondary intake line 502, and a check valve to avoid liquid flowing back into the sump pit from the secondary intake line 502.

In addition to the common outlet 430 penetrating the shroud 418, an inlet main 514 for receipt of a municipal utility water source and a utility water network outlet main 516 that may supply water to a domestic water distribution network may penetrate a back surface of the shroud 418. The domestic water distribution network may supply various fixtures such as sinks, toilets, showers, sill cocks and any other water distribution points connected to the network within the structure(s) were the system 400 is installed. The inlet 514 and outlet 516 may include quick disconnects for coupling with the quick disconnect station (FIG. 1) or may include fittings connectors or any other form of coupling device to couple with water pipes routed to the system 400 within the structure where the system 400 is installed. A number of electrical connection points may also penetrate the shroud 418. In FIG. 5, one or more data communication ports 520, such as USB, Firewire, and the like, an electric power supply port 522, such as a power connector for 120 VAC, and one or more external I/O connections 524, such as two wire, four wire, Cat5 RJ45 connectors, and other such terminations are illustrated. In other examples, any other form of electrical connection points and terminations may be present.

Figure 6:
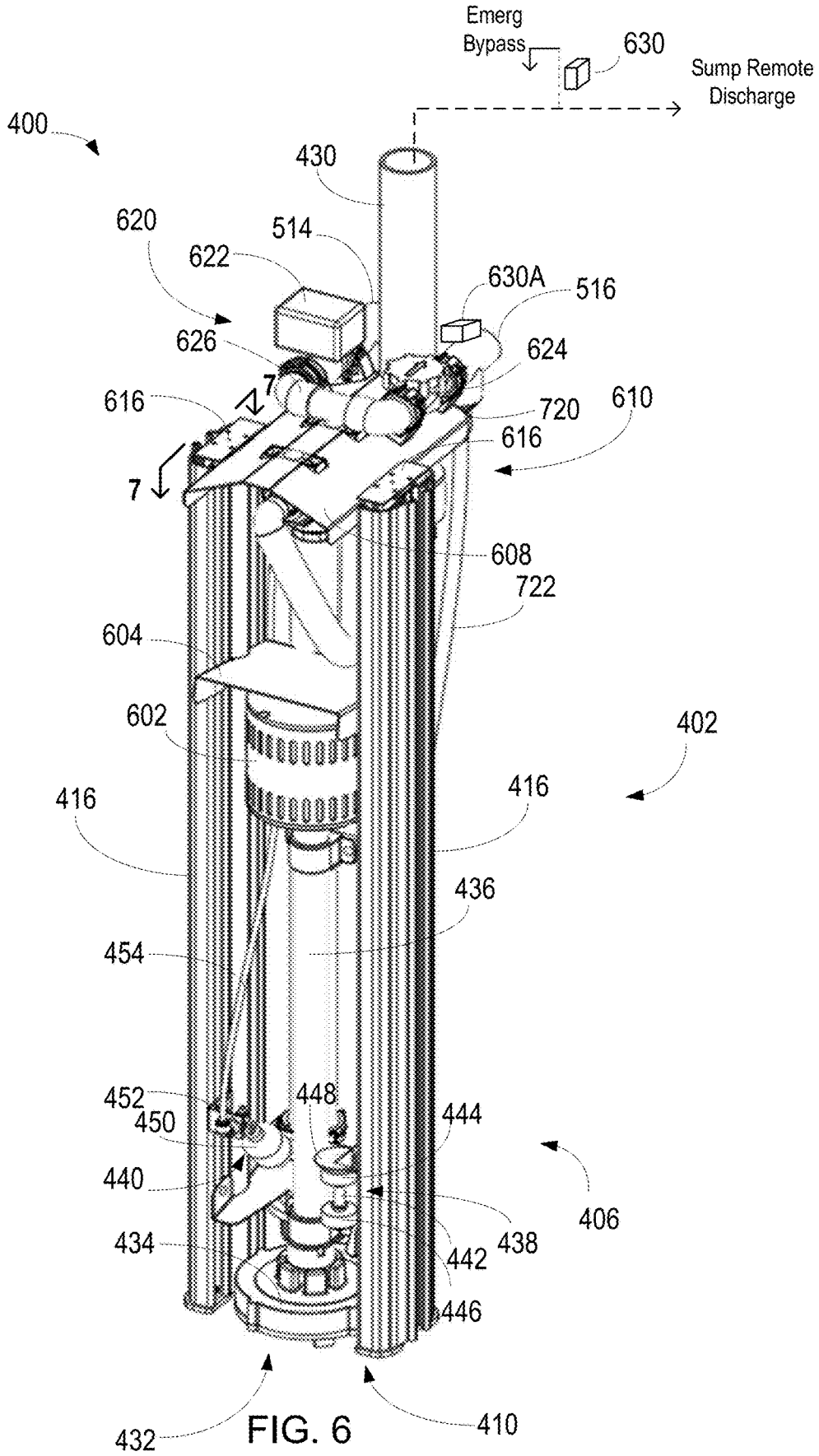
FIG. 6 is a perspective front view of an example home flood prevention appliance system with a shroud removed.

FIG. 6 is a perspective front view of an example home flood prevention appliance system 400 with a shroud 418 removed. With regard to the primary pump 432, in addition to the impeller 434 and the shaft 436, the motor 602 is also included in the structural frame 402. A bracket 604 coupled between the columns 416 forms a portion of the structural frame 402 to which the motor 602 is coupled. In addition, the motor 602 may be coupled to the structural frame 402 by one or more vibration isolating fasteners, such as clamps to minimize vibration in the structural frame 402. Also forming a portion of the structural frame 402 is a plate 608 positioned at a proximate end 610 of the structural frame 402, which is coupled between the columns 416. The shaft 436 may also be coupled to the structural frame 402 by a vibration isolating clamp to effectively couple the shaft 436 by both the bracket 604 and a vibration isolating clamp to minimize vibration. The columns 416, the bracket 604 and the plate 406 may be aluminum, steel, plastic or any other rigid material, and may be coupled together by suitable fasteners, welding or some other mechanism to fixedly and rigidly couple the components and form the structural frame 402.

In this example, coupled to each of the columns 416 at the proximate end 610 of the structural frame 402 are time of flight (TOF) sensors 616. The TOF sensors 616 are included in the sump pit liquid level sensing system as main level sensors used by the controller circuitry to control operation of the primary pump 432, and the back-up float sensors 438 are used by the controller circuitry as secondary or back-up level sensors. In other examples, other forms of level sensors, such as the sensor-less pump control system or a camera based level sensing system in which a camera is used to detect a level in the sump pit. Each of the TOF sensors 616 and the back-up float sensors 438 are in electrical communication with the controller circuitry.

Figure 7:
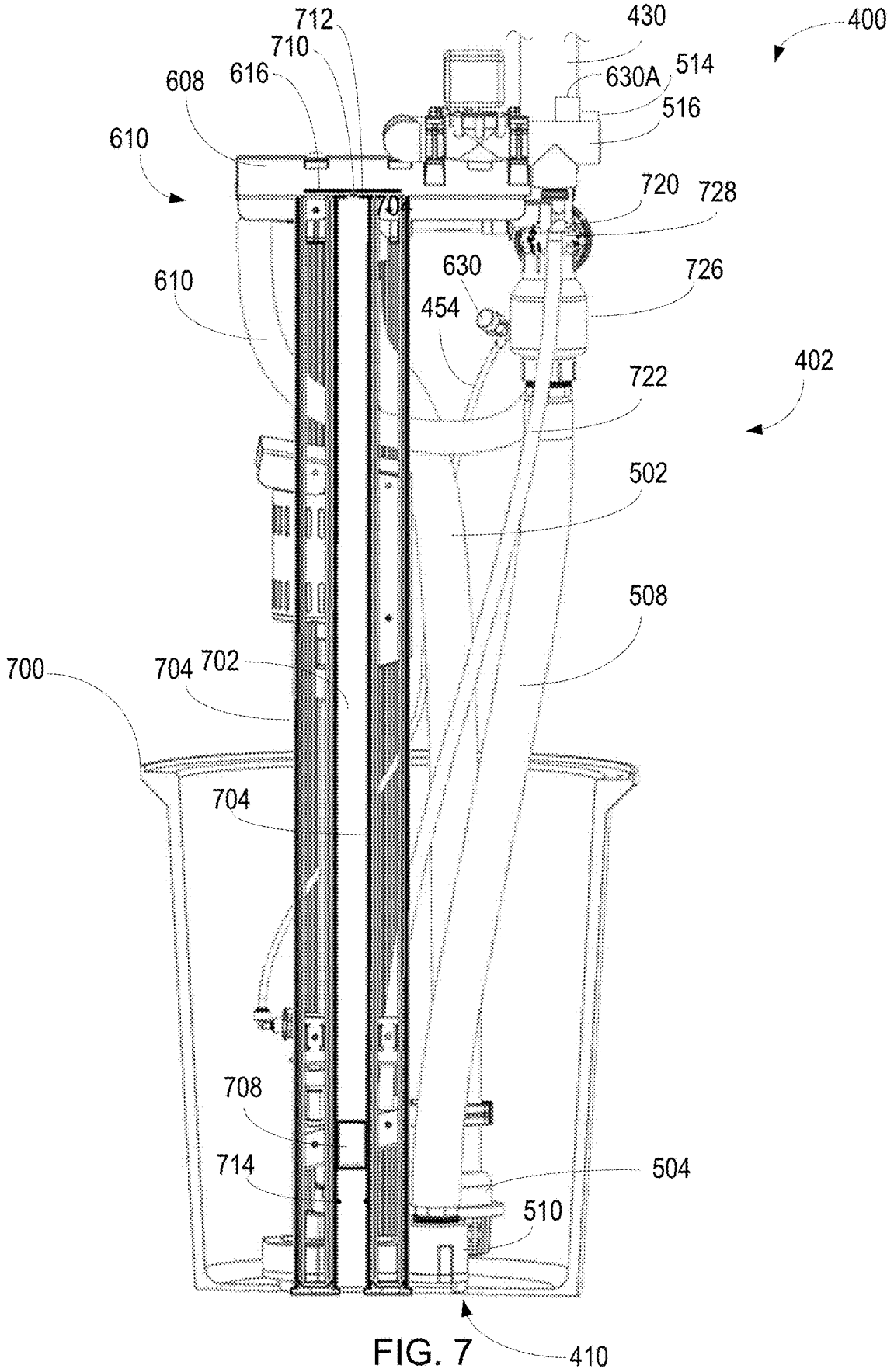
FIG. 7 is a perspective cut-away side view of an example home flood prevention appliance system with a shroud removed as illustrated in FIG. 6.

FIG. 7 is side view of a home flood prevention appliance system 400 that includes a cut-away view of the column 416. In FIG. 7, the home flood prevention appliance system 400 is positioned in an example of a sump pit 700. The column 416 includes a central passageway 702 positioned between carriages 704. Many of the elements position in the structural frame 402 are coupled thereto by being fixedly coupled with the carriages 704 by brackets as illustrated.

Figure 8:
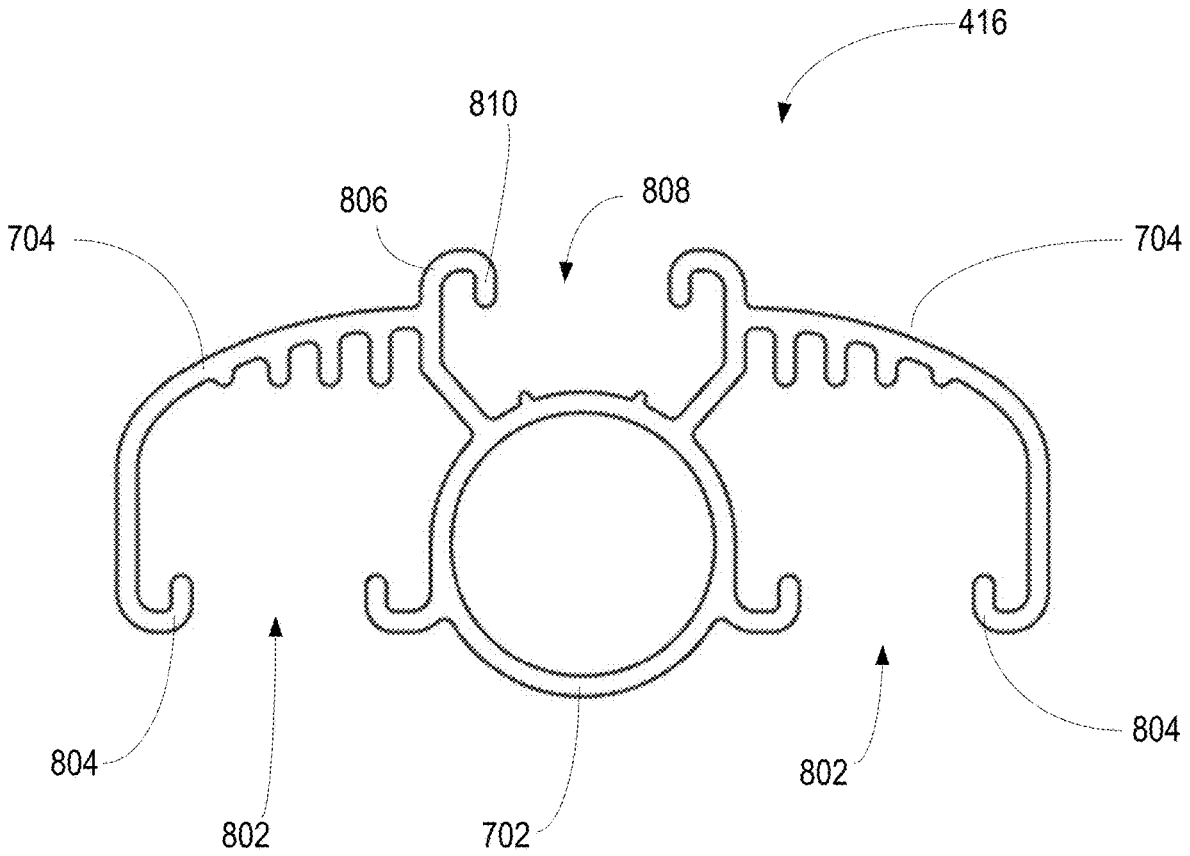
FIG. 8 is an end view of an example column included in the home flood prevention appliance system.

FIG. 8 is a top view of the column 416 depicting the passageway 702 and the carriages 704. The passageway 702 is formed as a continuous circular fully enclosed passageway between the proximate and distal ends of the structural frame. Each of the carriages 704 are formed to include an opening 802 and flanges 804. The openings 802 may receive brackets, which are coupled with the flanges 804. Since the openings 802 and flanges 804 extend continuously along the columns, brackets for different equipment included in the structural frame may be adjustably coupled along the length of the columns to enable the home flood prevention appliance system to accommodate varying sizes and depths of sump pits, as well as variations in sizes of equipment mounted in the structural frame 402. The column 416 may also include an external carriage 806 formed with an opening 808 to accommodate receipt of brackets and the like, and flanges 810. The columns 416 may be a single unitary structure. Each of the carriages 704 and 806 may be formed by coupling walls of the carriages with the passageway 702 such that an outer wall of the passageway 702 forms a portion of the walls of the carriages 704 and 806.

Referring now to FIGS. 7 and 8, a float 708 is movably disposed in each passageway 702. The float 708 moves up and down vertically in the passageway 702 as the level of liquid in the sump pit 700 changes. The TOF sensor 616 includes a light source 710 aligned to supply a beam of light in the passageway 702 parallel with the inner walls of the passageway 702 so that the beam of light strikes a top surface of the float 708. The light source 710 may be any device capable of generating electromagnetic radiation that is coherently and spatially focused and controlled to form a collimated beam of light in a predetermined spectrum. The predetermined spectrum may be electromagnetic radiation at any frequency, included in the visible light, infrared, and ultraviolet spectrum.

The top surface of the float 708 may include a reflective surface so that the beam of light, upon striking the top surface of the float 708 is reflected back toward the TOF sensor 616. The reflective surface may be specifically formulated and applied to maximize the amount of light energy reflected from the top surface of the float 708. The passageway 702 may act as a wave guide to the reflected beam of light and channels the reflected beam of light back to a light sensor 712 included in the TOF sensor 616. The interior surface of the passageway 702 may be reflective, and/or coated with a reflective material.

The TOF sensor 616 may be fully controlled by the controller circuitry to generate pulses of light energy, and/or the TOF sensor 616 may generate light energy pulses with a predetermined frequency. The TOF sensor 616, or the controller circuitry, or both, may temporally control emission of the beam of light by the light source 710 in order to detect a period of time between emission of a pulse of light energy by the light source 710 and detection of reflected light by the light sensor 712. From this detected period of time, the TOF sensor 616 may generate a signal to the controller circuitry indicative of the level of the liquid in the sump pit 700 based on the vertical position of the float 708 in the passageway 702. Alternatively, the TOF sensor 616 may provide an indication to the controller circuitry of a time when a pulse of light energy is emitted by the light source 710 and a time when reflected light from that pulse of light energy is detected by the light sensor 712, and the controller circuitry may calculate a depth of the liquid in the sump pit 700 therefrom. The passageway 702 may include a stop 714 to limit the vertical travel of the float 708 when the sump pit 700 is emptied of liquid. The stop 714 may be a predetermined distance from the TOF sensor 614 to enable calibration of the TOF sensor 616 during draw down testing by the controller circuitry.

Each of the columns 416 may include a TOF sensor 616 and a float 708 to provide redundancy of the main level sensors. The controller circuitry may compare the level measurements from each of the main level sensors to detect inconsistencies and/or malfunction based on a predetermined threshold of difference between the level readings.

Referring now to FIGS. 6 and 7, the home flood prevention appliance system 400 may also include a smart meter 620, which may be described as a smart water meter/shutoff valve 620. The smart meter 620 may include a water control actuator 622 such as a shutoff valve coupled with a flow meter 624 by a water source connection line 626. Water supplied from a municipal utility water source at the inlet 514 may sequentially pass through the water control actuator 622, the water source connection line 626, and the flow meter 624 before flowing out of the outlet 516 into the domestic water distribution network in the structure in which the home flood prevention appliance system 400 is installed.

A pressure sensor 630 may be included in the structural frame 402. The pressure sensor 630 may be included on the pressure control line 454 so as to provide the state of the secondary pump's (900) (water powered pump) hydraulic control valve (904). (FIG. 9) When the hydraulic control valve 904 is closed the pressure control line 454 should have the same pressure as the municipal utility water source supplied at the inlet 514. When hydraulic valve 904 is open the pressure in pressure control line 454 will drop significantly, providing an indication to the controller circuitry that the hydraulic control valve 904 is open. Alternatively, or in addition, the pressure sensor 630A may be included in the structural frame 402 on the outlet 516 to monitor the pressure of the water supplied to the domestic water distribution network. The pressure sensor 630 may provide a pressure signal to the controller circuitry. In some examples configurations, the pressure sensor 630 may be omitted or positioned elsewhere in the system.

In the example of FIGS. 6 and 7, the smart water meter/shutoff valve 620 may be included in the upper housing 408 within the structural frame 402 above the plate 608 and coupled thereto. In other examples, the smart water meter/shutoff valve 620 may be omitted. In still other examples, the smart water meter/shutoff valve 620 may be included in the quick disconnect station, or elsewhere in the house or structure.

A level test actuator 720 may be included in the structural frame 402. In the examples of FIGS. 6 and 7, the level test actuator 720 is included in a tee connected between the outlet of the smart water meter/shutoff valve 620 and the outlet 516 to receive the flow of municipal city water. The level test actuator 720 may be an electrically operated valve, such as a ball valve, controlled by the controller circuitry to open and close during performance of diagnostic self-testing of the home flood prevention appliance system 400. During a diagnostic testing mode, the controller circuitry may actuate the level test actuator 720 to an open position to flow water from the municipal city water source to the sump pit 700 via municipal water fill supply line 722. The controller circuitry may receive signals from the level sensors in the sump pit liquid level sensing system to test the primary and secondary pump functionality, capability and efficiency including testing in the three test modes. In addition, the controller circuitry may test the emergency bypass discharge.

Water from the municipal utility water source supplied at the inlet 514 may also be supplied to the secondary pump as a prime mover to drive (or energize) the secondary pump to extract liquid from the sump pit 700. When the secondary pump is driven by the prime mover, the intake 504 of the secondary pump receives a flow of liquid from the sump pit 700, which is supplied through intake 504 and the secondary intake line 502 to a secondary outlet. When the primary pump is driven by the motor being energized with electric power, the intake 510 receives a flow of liquid from the sump pit 700, which is supplied through the primary intake line to a primary check valve 726 included in the structural frame 402. The liquid is discharged from the check valve 726 to a primary outlet 728. The primary outlet 728 is in liquid communication with the common outlet 430.

Figure 9:
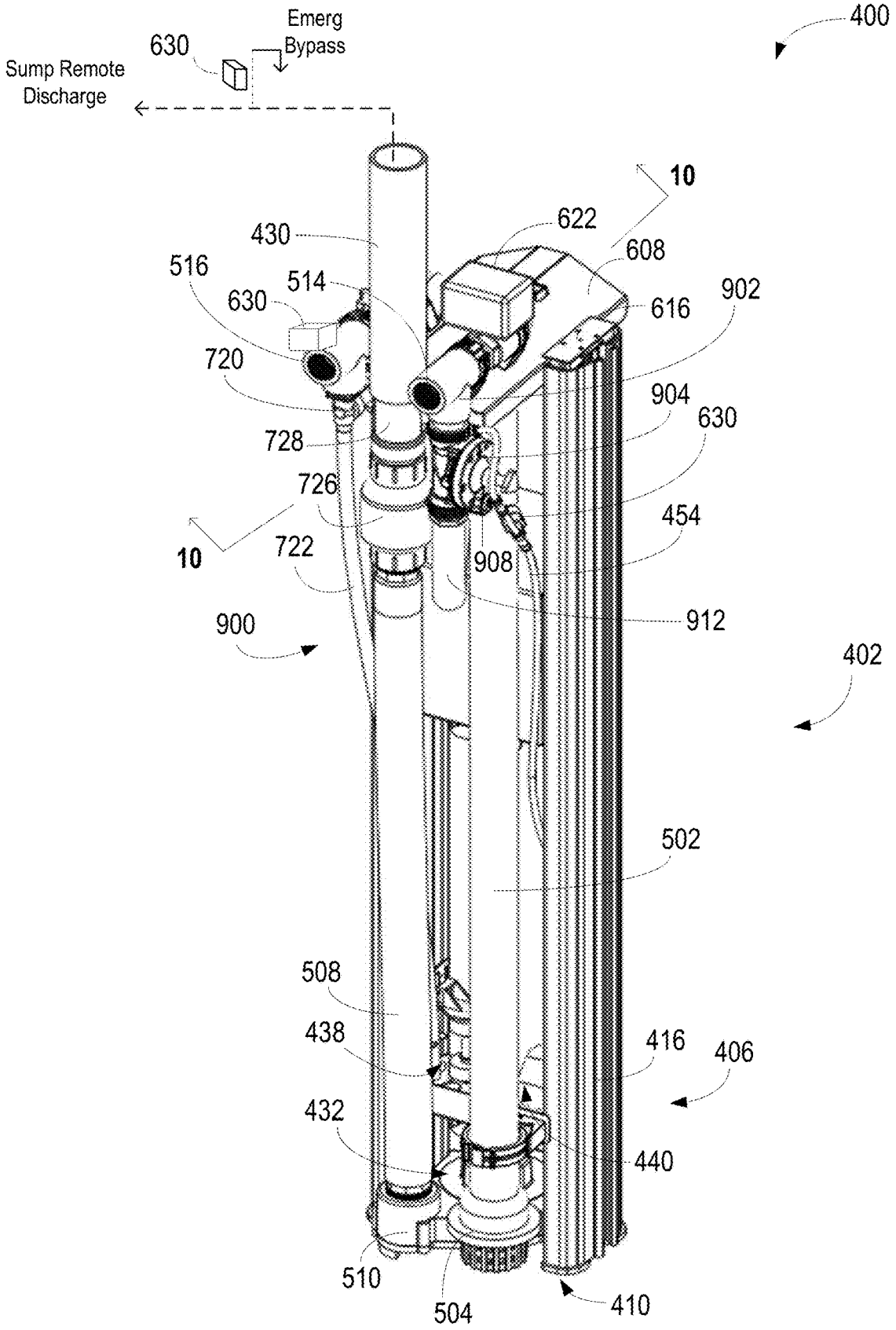
FIG. 9 is a perspective rear view of an example home flood prevention appliance system with a part of the shroud removed.

FIG. 9 is a perspective rear view of an example home flood prevention appliance system 400 with a part of the housing removed. A tee fitting 902 included in the structural frame 402 supplies the municipal utility water source to a hydraulic valve 904 mounted in the structural frame 402 and included in the secondary pump 900. The hydraulic valve 904 is controlled by the hydraulic level sensor 440 via the pressure signal line 454. A regulator 908 is included in the pressure signal line 454 to regulate the pressure in the line. When actuated to open via a drop in pressure in the pressure signal line 454 initiated by the hydraulic level sensor 440, the hydraulic valve 904 supplies a flow of the municipal utility water to a prime mover outlet 912 to act as the prime mover to drive the secondary pump 900 to evacuate a flow of liquid from the sump pit. The flow of municipal utility water is not detected by the flow meter 622 since the tee fitting 902 is upstream. In this example, the hydraulic valve 904 is a fully hydraulically operated device. In other examples, the hydraulic valve 904 may include an electric actuator 914 to optionally or solely control the secondary pump 900 with the controller circuitry.

Figure 10:
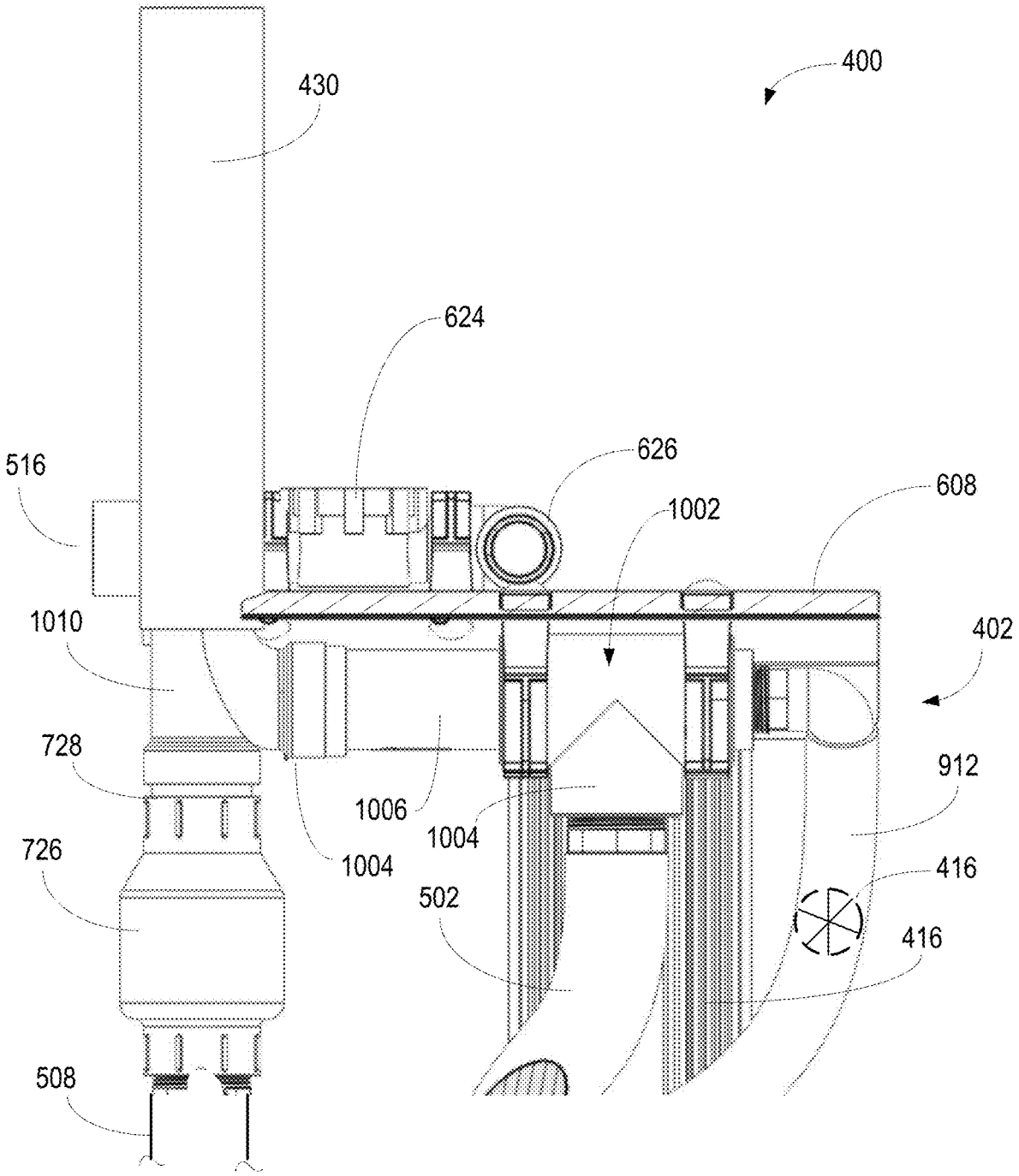
FIG. 10 is a cutaway side view of a portion of an example home flood prevention appliance system with a shroud removed.

FIG. 10 is a cutaway side view of a portion of an example home flood prevention appliance system 400. As illustrated in FIG. 10 with reference to FIG. 9, the prime mover outlet line 912 is supplied as an input flow to a prime mover header 1002 which is included in the structural frame 402 as part of the secondary pump 900. The prime mover outline line 912 may include a hydropower generator 1003 which is rotated by a flow of municipal water to generate electric power when the hydraulic valve 904 is open to supply the flow of the municipal water to the prime mover header 1002. In addition, the flow of liquid extracted from the sump pit by operation of the secondary pump 900 and flowing in the secondary intake line 502 is supplied to the prime mover header 1002 via a liquid inlet 1004 of the secondary pump 900.

An eductor 1006 is included in the secondary pump 900. The eductor 1006 provides a prime mover for the secondary pump 900, using a flow of liquid at the outlet of the prime mover header 1002. In some examples, the prime mover header 1002 and the eductor 1006 may be a single unitary structure, which may be referred to as eductor 1006. The flow of water from the municipal utility via the prime mover outlet 912 through the eductor 1006 is the prime mover driving the secondary pump 900. This flow of the municipal water supply through the eductor 1006 is the prime mover that creates a suction at the secondary intake 504 of the secondary pump 900. The suction creates an independent flow of liquid out of the sump pit and through the eductor 1006 to an outlet 1008 of the secondary pump 900. The flow of liquid exiting the eductor 1006 at the outlet 1008 of the secondary pump 900 is a combination of the liquid extracted from the sump pit and the flow of liquid supplied as the prime mover to the eductor 1006. The combination of the flow of liquid extracted from the sump pit via the second intake line 502 and the municipal water flow representing the prime mover for the secondary pump 900 enters a merge pipe fitting 1010 included in the structural frame 402.

The merge pipe fitting 1010 may be formed to allow the cooperative combination of the flow of liquid at the secondary outlet 1008 and the flow of liquid at the primary outlet 728. The liquid flows from the primary and the secondary outlets are combined in the merge pipe fitting 1010 without effecting operation of the primary pump 432 or the secondary pump 900. This is due to the selection and sizing of the primary and secondary pumps to have compatible pump curve characteristics. In addition, the geometry of the merge pipe fitting 1010 provides an angled trajectory of entry of the liquid flow from the secondary outlet 1008 into the liquid flow from the first outlet 728. Thus, the velocities of the liquid flow from the secondary outlet 1008 into the liquid flow from the first outlet 728 are successfully and efficiently merged in the merge pipe fitting 1010. The merge pipe fitting 1010 may be coupled with the common outlet 430.

When the primary pump 432 is operating, the flow of liquid extracted by the primary pump 432 via the primary intake line 508 is supplied through the primary check valve 726 and the primary outlet 728 to the merge pipe fitting 1010. Thus, the combination of the flow of liquid extracted from the sump pit by the secondary pump 900, the flow of liquid extracted from the sump pit by the primary pump 432, and the flow of liquid supplied by the municipal utility water supply as the prime mover in the eductor 1006 is provided to the common outlet 430 when both the primary pump 432 and the secondary pump 900 are operating. When the primary pump 432 is not operating, a combination of the flow of liquid extracted from the sump pit by the secondary pump 900 and the flow of liquid supplied by the municipal utility water supply are output from the merge pipe fitting 1010 to the common outlet 430. In this operational configuration, the primary check valve 726 prevents backflow of liquid into the sump pit via the primary intake 508. When the hydraulic valve 904 is closed such that the secondary pump 900 is not operating and the primary pump 432 is operating, only the flow of liquid extracted from the sump pit and supplied to the primary outlet 728 is provided in the common outlet 430. In this operational configuration, the hydraulic valve 904 and a check valve in the secondary intake line 502, such as in the foot valve 504 (FIG. 9).

In other example configurations, the merge pipe fitting 1010 and the common outlet 430 may be external to the home flood prevention appliance. In these example configurations, the primary outlet 728 and the secondary outlet may individually extend outside the structural frame 402 before being joined at the merge pipe fitting to form the common outlet. Thus, the common outlet may be within the building structure in which the home flood prevention appliance is located, or may be located outside the building structure.

The hydraulic level sensor may independently and pneumatically control the operation of the prime mover 1006 as provided by the flow of municipal water through the hydraulic valve 904. As such, the secondary pump 900 is driven by a prime mover, in the form of the municipal water supplied to the eductor 1006, that is other than the electric power source used to drive the primary pump 432. The prime mover supplied to the eductor 1006 invokes extraction of a first flow of liquid from the sump pit via the secondary inlet 504. Accordingly, the secondary pump 900 is driven by prime mover provided by the eductor 1006 to extract a second flow of liquid from the sump pit at a second inlet, which is the inlet 504. When the primary pump 432 is operating, the flow of liquid from the primary outlet 728 provides at least a portion of the flow of liquid in the common outlet 430. Thus, the flow of liquid in the common outlet 430 is at least equal to the flow of liquid extracted by the primary pump 432 and the secondary pump 900 when the primary pump 432 is operating. When the hydraulic valve 904 is open enabling a flow of municipal utility water to provide the prime mover 1006, the flow of liquid in the common outlet 430 is at least equal to the liquid extracted by the secondary pump 900 from the sump pit and the flow of municipal water.

Figure 11:
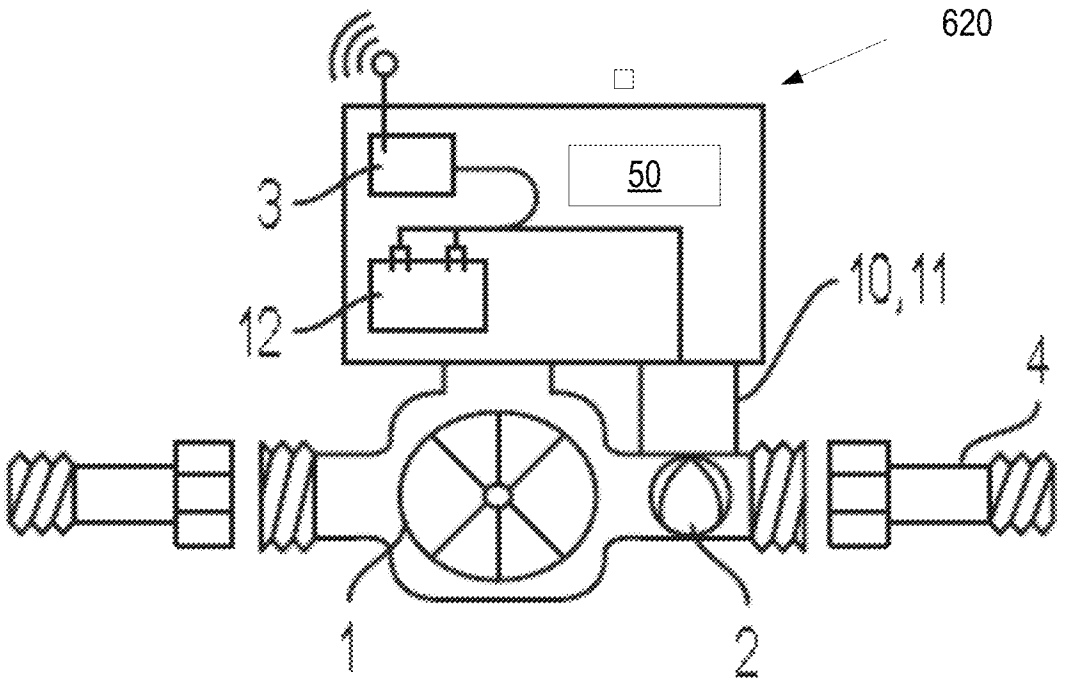
FIG. 11 is a block diagram of an example smart water meter/shutoff valve, which may be included in the home flood prevention appliance.

Referring to FIG. 11, with reference to FIG. 6, an example of the smart water meter/shutoff valve 620 can include (1) a water flow meter or flow meter 624, (2) a water control actuator or 622, and be in communication with the controller circuitry (50), which includes the user interface and communications circuitry (3). The smart water meter/shutoff valve 620 may control the flow of water into the home flood prevention appliance system and the domestic water distribution network in the building structure in which the appliance is installed. The (2) water control actuator, the (1) flow meter and the controller circuitry (50) can be included in a unitary or combo water control device, as illustrated. Alternatively, in other examples, similar to the example of FIG. 6, the smart water meter/shutoff valve may be separated elements. Thus, FIGS. 11-15 and the related description is not limited to just one of either a unitary water control device or separated elements forming a water control device. In an example, the smart water meter/shutoff valve can be pre-piped and assembled into a spool (4) which can include, for example, two half unions, or similar, quick connections for easy installation within the housing or the quick disconnect station. The water flow meter (1) can be any form of water flow detection device, such as a mechanical meter, a pressure-based meter, an optical meter, a vortex flow meter, an electromagnetic meter, an ultrasonic meter, a Coriolis meter, and/or a laser Doppler meter. In an example implementation, the water flow meter (1) can be a sensitive water flow meter having a wide flow range to detect very small water flows as well as large water flows. The water control actuator (2) may be an electrically operated valve, such as a motorized shutoff ball valve. In other examples, any other form of water flow control mechanism can be used, such as a solenoid valve, a gate valve, a butterfly valve or any other mechanism to control the flow of water from the municipal water source.

The output from the smart water meter/shutoff valve 620 may be supplied via the outlet 516 to a home water distribution network system such as the water piping feeding sinks, showers and toilets throughout the home. In addition, the output from the smart water meter/shutoff valve 620 may be provided through the level test actuator 720.

The level test actuator 720 may be used to automatically test the level sensors and the primary sump pump and/or the secondary sump pump at predetermined intervals. In addition, the level test actuator 720 may be used to calibrate the sensorless pump control or the laser pump control for primary pump level control. During a diagnostic test of the primary and secondary sump pump and the level sensors, the controller circuitry may automatically actuate the level test actuator 720 to fill the sump basin with water from the municipal water supply line. The controller circuitry may then confirm that the primary sensors for primary pump level control and the primary pump are operational, and also confirm operation of the back-up dual float switches. Also, the controller circuitry may not operate the primary pump in order to test the fully mechanical operation of the hydraulic level, the hydraulic valve and the secondary pump. In addition, the controller circuitry may disregard the different level signals so as to selectively energize the primary sump pump, or the secondary sump pump, or both the primary and the secondary sump pumps in response to the level signals to confirm operation of the sump pumps are within expected performance. Using the level sensors included in the sump pit liquid level sensing system for electrical and hydraulic pump level control the controller circuitry may not only confirm that the primary and secondary pumps are evacuating water from the sump basin, but also estimate a flow rate at which the pumps are operating alone or cooperatively in combination. The estimated flow rate may be compared to a predetermined expected flow rate, such as a table of flow rates, to confirm performance of each of the primary and secondary sump pumps is within an expected range.

In addition, the controller circuitry may automatically perform calibration of the main level sensors used for pump level control of the primary pump by energizing the primary sump pump to evacuate the sump basin until a level of the liquid is sufficiently lowered toward the distal end 410 of the columns 416 unit either the end of the pressure sensing tube is no longer submerged or the float in the passageway has reached the stop 714. The controller circuitry may then calibrate the pressure sensor of the pressure sensing tube, or the time of flight of the TOF sensor for pump level control to zero. Following calibration, the controller circuitry may actuate the level test actuator 720 to fill the sump basin until the end of the pressure sensing tube for pump level control is again submerged in order to capture air within the pressure sensing tube for pump level control, or the float has floated vertically away from the stop 714.

Figure 12:
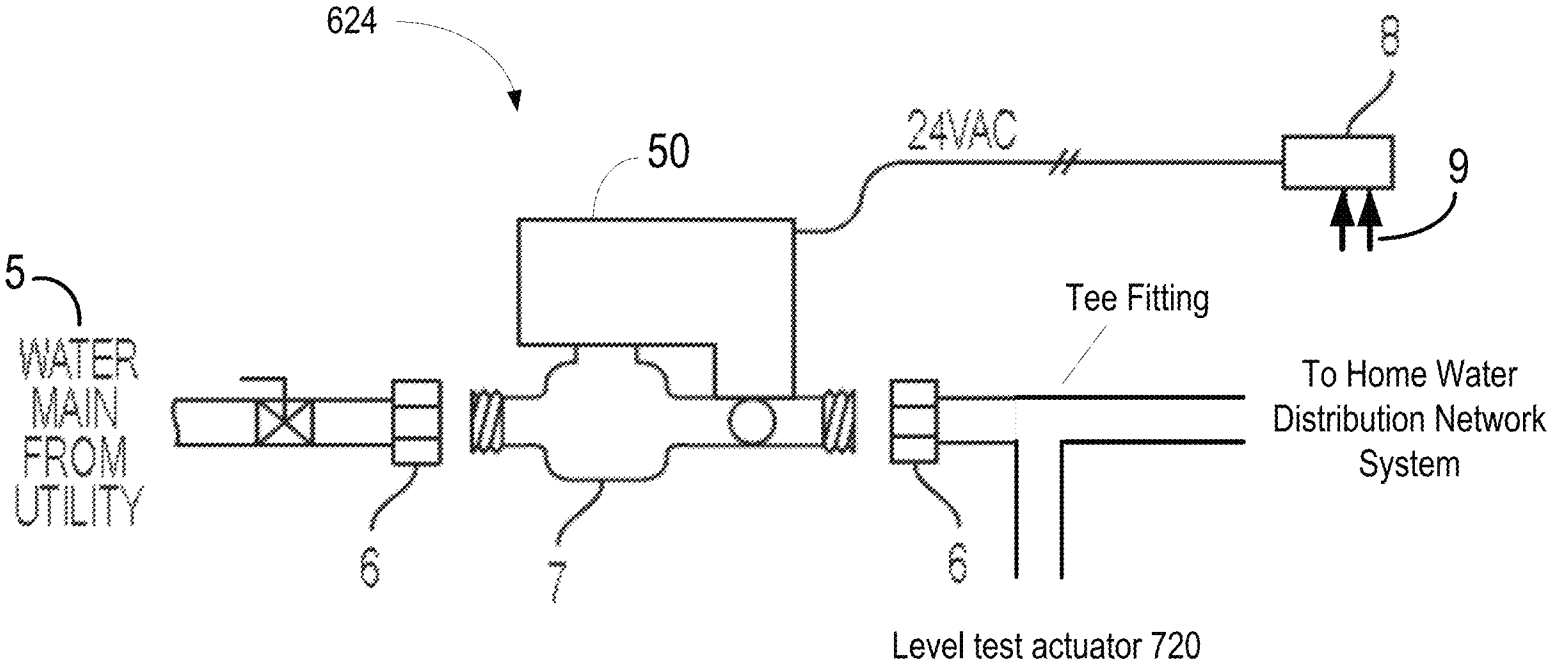
FIG. 12 is a block diagram of another example of a smart water meter/shutoff valve, which may be included in the home flood prevention appliance.

FIG. 12 is another example of the smart water meter/shutoff valve 624. The smart water meter/shutoff valve 624 of this example may include mating union connections (6) for coupling with the water main from the utility and also coupling with a tee fitting included in the housing that supplies the level test actuator 720 included in the housing and the home water distribution network system via, for example, the quick disconnect station. Thus, the smart water meter/shutoff valve 624 of this example may be factory installed in the housing of the home flood prevention appliance or the quick disconnect station, or may be added later as an optional feature since the smart water meter/shutoff valve 624 may be coupled into place (7) using the mating union connections (6). In other examples, other types of coupling mechanisms may be used to install the system in the housing of the home flood prevention appliance system, or in the quick disconnect station so as to control the flow of water into a building structure.

A power adapter (8), such as low voltage AC power adapter, may be plugged into the quick disconnect station via a quick disconnect. Alternatively, the power adapter (8) may be plugged into a wall receptacle located within a predetermined distance, such as up to 250 feet, from the smart water meter/shutoff valve 624. In another example, the power adapter may be omitted since the smart water meter/shutoff valve 624 may operate at 120 VAC. The power adapter (8) can be coupled with power wires (9) to power the smart water meter/shutoff valve 624. In an example, the power wires (9) may be present in a 120 VAC outlet in the quick disconnect station, and the power adaptor (8) may have a 120 VAC plug configuration, and a transformer to convert and/or step the voltage down to a predetermined level, such as 24 VAC. In other examples, other voltages and types of connectors may be used.

Referring to FIGS. 11-15, the communication circuitry (3) may provide communication with any of a number of different mobile devices (17), such as cellular phones, smart phones, tablets, or any other device with wireless communication functionality. The communication circuitry (3) may communicate over one or more wireless networks, such as a CDMA or 4G network, the internet, a Wi-Fi network, short range networks, such as Blue Tooth™ and/or any other wireless communication network with the mobile devices (17). In an example embodiment, the communication circuitry (3) communicates with the mobile devices (17) over only a cellular network to ensure reliability and robustness of the communication path. The communication circuitry (3) may also be part of a system for remote monitoring and control of remotely located equipment that minimizes wireless airtime, such as the system described in U.S. Pat. Nos. 7,228,129 and 7,778,633, which are both herein incorporated by reference in their entirety. In this example configuration, the communication circuitry (3) can be a bi-directional wireless interface that communicates using a first protocol based on a user configurable data string, and a second protocol based on a user configurable data file. In an example system for remote monitoring, the communication circuitry (3) can selectively communicate with a central server computer (not shown) or the mobile devices (17) using the first and second protocols. The central server may provide a user interface to the system; event logging; configuration; data capture and storage; system and device configuration, manipulation, operational control, security and any other system related functions.

In an example, the water control actuator (2) can be a valve that operates at a predetermined voltage, such as 12 VDC motorized ball valve (11) in lieu of a lower cost solenoid valve. A motorized ball valve may be used to eliminate water hammer noise that can otherwise occur when a solenoid valve is slammed shut under full pressure. The additional reason is that an energized solenoid valve can create pipe vibration noise which can be heard throughout the building structure water lines, such as home water lines. A solenoid valve can be either of the normally open or normally closed design. For example, a normally open solenoid valve must have voltage applied to its' coil to close it, and when power is removed, it will open. The proposed system uses a geared, motorized ball valve because it drives open/closed in approximately five seconds, eliminating water hammer. Additionally the motorized valve does not require power to maintain its position, such as an open or closed position. Once driven to its position, power can be removed, and it will stay put. This can be preferential during a power loss condition because the valve will stay closed, or open, as needed. Additionally, the 12 VDC motorized ball valve can be driven to its open or closed state during power loss events using a battery, such as an external battery, a battery included in the structural frame of the home flood prevention appliance, an onboard backup battery (10) included with the water control actuator (2), or from the micro-hydroelectric power generator which generates suitable power to operate the valve from the domestic water line.

During AC power loss, the water meter (1) can continue to monitor water flow using a backup battery 12 (FIG. 11) included in the home flood prevention appliance, and if water flow is detected, the onboard backup battery (10) can be used by the controller circuitry to power the water control actuator, such as an electrically operated shutoff valve, to the closed position. The water control actuator, such as a valve, can be driven closed, and then power can be removed from the water control actuator, so that power from the on board battery backup (10) is available, and thus is reserved for the communication circuitry (3) and other electrical devices in the system, thus reserving battery power of the battery (12). If AC power is lost for an extended period of time, the system logic may open the level test actuator 720 to fill the sump pit. The micro-hydrogenerator is operated from this water flow, and harnesses this energy to recharge the depleted backup battery. This cycle can repeat indefinitely, as long as domestic water pressure and flow are available, providing an unlimited venturi pump runtime, and valve control, during long duration AC power loss events, using the water powered venturi pump to keep the sump pit at normal levels, and keep all electronic circuitry functioning The water meter (1) can detect even the smallest leaks in the home flood prevention appliance or in the home in which the appliance is installed. Thus, leaking toilets, leaking faucets, appliance leaks, ice maker leaks, or any other type of undesired water escape may be detected with the smart water meter/shutoff valve. These small leaks can equate to a large water bill over time, and although do not typically cause building damage; they can cost the user lots of money. The proposed system detects these water "vampires" so that the home owner can take action. Frozen pipes are also another major source of water damage. Many times a frozen pipe will start as a "pin hole" leak (13) in some remote pipe somewhere in a building structure, such as in a wall, and then progress to an increasingly larger hole. Even the smallest pinhole leak anywhere in the building enclosure piping system can be detected. Leaking water heaters, and any other appliance can also be detected if having even the smallest leak.

Figure 13:
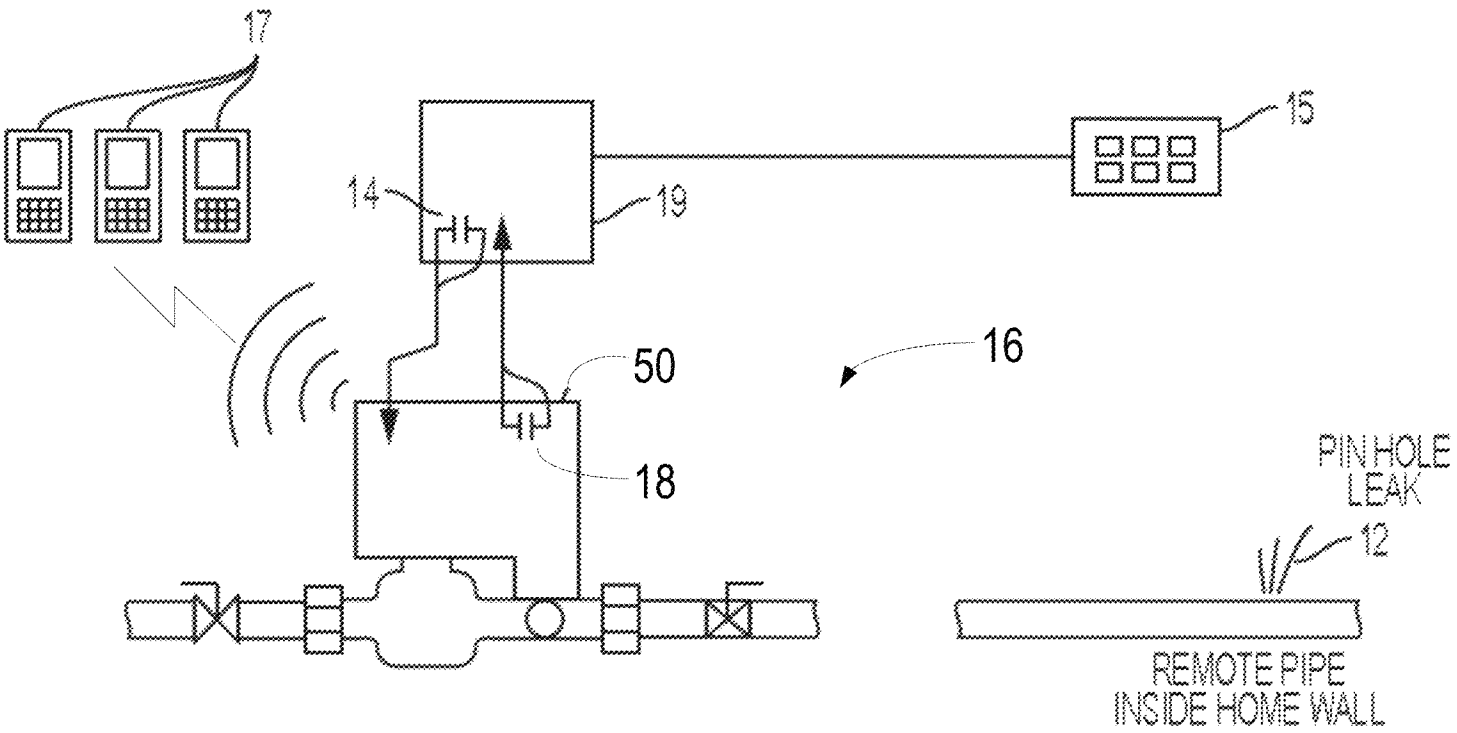
FIG. 13 is a block diagram of another example of a smart water meter/shutoff valve, which may be included in the home flood prevention appliance, and which includes a user interface and also depicts mobile devices.
Figure 14:
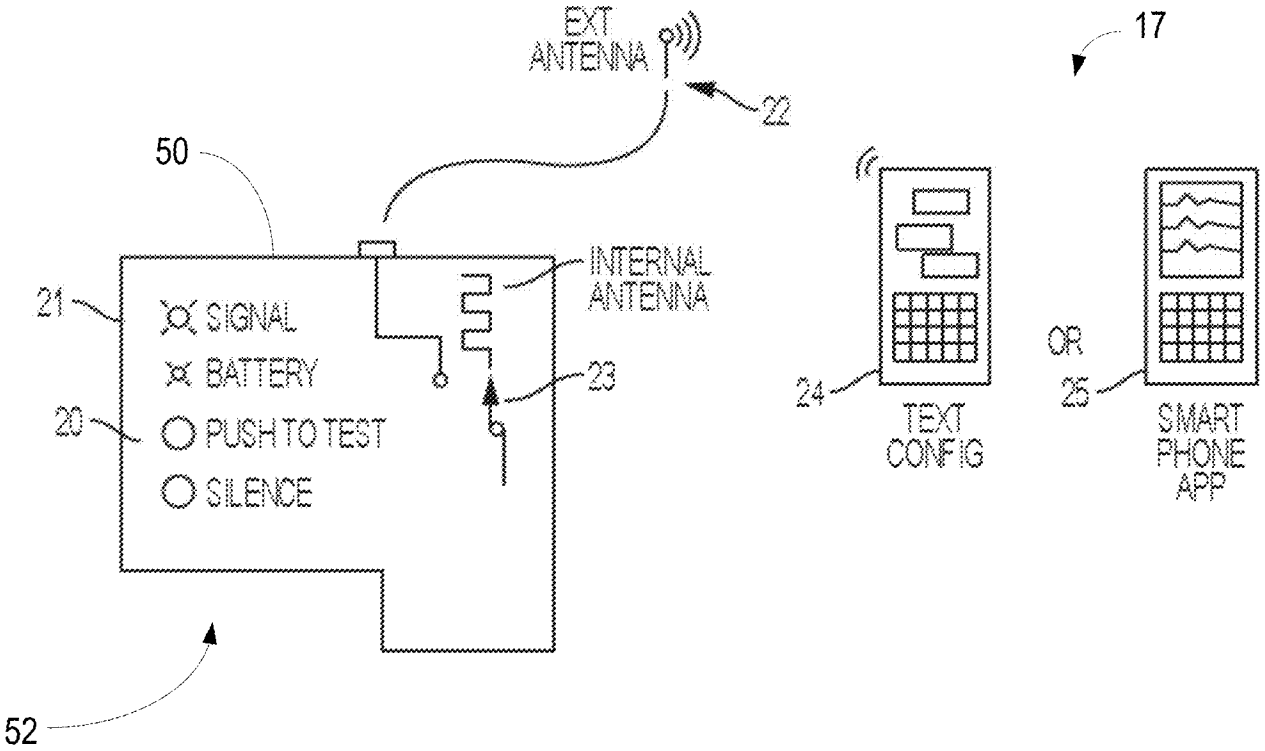
FIG. 14 is a block diagram of a part of an example of a portion of a home flood prevention appliance illustrating an example of a portion of a user interface, which also depicts mobile devices.
Figure 15:
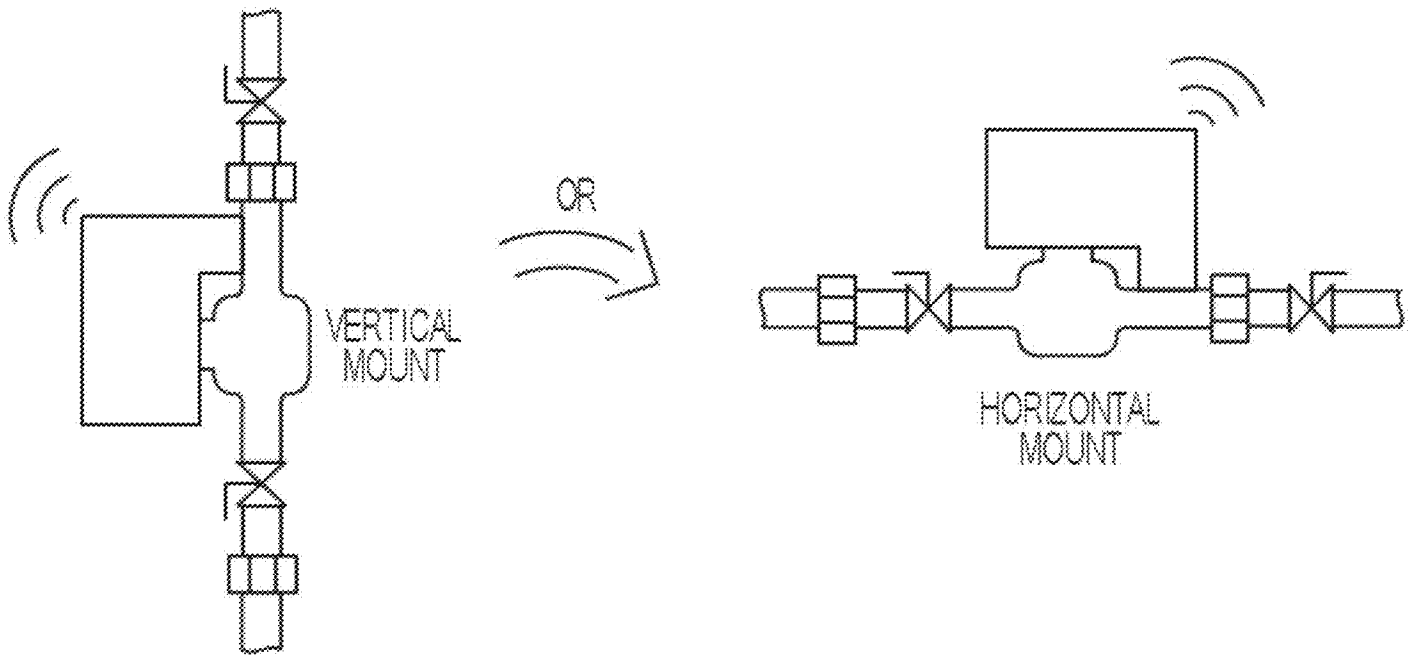
FIG. 15 is an example of orientation of an example of a smart water meter/shutoff valve, which may be included in the home flood prevention appliance.

In an example configuration with reference to FIGS. 13-15, the system can accept one or more different input signals (14) such as relay contact closures from any $3^{rd}$ party system (19), such as an alarm system provided from an alarm system supplier. In an example implementation, at least one of the input signals (14) can correspond with when the user, such as a homeowner, arms/disarms a premises alarm system. For example, a home owner can be leaving for work in the morning, and control or "arm" his home alarm system from a user interface (15), such as a keypad at his front door. The alarm system main panel can provide an output signal, such as by closing a relay contact output (14), which "arms" the home flood prevention appliance (16). The home flood prevention appliance in this mode will monitor for the smallest water leaks while the homeowner is away, while ignoring one or more previously defined water use profiles such as a profile of an ice maker making new cubes, washing machine finishing a load of laundry, a water softener's scheduled regeneration, etc. If an unexpected/unrecognized water flow in the form of a water leak event is detected, the wireless transmitter (3) can send a text message to a predetermined quantity of different mobile devices (17), such as by sending sms text messages, or data to a users smartphone app, to up to three or more different, phone numbers of mobile devices (17) so the home owner or plumber can take action. In addition, the system can also trigger an on-board output signal, such as a relay output (18), to trigger an indication to the home alarm system 19 of the same event. Therefore, the proposed system can work side-by-side with any $3^{rd}$ party system (19) by including the ability to send an output signal, such as by closing an onboard relay, which will indicate an alarm event to any 3rd party system, such as an alarm system being 24/7 monitored by an alarm system supplier.

The on board battery backup (10) and/or the battery back system (12) included in the housing can be a rechargeable battery, and the system can include a low battery alarm as an integral feature of the home flood prevention appliance. The battery backup system (12) can, eliminate the need for the owner to come up with his own battery backup protection scheme. The system can continuously keep the backup battery (12) charged, via onboard AC charger or via onboard micro-hydro-power-generator, and if for any reason the battery becomes unplugged, uncharged, or unable to charge, the system can alert the homeowner to replace the battery(s) or perform other maintenance/troubleshooting/repair.

Referring now to FIG. 14, an example of a user interface for the home flood prevention appliance is illustrated along with a text device and a smart phone device. The example system may employ a push-to-test push button (20) in a user interface 52. The user interface 52, may, for example, be positioned on a face plate of the system in communication with the controller circuitry 50 such that when the button (20) is actuated, the water valve is closed, and a text message alert is sent to the homeowner's preprogrammed phone numbers, with a time/date stamped event date. This feature may also be used to periodically test the operation of the primary and backup sump pumps in the system.

On board, indicator(s), such as bi-color LED indicators can be used to show if suitable wireless signal strength (21) is available. For example, a green color can indicate a suitable signal, and a red color can indicate the signal should be improved. The system allows for connection of a remote high gain antenna (22) which can be placed in a higher elevation in the home to correct a weak signal condition. The wireless transmitter can include an on-board analog switch (23) which can automatically detect an external antenna is plugged in, and then automatically switch the antenna to the strongest signal source.

The home flood prevention appliance can be programmable via at least three different modes, 1) text message commands from any device which can send a text message (24), or 2) from a smart phone app (25), or 3) from the appliance front panel HMI display. In an example configuration, the home flood prevention appliance can provide the capability to program and configure operation of the system, using a free form text based approach. For example, programming and configuration of the system can be performed using text messages either locally via the user interface, or remotely via the mobile devices 17 communicating via text message or standard data exchange methods. The free form text based approach eliminates the need for structured syntax programming methods since no predetermined format or syntax is needed for either the command portion of a command message, or the data portion of a command message. Instead, the system includes a command interpreter module capable of processing messages in an unstructured format by parsing the text message to identify a command and data that is present therein. An example of such functionality is described in U.S. Patent Publication No. 2014/0120901 published May 1, 2014, which is herein incorporated by reference in its entirety.

As illustrated in FIG. 15, an example of the smart water meter/shutoff valve in the form of a unitary structure can be mounted in any orientation in the structural frame of the home flood prevention appliance, in the quick disconnect station, or elsewhere in the home. For example, the smart water meter/shutoff valve mounted within, or external to the home flood prevention appliance can be mounted in either a vertical or horizontal orientation giving the installer the option for the most convenient mounting method. Some water meters and valves can only be mounted in the vertical orientation, but this is not a limitation with the home flood prevention appliance's smart water meter/valve.

Significant water damage can happen not only from frozen or leaky water lines, but also from the failure of other water related systems, such as a sump pump. The pressure sensing tube and corresponding pressure sensor, and/or the dual float switches can be included within the home flood prevention appliance and alert a user to a high water condition in the sump basin, so that the user can take immediate action to mitigate additional water damage. Additionally, or alternatively, a tether float can be attached to a secondary input of the home flood prevention appliance to monitor a water system, such as a grinder pump system. In this example, the grinder pump system can be present on building structures, such as homes with basements where a restroom or kitchen is located in the basement. The grinder station can collect waste water from the basement sink or restroom, and pump such water to the city sewer or local septic system. This grinder pump system can be separate from the home sump pump which can be established to collect only certain types of water events, such as black water from the building's toilets and sinks. A failure of the grinder pump can, for example, potentially cause backup of wastewater into the building enclosure. The home flood prevention appliance can also supply early warning of system failures, such as a grinder pump system failure.

In the event of any alarm condition, the system can provide a local audible siren in addition to the data or wireless text notification so if the user is nearby when the event occurs, he gets immediate notification even if he is not carrying his portable mobile device.

The water control actuator (2) can also include a position indicator to visibly indicate if the valve is in an opened or closed position. Since water lines are not transparent, the position indicator is valuable, especially when using the manual override lever to determine the full open or closed position of the valve. If the valve would fail to close/open for any reason under automatic control, or the user, such as a home owner, wants to manually open/close the valve for any reason, without initiating the automatic features, the user can manually open/close the water valve by actuating an override lever to an enabled position, such as by manually pulling out the override lever from a recessed position in the home flood prevention appliance. The system can monitor the override lever and automatically pass between manual and automatic control. Once actuated, the override lever may be manually turned until the valve position indicator shows the valve is in the desired position. Once manual testing is complete, the override lever can be returned to a disabled position, such as by pushing the override lever in to return the valve to automatic control.

The home flood prevention appliance can be used as a total home water protection system by using a water meter for functionality that is applicable to more than just emergency shutoff situations. In some examples, the system can continually track water usage and the associated reports can be compared to utility meter readings to catch leaking toilets, faucets and more . . . including inaccurate utility meters. The system can include a smart learn mode for use in monitoring and tracking water usage. For example, a user can input water consumers present in the water distribution system, such as devices which use water like ice makers, etc.) to ignore. In home application examples, the system can work in harmony with the modern home owner, alerting him to critical conditions, but not shutting down the water supply when common water using appliances are merely trying to function. For example, the system can "learn" the characteristics of the refrigerator, and when the refrigerator uses water for a short duration, such as to make ice cubes, this event can be ignored and treated as a non-critical event. This learned profile allows the user to input water consumers within the water distribution system to prevent false alarms. Such identified water user can include, for example, if a user simply leaves a faucet dripping to prevent a frozen pipe during extremely frigid winter months.

Operation of the home flood prevention appliance can include a number of significant benefits, including: Prevent/mitigate large insurance claims, and cooperatively operate with whole home automation—wifi, zigbee, Nest™ network, etc.

In a home application, significant damage from water can result from leaking clothes washer/dishwashers and other appliances, mechanical failures of toilets and other water dispensing devices, leaking ice makers, or any other appliance or device connected with the water distribution system in a home building structure.

In example applications in commercial building structures other than a home, such as a doctor's and dentist's offices, the home flood prevention appliance can protect valuable equipment and other assets, such as when the office is closed. For example, in dentist offices and medical offices, expensive electronic equipment can be damaged even by the smallest water leaks. Using the home flood prevention appliance, water leaks can be automatically detected and damage can be minimized to the business similar to a home.

The typical home or business can suffer quick, immediate, and extensive damage from fire, theft/vandalism, natural disaster, and water damage. Other forms of home damage can occur over a longer period of time, or are simply not as significant as damage from these primary sources. Fire and burglar alarms are prevalent in society, but to date the concept of a water detection and shut down system is unavailable. It is a major area of significant home damage, and is simply unmonitored without the home flood prevention appliance.

Example Operating Modes

The home flood prevention appliance can operate in any one of a number of different operating modes in addition to the boost mode. Within the operating modes, the system can operate based on expected water usage. Expected water usage can be monitored based on water flow rates. For example, one or more water flow rate profiles may be used. The water flow rate profiles may be generated by the system, input by a user, and/or be predetermined. In addition, different flow rate profiles may be generated/applied based on different external parameters received as inputs to the system, such as whether an external system is operating (e.g. alarm system armed/disarmed, water softener regenerating), a time of day, a day of the week/month, or any other parameter that can be provided to the system as an indication of expected water usage. In one example, there can be three modes: 1) an Away Mode; 2) a Home Mode; and 3) a Disabled mode.

Figure 16:
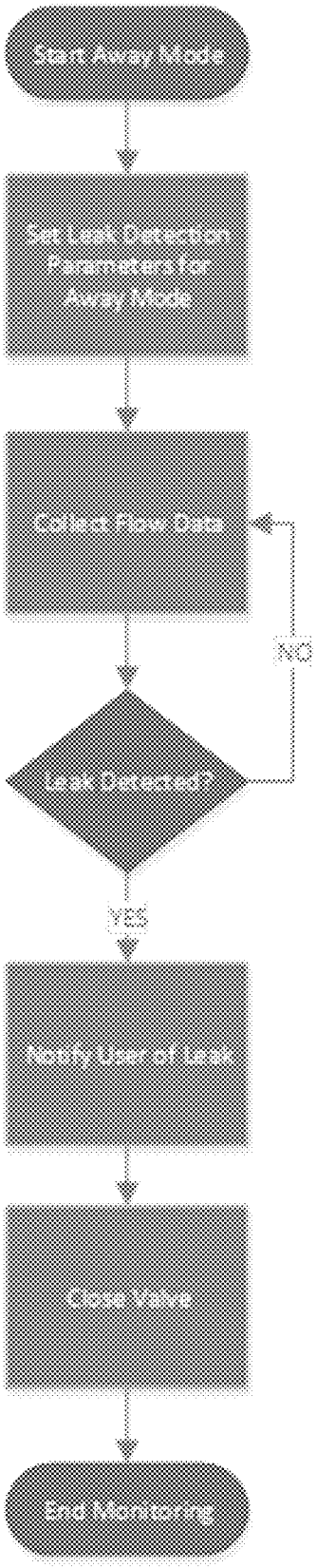
FIG. 16 is a flow diagram illustrating an example of operation of a home flood prevention appliance in an Away Mode.

In the Away Mode, as further illustrated and operationally described in FIG. 16, the system is expecting very little water flow since operation of the water distribution system by a user is unlikely while the user(s) is away from the building structure. Thus, in the Away Mode, the leak detection sensitivity of the home flood prevention appliance is increased in order to more quickly detect a potential leak condition. In an example, the system may include one or more predetermined water flow profiles representative of the building enclosure not being inhabited. Detected water flow conditions outside the predetermined water flow profile(s) can be characterized by the system as a leak condition.

This mode allows the system to collect flow data, and analyze the collected flow data for conditions indicating a water leak under circumstances of little or no water flow in the water distribution system, except from predetermined automated water use sources, such as ice makers, humidifiers, water softeners and other automated equipment. Thus, the system can respond quickly to any unexpected water flow as a detected leak, while also reducing the chances of false alarms. Also, the system can automatically actuate a water control device to stop water flow, such as by automatically closing a water valve, if a leak is detected without regard to other operational conditions in the water distribution system being monitored. In an example configuration, once a water control device is actuated, such as by closing a water valve, the user can manually intervene to re-open the valve. In some example configurations of the Away Mode, upon detection of a leak, the system can enter a lock mode where the system will not automatically actuate the water control device to resume a water flow condition, such as actuating a valve back to an open position, under any circumstances until removed from the lock mode by a user.

Figure 17:
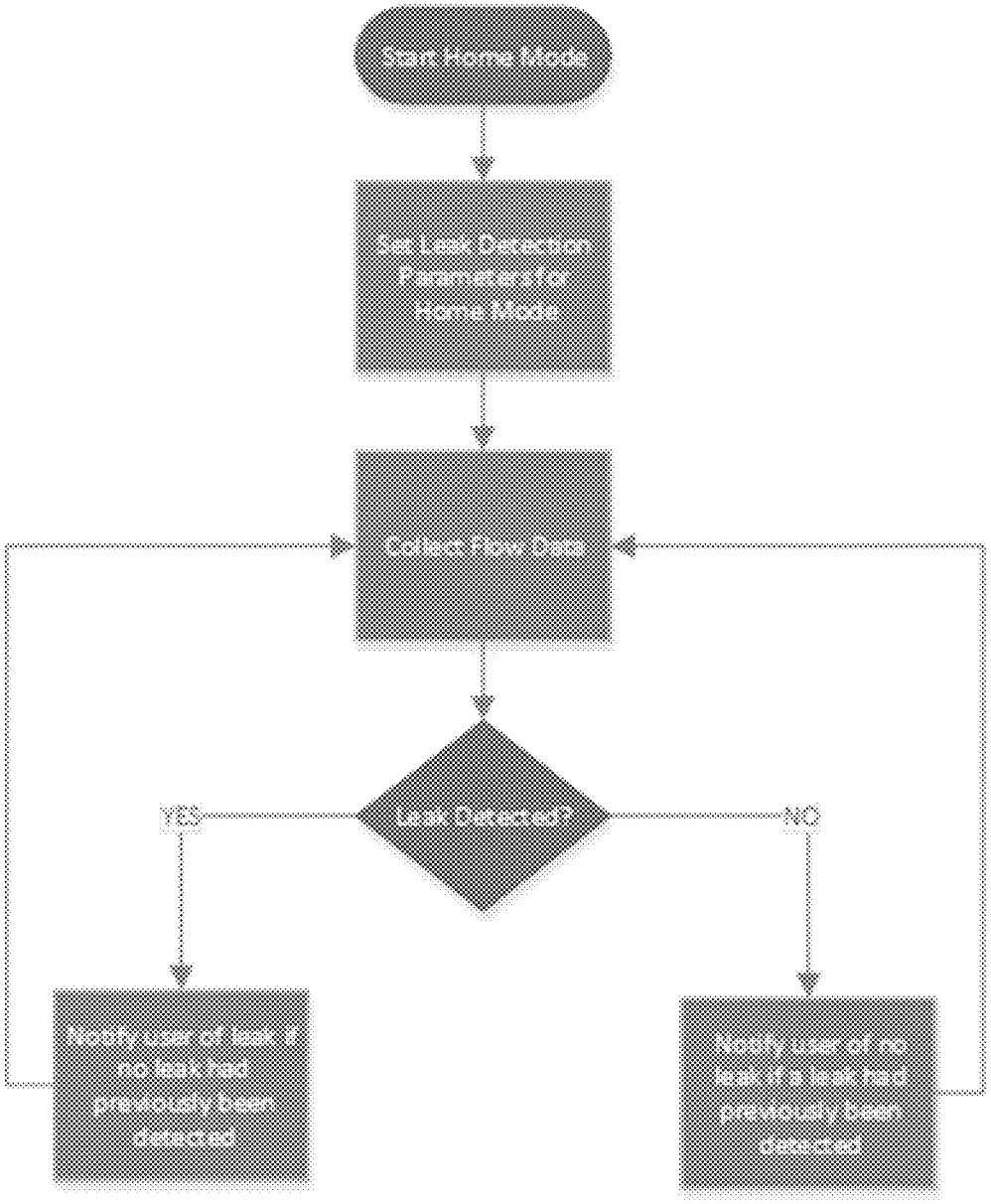
FIG. 17 is a flow diagram illustrating an example of operation of a home flood prevention appliance in a Home Mode.

In the Home Mode, as further illustrated and operationally described in FIG. 17, leak detection parameters may be set for conditions where the system is expecting variability of water flow due to the building enclosure being occupied by people or appliances using water. The leak detection sensitivity of the home flood prevention appliance can be lower relative to the Away Mode in order to prevent false alarms. For example, predetermined water flow profiles can be customized by the user in accordance with expected water usage to provide wider acceptable variability due to predetermined expected operational conditions. In at least some embodiments, the system may allow a user to identify the type and quantity of water usage devices/systems in the building structure so that the system can generate one or more expected water flow profiles. For example, a user can indicate that a building structure includes three showers, four toilets, three bathroom sinks, one kitchen sink, one dishwasher, one clothes washer, and three outdoor sillcocks.

Using this information, the system can construct one or more water flow profiles that are customized to the building structure. In another example, the system can be placed in a monitor mode in which one or more water flow profiles are generated by the system based on actual daily usage. In this example, once one or more initial water flow profiles are generated, the system can dynamically and automatically, and/or with user input, adjust the water flow profiles based on operational conditions. In at least some example configurations of the Home Mode, the system does not automatically actuate the water control device, such as opening or closing a water control valve, and instead, the user can manually intervene to control the water control device, such as the valve.

In the Disabled Mode, the system does not monitor water flow, and the system does not automatically actuate a water control device, such as by opening or closing a water valve. Instead, in the Disabled Mode the user must manually intervene to control the water control device.

Example User Interface and Configuration

Physical User Interface

The home flood prevention appliance can provide a user interface that facilitates changing the operating mode of the system, turning on and off the primary and secondary pumps, opening and closing one or more water control devices, such as a water control valve, and various other miscellaneous functions. The user interface can also provide visual indication of the operating mode, water control device status, battery status, and other miscellaneous information such as error conditions.

Example SMS Interface

The home flood prevention appliance can be configured to send and receive standard text messages, such as SMS messages, sent to and received from an external device, such as a user's cellular phone. Such text messages received by the system can contain pre-defined commands. The table below describes examples of some commands to interface with the home flood prevention appliance's flow monitoring features. Upon receipt of any command, the system can dynamically and automatically respond back to the user with a text message such as a command acknowledging the command.

TABLE 1

| Command | Description |
|---|---|
| Home | Changes operating mode to "home" mode |
| Away | Changes operating mode to "away" mode |
| Disable | Changes operating mode to "disabled" mode |
| Open | Opens the water valve |
| Close | Closes the water valve |

System Operational Leak Detection Examples

An example of two different leak detection methods for the home flood prevention appliance are illustrated in FIGS. 12 and 13. The two leak detection methods may be described as: max flow time and usage learning. In other examples, other leak detection methods can be used with the home flood prevention appliance.

Max Flow

Figure 18:
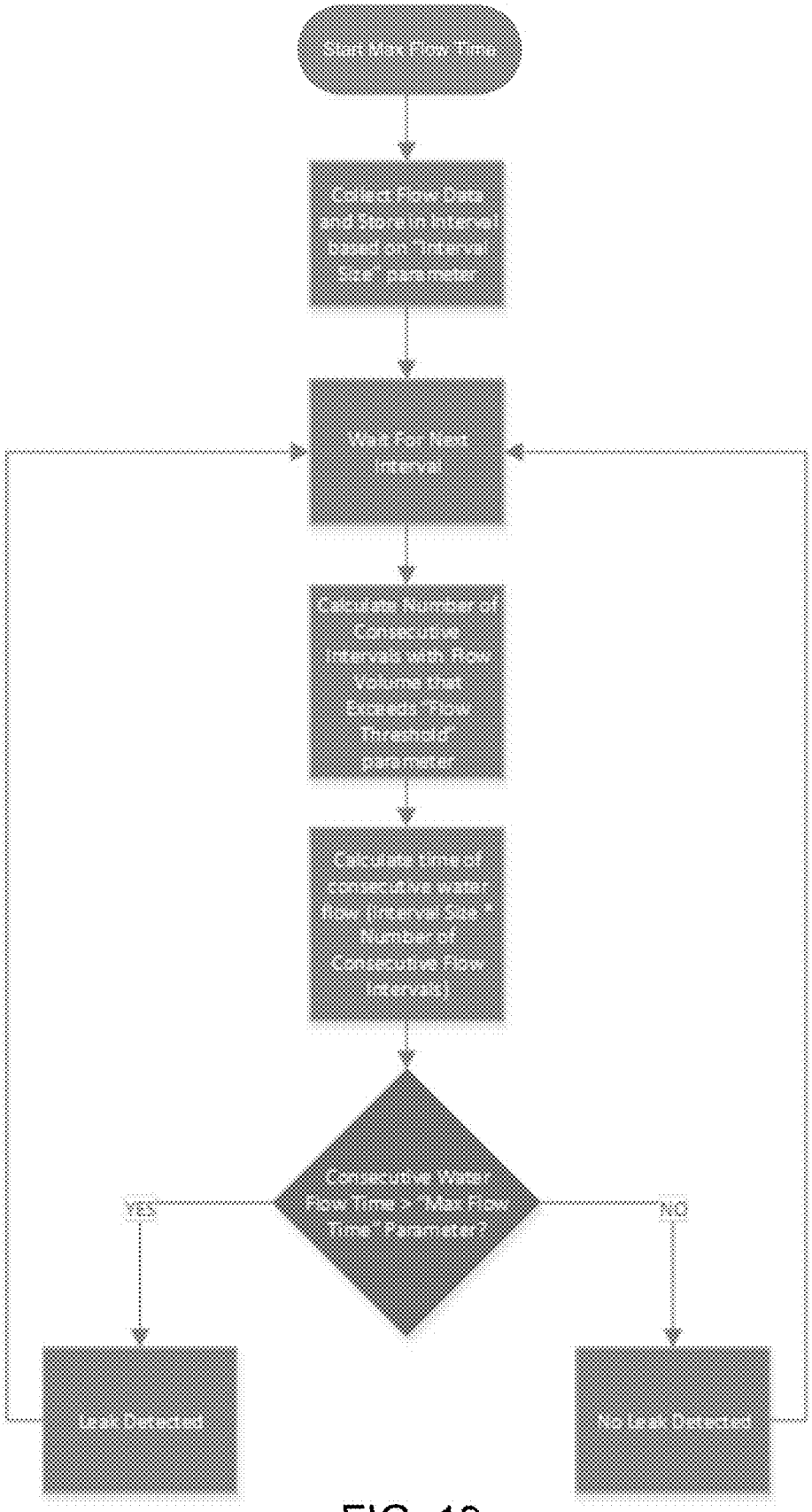
FIG. 18 is a flow diagram illustrating an example of operation of a home flood prevention appliance performing Max Flow leak detection.

As further described and illustrated in the example of FIG. 18, a Max Flow leak detection method can be used in monitoring the water flow and if the flow time exceeds a configured predetermined threshold, the system can indicate a potential leak has been detected.

Usage Learning

Figure 19:
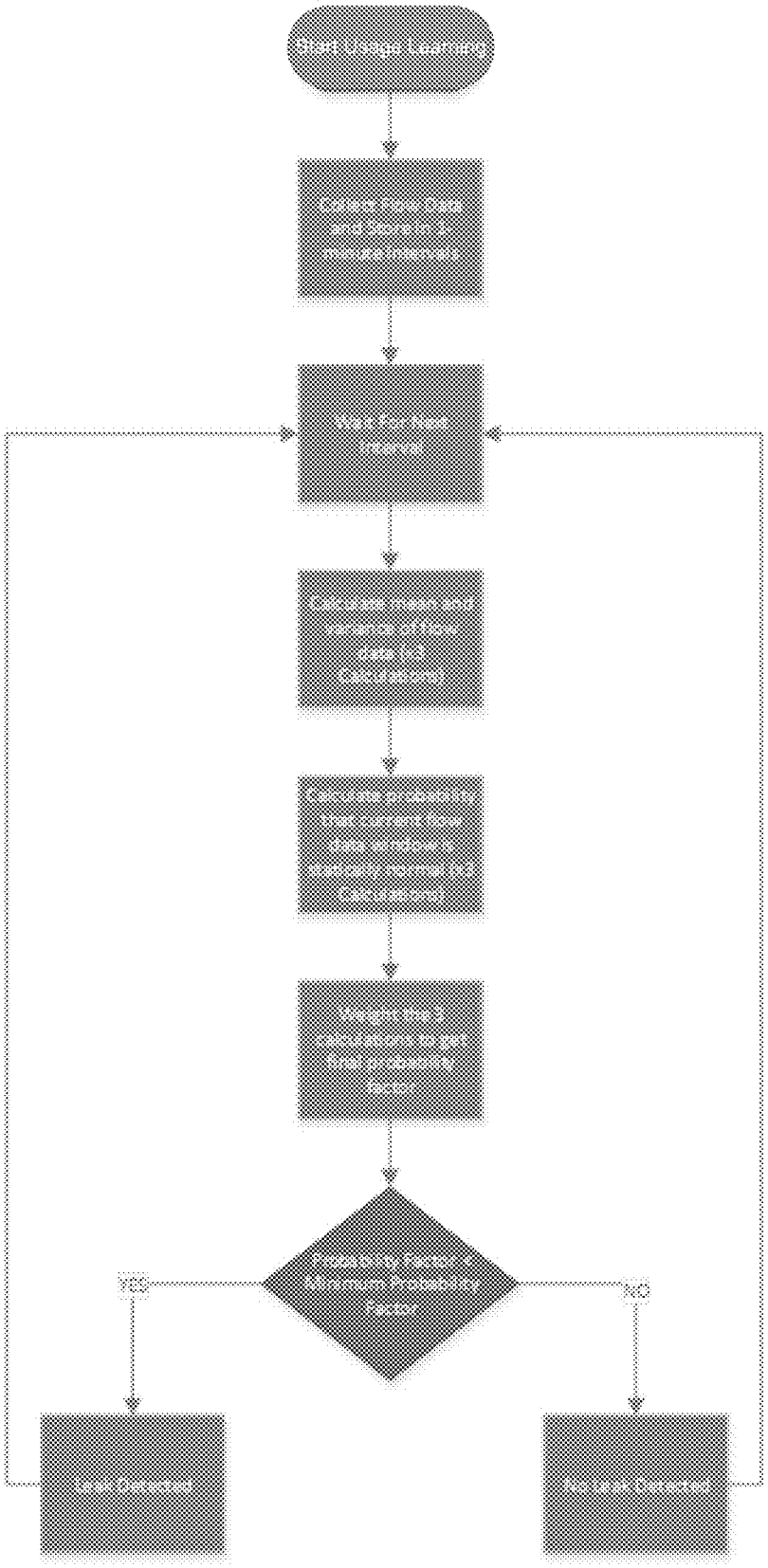
FIG. 19 is a flow diagram illustrating an example of operation of a home flood prevention appliance performing Usage Learning leak detection.

As further described and illustrated in the example of FIG. 19, a usage learning leak detection method can include collection and storage of flow data usage by the home flood prevention appliance in configurable duration time intervals. The configurable duration of the time intervals can be set by the user as a parameter in the home flood prevention appliance and/or dynamically determined by the system based on water flow patterns. In the example of FIG. 19, the time interval is indicated as one minute, however, in other examples, any other time interval may be used. Also, in other examples, intervals of varying and different time duration may be dynamically determined, and/or set by the user and used by the system. The system can store a large number, such as several hundred, intervals, which provide a history of water flow. The intervals, or profiles, can be later analyzed to detect leaks. The total flow, as measured from the flow meter, can be integrated over the interval time duration and stored in the interval time slot in chronological order by the home flood prevention appliance.

Once flow data has been collected, it can be analyzed by the home flood prevention appliance to detect a potential leak. A predetermined number of parameters can be used in the analysis of any interval. In an example, three parameters can feed into the data analysis: 1) Interval Size; 2) Flow Threshold; 3) Max Flow Time. In other examples, any other number of parameters may be included in the analysis by the system.

Interval Size: This parameter can be used by the home flood prevention appliance to set the duration, such as in minutes, of flow data collection intervals used by the home flood prevention appliance. In an example embodiment, a short value will make the system less sensitive to slow leaks, but respond faster to fast leaks, whereas a long value will make the system more sensitive to slow leaks, but respond slower to fast leaks. In this example, the time intervals can be configurable in whole minute increments. In other examples, different values may be used for the Interval Size.

Flow Threshold: This parameter can be used to set a flow volume threshold which indicates that an interval can be considered to have water flowing. Setting this flow threshold parameter to a low value causes the system to be very sensitive to slow leaks. Setting this flow threshold parameter to a high value causes the system to be "forgiving" to slow leaks.

Max Flow Time: This parameter can be used to set a maximum time of continuous water flow. If the number of intervals with consecutive flow multiplied by the interval size in minutes is greater than this max flow time, then the system indicates a potential leak.

An Example Configuration

A typical user, such as a home owner, will not understand or be able to quantify a volume of water flow over a given interval or a potential sump pump failure. This fact can make configuring and tuning the system difficult for a user. To simplify configuration and tuning, in an example, the parameters that feed into flow data analysis can be abstracted to simpler concepts.

The interval size can be user configurable, but can also be considered an advanced setting and can be hidden from the user. In an example embodiment, the system can include a default interval size, such as, for example, 5 minutes. A user may not need to reconfigure this parameter for some applications, such as a typical residential use application. Alternatively or in addition, the system can dynamically learn or determine the interval size during operation.

The flow threshold value can be abstracted from a volume of flow measurement to a "high", "medium", or "low" sensitivity value. The "high" value sets a low flow threshold value. The "low" value sets a high threshold value. These pre-determined threshold values can be preconfigured, but can also be configurable by a user through advanced settings. Alternatively or in addition, the system can dynamically learn or determine the flow threshold values during operation.

The max flow time is measured as a time period, such as minutes, of continuous water flow. The user can set this value directly based on a maximum anticipated continuous water usage time. Alternatively or in addition, the system can dynamically learn or determine the max flow time during operation.

Example Usage Learning

The home flood prevention appliance can learn water usage patterns to detect abnormal usage which may indicate a leak. By learning the times of day when water is typically being used in a particular application, the system can quickly respond to leaks while reducing the possibility of false alarms. For example, if the system has detected that little to no water has been used from 2:30 am to 2:40 am in the past, but has currently detected water flow, the system can indicate a potential leak to the user. On the other hand, if a building structure such as home experiences several people showering each weekday morning, the water usage will be high but the system will have learned this and will not indicate a leak.

Example Flow Data Collection

The home flood prevention appliance can store flow volume data in predetermined intervals, such as fixed 1-minute intervals, that are stored in "time slots" based on, for example, day of the week and minute of the day. In this example, each day can be divided into a predetermined number of interval time slots, such as 1440 interval time slots. In addition, each week can be divided into predetermined number of interval time slots, such as 7 days. The system can store a predetermined period of data, such as several weeks of data. In other examples, other types and durations of interval time slots may be used.

Example Flow Data Analysis

The home flood prevention appliance can employ anomaly detection, which can be based on dynamic machine learning. The historical flow data stored in determined intervals, such as 1-minute intervals, can be used as inputs to anomaly detection to determine the probability that a current flow window's volume is statistically normal. The flow window is the number of intervals being used in the analysis. If the home flood prevention appliance determines that the flow volume is not statistically normal, the system can indicate a potential leak. In addition, the system can calculate mean and variance of the flow data in various ways. For example: Across a window of the same intervals over any number of previous days; Across a window of the same intervals over the same day in any number of previous weeks; and/or Across any number of previous intervals.

The flow data can be characterized by the home flood prevention appliance as a normal distribution. The system can perform dynamic probability analysis using mean, variance, and/or current data to determine the probability of normalcy of the current flow data. In an example, the probability analysis by the home flood prevention appliance can be used to dynamically produce a probability for one or more of mean, variance, and/or current data. These probabilities can be weighted by the system to produce a final probability factor that is compared against a configured minimum probability. The configured minimum probability may be user entered or dynamically learned by the system during operation. If the calculated probability is lower than the configured probability, then a potential leak has been detected.

Example Configuration

One primary configuration parameter for the home flood prevention appliance is the minimum probability factor. However, some users, such as home owners, may not have a good concept of what this value means. So, the minimum probability factor can be abstracted to a "high", "medium", and "low" sensitivity value. A "high" sensitivity will have a higher minimum probability factor. A "low" sensitivity will have a lower minimum probability factor.

Further advanced configuration includes the window size of the number of intervals to be used in the mean and variance determinations by the home flood prevention appliance. Also, the number of days, weeks, and previous intervals to be included in the mean and variance calculations can be configurable through advanced settings.

Example Usage Signature Detection

Figure 20:
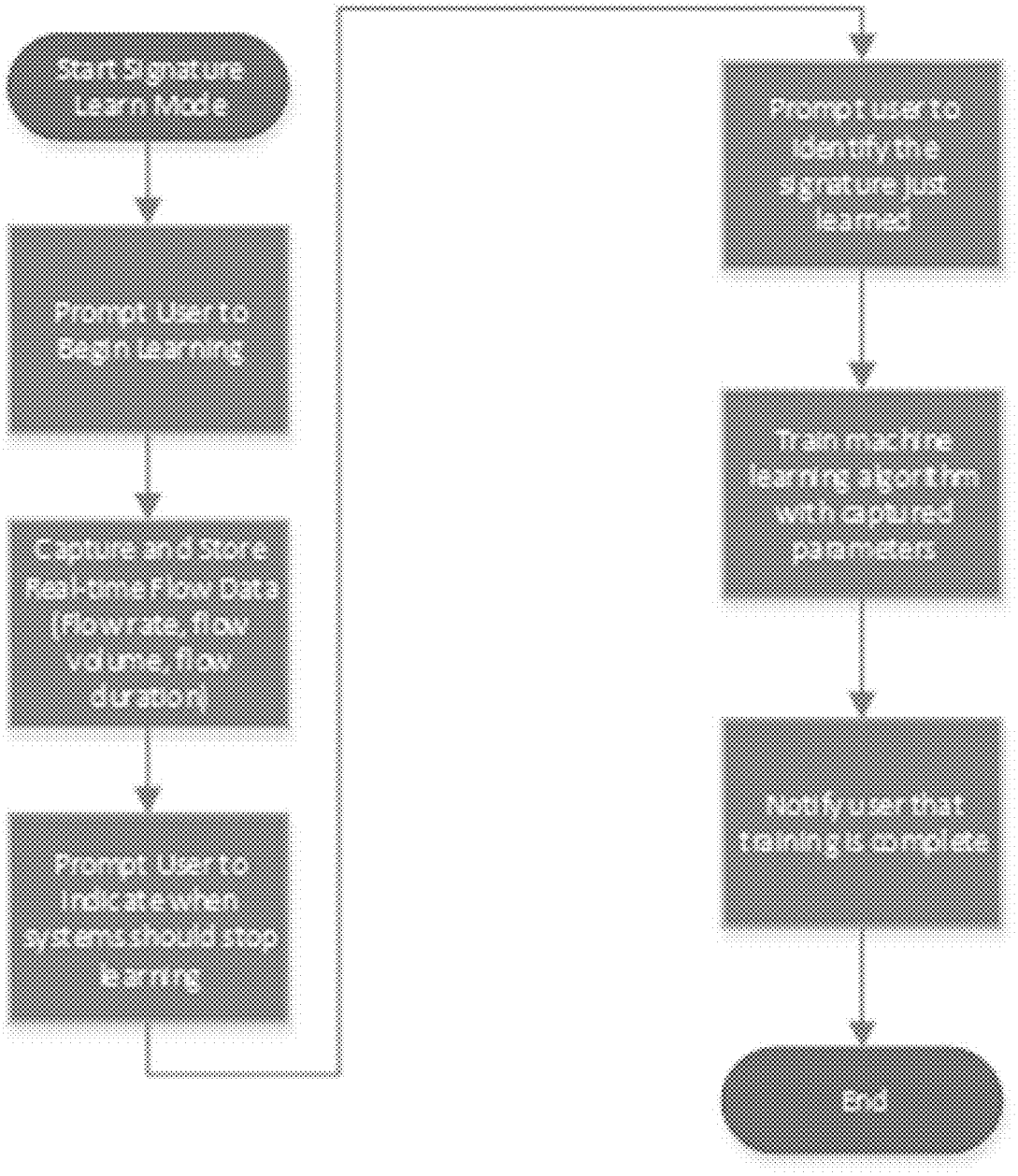
FIG. 20 is a flow diagram illustrating an example of operation of a home flood prevention appliance performing usage signature detection.

As further described and illustrated in the example of FIG. 20, the home flood prevention appliance can include usage signature detection. The system can use supervised machine learning to dynamically learn the usage signatures of different water consumers in a building structure. In general, different devices or system using water will have a unique signature that can be dynamically learned by the home flood prevention appliance and used to determine when the device or system is operating to use water. Each water user, such as an appliance, can have different flow rates, flow volume, and flow duration. These parameters can be used by the home flood prevention appliance to dynamically learn the usage signature of each system or device. Further parameters can be derived by the home flood prevention appliance from these core parameters, such as flow rate of change.

The system can dynamically learn/be taught what signature belong to what system or device in a particular water distribution system. This can be accomplished by placing the system in signature detection mode and then running each system or device to be learned. While in learn mode, the system can capturing real-time flow data and store it. This information can be used by the home flood prevention appliance to generate parameters that are used to train the home flood prevention appliance using supervised machine learning about the signature. In the application of a neural network within the home flood prevention appliance, for example, these parameters can be used in a backpropagation method of training. Once the home flood prevention appliance has been trained with a set of devices/systems, the system can continuously monitor current flow data, which can be dynamically analyzed by the home flood prevention appliance to determine if the data matches any learned signature.

The system keeps track of statistics of each device/system that it has been trained on. Thus, the system can keep track of the number of times a device or system has operated, the total and average volume of water consumed by the device/system, and/or the total and average duration of usage. This information can be stored and requested by the user at any time.

As more signatures are learned by the system, accuracy of dynamic detection of a water leak can increase. The device signature statistics can be used by the home flood prevention appliance as an additional input to the Usage Learning described above to flag usage as a leak or not.

Automatic Antenna Selection

Figure 21:
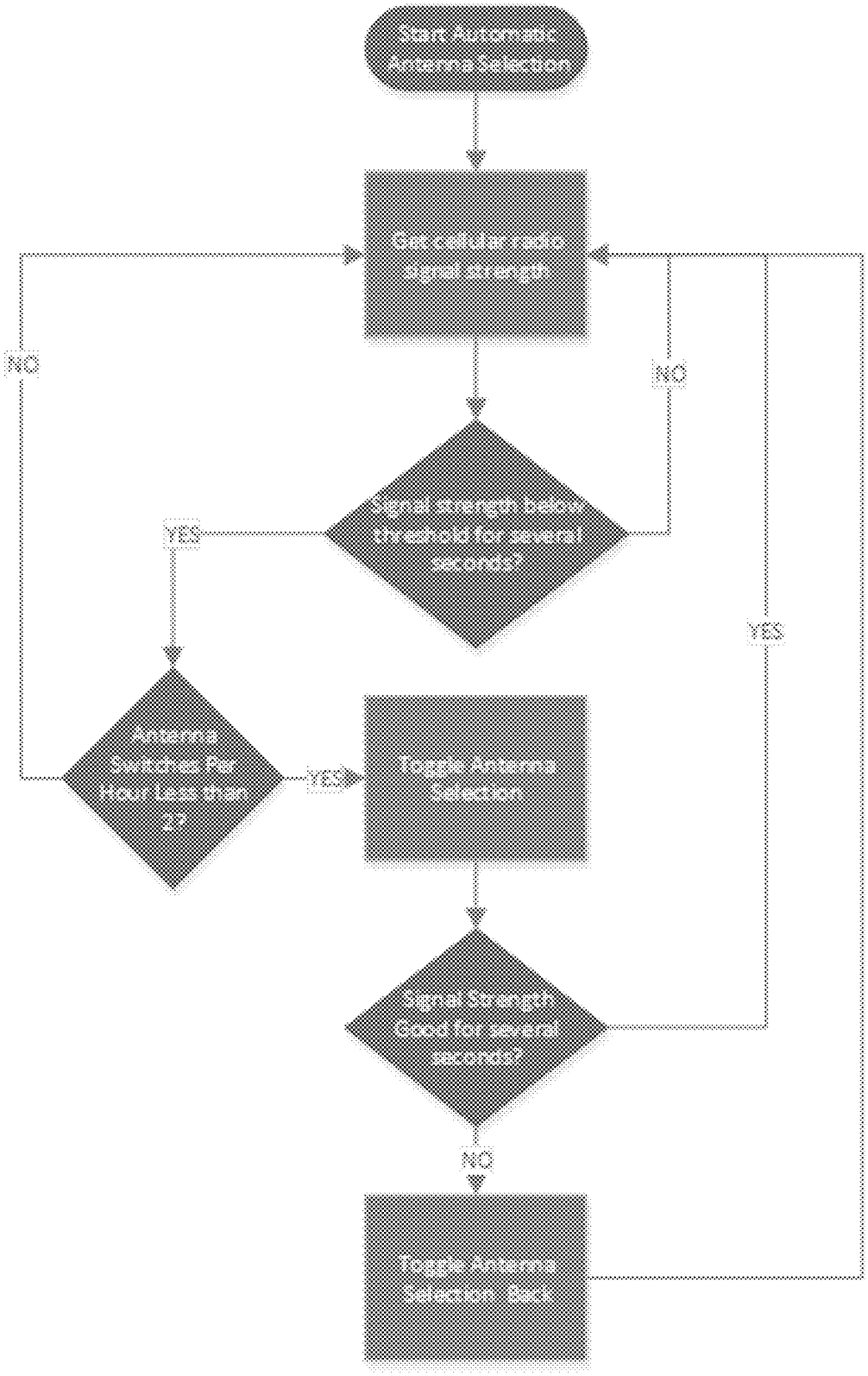
FIG. 21 is a flow diagram illustrating an example of operation of a home flood prevention appliance performing antenna selection.

FIG. 21 is an example of an operational flow diagram for selecting a system antenna. The system can include the ability to switch between an internal on-board antenna and an external antenna. The home flood prevention appliance can dynamically and automatically switch to the antenna with the best and most reliable signal. During operation, the system can continuously monitor the signal strength of the cellular radio. If the signal strength falls below a certain minimum value, the system can dynamically switch to the other antenna. For example, if the system is currently on the internal on board antenna and the signal strength is poor, it can dynamically switch to the external antenna. The signal strength can then be monitored by the home flood prevention appliance for several seconds to compare the current and previous signal strength, signal-to-noise ratio or other parameter indicative of quality of the signal. If the signal strength is worse after the switch, the system can dynamically switch back to the previous antenna. To prevent a continuous switching back and forth in the case of continuously poor signal strength, the system can limit the number of antenna switches to a predetermined number in a predetermined duration, such as 2 switches per hour.

The communication circuitry may include a cellular backup radio that can send critical data to the outside world if home wifi would become unavailable for any reason. The cellular radio may include both an internal and external antenna connection. Signal strength of the cellular signal may be monitored by the controller circuitry. As long as the internal antenna provides a suitable cellular signal strength, the controller circuitry may use the internal antenna. If, however, the cellular radio is not receiving a suitable cellular signal (i.e. stronger then −110 db) from the internal antenna, then the controller circuitry may automatically attempt to connect to the cellular radio to the external antenna port (and thus an external mounted antenna) to see if the antenna connected to the external antenna port has a stronger signal.

Figure 22:
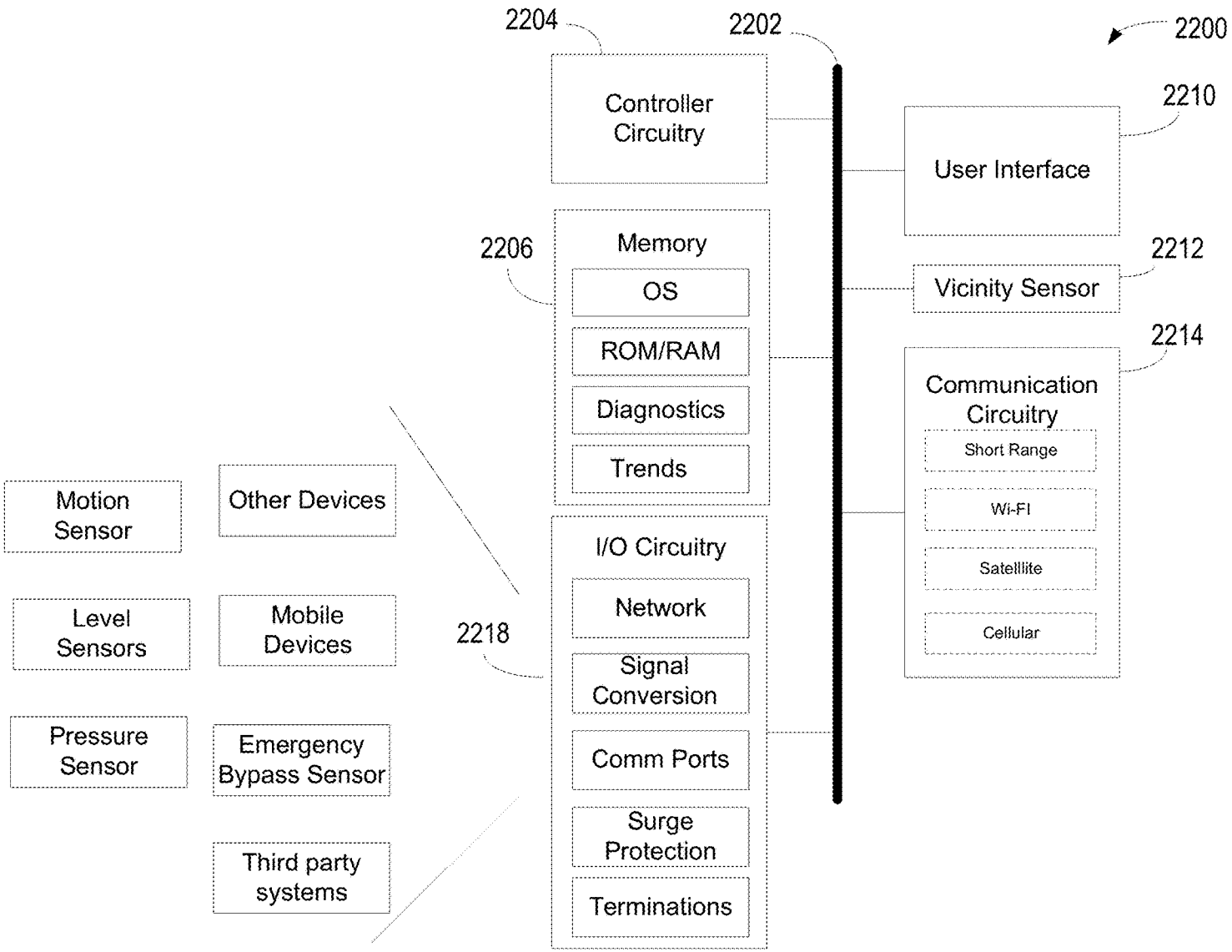
FIG. 22 is a block diagram illustrating an example of an electronics system 2200 included in the home flood prevention appliance system.

FIG. 22 is a block diagram illustrating an example of an electronics system 2200 included in the home flood prevention appliance system 400. Electronics system 2200 includes a communication mechanism such as one or more busses, cables, circuits or components for passing information between other internal and external components of the electronics system 2200. Information is represented as physical signals of a measurable phenomenon, typically electric voltages, but including, in other embodiments, such phenomena as magnetic, electromagnetic, pressure, chemical, molecular atomic and quantum interactions. For example, north and south magnetic fields, variable analog voltage or current or a zero and non-zero electric voltage representing two states (0, 1) of a binary digit (bit). A sequence of binary digits constitutes digital data that is used to represent a number or code for a character. A bus 2202 includes many parallel conductors of information so that information is transferred quickly among devices coupled to or in wireless communication with the bus 2202. Controller circuitry 2204 for processing information are coupled with the bus 2202. The controller circuitry 2204 may include processor(s) and/or other logic circuitry to receive and transmit information, execute logic, and perform a set of operations on information. The set of operations may include receiving information from the bus 2204 and placing information on the bus 2204. The set of operations may also include comparing two or more units of information, shifting positions of units of information, and combining two or more units of information, such as by addition or multiplication or other mathematical operation. A sequence of operations to be executed by the controller circuitry 2204 constitute computer instructions.

Electronic system 2200 may also include a memory 2206 coupled to bus 2202. The memory 2206, such as a random access memory (RAM) or other dynamic storage device, stores information including computer instructions. Dynamic memory allows information stored therein to be changed by the controller circuitry 2202. RAM allows a unit of information stored at a location called a memory address to be stored and retrieved independently of information at neighboring addresses. The memory 2206 is also used by the controller circuitry 2204 to store temporary values during execution of computer instructions. The memory 2206 may also include a read only memory (ROM) or other static storage device for storing static information, including instructions, that is not changed by the controller circuitry 2204. The RAM or the ROM may also include instructions, that persists even when the electronics system 2200 is turned off or otherwise loses power.

Stored within the memory 2206 may be data and instructions. Data may include operational data, predetermined variables, system parameters and the like. Instructions may be executable by the controller circuitry. The memory 2206 may store a home flood prevention appliance operating system (OS) that is executable to support the functionality described herein. In addition, trending may be executable to provide trend pages and generate operational information for trending and display. Also, diagnostics instructions may be stored that are executable by the controller circuitry to performing testing and ascertain the operational status of the whole home water protection system.

A user interface 2210 is also coupled with the bus 2202. The user interface 2210 may include one or more external input devices, such as a touch screen display, buttons, a keyboard, or a sensor, such as a fingerprint or facial recognition sensor or other external devices used for interacting with humans. The touch screen display may present images and allow user interaction via the screen or via a pointing device, such as a mouse or stylus included in the user interface 2210, for controlling a position of a cursor image presented on the display to issue commands associated with graphical elements presented on the display.

Although not illustrated, special purpose hardware, such as an application specific integrated circuit (IC) or an field programmable gate array (FPGA) may also be coupled to bus 2202. The special purpose hardware may perform operations not performed by the controller circuitry 2204, or may be included as part of the functionality performed by the controller circuitry 2204. Examples of application specific ICs include graphics accelerator cards for generating images for display, cryptographic boards for encrypting and decrypting messages sent over a network, speech recognition, and interfaces to external devices.

The electronics system 2200 may also include a vicinity sensor 2212, such as a camera or a motion detection sensor. The vicinity sensor 2212 may detect conditions in its vicinity and transform those detections into signals compatible with the controller circuitry 2204, or other parts of the electronics system 2200.

The electronics system 220 may also include communication circuitry 2214. Communication circuitry 2214 may include one or more instances of different communications interfaces. Communication interfaces may provide two-way communication with a variety of external devices that operate with their own processors, such as servers, mobile devices, and the like. Wireless links may also be implemented. For wireless links, the communications circuitry 2214 may send and receive electrical, acoustic or electromagnetic signals, including infrared and optical signals, that carry information streams, such as digital data. Such signals are examples of carrier waves.

In an example, the communication circuitry 2214 includes one or more wireless communication transceivers such as a short range transceiver, a Wi-Fi transceiver, a satellite transceiver and a cellular transceiver.

The short range transceiver may provide wireless communication within a predetermined physical distance of the home flood prevention appliance using a personal area network (PAN) or piconet that may include one or more devices. The predetermined physical distance may be, for example, within 100-500 feet, and the short range transceiver may use a predetermined short range wireless communication protocol. Example short term communication protocols include Bluetooth™, Infrared, near field communication, ultraband and Zigbee™. Using the short range communication protocol, the home flood prevention appliance system may wireless messages to devices that come within the PAN. Such wireless messages may include status messages, alarms and messages related to the device being with a short distance of the device. In addition, upload and download of data may occur over the PAN. For example, a user may download a program update to their mobile device and then come within the PAN to download the program update to the home flood prevention appliance system without incurring wireless data charges. The importance of the PAN becomes obvious when the reader considers the nature of cellular and satellite networks, in which the end user typically pays for data based on the amount of data used. A large update file for the operating system could be in the hundreds of megabytes, and accordingly create a large over-the-air update fee. The PAN receives this file from the users smartphone or other mobile device, which typically receives the update file from a central update server via Wi-Fi or other "free" network connection. This eliminates receiving the large update file via a paid cellular or satellite connection where the user is charged for megabytes uploaded/downloaded.

The Wi-Fi transceiver may provide a communication protocol and handshaking for short range communication with a wireless router providing internet access. The Wi-Fi transceiver may support a peer-to-peer link between the home flood prevention appliance system and a wireless router with MAC address based communication protocol such as 802.11 operable at 2.4 GHz or 5 GHz.

The satellite transceiver may provide communication protocols for long range communication via a gateway to relay data bi-directionally via satellite. The home flood prevention appliance system may communicate in a predetermined communication protocol with the gateway.

The cellular transceiver may provide long range communication between the cellular transceiver included in the home flood prevention appliance system and a cell tower in the vicinity of the structure in which the home flood prevention appliance system is installed. The communication protocol may include text message communication protocols, such as SMS. The cellular transceiver is constructed in the form of a "socket modem". In this configuration, the socket modem is a plug-and-play device which can be easily replaced by an end user without specialized knowledge of cellular networks. Cellular networks have "sunsets" where a communications generation, such as 3G for example, will be shutdown by the underlying carrier to free up bandwidth and electromagnetic spectrum for 4G service, for example. When this happens, the end device must receive a new radio technology, and the older 3G radio is no longer supported by the carrier. The socket modem allows quick radio replacement, and when the new socket modem is plugged into the HFPA, it detects the Operating system (OS) version of the HFPA, and reprograms it with the latest, needed version of OS. In addition, the socket modem can come in not only cellular formats, but also wifi and satellite, and in these modes is also a plug-and-play implementation, eliminating the need for the user to be expert of the underlying technology. The user merely plugs in the socket modem, and the socket modem itself updates the overall system OS with the correct program to operate the respective radio technology. In all cases, when the socket modem completes the OS updates, the HFPA updates its OS version, and radio identification information automatically with a central cloud server database, so that the manufacturing and build information is completely up to date. This automated process eliminates the need for manual operator intervention to keep manufacturing files up to date The electronics system 2200 may also include an input/output (I/O) circuitry 2218. The I/O circuitry 2218 may include a network interface. In general the network interface may enable connecting with a local network to which a variety of external devices with their own processors are connected. For example, the network interface may be network interface card (NIC) having an RJ45 connection for network communication via communication protocol such as TCP/IP. In some examples the network communication interface may be an integrated services digital network (ISDN) card or a digital subscriber line (DSL) card or a telephone modem that provides an information communication connection to a corresponding type of telephone line. In some examples, the network interface may be a modem that converts signals on bus 2202 into signals for a communication connection over a coaxial cable or into optical signals for a communication connection over a fiber optic cable. As another example, network interface may be a local area network (LAN) card to provide a data communication connection to a compatible LAN, such as Ethernet.

The network interface typically provides information communication through one or more networks to other devices that use or process the information. For example, the network interface may provide a connection through a local network to a host computer or to equipment operated by an Internet Service Provider (ISP). ISP equipment in turn provides data communication services through the public, world-wide packet-switching communication network of networks referred to as the Internet. Servers connected to the Internet provides a service in response to information received over the Internet. For example, servers may provide information for display or may store information received from the home flood prevention appliance system.

The I/O circuitry 2218 may also include signal conversion circuitry, surge protection circuitry and communication ports. Signal conversion circuitry may include analog-to-digital and digital-to-analog converters, contact closure conversion, frequency converters, and any other form of circuitry for changing from one signal type or range to another. The surge protection circuitry may include optical isolators, capacitors, current and/or voltage arrestors, isolated grounds, floating grounds and any other circuitry to address undesirable changes in voltage and/or current. The communication ports may provide a communication interface in the form of wired parallel ports or a serial ports or universal serial bus (USB) port or other form of port communication.

The I/O circuitry 2218 may also include terminations. Terminations may include incoming and outgoing contact closures, 4-20 ma signals, 2 wire, 4 wire, and other forms of wired signals and communications for the home flood prevention appliance system. The I/O circuitry 2218 may also cooperative operate with the communication circuitry 2214 to provide an interface for communication external to the home flood prevention appliance system and/or internal to the home flood prevention appliance system.

Devices within the home flood prevention appliance system may include the emergency bypass sensor, the level sensors, the pressure sensor, humidity sensors, motion detectors, power quality sensors, natural gas sensors, CO2 sensors, temperature sensors, audio sensors, motor ampere sensors and the various other sensors and indications described herein. The HFPA may act as the monitoring hub for the entire home mechanical room by providing external I/O accessible from, for example, the rear of the appliance shroud of the HFPA or the quick disconnect stations, via external terminal blocks, connectors or other signal connection means. For example, it would be common that the home furnace, hot water heater, radon fan, sewage ejector pump, humidifier, dehumidifier, water softener, water filter, and other central home equipment is located in the mechanical room. The HFPA external I/O can receive signals (analog, digital, or via a communication protocol such as RS232, Bluetooth™, proprietary communication protocols, and the like) and monitor critical or routine reminder alarms from all these devices. By consolidating all signals/readings/indications into a single appliance, or via wirelessly connected remote I/O hub, the need for multiple different alarm monitoring systems can be eliminated or minimized. In addition, remote automated notification of the homeowner via smartphone of important failures, alarms, operational conditions or needed routine maintenance to any mechanical room equipment may be enabled and communicated via the HFPA The I/O circuitry 2218 may also be used to interface other third party systems such as an HVAC system, premise alarm systems and the like to the HFPA where such indications are used to optimize or otherwise effect operational behavior of the HFPA. Also, the I/O circuitry 2218 may also be used to communicate with other devices, such as devices located proximate the home flood prevention appliance system, for which the home flood prevention appliance system may be used to communicate. The I/O circuitry 2218 may also be used to communicate locally with devices such as laptops, smart phones, tablets and the like.

The methods, devices, processing, circuitry, and logic described above for the home flood prevention appliance system may be implemented in many different ways and in many different combinations of hardware and software. For example, all or parts of the implementations may be circuitry, such as the controller circuitry, that includes an instruction processor, such as a Central Processing Unit (CPU), microcontroller, system on a module (SOM) or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Accordingly, the circuitry may store or access instructions for execution, or may implement its functionality in hardware alone. The instructions may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed. For instance, the circuitry may include multiple distinct system components, such as multiple processors and memories, and may span multiple distributed processing systems. Parameters, databases, and other data structures may be separately stored and managed, may be incorporated into a single memory or database, may be logically and physically organized in many different ways, and may be implemented in many different ways. Example implementations include linked lists, program variables, hash tables, arrays, records (e.g., database records), objects, and implicit storage mechanisms. Instructions may form parts (e.g., subroutines or other code sections) of a single program, may form multiple separate programs, may be distributed across multiple memories and processors, and may be implemented in many different ways. Example implementations include stand-alone programs, and as part of a library, such as a shared library like a Dynamic Link Library (DLL). The library, for example, may contain shared data and one or more shared programs that include instructions that perform any of the processing described above or illustrated in the drawings, when executed by the circuitry.

Software Based Artificial Intelligence & Virtual Home Manager

The home flood prevention appliance system, described herein, contains sophisticated electronic sensors and controller circuitry. In an example implementation, sensor data combined with historical usage records can be used by the controller circuitry to provide artificial intelligence (AI) type of analysis for a user, such as a homeowner or customer. This controller circuitry may include models, databases and executable instructions to perform AI by prediction based on historical data, extrapolation and/or predetermined operational characteristics or patterns. The AI performed by the microprocessor may be self-learning such that the controller circuitry is capable of dynamically adjusting the models, patterns, operational characteristics and data to maintain or improve accuracy of the AI as operational parameters of the system fluctuate.

The AI may be executed by the controller circuitry such that the system operates as a Virtual Home Manager, to analyze the collected data to make notifications, analysis, and reports to the customer on important events and trends which may be overlooked by the untrained eye, attempting to analyze scores of data, presented over long periods of time. For example, the following uses may be optional AI features which may be contained in the appliance, and made available to the homeowner or customer. 1) POWER QUALITY METERING circuitry; 2) HUMIDITY circuitry; 3) NATURAL GAS DETECTOR circuitry; 4) CO2 DETECTOR circuitry; 5) TEMPERATURE DETECTION circuitry; 6) LISTEN-IN MODE circuitry; 7) TIMED ALERTS circuitry; 8) OCCUPANCY DETECTION circuitry; and 9) Nest™ Network COMPATIBILITY circuitry.

1) POWER QUALITY METERING circuitry—the whole home appliance monitors for AC power loss in a home, as previously discussed. The power quality metering circuitry may be hardware or a combination of hardware and software which provides enhanced features in the form of data capture, processing and analysis functionality in order to provide additional information to the user or customer, such as detailed graphs of power sags, dips, spikes, brown-outs, and other common power problems. In addition, the functionality of the power quality metering circuitry may provide the homeowner with UPS quality power quality indicators, and analysis to make suggestions to correct poor or undesirable power situations.

2) HUMIDITY circuitry—the whole home appliance may include humidity sensors and corresponding functionality to monitor the humidity level in the mechanical equipment room or other location of whole home appliance. During operation, the humidity circuitry may issue "possible mold alerts" based on high humidity levels for extended periods, and make suggestions on how to solve such issues. These alerts may be in the form of text messages sent to a mobile device, generated reports, indications of the user interface of the whole home appliance, or any other form of communication to the user or customer 3) NATURAL GAS DETECTOR Circuitry—the home flood prevention appliance system may also be equipped with one or more optional natural gas leak detector or sensor. The natural gas leak detector(s) may be included in the structural frame. Using the natural gas leak detector, the gas detector circuitry can detect a natural gas leak and alert the homeowner of the gas leak, such as from a furnace or hot water heater in the vicinity of the home flood prevention appliance system. The gas detector circuitry may also make suggestions on what this means and provide possible solutions to the user or homeowner via text messages sent to a mobile device, generated reports, indications of the user interface of the whole home appliance, automated phone calls, or any other form of communication to the user or customer.

4) CO2 DETECTOR circuitry—the home flood prevention appliance may be equipped with one or more optional Co2 detectors, such as CO2 sensors. The CO2 detector(s) may be located in the structural frame. The CO2 detector circuitry may include functionality to alert the user or homeowner to excess CO2, such as from incorrect exhausting of a natural gas furnace or hot water heater, and the like based on readings from the CO2 detector(s). These alerts may be in the form of text messages sent to a mobile device, automated phone calls, generated reports, indications of the user interface of the whole home appliance, or any other form of communication to the user or customer. In addition, the CO2 detector circuitry may include functionality to make suggestions on what the alerts mean, and how to solve.

5) TEMPERATURE DETECTION circuitry—the home flood prevention appliance may be equipped with one or more optional temperature sensors. The temperature sensors may be located in the structural frame and configured to detect ambient air temperature and/or water temperature. The temperature detector circuitry may include functionality to, for example, alert a homeowner to freezing conditions in the mechanical room or other location where the whole home water protection application resides. These alerts may be in the form of text messages sent to a mobile device, automated phone calls, generated reports, indications of the user interface of the whole home appliance, or any other form of communication to the user or customer In addition, the temperature detection circuitry may include functionality to make suggestions on what the alert means, and how to solve.

6) LISTEN-IN MODE circuitry—the home flood prevention appliance may be equipped with an optional sensitive microphone, or other form of listening device, which may be located in the structural frame. The listen-in mode circuitry may include functionality to alert the homeowner or customer to the fact that the other equipment in the vicinity of the home flood prevention appliance is malfunctioning. For example, the listen-in mode circuitry may determine that the furnace, or hot water heater, is not starting/stopping correctly by monitoring or "listening" for the equipment to be operating or running as expected in the mechanical room where the home flood prevention appliance is located. These alerts may be in the form of text messages sent to a mobile device, automated phone calls, generated reports, indications of the user interface of the whole home appliance, or any other form of communication to the user or customer. In addition, the listen-in mode circuitry may include functionality to make suggestions on what the alerts mean, and how to solve.

7) TIMED ALERTS circuitry—the home flood prevention appliance may include functionality to provide optional recurring, timed schedules to alert a homeowner or customer when it is time to perform a task, such as a routine maintenance task. Routine maintenance tasks may include replacement of furnace filters, water filters, and/or any other recurring maintenance tasks. These alerts may be in the form of text messages sent to a mobile device, automated phone calls, generated reports, indications of the user interface of the whole home appliance, or any other form of communication to the user or customer. In addition, the time alerts circuitry may include functionality to make suggestions on what the alerts mean, and how to solve. For example, the alerts may include links to online retailers, such as Amazon, for convenient reordering of items associated with the maintenance, such as filters, etc. The links may be embedded in the alert notifications.

8) OCCUPANCY DETECTION circuitry—the home flood prevention appliance may include functionality that provides optional occupancy notifications to alert homeowner or customer. The alerts may provide, for example, information that someone may be in the home. The functionality of the occupancy detection circuitry may be configured to monitor home water usage, such as flushing toilets or a faucet being opened, and then alerting the homeowner of a possible home breach. In addition, the functionality of the occupancy detection circuitry may make suggestions regarding what the alert means, and how to solve.

9) Nest™ Network COMPATIBILITY circuitry—the home flood prevention appliance may be equipped with optional Nest Network interface circuitry such that the home flood prevention appliance can be viewed from the homeowners Nest phone app, and use this single app to monitor his whole home water system, Nest smoke detectors, Nest thermostats, and Nest cameras.

10) EXTRA INPUTS/OUTPUTS circuitry—the home flood prevention appliance may be equipped with additional inputs/outputs (I/O) to monitor any additional sensors or appliances the homeowner or customer wishes to monitor. In addition, the extra inputs/outputs circuitry may provide functionality to use the home flood prevention appliance as a single gateway to aggregate this additional collected data for the homeowner or customer. In addition, functionality of the extra inputs/outputs circuitry may make suggestions on what this additional data/alert means, and how to interpret.

Figure 23:
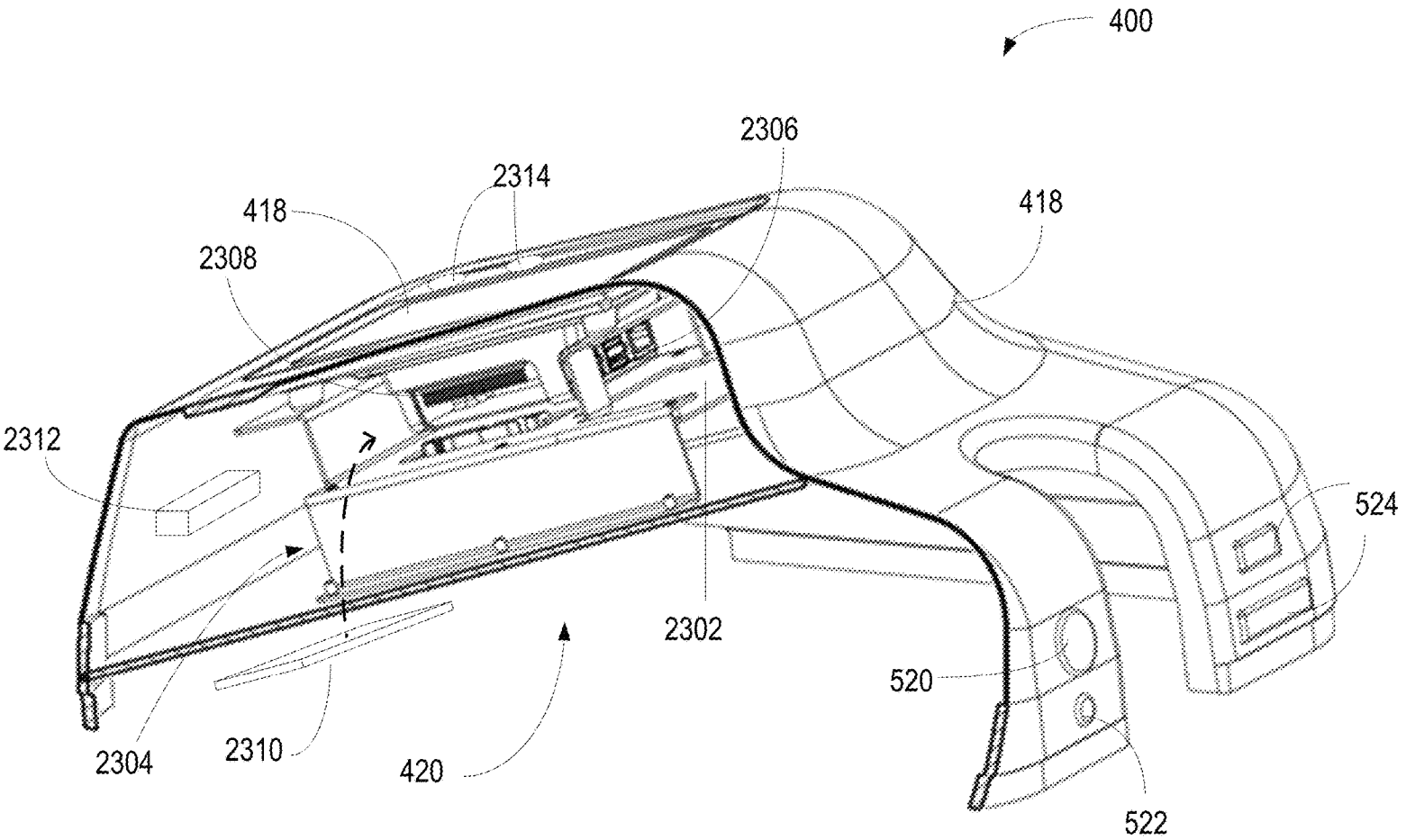
FIG. 23 is a perspective cutaway view of a portion of an example of the home flood prevention appliance system.

FIG. 23 is a perspective cutaway view of a portion of an example of the home flood prevention appliance system 400. In FIG. 23, a cutaway view of an example of a shroud 418 is depicted illustrating an example of an electronics enclosure 420, which is included therein. Thus, the electronics and circuitry associated with the whole home water system are modularized in an area that is spaced away from the septic pit and isolated from liquid related components of the home flood prevention appliance system. In other examples, one or more of the electronic enclosure 420 can be included elsewhere in the structural frame of the home flood prevention appliance system 400.

The electronics enclosure 420 may include any or all of the electronic related functionality described herein. In addition, any electronic related devices positioned elsewhere in the structural frame may be in electrical communication with electronics, such as the controller circuitry, included in the electronics enclosure 420. The electronic enclosure 420 may be removable from the structural frame as part of the shroud 418. Accordingly, the electronics in the electronic enclosure 420 may be in electrical communication with other components included in the home flood prevention appliance system via one or more wiring harnesses that include two piece connectors that enable quick disconnect.

The illustrated example includes the display 418 in electrical communication with a printed circuit board (PCB) 2302 included in the electronics enclosure 420. The PCB 2302 may include the controller circuitry, memory, I/O circuitry and the like. In other examples, multiple PCBs, circuitry, or a combination of circuitry and PCB's may be used. Also included in the electronics enclosure 420 is a power supply 2304 for supplying power for the home flood prevention appliance system 400, and a connector panel 2306. The connector panel 2306 may include the two piece connectors to enable disconnection and removal of the electronic enclosure 420. In addition, connections for the I/O circuitry may be include in the connector panel 2306. Alternatively, or in addition, other connectors may not be landed on the connector panel 2306.

The connector panel 2306 may be included in the electronics enclosure 420 to enable quick disconnect. The connector panel 2306 may also include connectors to electrically connect the display 418, such as ribbon cable connectors, and one or more wiring harnesses or ribbon cable connectors to connect the data communication ports 520, the electric power supply port 522, and one or more external I/O connections 524, such as terminations, to the I/O circuitry.

The electronics enclosure 420 may also include a communications connector 2308. The communications connector 2308 may be, for example, an edge connector in which communications circuitry, such as in the form of a communication circuitry PCB 2310 may be inserted as illustrated by dotted arrow in FIG. 23. In this configuration, different communication circuitry PCBs 2310 may be installed and removed from the system in accordance with the needs of a user. For example, in a system that included only cellular communications capability, a communications circuitry PCB 2310 for cellular service may be removed from the communications connector 2308 and replaced with an upgraded communications circuitry PCB 2310 for both cellular communications capability and WI-FI capability. In another example, a communication circuitry PCB 2310 for cellular communications could be removed from the communications connector 2308 and replaced with a communication circuitry PCB 2310 for satellite communications due to lack of availability of cellular service at the installation site of the home flood prevention appliance system.

The electronic enclosure may also include a motion detector 2312. The motion detector 2312 may include motion sensor, such as a camera, an optical sensor, a microwave sensor or an acoustic sensor to detect movement in the vicinity of the home flood prevention appliance system, such as in the room or space where the home flood prevention appliance system is installed. The motion sensor may penetrate the shroud 418 to enable detection of motion. The motion detector 2312 may output a signal indicative of a detected motion to the controller circuitry. The controller circuitry may, in response to the detection of motion, may, for example, illuminate the display, generate audible alarms, illuminate indicators 2314, such as light emitting diode (LED) indicators and/or perform other visual indications due to a user being present. In an example system, the home flood prevention appliance system may optionally also include LED lighting within the structural frame which is illuminated upon motion being detected. The LED lighting may provide illumination inside the shroud 418 and the sump pit for inspection and maintenance. Although not illustrated, the electronic enclosure 420 may also include other electronics and equipment, such as the level sensors, the pressure sensor, humidity sensors, motion detectors, power quality sensors, natural gas sensors, CO2 sensors, temperature sensors, audio sensors, motor ampere sensors, radon sensors, and other sensors and indications related to the home flood prevention appliance system. The HFPA may be configured as an internet connected device via the communication circuitry and/or the I/O circuitry, and as such can operate in a variety of mash-ups with 3$^{rd}$ party cloud based application programming interfaces (APIs). For example, monitoring the local weather, and then automatically testing all systems before weather strikes. In another example, the homeowner, via the local graphic display or phone app, can order an online water quality test where the HFPA will accept credit card payment, and then the homeowner is shipped a water test kit to test for lead and other water contaminants in their drinking water.

Figure 24:
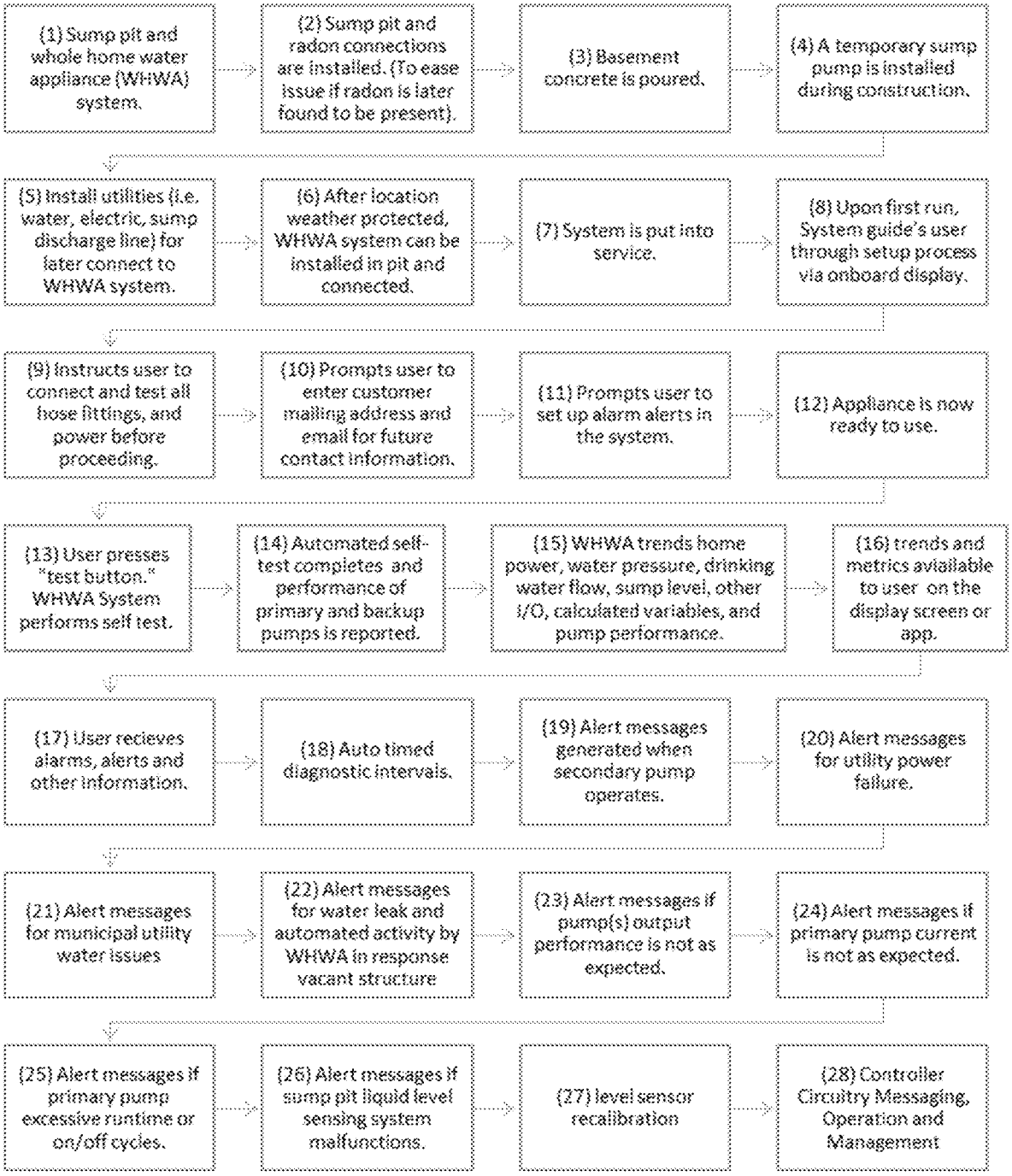
FIG. 24 is a block diagram illustrating an example of installation and operation of the home flood prevention appliance.

FIG. 24 is a block diagram illustrating an example of installation and operation of the home flood prevention appliance.

Sequence of Operation

Referring to FIG. 24, in an example sequence of steps to install and operate an example home flood prevention appliance system for a residential home installation:

1. Sump pit and home flood prevention appliance (HFPA) system provided to builder erecting a new structure such as a home that includes a basement.
2. New home builder installs empty sump pit in desired location. Radon connections are also installed in proper location since this piping is typically installed in the concrete. HFPA may include connection in the system for radon pipe/fan (if radon equipment supplied), to ease issue of addressing radon if found to be present.
3. Basement concrete is poured.
4. During basement concrete pouring, and early construction, it is common that a builder will install a temporary "used" sump pump (during early construction) as the sump pit can collect debris and damage a new pump. This process will not change with the home flood prevention appliance system, and the HFPA is installed after rough construction is complete, and is typically installed when other home appliances are installed.
5. New home builder may install utilities (municipal water supply and electricity) and run sump discharge common outlet line to sump pit location where home flood prevention appliance will be positioned. Where the connection quick disconnect station is included, utilities and common outlet can be connected thereto.
6. When roof is on the home, or the location of the HFPA is otherwise weather protected, the whole home protection appliance system can be inserted into the sump pit, and the utility and common outlet connections completed.
7. Put system into service by powering up and turning on municipal water supply.
8. Once the system is powered up, instructions on face of appliance local color graphic display prompt installer to start up appliance and guide the installer through the setup process.
9. Local color display instructs installer to connect and test all hose fittings, and power before proceeding.
10. Next, the system prompts for entry of contact information on the display. The local display may instruct to download one or more applications, such as a sump control phone application and accompanying API. Alternatively, or in addition, the user may enter a customer mailing address and email address into the local display for future contact information. In an example, The HFPA may be, for example, sold with 2 years of prepaid cellular service, and after 2 years the homeowner is automatically notified regarding how to pay for and extend service. In this example, the user will merely enter his address, contact, and credit card information on the face of the appliance, and it is digitally sent to a registrar (i.e. a back-end billing and product management platform), via an API, to auto activate/extend cellular service. In an alternative example, a user may launch a phone app on the user's mobile device. The phone app may open to "first time setup screen" where credit card info is entered into app to enable device. Data is connected to Registrar API and card processed and account established in Registrar. Cellular service may now be ready to use 11. The local display or the App may prompt user how to set up alarm alerts within appliance system.
12. Appliance is now ready to use.
13. User presses test button on app or the appliance. HFPA performs automated diagnostic self-test. Diagnostic test includes the controller circuitry energizing the level test actuator to fill the sump with water from the municipal water supply. In an example test, the controller circuit times the drawdown and amps on the primary pump running alone. Pit is auto refilled, and system now times drawdown time on secondary, or backup water pump. Gallon per minute (GPMs) may be calculated for both pumps and compared to predetermined information, such as original equipment manufacture (OEM) pump curve, along with amp data.
14. HFPA reports status and results of diagnostic tests. Text message(s) may be issued stating pumps either passed/failed pump volumetric tests. The text messages may also include statistics, and state what is next. Data may be dynamically stored for trending.
15. HFPA generates trends. Some example trends, reports and information generated may include appliance auto trend logs home power, water pressure, drinking water flow, sump level, and/or any other salient I/O and calculated variables on an I/O list stored in the system and accessible by a user.
16. User can look at app or display at any time to see latest operation of entire system including domestic water usage and pressure, and any other operational parameter.
17. User may get alerts, alarms and/or other system related information messages, such as text messages. For example, user may get an alarm if batteries need replacement. A link in the message received by the user may be executed, such as to reorder filters on a retailer website, such as AMAZON™, with one click.
18. System may perform auto timed diagnostic intervals, such as once/month or some other set interval or user or system derived interval. Diagnostics may be automatically performed by the controller circuitry at regular intervals, during low-service times (i.e. once/month), system automatically performs self-test and reports.

At the conclusion of the interval, the system may perform maintenance and upkeep activities, such as recalibrate water level measurement sensors, perform pump volumetric water pumping tests, confirm calcium chloride levels are adequate, and the like. In addition, the system may issue one or more user reports, such as during low service times. (i.e. when it is not raining or the system is otherwise experiencing dynamic inflow of water to the sump pit).
19. HFPA may generate a message whenever secondary pump is operated using the municipal water supply. For example, if water powered backup pump cycles for any reason, the user is alerted—except for the auto self-test. For example, if the primary pump fails for any reason, the water level measurement devices in the sump pit liquid level sensing system, such as the hydraulic float switch, may detect the high level and the controller circuitry may auto cycle the secondary water pump to maintain water level. In addition, the user may be alerted via local and text message alerts. For example, in extremely high flow of liquid to the sump pit, both pumps may be started for boost mode operation in order to pump at higher rate than either pump could pump individually
20. If utility AC power supply fails, user may be alerted and water pump may control level using secondary water pump, or any other back up pump not energized by AC power. In another example, upon AC power failure, user is alerted and automatically system controls water level via 100% mechanical water-powered backup system using the secondary pump.
21. HFPA generates alarms if municipal water supply has issues. For example, if pressure drops low, user is alerted and advised what to do.
22. If the system detects a leak the user is alerted. If no customer response, home drinking water is shut off and user alerted.

For example, if the HFPA determines user is not home, such as by an input from a connection to a home security system or motion detector, the flow meter may be enabled to detect leaks, and customer may be alerted. If no customer response, then home drinking water is shut off, and user may be alerted. In alternative examples, the user may indicate they are not home, or the system may detect that no one is home based on water flow parameters or other input parameters from external devices, such as a garage door opener.

In another example, if the system monitors the flow meter and detects a leak, detected by, for example, onboard AI software executed by the controller circuitry, the user may be alerted. If no customer response, then the controller circuitry may shut off the home drinking water, and the user may be alerted.
23. Pump output performance monitored by controller circuitry and performance anomalies generate alarm messages. For example, if pump(s) are determined to not be pumping at predetermined GPM, such as rated GPM, user is alerted and instructed how to proceed. In another example, if the system determines that pump(s) are not pumping at rated GPM (as calculated by timed drawdown tests) then user may be alerted to possible line blockage and given instructions "how to proceed".
24. If system determines that primary pump amps are not normal (as compared to nameplate rating, or historical operation) then user may be alerted to possible line blockage or pump issue, and given instructions "how to proceed".
25. If system determines that primary pump has excessive runtime or on/off cycles, user is alerted, and told how to proceed.
26. If system determines the level measurements, such as the sensor-less pump control or the laser pump control has stopped working or is otherwise not accurate, user is alerted, and backup floats, such as the dual back-up float switches and the hydraulic float switches may be used by the system to control on/off of both primary and secondary pumps. In another example, if analog laser level stops working, user is alerted, and backup floats control on/off of primary pump.
27. The system may operate to "reset" or recalibrate the sump pump level measurements according to operational parameter, such as a run time interval, once every predetermined number of pump cycles, such as 10 cycles, or any other varying parameter. The system may dynamically and automatically "reset" or recalibrate the sump pump level measurements by drawing down the water level in the sump pit. With the sensorless pump control, the liquid level in the sump pit is drawn down below the bottom of the sensing tube, and allow air to be re-trapped at zero level. In the laser pump control, the liquid in the sump pit may be drawn down until the float rests against the stop and the TOF sensor(s) may be recalibrated. User may be alerted to any recalibration issues with alert messages. The system may perform automatic testing of high level float switches during an auto test by filling sump pit to level of floats and confirming that the floats actuated. Auto test may be performed on a predetermined schedule, during times of quiescence, or based on any other trigger. If floats are not actuated, or test otherwise fails, customer may be alerted, and instructed what to do next.

28. The controller circuitry may provide local messages via the display and/or generate messages such as text messages to a user with contact information stored in the HFPA. In addition, the controller circuitry may take corrective actions or preventative actions to avoid issues. Examples of such actions by the controller circuitry include:
    a. The controller circuitry may avoid water hammer by controlling on/off ball valves to open/close slowly (such as for example, travel between open and close in about 2 seconds)
    b. The controller circuitry may generate a message on the display screen and or generate a message providing contact information for service help. Alternatively, or in addition, the controller circuitry may initiate an application, such as a phone app which may include a local screen having contact data for service help.
    c. A local screen on the home flood prevention appliance and/or the phone app may be synched by the controller circuitry to share system data, trend logs, user configured data, and other useful data. The screen may be designed and constructed such that a novice can navigate the menu without a user's manual.
    d. If any alarm is present in the system, the controller circuitry may initiate a backlight of the LCD color display to illuminate and flash with a predetermined color, such as red, so a user can easily see the alarm backlight in a dark basement. If all systems are normal, and no alarms are present, the LCD display may include an operational backlight, such as a green glow, to indicate no abnormalities have been detected in the system.
    e. In an example, if the customers wireless service expires, or is ready to expire, the user may get a text message initiated by the controller circuitry indicating a subscription lapse, and instruction to re-subscribe from the face of the HFPA LCD screen. The backlight color of the screen may be, for example, a "red" color if wireless service has elapsed. The user may be prompted via the LCD screen to enter credit card information into the appliance system to re-institute the wireless service. The credit card info may be securely transmitted to a registrar via API, and a "success" or "fail" message may be sent to the customer via text message from the HFPA indicating the credit card transaction status. In an example, the system may include a credit card reader embedded in the system such as in a face of the appliance to enable a credit card transaction without user data entry. In another example, the user may initiate a credit card payment, or a bill payment service, such as PAYPAL from an application on the user's wireless device or at a website provided in a text message.
    f. In another example, wireless text notifications may be optional. If users opts to not get remote text notifications, the HFPA may otherwise include all the functionality described herein, and the local LCD display can be used for system information and user interaction with the system. For example, with the wireless text notifications disabled, when an event occurs, such as a lapse wireless service, a local piezo buzzer can sound to indicate a system alarm, and the homeowner may manual disable in the user interface, such as by pressing an LCD screen acknowledge button to silence the alert.
    g. The controller circuitry may determine when wireless service is expiring (first 2 years free), the user is alerted, and instructions are provided to re-subscribe from the face of the system display screen.

Referring again to FIGS. 22 and 23, in an example system, the input/output (I/O) circuitry 2218 may be hardware implemented as an independent device capable of executing logic, such as a programmable logic controller (PLC). The PLC may be positioned in the electronic enclosure 420. Alternatively, or in addition, the I/O circuitry 2218 may be hardware, such as a printed circuit board included in the electronic enclosure 420, that is administered and controlled by the controller circuitry and/or be included in the controller circuitry. The I/O may include analog and digital inputs and outputs. In addition, signal conversion capability, such as analog to digital or digital to analog, buffering, communication protocol conversion, and the like may also be included as part of the functionality of the I/O circuitry 2218. In an example, the I/O circuitry 2218 in the system may include terminations in the form of:

Digital Inputs (Dry Contact Inputs)
1. Domestic water flow meter, such as a high speed pulse output flow meter
2. High level back-up float #1
3. High level back-up float #2
4. Home security system is armed (connect to home security system if present)
5. Input detecting enclosure door is opened, linked to turn on sump light Digital Outputs
1. output to drive open/close level test actuator for whole home shutoff
2. output to drive open/close water valve for sump water fill
3. Primary pedestal pump on/off
4. Calcium chloride air intake fan on/off
5. Home flood prevention appliance is in "away" mode (connect to home security system if present)
6. Output to turn on/off LED light to illuminate sump during service/inspection/door open Analog Inputs
1. Pedestal pump amps
2. Tank analog level (laser 1) [I2C bus #1]
3. Tank analog level (laser 2) [I2C bus #2]
4. Strain gage for weight of calcium chloride tray
5. Home water pressure Analog Outputs
1. The HFPA may include an optional expansion card slot where an optional analog output card may be inserted to provide predetermined range(s) of analogy outputs.

For example, the analog output card may include an adjustable 0-10 VDC, or 4-20 mA output signal(s) to drive any device operating from an adjustable 0-10 VDC or 4-20 mA signal.

The controller circuitry 2204 may operate, control and monitor the functionality of the home flood prevention appliance system described herein. The controller circuitry 2204 may be the heart of a "product platform" strategy, on which several variations in functionality of the home flood prevention appliance system may be based, as described herein. In an example, the controller circuitry may include several inputs and outputs of various types that are used to monitor and control equipment. I/O may, for example, leave I/O circuitry, such as a PCB, through a set of two connectors—a low voltage harness and a high voltage harness. The controller circuitry may include several communication buses, which are exposed outside the system via ports or connectors to allow for connection/communication with third-party devices. The controller circuitry may be powered from a power source such as a DC or an AC power source and may include a battery backup. In an example, the controller circuitry may be powered by DC power provided from a backup battery, such as a Li-Ion backup battery, and charger.

Wireless connectivity may be provided by the communication circuitry 2214 using a modular radio wireless communication interface. The initial connectivity of the modular radio wireless communication interface may be provided by a cellular module. The cellular module may be hosted on a circuit board. The user interface 2210 may include a display, such as a color liquid crystal display (LCD). In an example, the display be about 4" in size, include a touch screen interface, and include an array of LEDs for general purpose use as indicators.

The controller circuitry 2204, may include any hardware device(s) capable of executing logic or software. In an example, the controller circuitry may include a microcontroller from the NXP Kinetis™ family of microcontrollers, such as a K7X™ series microcontroller. The controller circuitry may include memory such as at least 128 KB Ram, 1 MB flash. The system may also include fast external memory for graphics, data, and log storage, of at least 128 MB in size that is external to the controller circuitry but included in the home flood prevention appliance system. The system may also include a removable memory storage capability, such as a port or other form of connection for receiving an external memory, such as a MicroSD card upon which data and other information may be stored.

In addition, and/or as part of the controller circuitry, included within the operational functionality of the home flood prevention appliance may be user interface circuitry, power system circuitry and I/O circuitry as previously discussed.

Examples of hardware to perform the operational functionality include:

User Interface Circuitry:
4" color LCD with touchscreen
Touchscreen may be capacitive or resistive
At least 4 red/green LEDs for general purpose status indication
Buttons in a "softkey" configuration around LCD
Power System Circuitry:
12 VDC primary power+/−10%
Li-Ion battery, sized to provide at least 6 hours of runtime
Li-Ion charger with typical safety features
Primary power and battery may be in the same harness, and may be separate from I/O harnesses
Regulator providing power to system may provide 3.8 VDC at 2A, and a fast transient response
I/O Circuitry—Dry Contact Inputs:
Each input to accept a contact closure or open collector output as a signal
At least 3 of the inputs may accept pulses up to 10 KHz
Each input set may consist of the following signals: 12 VDC, Ground, Signal
ESD protection including optical isolation, isolated ground systems, surge suppression devices and the like
Overvoltage protection in the form of diodes and capacitors
May be routed through the low voltage harness
I/O Circuitry—Analog Inputs:
Each input may accept a 4-20 mA signal, or 0-10 vdc, or other variable low voltage signal
At least 12-bit analog-to-digital (ADC) resolution
ESD protection
Reverse and over voltage protection
Each input set may consist of the following signal: 12 VDC, Ground, Signal, Return
May be routed through the low voltage harness
I/O Circuitry—Open Collector Outputs:
Each output to provide at least 2 A of current with a 12 VDC source
Each output may operate in current sink mode or a current source mode.
At least 2 outputs may provide pulse width modulation (PWM) circuitry up to 80 kHz
I/O Circuitry—Relay Outputs:
Each relay may be rated for at least 240 VAC at 20 A, and may be a relay type such as an appliance type relay
Each contact output set may consist of the following signals: C, NO, NC
May be routed through the high voltage harness
relay output circuits may measure the AC current flowing through the respective relay
A current sensor may be used to measure between 0.1 Amps and 12 Amps with at least 12 bit ADC resolution
I/O Circuitry—USB Bus:
Multiple mini USB connectors present
May serve as a device, not host
I/O Circuitry—Ethernet:
May include network communication circuitry in the form of, for example, 100 Mbit Ethernet with standard RJ45 jack
I/O Circuitry—RS232:
May include a standard RS232 with DB9 port
Does not need flow control lines
I/O Circuitry—CAN Bus:
CAN bus may be routed to external devices through an RJ11 jack
Provide 12 VDC and Ground are provided. In some examples, provided externally via RJ11 jack
ESD protection
I/O Circuitry—External I2C Bus:
May include two independent packet switched communication busses, such as I2C busses
Each bus may be routed to external devices through RJ45 jacks
Each connector providing communication to external devices may include various protocols and/or signals, such as a serial data line (SDA), signal clock lines (SCL), 12 VDC, Ground, and the like
Signals may be communicated via signal bus or via twisted pair.

Communication Circuitry:

Short range radio circuitry

WiFi circuitry

Satellite communication circuitry

Cellular communication circuitry

The operational functionality may also include the following features:

Electronics enclosure may be sized at about 8"×8", or as smaller to minimize footprint. In other examples, other sizes are possible.

Surface mounted printed circuit board(s) (PCB) disposed in the electronic functionality enclosure Functionality and components positioned on a front surface of the PCB may include user interface circuitry such as a liquid crystal display (LCD), buttons, and LEDs Functionality and components positioned on a rear surface of the PCB may include bus connectors and card slots, such as an SD card slot. In an example, bus connectors and card slot(s) may be positioned on a rear surface of board along an edge of the PCB in a right angle orientation to a planar surface of the PCB Power and I/O harness connectors may be position on a rear surface of the PCB in a perpendicular orientation to a planar surface of the PCB The circuitry for operational functionality related to the communication circuitry may be near a top edge of the PCB so an antenna may clear the PCB and an external SMA connector is accessible.

Figure 25:
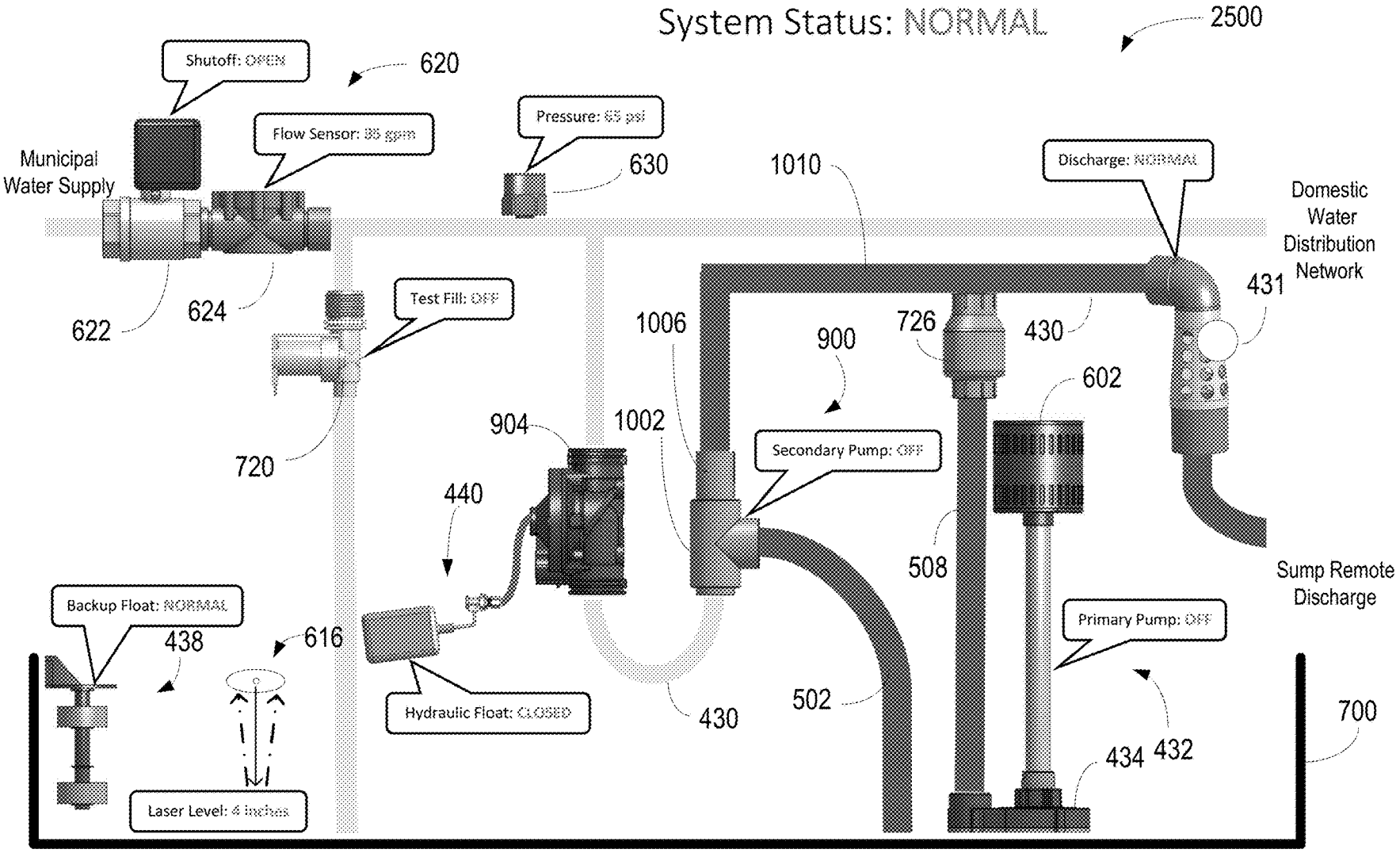
FIG. 25 is an example graphical user interface status screen for the home flood prevention appliance system.

Access panel or door for easy access to change PCB or other circuitry related to operational functionality in field by customer PCB mounted in enclosure FIG. 25 is an example graphical user interface status screen 2500 for the home flood prevention appliance system. The illustrated status screen is an example of process flow diagram of the system that dynamically provides operational parameters associated with the various elements of the system. The status screen also illustrates a municipal water supply side of the system (lightly shaded lines in the example of FIG. 25) within which the municipal water supply flows, and a sump pit discharge side of the system (darkly shade lines in the example of FIG. 25) in which liquid extracted from the sump pit 700 flows. The status screen 2500, as well as the rest of the GUI screens described herein may be viewed and manipulated on the display 422 of the system, in an app executing on a mobile phone and communicating with the system for data and information, and/or a personal computer or tablet via a web browser.

Within the municipal water supply side, the municipal water supply is provided to the water control actuator 622 and the flow meter 624 of the smart water meter/shutoff valve 620, and a position of the water control actuator 622 and a flow rate of the municipal water is indicated in the status screen 2500. In addition, a pressure of the municipal water flow provided to the domestic water distribution network, which is sensed with the pressure sensor 630, and the position of the level test actuator 720 are also dynamically indicated in the status screen 2500.

The position of the hydraulic level sensor 440 and the operational status of the secondary pump 900, which includes the hydraulic valve 904 in the municipal water supply side, as well as the check valve 726, and merge pipe fitting 1010 on the sump pit discharge side, are also dynamically provided. In the sump pit discharge side of the system, the status of the primary pump 432, which includes the impeller 434 and the motor 602, and the status of the common outlet discharge as provided by the emergency bypass sensor 431 is also dynamically provided in the status screen 2500. Also, the primary level sensor, which is the laser pump control provided by the TOF sensor 616 and the backup float sensor provided by the dual float sensor 438 from the sump pump discharge side are also dynamically indicated. An overall status of the whole house water appliance system is also provided by a dynamically changing system status indication 2502.

Figure 26:
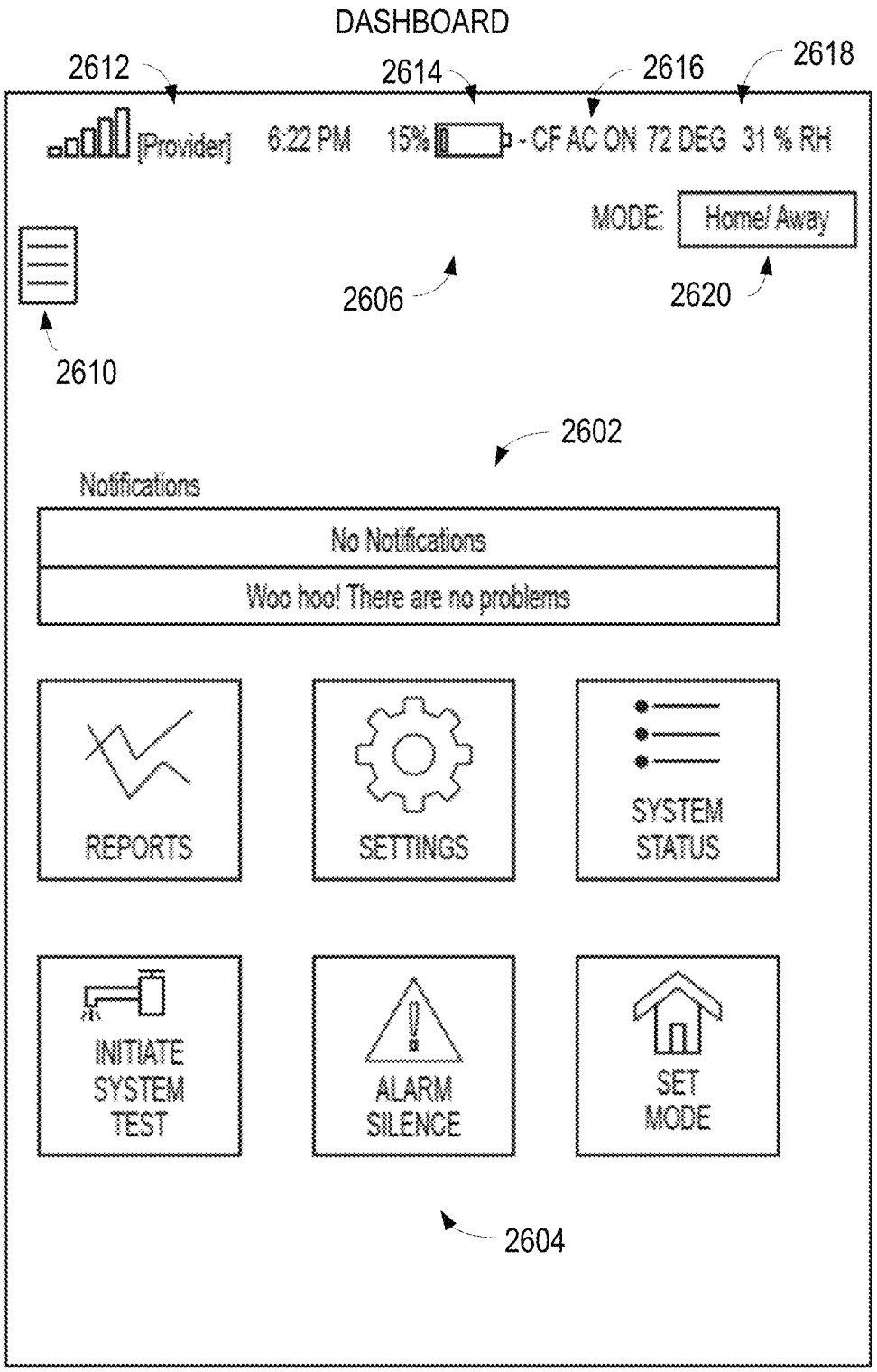
FIG. 26 is a graphical user interface screen of an example dashboard screen for the home flood prevention appliance system.

FIG. 26 is a graphical user interface screen of an example dashboard screen 2600 for the home flood prevention appliance system. The illustrated dashboard screen 2600 includes a notification section 2602, a menu section 2604 and a dynamic summary section 2606. The notification section 2602 may provide alarms and status indications, as well as other information. In example configurations, the notifications may also include advertising, upgrades and other information that is targeted at the specific user of the system.

The menu section 2604 may include icons for different subject matter sections or information related to the home flood prevention appliance system. In the illustrated example, the menu selections include a reports selection, a settings selection, a system status selection, an initiate system test selection, an alarm silence selection and a set mode selection.

The dynamic summary section 2606 provides select current information for the home flood prevention appliance system, such as alarms, status, reminders, and notices. The dynamic summary section 2606 may be included on all graphic screens in the system by default unless omitted by user selection of omission. Also, the dynamic summary section 2606 may be customized by the user to display selected operational parameters using a pull down list of available operational parameters for display.

In the illustrated example, the dynamic summary section 2606 includes a menu pull down 2610, and a cellular, satellite, or Wi-Fi signal strength indicator and wireless service provider name 2612. In addition, the dynamic summary section 2606 of this example includes a battery life indication 2614 of a backup battery for the system, a utility power indicator 2616 indicating that AC power is being supplied to the system, and environmental conditions 2618 at the location of the home flood prevention appliance system, such as the temperature and relative humidity in the basement or crawl space where the sump pit is located. Further, the dynamic summary section 2606 of this example includes a mode indication 2620 indicating whether the system is in home mode or away mode based on an input from an external system, a user entered indication, or water flow detected in the domestic water distribution network. In other examples, other operational parameters may be displayed in the dynamic summary section as selected by a user.

Figure 27:
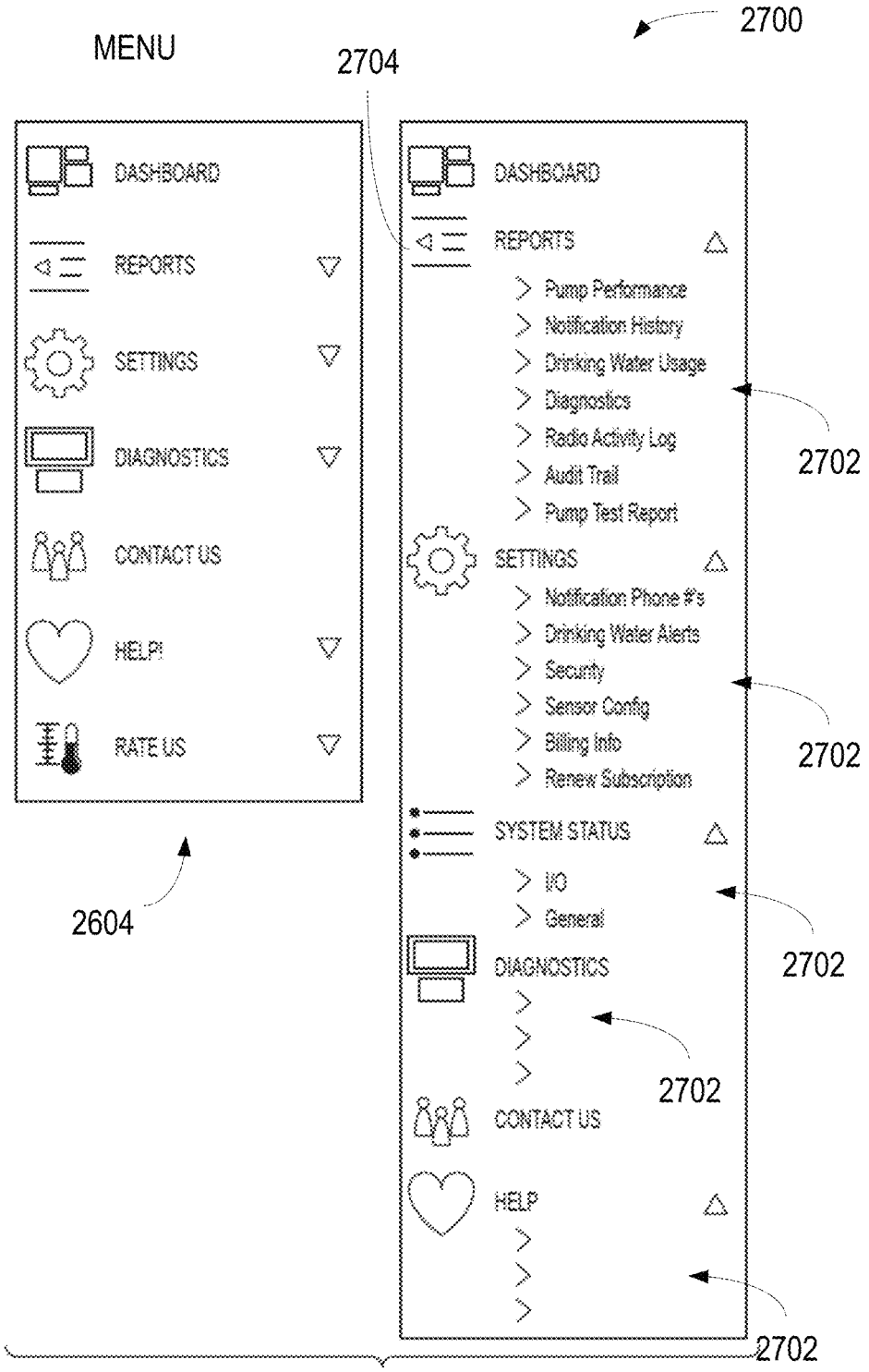
FIG. 27 is an example menu screen illustrating example sub menu items within the menu selections of menu section shown in FIG. 26.

FIG. 27 is an example menu screen 2700 illustrating example sub menu items 2702 within the menu selections of menu section 2604 in FIG. 26. The list of sub menu items 2702 may be pull downs under each menu section 2604. Each sub menu item 2702 may be a link to a graphics screen within the whole home water system.

In addition to preconfigured sub menu items 2702, a user may add additional graphic screens, such as different report screens as new sub menu items 2702 to customize the system. For example, using a new reports menu pull down 2704 and selecting a report type from a predetermined list of types of reports a user may create and save new reports showing parameters of interest. Different report types may have different predetermined information display locations and formats and provide different functionality and user interaction. Types of reports may include, for example, trend reports, status reports, and the like. Upon selection of a report type, the user is prompted to name the new report and select operational parameters for display in a report screen of the selected report type. Operational parameters may include signal values received via the I/O circuitry and calculated values determined by the controller circuitry. The user may also add tabs to a new report by selection of an add tab menu item. Upon adding a new tab, the user is prompted to name the tab and use pull down menus to add operational parameters in the report screen for that tab of the report type.

As illustrated in the sub menu items 2702, any number of different reports may be present in the system. For example, the system may include a pump performance report, a notification history report, a drinking water usage report, a diagnostic report, a communications circuitry (radio) activity log report, an audit trail report and a pump test report. In other examples any other reports may be included since the reports in the system are configurable by a user to display any combination of operational parameters.

Figure 28:
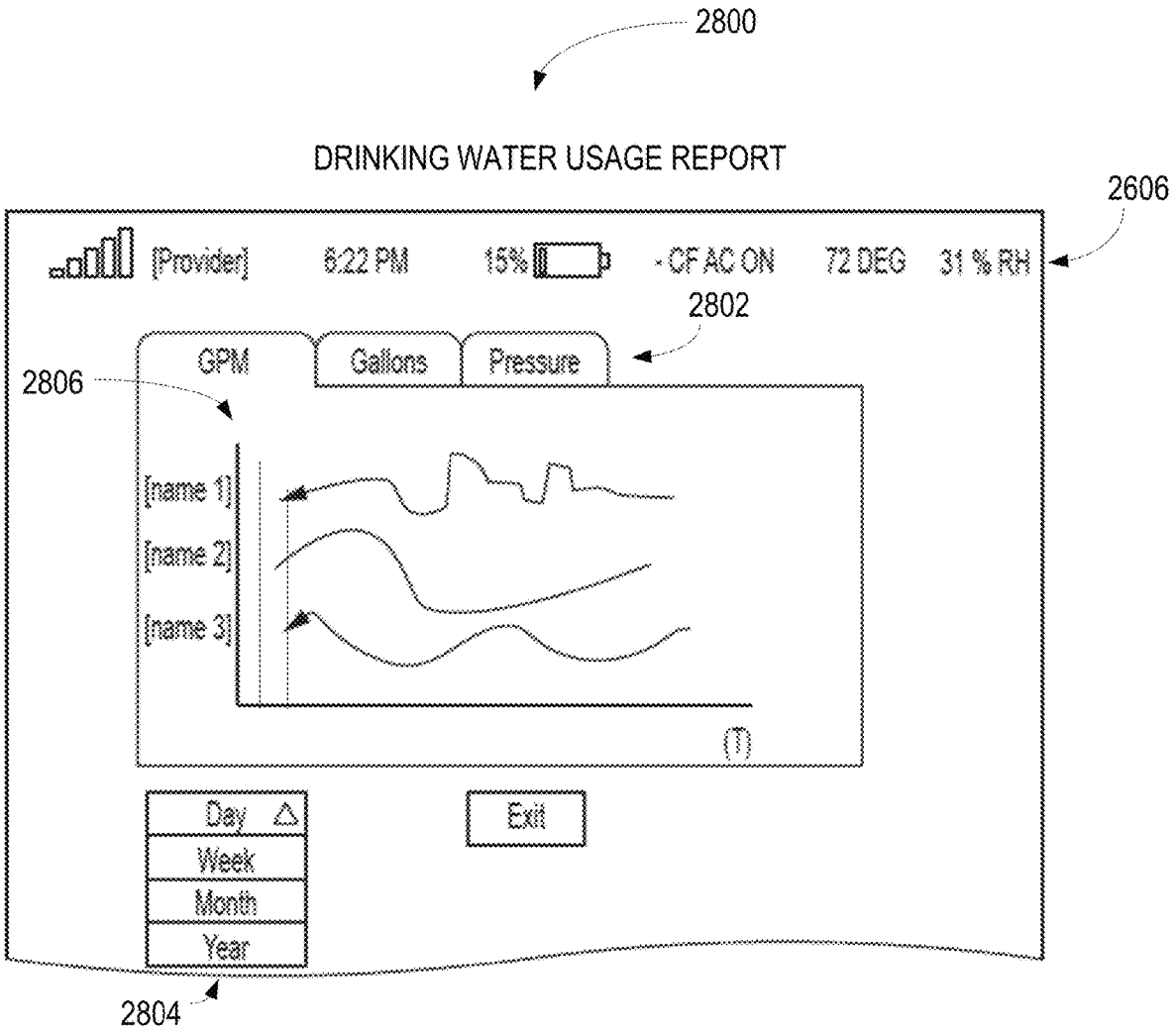
FIG. 28 is an example of a user configurable trend graph report for drinking water usage related operational parameters.

FIG. 28 is an example of a user configurable trend graph report 2800 for drinking water usage related operational parameters. The user configurable trend graph report 2800 is a report type that may be accessed by user selection of a piece of equipment, such as primary pump 432 from the status screen 2500, or from the menu 2700.

Upon selection, a corresponding dynamically trending graphic is displayed as the trend graph report 2800. The report type format of the trend graph report 2800 includes a number of name selections along the Y-axis which are identified as Name 1, Name 2 and Name 3 in the example of FIG. 28. When creating a new trend graph report, or modifying an existing trend graph report, a user may select one of the name selections, which will bring up a pull down list of available measured and calculated process related parameters in the system. The user may select an operational variable, such as a pressure, a temperature or a flow rate from the pull down list. Following selection by the user, the selected operational parameter is visually provided over time (T) of the x-axis on the trending graphic. The user may also select a pen color for each dynamically trending operational parameter selected for display in the trend graph report 2800. There may be a number of trending report tabs 2802 for different types of operational parameters. In the example of FIG. 28, trending report tabs for GPM, total gallons and pressure are provided.

The trend graph report 2800 may also have a user selection capability for dynamically selecting a trend period from a trend period selection 2804, which may be in the form of a drop down menu. The drop down menu may include selectable trend periods, such as a day, a week, a month or a year, as illustrated in FIG. 28.

A user may configure and store any number of user configurable trend graph reports 2800 in the system in association with system parameters and corresponding system equipment/elements. A trending graphic report 2800 may be configured and saved by the user in association with a graphic of a particular piece of equipment/element or elements, such that selection of the graphic of the equipment/element or elements brings up the trending graphic associated therewith. Association may be performed by the user entering an association mode from a report type, selecting an association action, and navigating to the particular graphic in a particular display screen. By the user clicking on the graphic in one or more different particular display screens, the system stores the association such that future clicks on the graphic will change the view to the associate trending graphic report 2800.

As the user creates a new trending graphic report 2800, the user may select additional operational parameters. Following selection, the system may automatically adjust the scaling of the operational parameters to maintain correspondence in the trending graphic report 2800 between different operational parameters being trended in the same graphic trend. For example, a trend graph report for drinking water usage may be configured by user selection of a trending pressure between 0 and 40 psi as Name 1, and a flow between of 0 and 120 GPM may be selected as Name 2, and a trending temperature between −25 and 110 degrees Fahrenheit may be selected as Name 3. Due to automated scaling by the controller circuitry, coherency of the trend graph report may be maintained and parameters with significantly different scaling can be auto correlated and displayed over time (T) in the user selected trend period 2804.

Automated scaling by the controller circuitry may be based on, for example, the level of variability of the operational parameter selected for display within the selected trend period range 2804. Upon selection of a trend period 2804, the controller circuitry may dynamically perform a review of the maximum and minimum operational parameter actual values based on the trend period selected. Based on the actual values in the selected trend period range, scaling of operational parameters may be automatically performed. In addition, the controller circuitry may compare the range of each of the user selected operational parameters and correspondingly scale the displayed operational parameters accordingly so that the trend lines shown are intuitively comparable by the user.

For example, in a trend period selection 2804 of one day, the variability of the operational parameters may be lower resulting in a more granular dynamic scale selection by the controller circuitry for each selected parameter, such as 38 to 42 psi for Name 1, 30 to 50 GPM for Name 2, 60 to 75 degrees F. for Name 3. In another example with a trend period selection 2804 of one year, the variability of the operational parameters may be significantly higher resulting in a more course scale for each selected parameter, such as 0 to 75 psi for Name 1, 0 to 150 GPM for Name 2, and −15 to +115 degrees for Name 3. In either case, the vertical axis of the chart will contain a number of vertical scales 2806, such as three, which correspond to the three different variable ranges. These vertical scales 2806 are represented in three distinct, different colors, that correspond to the colors of the corresponding charted variable colors. Thus allowing a novice to plot three different variables, of different scales, onto a single graph, and see how the variables interact on the same time scale without the need to manually compare separate charts to each other.

Figure 29:
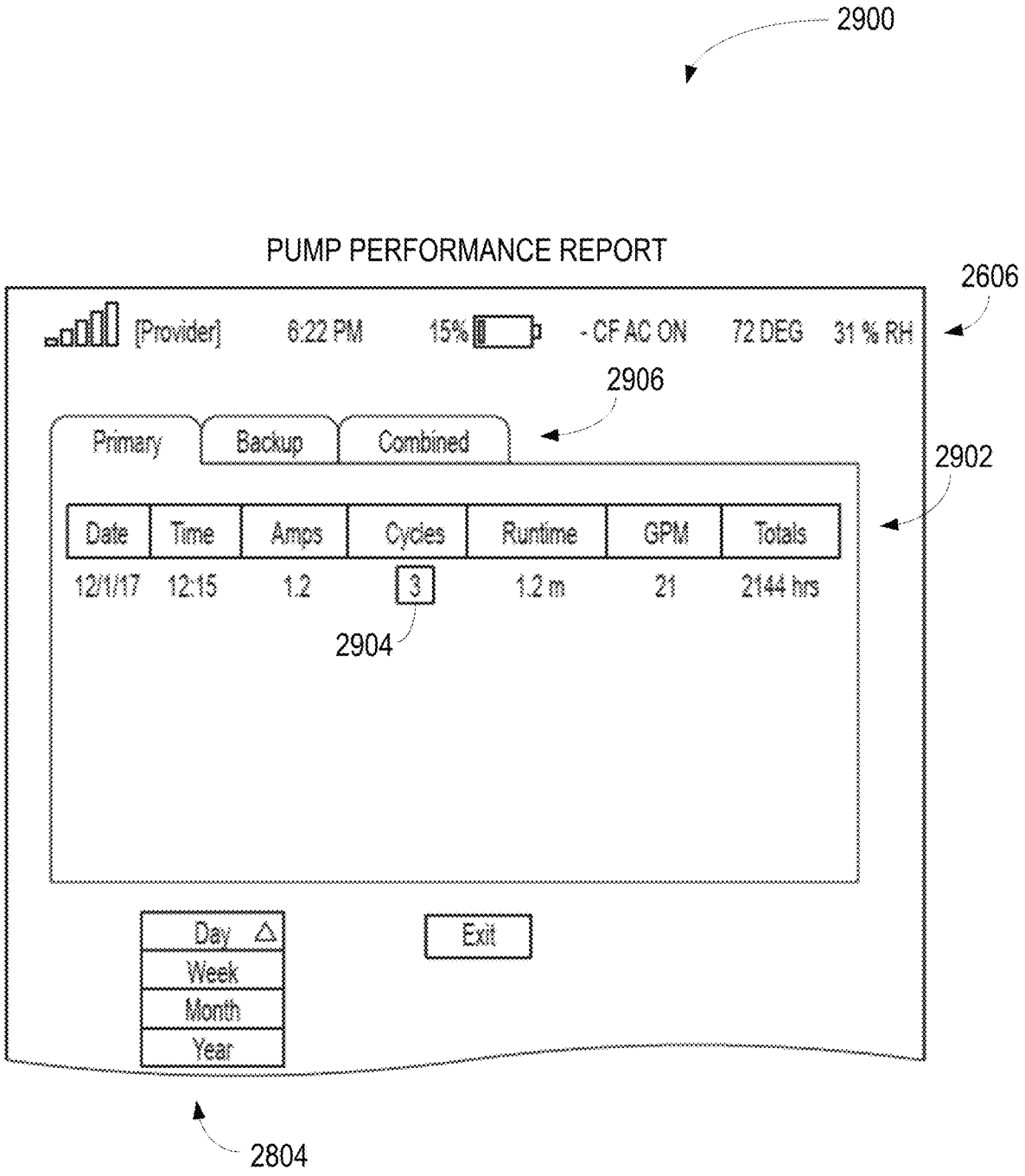
FIG. 29 is an example of a user configurable stats report for pump performance related process parameters.

FIG. 29 is an example of a user configurable stats report 2900 for pump performance related process parameters. The user configurable stats report 2800 may be accessed by user selection of a piece of equipment, such as secondary pump 900 from the status screen 2500, or from the menu 2700.

Upon selection, a corresponding stats report screen graphic is displayed as the stats report 2900 that includes a number of operational parameter columns 2902, which are identified as date, time, amps, cycles, etc. along the top of the screen in the example of FIG. 29. When creating or modifying a stats report 2900, a user may select one of the operational parameter columns 2902, which will provide a pull down list of available measured and calculated process related parameters in the system available for the stats report. The user may select an operational variable, such as runtime, GPM, and the like from the pull down list. Following selection by the user, the selected operational parameter is visually provided in the corresponding operational parameter column 2902. The user may use the default description of the operational parameter in the operational parameter column 2902, or may create a custom description of the selected operational parameter.

Operational parameters displayed in the stats report 2900 may dynamically update during operation of the system. In addition, status and alarming may be dynamically provided by visual changes of the displayed operational parameters. For example, in the example stats screen 2900 of FIG. 29, number of cycles is highlighted in a box 2904 and a color of the text of the operational parameter may be changed from green to red to indicate an alarm condition due to, for example, a number of cycles of the primary pump above a predetermined threshold within a predetermined time period. In another examples, total hours of operation may be similarly highlighted and changed to yellow to indicate maintenance on the primary pump should be completed.

User selectable equipment tabs 2906 may also be included in the stats report 2900 for different pieces of equipment in the home flood prevention appliance system. In FIG. 29, a tab for the primary pump, a tab for the backup or secondary pump, and a tab for the combination of the primary and the backup pump are indicated. Each tab may include corresponding operational parameter columns 2902 with operational parameters selectable by the user from pull down lists.

Figure 30:
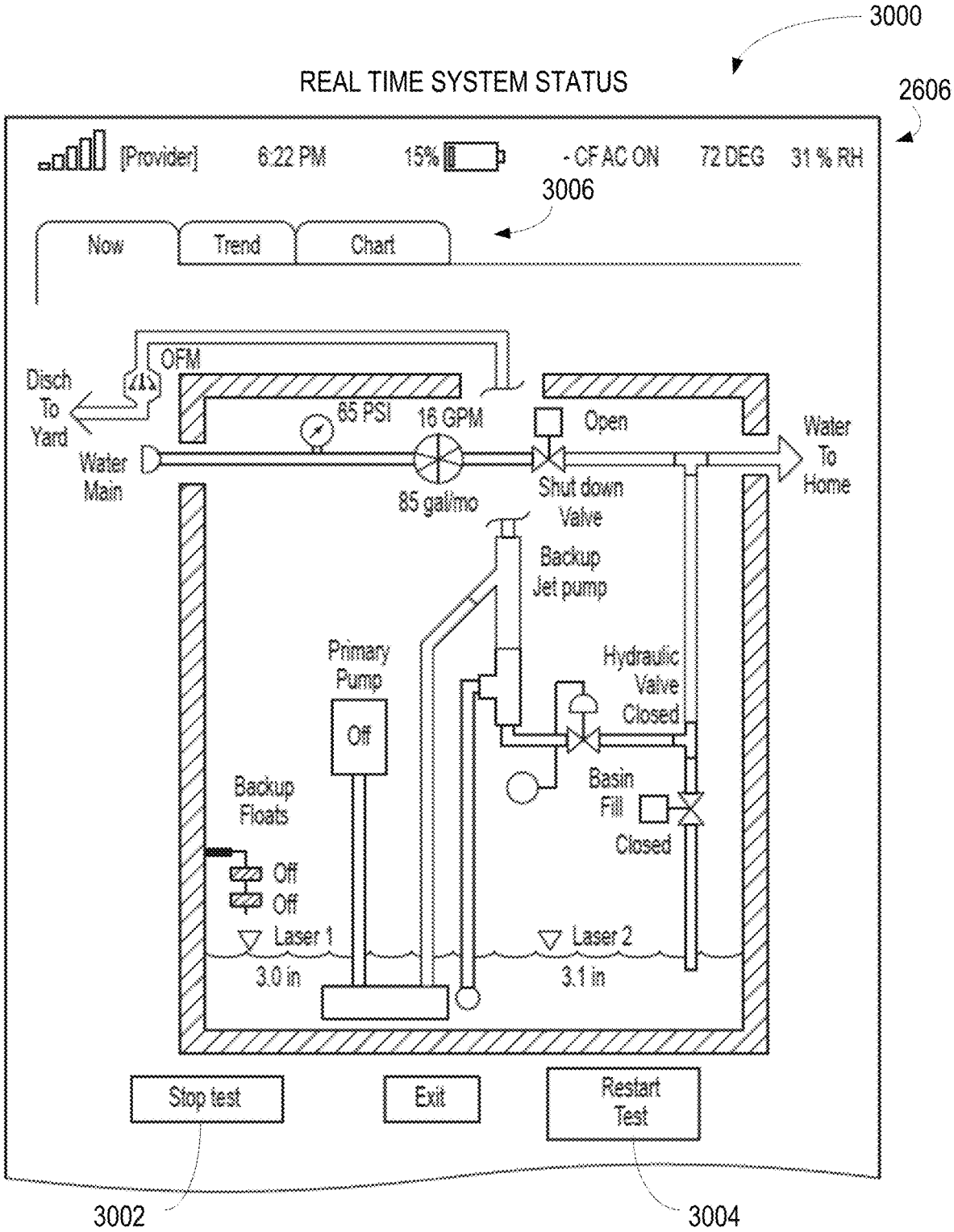
FIG. 30 is an example of a real time system status screen displaying system operational parameters.

FIG. 30 is an example of a real time system status screen 3000 displaying system operational parameters. The real time system status screen 3000 may be a different selection in menu 2700 from the status screen 2500 illustrated in FIG. 25. For example, real time system status screen 3000 may be accessed by selection of the "I/O status" selection in the menu 2700, and the status screen 2500 may be accessed by selection of the "General" selection in the menu 2700.

The real time system status screen 3000 may be launched automatically by the controller circuitry at a time when the system enters a diagnostic test mode. In addition, or alternatively, the real time system status screen 3000 may be accessed by user selection of a piece of equipment, such as primary pump 432 from the status screen 2500, or selecting a status view under the system status selection in the menu 2700, such as "I/O status." In the case where the real time system status screen 3000 is launched automatically upon entry into a diagnostic test mode, a stop test icon selection button 3002 may be available so the user can manually abort the test if desired. Also, a re-start test icon selection button 3004 may be available for a user to manually initiate or re-start a diagnostic test.

The real time system status screen 3000 may show a layout of the system, such as the layout provided in FIG. 30, in which variable numerical value and textual (e.g. on/off; open/close) operational parameters are updated in real time within the screen. In addition, equipment and objects within the real time system status screen 3000 may be dynamically adjusted to reflect corresponding variable operational parameters. For example, the pumps, and piping between equipment may dynamically and automatically change color when a pump starts or a valve opens to indicate flow of liquid in the system. In addition, for example, a water level graphic may be updated to different vertical positions as the sump pit level dynamically varies. Also, user selection of any element depicted or variable parameter displayed, such as from the touch screen of the display, may bring up a corresponding trend graph report 2800 or stats report 2900.

The real time system status screen 3000 may include a number of status tabs 3006, such as the current (now) tab, trend tab (numeric values) and chart tab (lines), which are selectable by a user and may show the same operational parameters if different formats. Additional custom real time system status screens 3000 may be generated by the user with user selected operational parameters. Selection of elements and equipment may be based on selection of available icons from a pull down list. The controller circuitry may automatically and dynamically position and size the selected icon and show corresponding operational parameters depending on the other icons selected for the custom real time system status screen 3000.

In addition, the controller circuitry may automatically and dynamically illustrate relational between selected icons. For example, interconnecting piping between two selected Icons may be automatically and dynamically added to the screen by the controller circuitry at the time the related icons are selected by the user. In another example, additional graphical detail and corresponding dynamically updated variables or graphics may be scaled in accordance with the number and relation of other selected icons. Thus, for example, a custom real time system status screen 3000 created by a user to focus on the smart water meter/shutoff valve 620 may automatically include additional equipment details, I/O values, piping details and multi-color flow rate and pressure ranges, whereas when the smart water meter/shutoff valve 620 is depicted in a custom real time system status screen 3000 also depicting the primary and secondary pumps 432 and 900, the additional details for the smart water meter/shutoff valve 620 may be omitted. Accordingly, not only does the system dynamically arrange and connect the selected icons, but also, dynamically adjusts the complexity in accordance with the number of system elements being depicted.

Figure 31:
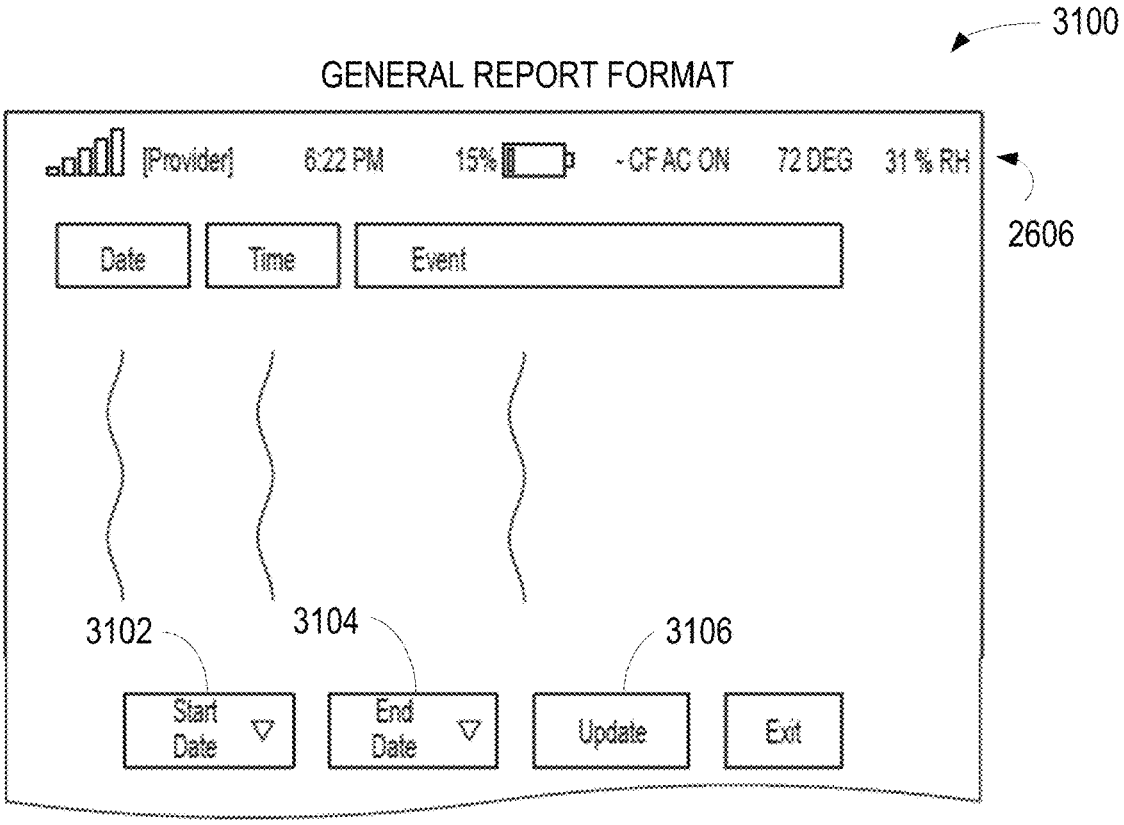
FIG. 31 is an example of a dynamically user configurable general report.

FIG. 31 is an example of a dynamically user configurable general report 3100. Similar to previously discussed reports, the dynamically user configurable general report 3100 may be in a predetermined format that is fully configured with user selected operational parameters selected from pull down menus at the time the report is created. In addition, the dynamically user configurable general report 3100 includes a start date icon selection 3102, an end date icon selection 3104 and an update icon selection 3106 for use by a user after the report is fully configured with operational parameters while data is being dynamically collected/generated and displayed. Accordingly, the user may create and store a dynamically user configurable general report 3100, and then use the stored report for analysis of system operation during particular events or date ranges. For example, if a user got alarm messages regarding excessive cycles of the primary pump during an overnight period, the user could generate a primary pump specific dynamically user configurable general report 3100 the next day and select start and stop dates to analyze the cause(s) of the alarm.

The dynamically user configurable general report 3100 may be used to create any type of reports. Examples of such reports include a notification history report with operational parameters and corresponding alarm messages, a radio activity log with operational parameters related to communication via the communications circuitry and related operational parameters of interest, audit trail reports with operational parameters related to audit results, and pump test reports providing pump related operational parameters. Any dynamically user configurable general reports 3100 may be included in the sub-menu 2702 of the reports selection in the menu 2700.

Figure 32:
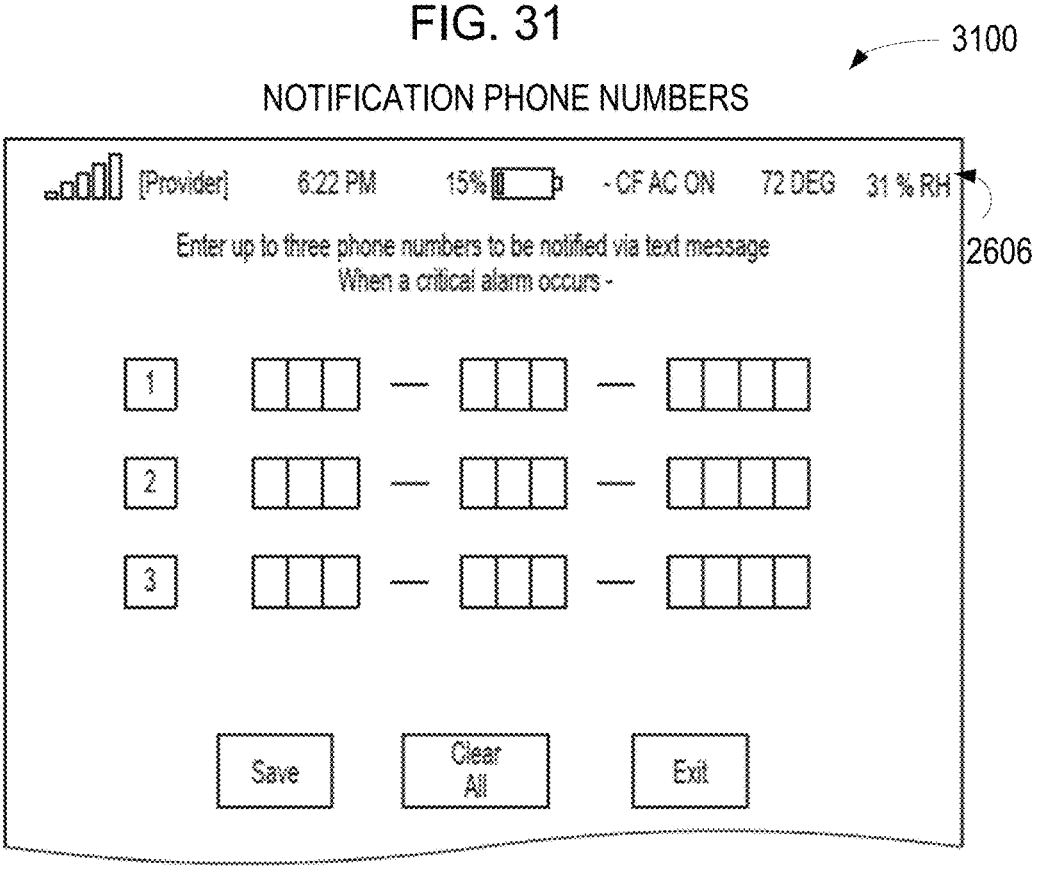
FIG. 32 is an example of a notification phone numbers screen.

FIG. 32 is an example of a notification phone numbers screen 3200. Access to the notification phone numbers screen 3200 may be automatically provided during startup of the home flood prevention appliance system. In addition, the notification phone numbers screen 3200 is accessible from the menu 2700 as "Notification Phone #'s". Users of the home flood prevention appliance system may input their phone number to receive messages from the system. In addition, the inputted phone numbers may provide a security function. The controller circuitry may use the inputted phone numbers as security verification before accepting requests and commands in the form of text messages from a user. The controller circuitry may contact a central server, such as a registrar to provide information input into the notification phone numbers screen 3200. Such information may be synched between the home flood prevention appliance system and the central server.

Figure 33:
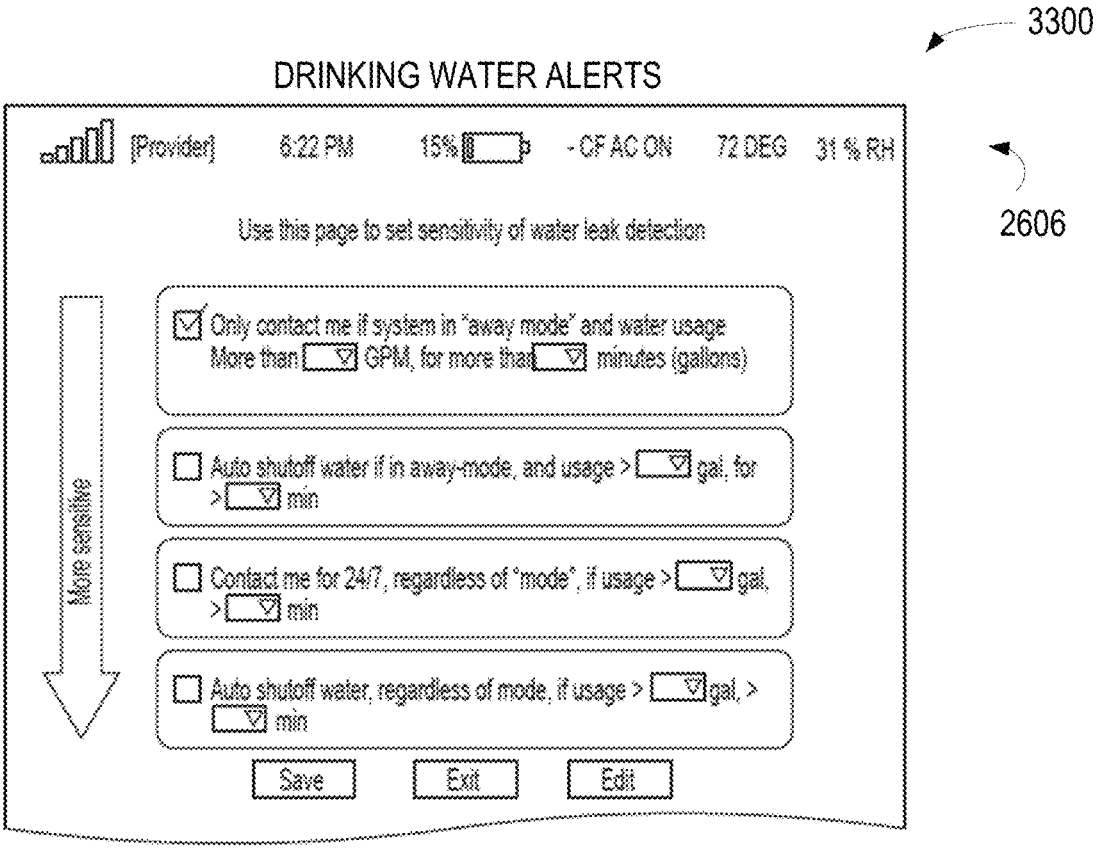
FIG. 33 is an example of drinking water alert level user settings screen.

FIG. 33 is an example of drinking water alert level user settings screen 3300. A user may configured the sensitivity of the system in detecting water leaks in the domestic water distribution network. By checking boxes and selecting thresholds for operational parameters of a detected flow rate and duration, the user may increase or decrease the response level of the smart water meter/shutoff valve 620 to a leak detection event. The detected flow rate may be a flow rate outside of predetermined water use profiles create or modified by the user. Such predetermined water use profiles include a profile of an ice maker making new cubes, washing machine finishing a load of laundry, a water softener's scheduled regeneration, etc. The sensitivity of the system may be set in a least sensitive setting where the user is only notified of a leak detection event when the user is away and the duration and magnitude of usage exceeds a amounts set by the user. In a most sensitive setting, the smart water meter/shutoff valve 620 may shut off domestic water supply to the domestic water distribution network based solely on the magnitude and duration of a flow event.

Figure 34:
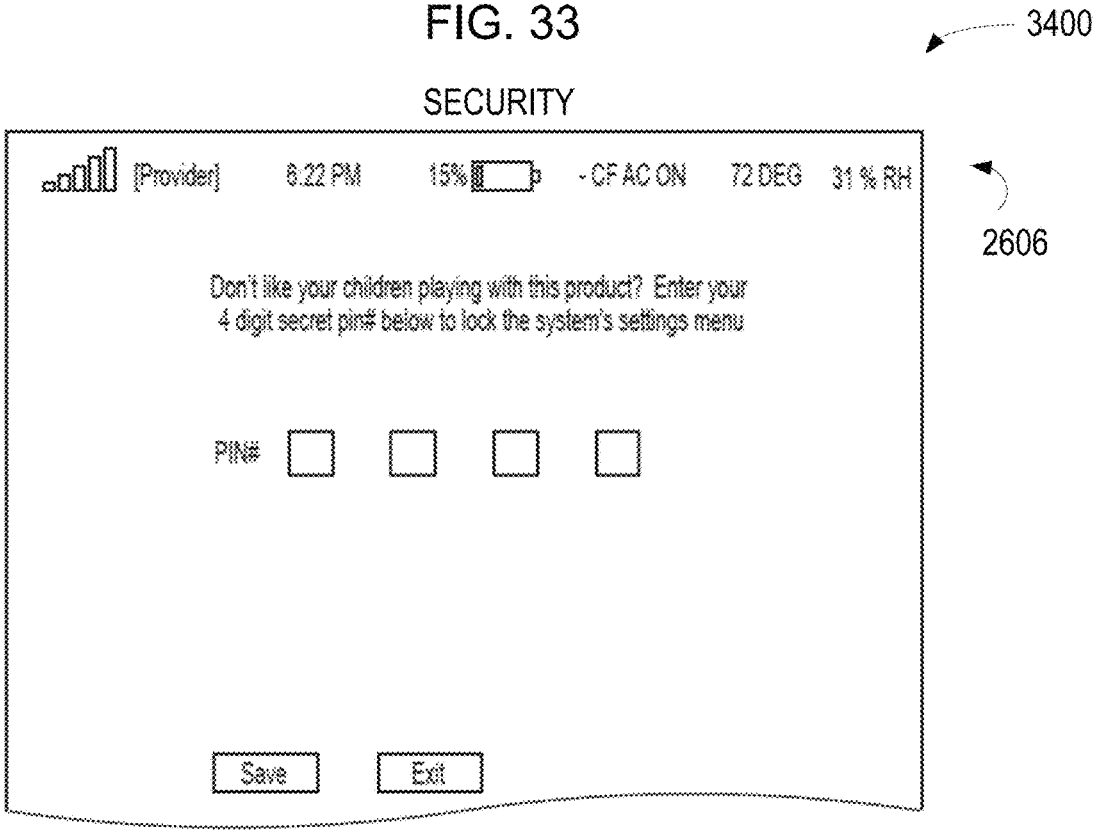
FIG. 34 is an example of a security screen.

FIG. 34 is an example of a security screen 3400. The security screen allows a user to set a personal identification code. A request for the personal identification code may be generated whenever a user first accesses the system, or when a predetermined period of time, such as 15 minutes has expired since the identified registered user last interacted with the home flood prevention appliance system.

Figure 35:
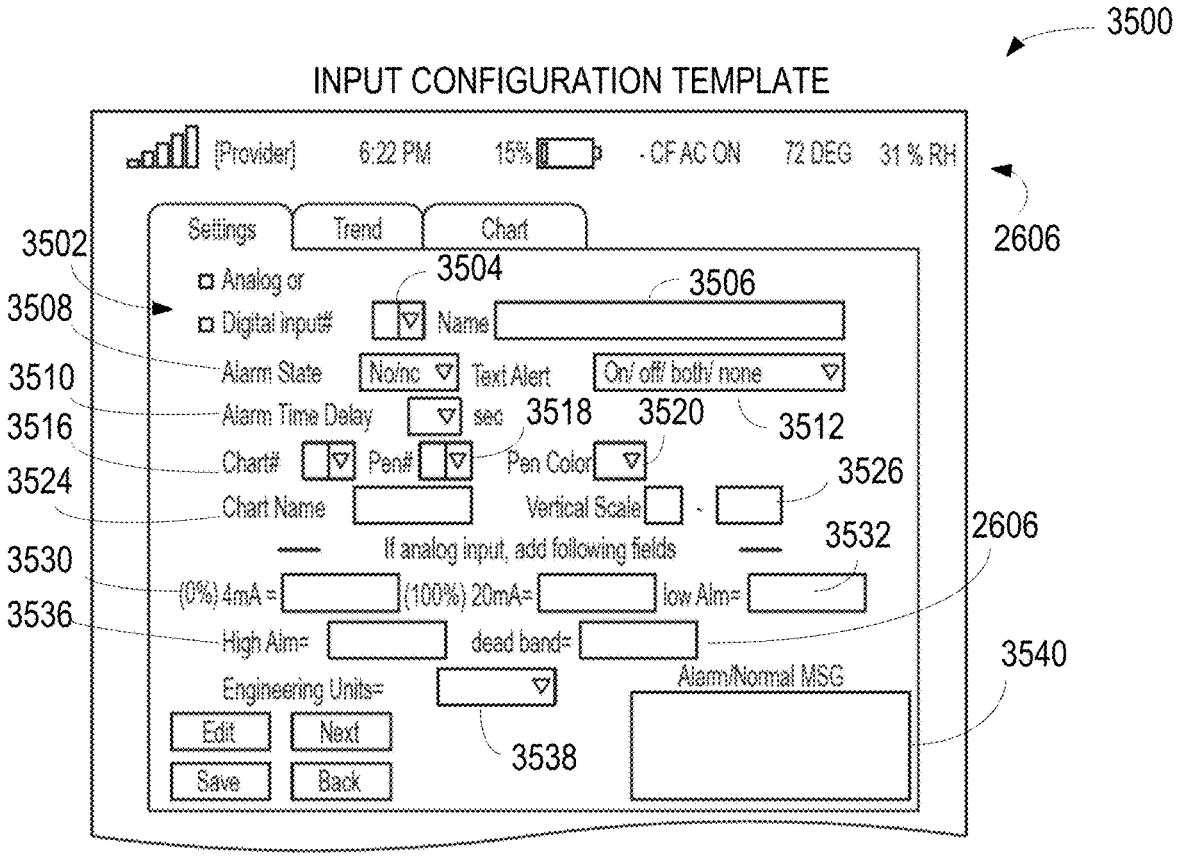
FIG. 35 is an example of an input configuration template user entry screen.

FIG. 35 is an example of an input configuration template user entry screen 3500. The input configuration template user entry screen 3500 may be used configure operational parameters received as inputs to the home flood prevention appliance system via the I/O circuitry 2218 (FIG. 22). The operational parameters may be provided from sensors and other devices included in the external frame of the home flood prevention appliance system (internal inputs), or may be received from devices external to the home flood prevention appliance system.

A user may identify an input type 3502 of the operational parameter as an analog or digital input via check box, and identify an input number 3504 upon which the signal is received. In an example embodiment, the I/O circuitry includes terminations #1-8 for analog inputs and terminations #1-8 for digital inputs, and a pull down selection of #1-8 is provided. The user may also provide a name 3506 for each input, which will be displayed in reports, status screens and other graphic screens where the operational parameter is provided.

For operational parameters that are digital inputs, an alarm state 3508 of normally open (NO) or normally closed (NC) may be selected. Also, an alarm time delay value 3510 may be selected from a pull down to avoid repetitively receiving the same alarm due to noise, contact bounce, or contact chatter, and whether the alarm should produce a text message, a local alarm, both text message and local alarm or no alarm is selectable from a text alert 3512 pull down.

For those input which are used in a user configurable trend graph report 2800 (FIG. 28), a chart number 3516 (e.g. number assigned by system when created), a pen number 3518 (e.g. Name 1, Name 2, or Name 3), and a pen color 3520 may be selected from pull down menus; and a chart name 3524 and vertical scaling range 3526 may be input.

For operational parameters that are analog inputs, low (0%) and high (100%) units values 3530, a low alarm value 3532, a high alarm value 3534, a dead band 3536 and engineering units 3538 may be entered. Also, for both analog and digital inputs, an alarm message and normal message 3540 may be entered by the user. The utility of the trend graphs now becomes apparent in that three variables of any type and scale can be plotted against each other on a single graph. This applies even to a digital on/off style signal being plotted against two analog variables onto a single graph. For example, if the user wanted to plot the on/off run status of the primary pump vs pump amps, and domestic water pressure, these variables can all be assigned to the same graph. The vertical scale of the graph will contain three vertical scales of different colors and scaling. The associated line graph for each variable will match the color of the corresponding vertical scale. This applies even for the digital on/off signal. This digital signal will look merely like a step-function square wave transitioning on and off based on the time it is running vs stopped, and then corresponding pump amps and water pressure can be observed against this square ware line graph to ensure all parameters are functioning correctly and in the correct timeframe. Anomalies and trends can be easily spotted graphing different scale variables on a single graph.

Figure 36:
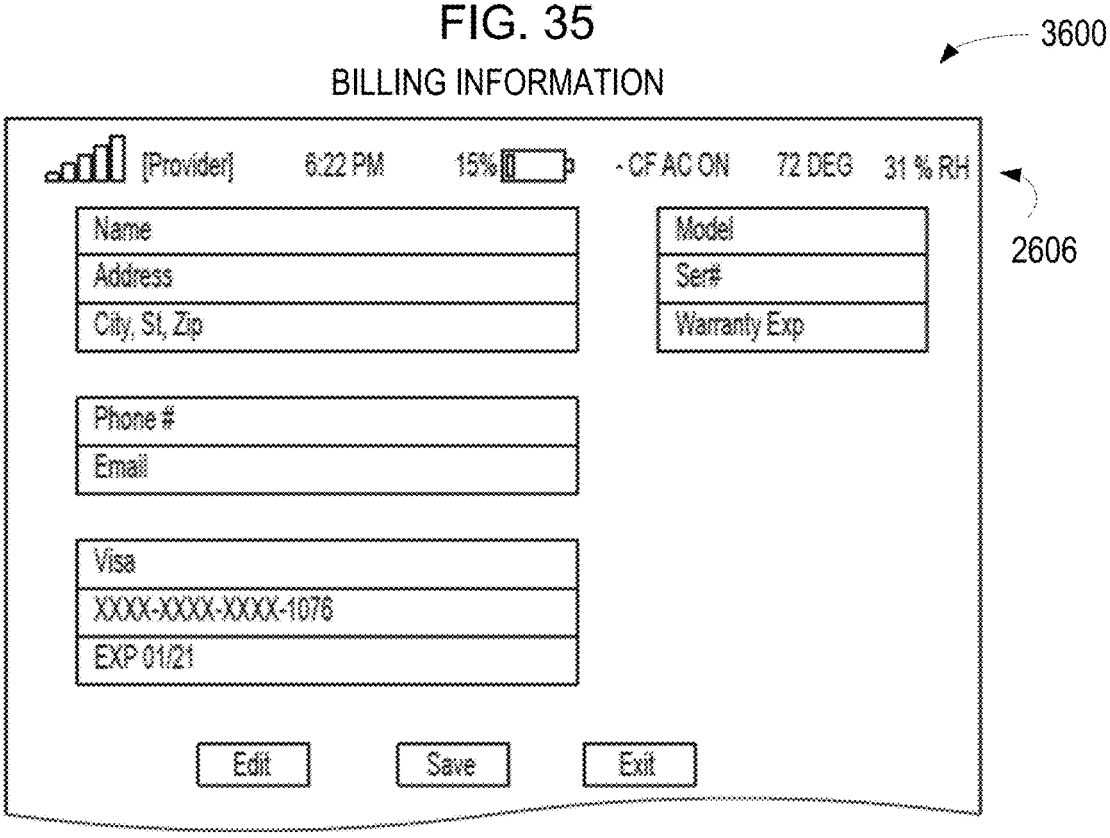
FIG. 36 is an example of a billing information input screen.

FIG. 36 is an example of a billing information input screen 3600 where a user may enter information for purchase made through the home flood prevention appliance. Purchase may include, for example, consumables, such as desiccant, equipment replacement parts, equipment upgrade parts such as a multi-function communication PCB providing cellular and WIFI communication capability, and services, such as in home repair services, technical support, troubleshooting and the like.

Figure 37:
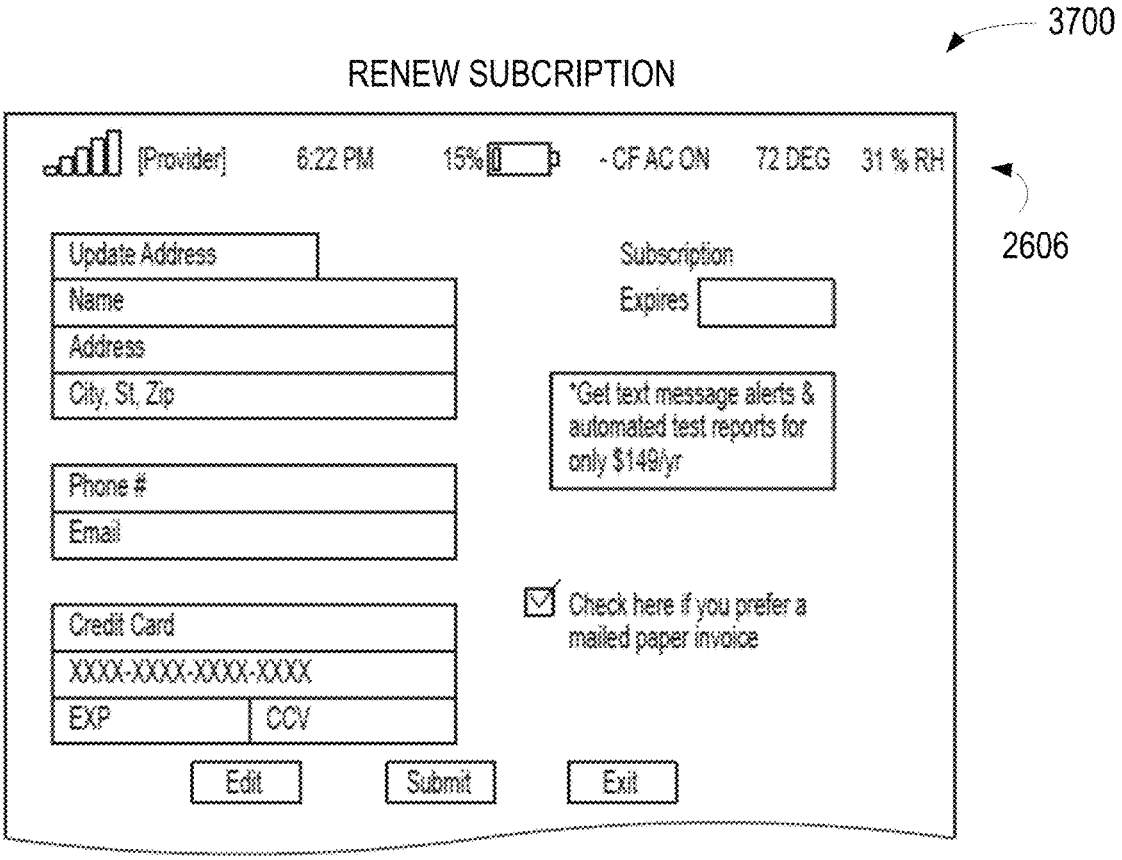
FIG. 37 is an example of a subscription renewal screen.

FIG. 37 is an example of a subscription renewal screen 3700. The subscription renewal screen may be used to upgrade or renew wireless communication services by entering billing information. Wireless communication services may be provided via satellite or cellular to send and receive, for example, text messages.

Figure 38:
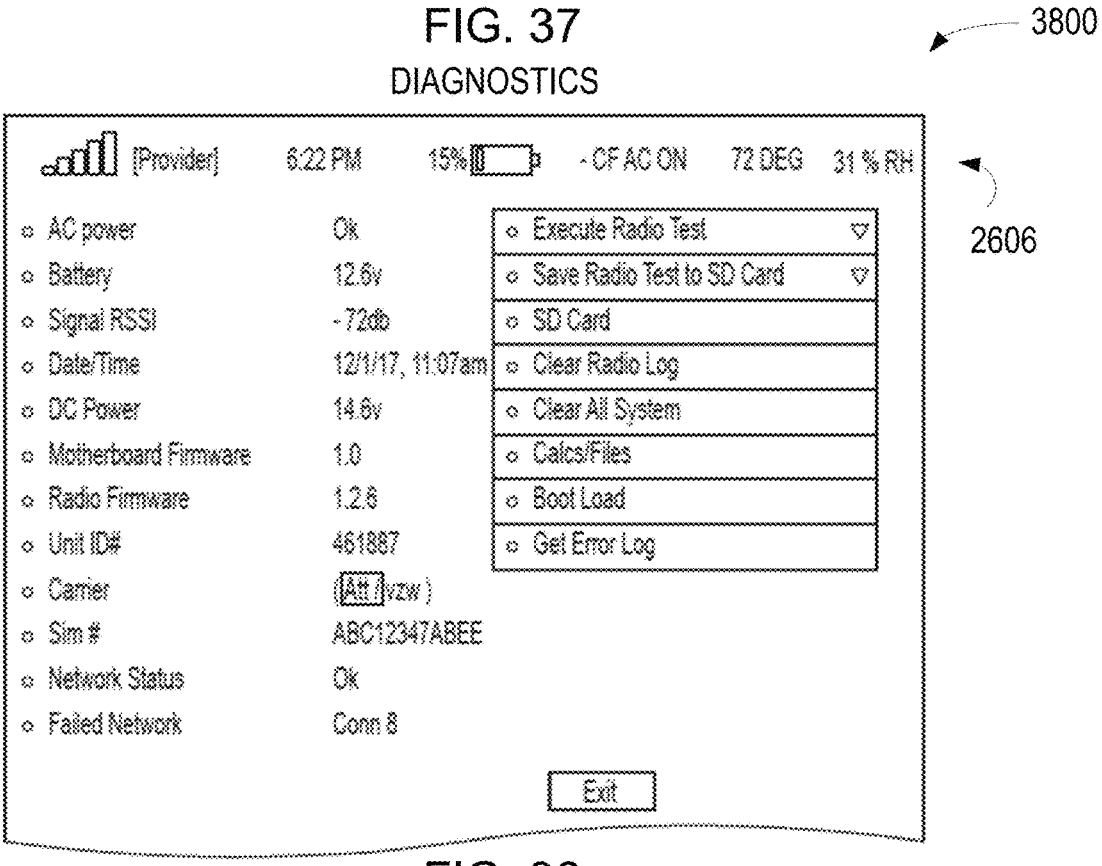
FIG. 38 is an example of a diagnostics screen.

FIG. 38 is an example of a diagnostics screen 3800. The diagnostic screen 3800 may be automatically presented to the user upon completion of diagnostic testing by the controller circuitry. Alternatively, or in addition, a user may retrieve the diagnostic screen via submenu in menu screen 2700 (FIG. 27) or by selecting a link in an alarm message. The example diagnostic screen 3800 may include an diagnostic test values section 3802 and an actions section 3804.

The diagnostic test values section 3802 includes test results for various systems that were tested and system specific information for the home flood prevention appliance system. The actions sections 3804 provides various actions that a user can initiate. In the example of FIG. 38, an execute radio test is available to test the wireless communications. Where multiple wireless communications are available, such as cellular, satellite, short range, and WIFI, the user may select individual services to be tested. An option to save results of a radio tests to a storage medium, such as an SD card, thumb drive, laptop, or other memory device connected with the system may be used to, for example, obtain assistance from the service provider with troubleshooting. In alternative examples, selection of another wireless communication service may be selected to obtain radio tests results may be selected. For example, a user may select short range communication (such as Blue Tooth™ to transfer the radio test results to the users cell phone while the user is in the basement within a short distance of the home flood prevention appliance system.

A clear radio log selection is also available to remove the log of previous radio communication, and a clear all systems/calculations selection may empty the memory of all operational parameters and stored calculations (e.g. system reset). A boot/load selection may be used to re-boot the home flood prevention appliance system, and a get error log selection may be used to retrieve an error log for download via the communication circuitry or to a storage medium connected with the system. In other examples, additional diagnostic test related activities may be included in the diagnostics screen 3800.

Figure 39:
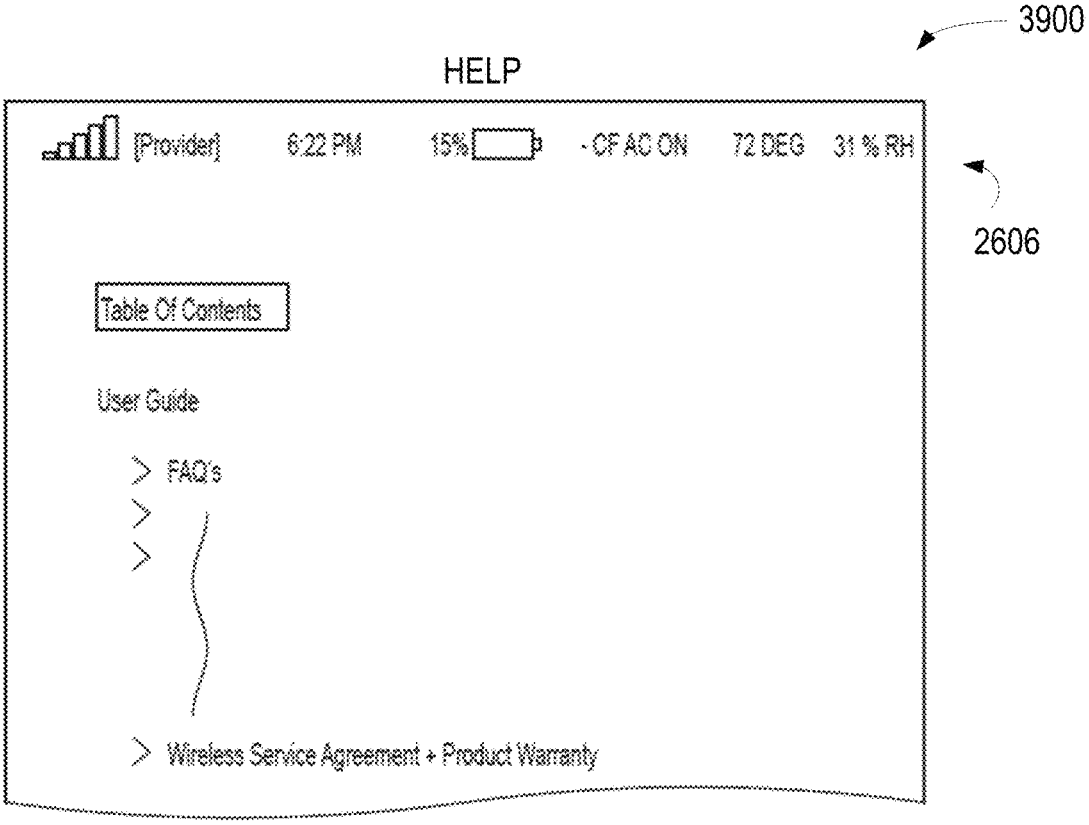
FIG. 39 is an example of a help screen.
Figure 40:
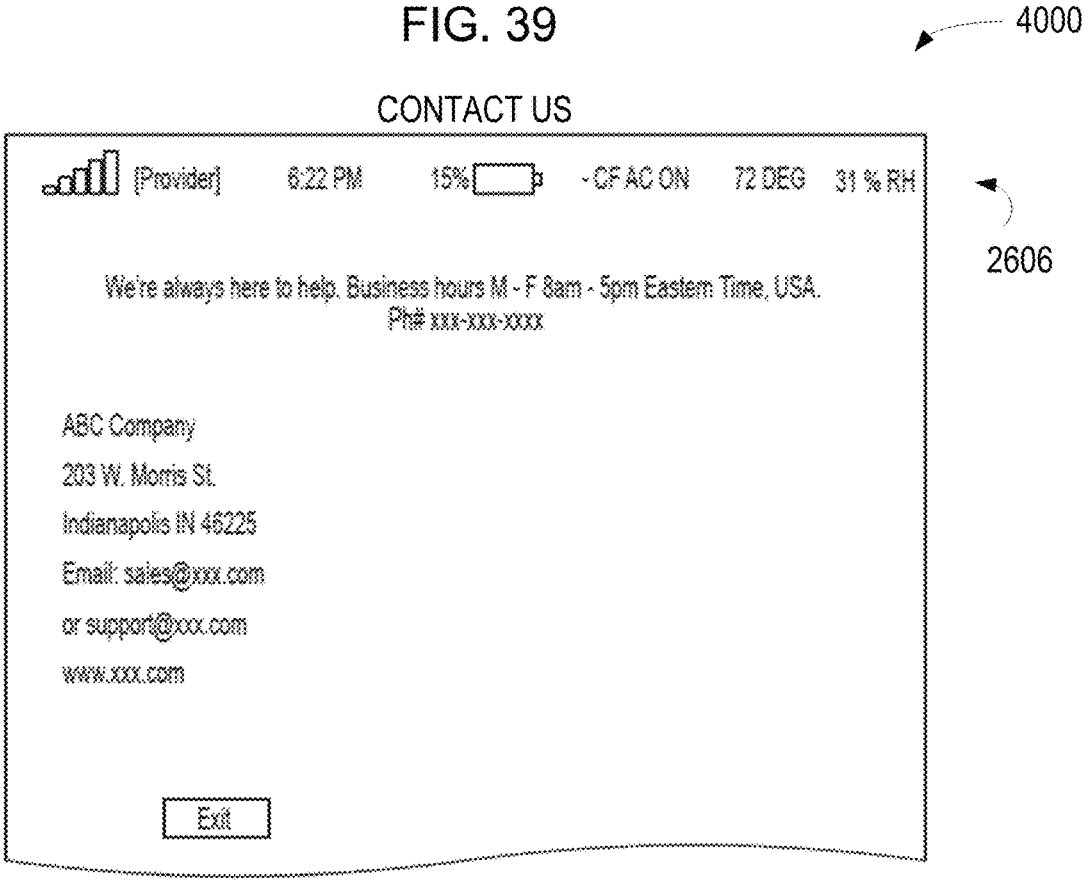
FIG. 40 is an example of a contact us screen.
Figure 41:
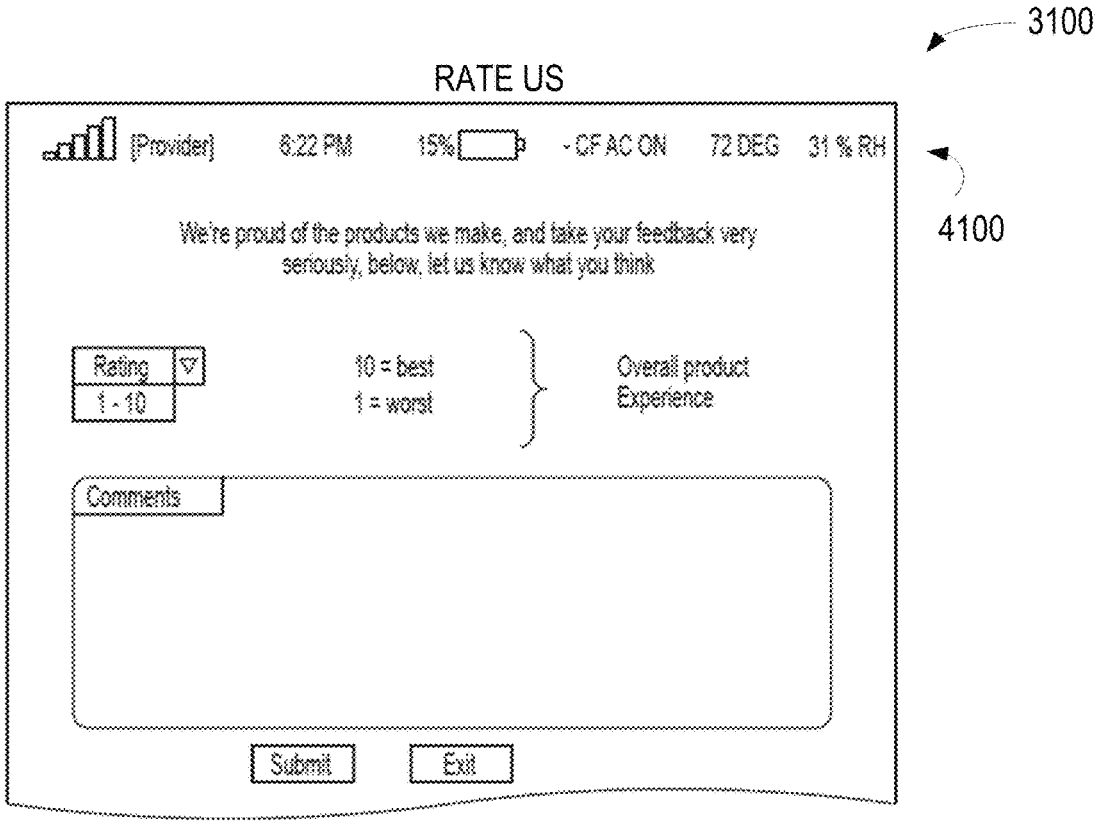
FIG. 41 is an example of a consumer rating screen.
Figure 42:
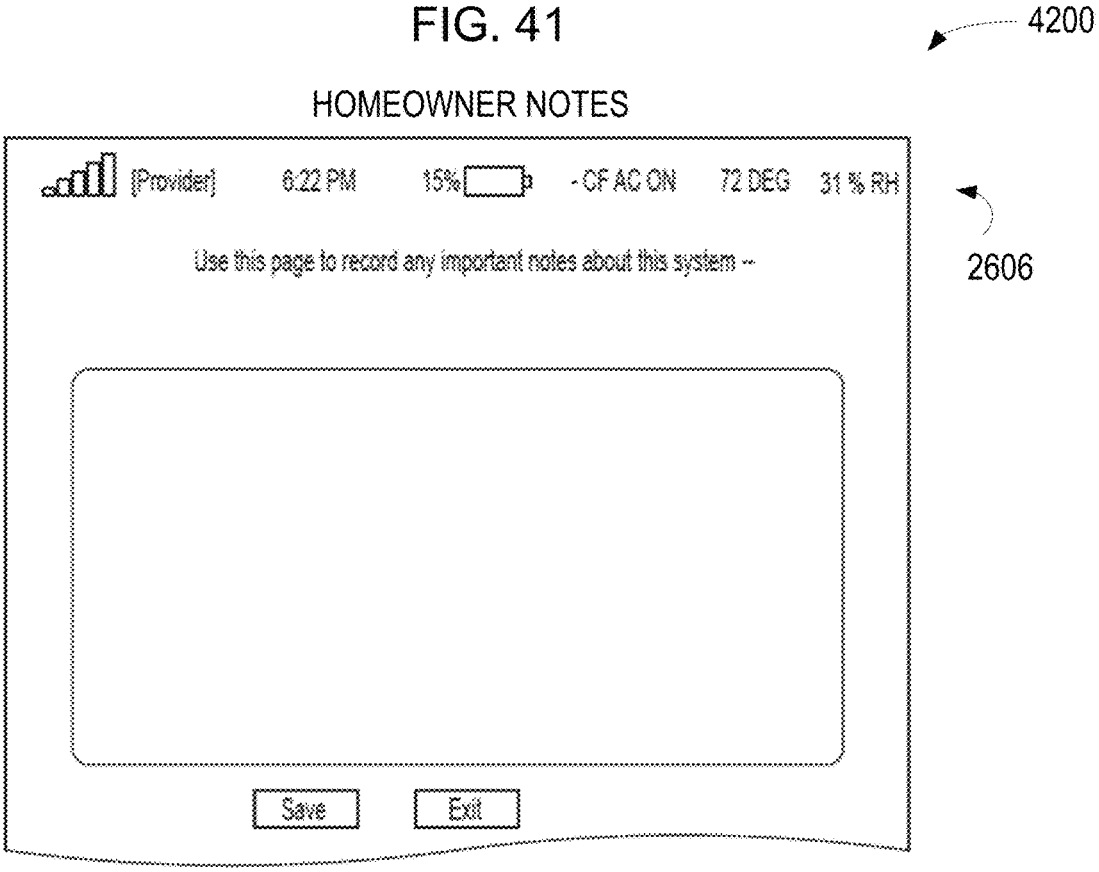
FIG. 42 is an example of a notes page screen.

FIG. 39 is an example of a help screen 3900. The help screen 3900 may display a table of contents of a user's guide for the home flood prevention appliance system, which may include frequently asked questions, troubleshooting information, and the like. FIG. 40 is an example of a contact us screen 4000, FIG. 41 is an example of a consumer rating screen 4100, and FIG. 42 is an example of a notes page where a user may store system related information. The HFPA can play full motion instructional videos with sound to make product use easy to understand without the need to read lengthy manuals. The videos may be stored in the HFPA and may be selectable via one or more of the screens, or may be accessible via links on the screens, or may be accessible via the communication circuitry or the I/O circuitry by an external device, such as mobile phone. Control of audio volume, pause, play, forward and other functionality may be available via the screens. Such videos may also be downloaded to the HFPA via the communication circuitry, such as via the short range transceiver or the I/O circuitry. Accordingly, product updates and feature enhancements can be provided as program updates, with an accompanying video to explain the reasons for the updates and/or the modified or enhanced functionality the update provides.

The previously discussed home flood prevention appliance is not limited to the configurations described. In addition, the features described in the examples may be used in different configurations in which features described in one example form a part of another example, features may be interchanged among the different examples, and/or features of different examples may be cooperatively used in examples of the whole home water protection system.

In addition, the described examples of the whole home water protection system include a number of interesting features, which include: a dehumidification and aroma emission cartridge included in the shroud, and a fan configure to move air across the cartridge.

Another interesting feature relates to the single appliance structural frame which includes a primary electric powered centrifugal pump with its water discharge piped in parallel with a second water powered venturi pump where the pumps can be run separately, or together, and when running together achieve at least 1.5× system pumping rate of the primary pump or the secondary pump operating alone.

Yet another interesting feature relates to the single appliance structural frame which includes a primary electric powered centrifugal pump with its water discharge piped in parallel with a second water powered venturi (eductor) pump where the pumps can be run separately, or together, and when running together achieve 1.5× system pumping rate of the primary pump or the secondary pump operating alone, which is discharged through a single common outlet discharge pipe.

Still another interesting feature relates to the single appliance structural frame which includes a primary electric powered centrifugal pump with its water discharge piped in parallel through a sump pump discharge system that includes a merge pipe fitting, with a second water powered venturi pump. The primary and secondary pumps can be run separately, or together, and when running together to each independently supply a flow of liquid to a single common outlet achieve 1.5× system pumping rate of the primary pump or the secondary pump operating alone.

Another interesting feature relates to the single appliance structural frame which, includes a primary electric powered centrifugal pump with its water discharge piped in parallel through a merge pipe fitting, with a second water powered venturi pump where the pumps can be run separately, or together, and when running together to each independently supply a flow of liquid to a single common outlet achieve 1.5× system pumping rate of the primary pump or the secondary pump operating alone due to the effect of the merge pipe fitting and the balanced operation of the primary and secondary pumps to feed the common outlet.

Another interesting feature of the single appliance structural frame, which includes a primary electric powered centrifugal pump with its water discharge piped in parallel through a merge pipe fitting, with a second water powered venturi pump where the pumps can be run separately, or together, and when running together to each independently supply a flow of liquid to a single common outlet achieve a 50% system pumping rate increase when compared to of the primary pump or the secondary pump operating alone due to the effect of the merge pipe fitting and the balanced operation of the primary and secondary pumps to feed the common outlet.

Another interesting feature of the single appliance structural frame which contains a primary electric powered centrifugal pump with its water discharge piped in parallel through a merge pipe fitting, with a second water powered venturi pump where the pumps can be run separately, or together to supply a flow of liquid to a single common outlet, and when running together allow either pump to be started when one pump is already running, and achieve a 50% system pumping rate increase due to the merge pipe fitting and the balanced independent operation of the primary pump and secondary pump to each independently supply a flow of liquid to the single common outlet.

Another interesting feature of the home flood prevention appliance system relates to the minimized number of external connections for the system. In an example, the external connections to system may include only 1) an electric power input, 2) a utility water supply inlet, 3) a utility water supply outlet feeding a water supply system of the structure in which the system is installed, and 4) a common outlet for discharge of liquid from a sump pit within which the structural frame is positioned.

Another interesting feature of the home flood prevention appliance system relates to a utility connection wall box included in the system. The utility connection wall box includes quick connection and disconnection fittings, such as snap fittings, compression fittings and the like to interconnect the elements included in the structural frame with the utility wall connection box. The quick connection and disconnection fittings may be unique for each connection to eliminate interconnection errors. The utility connection wall box may be wall mounted in close proximity to a sump pit where the home flood prevention appliance system so as to provide water terminals, electric power terminals, and a common outlet terminal for landing or otherwise connecting a municipal utility water source and utility water network outlet main, a utility electric power feed, and a common outlet water discharge. The utility water network outlet main may supply a municipal water source to a domestic water network within the structure in which the whole house home water protection appliance is installed, and the common outlet water discharge may provide a flow path out of the structure for liquid extracted by the system from the sump pit. Corresponding quick connection and disconnection fittings may be accessible at the shroud of the system, and in some examples, interconnecting lines and cables may be included as part of the system.

Another interesting feature of the home flood prevention appliance is that the system includes in the structural frame a domestic water meter and shutoff valve configured to detect abnormal water usage anywhere in the domestic water network system of the structure. In addition, the domestic water meter and shutoff valve may automatically close the shutoff valve to turn off the supply of water from the municipal utility thereby preventing a flood, water damage, or high water bill.

Another interesting feature of the home flood prevention appliance system relates to a dehumidification system included in the system. The dehumidification system may include a calcium chloride desiccant, such as a pouch, with scented beads. An inlet air fan is also included in the dehumidification system and place to allow ambient air to be drawn in through the shroud into the calcium chloride desiccant for dehumidification of the local ambient air, and discharge of scented air from the shroud back into the surround air space for a fresh smelling basement or crawlspace.

Another interesting feature of the home flood prevention appliance system relates to communication circuitry included in the system. The communication circuitry may provide wireless telemetry capable of communicate via wifi, cellular, or satellite to remote locations across the Internet, and can report to a mobile device. The mobile device may include a stand-alone smart phone app, such as the Nest™ network, or the Amazon Echo™ appliance to display, store and/or provide a user interface for a user of the mobile device.

Another interesting feature of the home flood prevention appliance system relates to a refrigeration type dehumidification unit included in the structural frame. An inlet air fan is also contained in the appliance for drawing-in ambient air into the dehumidification unit for dehumidification of the local ambient air, and discharging this dehumidified air back into the space surrounding the system for a fresh smelling basement or crawlspace.

Another interesting feature of the home flood prevention appliance system relates to the appliance including a controller circuitry, a water actuator control device in communication with the controller circuitry; and a water flow meter. The controller circuitry is configured to receive a flow indication from the water flow meter, and detect leaks in a water distribution system network of a building structure based on the flow indication. The controller circuitry may also control the water actuator control device to turn off a municipal utility water source being supplied.

Another interesting feature of the home flood prevention appliance relates to the appliance including a water flow meter configured to measure a flow of water in a domestic water distribution network system of a home, and a water control device mounted in the structural frame of the system to control a flow of water in a water inlet pipe to the home or other structure based on the measured flow of water.

Another interesting feature of the whole home water protection application system relates to a micro-hydropower generator that may be included in the structural frame. The micro-hydropower generator may be deployed in a liquid line such as municipal water utility supply line so as to be rotated by a flow of water therethrough. The micro-hydro power generator may output AC or DC power to charge an energy storage device such as a battery or capacitor. In addition, or alternatively, the micro-hydro generator may supply power to the controller circuitry, the display and/or other electronic devices included in the system.

FIGS. 43-51, illustrate examples of other embodiments of a home flood prevention appliance (HFPA) system 4300 (also known as DriBot) that includes a three pump configuration with battery backup that is capable of wireless or wireline communication to allow a homeowner user full access and communication. In addition to sump basin evacuation using the triplexed variable speed pumps, the system is also configured to provide flow monitoring and leak detection. Also, the system includes controller circuitry 4330 and an interactive graphical user interface—display screen 4331 to provide a fully automated and self-contained system that can be easily monitored and controlled by a user. Unless otherwise indicated, the features and functionality of the HFPA systems discussed with reference to FIGS. 1-42 are similar. Accordingly, for purposes of brevity the details of these features and functionality may not be fully repeated, and it should be understood that features and functionality are fully interchangeable, combinable, and/or useable in any of the example systems described herein, unless otherwise indicated.

The appliance system 4300 includes multiple pumps 4302 positioned in a lower portion of a structural frame 4304 below a shroud 4306 forming an upper portion of the structural frame. In the illustrated example, three electric pumps are positioned in a sump basin 4308 installed in a floor 4312 of a room, such as a mechanical room of a home and supplied power from a power source that includes an AC power source 4314 and a DC power source 4316. The AC power source 4314, may be for example, 120 VAC or 240 VAC 50/60 hz, and the DC power source may be an energy storage device such as one more batteries. In the illustrated example, the AC power source 4314 is a 120 VAC wall outlet, and the DC power source includes two DC batteries operating as a backup power source. The pumps 4302 may be variable speed pumps 4302. The controller circuitry 4306 may control the magnitude and source of power supplied to the pumps 4302. In other examples, additional or fewer pumps 4302 may be present.

The pumps 4302 may be driven by an electric power source to selectively extract a flow of liquid from the sump basin 4308 in which the lower portion of the structural frame is inserted and discharge the flow of liquid at an outlet. In the illustrated example, each of the pumps 4302 is coupled with a respective outlet line 4320 having a one-way valve 4322, or check valve, to carry liquid to a respective outlet. In other examples, one or more of the pumps 4302 may share at least a portion of a common outlet line to a common outlet.

Figure 51A:
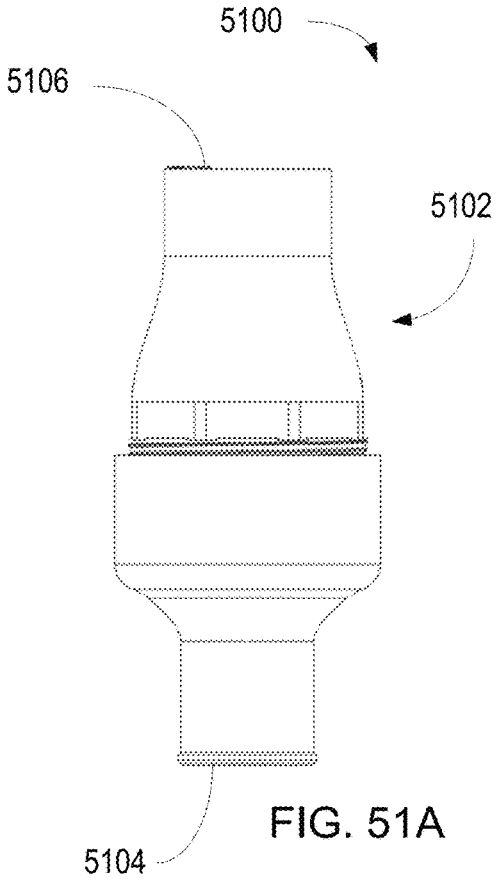
FIG. 51A and FIG. 51B and FIG. 51C depict a perspective view and cutaway side views of an example one-way valve in the HFPA system.
Figure 51B:
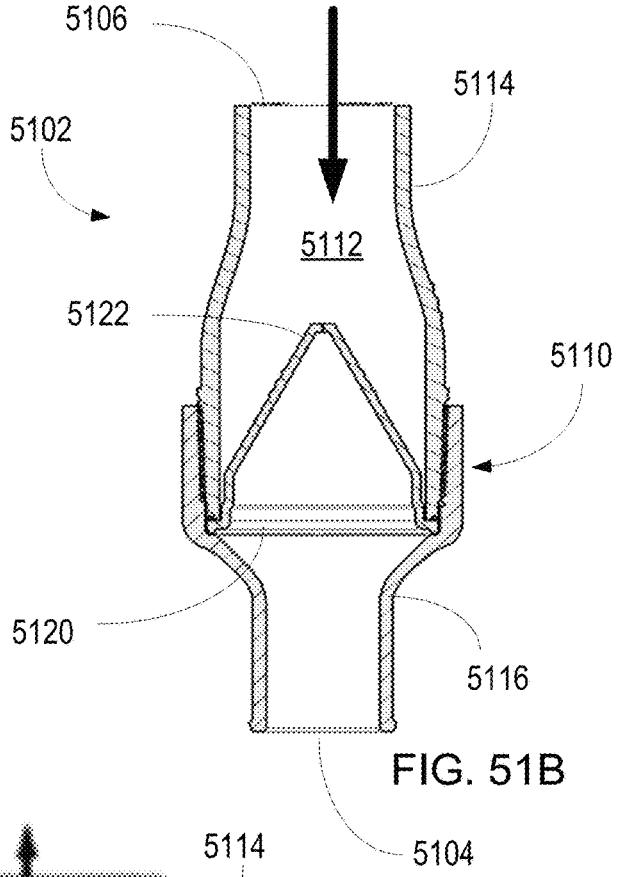
Figure 51C:
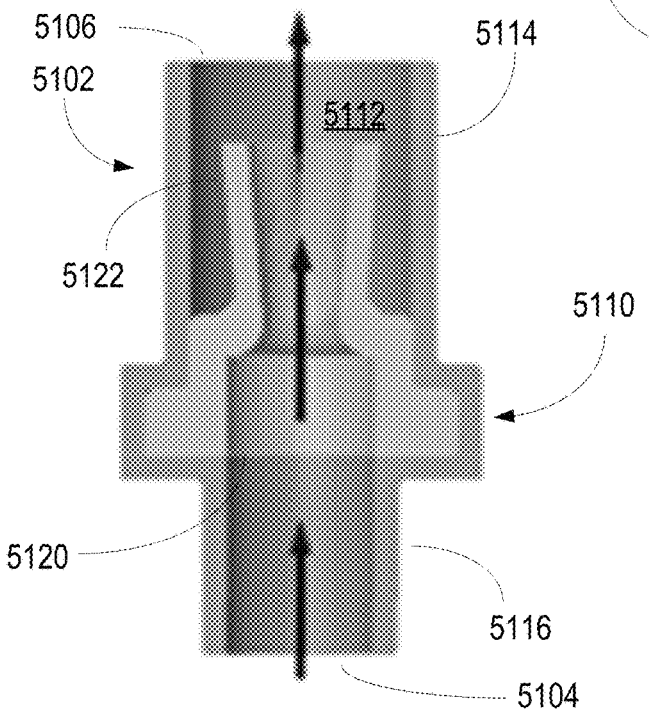

FIG. 51A and FIG. 51B and FIG. 51C depict a perspective view and cutaway side views of an example one-way valve in the HFPA system. The one way valve 5100 includes a housing 5102 having an inlet 5104 and an outlet 5106. A frustoconical valve 5110 is included in a cavity 5112. The cavity 5112 is formed in the housing by a first housing section 5114 coupled with a second housing section 5116 by, for example, friction fit, snap fit, threaded fit, glue or some combination. In the illustrated example, the first h The frustoconical valve 5110 may be formed of rubber, silicone, or some other rigid and flexible material to include an upstream opening 5120 formed as an always open aperture, and a downstream opening 5122 formed as a cone shaped gate, which opens and closes according to the flow of liquid in the one-way valve 5100. The rest position of the downstream opening 5122 is in the cone shape as illustrated in FIG. 51B. The open position as illustrated in FIG. 51C is a position biased by the pressure of liquid flowing in through the one-way valve 5100 from the inlet 5104 to the outlet 5106.

As liquid flows through the inlet 5104 and the upstream aperture 5120, as illustrated by the arrows in FIG. 51C, the pressure provided by the liquid biases the downstream opening 5122 to assume an open position where the cone shape of the downstream opening 5122 becomes substantially cylindrically shaped such that the liquid flows through the one-way valve 5100 to the outlet 5106. When liquid flows in the opposite direction into the outlet 5104, as illustrated in FIG. 51B, the pressure of the liquid on the downstream opening 5122 maintains the downstream opening in the closed resting position.

Referring to FIGS. 43 and 51A, 51B and 51C, the outlet 5106 may be sized to connect a rigid pipe forming a portion of the outlet line 4320*a*. In an example, the outlet 5106 may be friction fit slip connection glued to the portion of the outlet line 4320*a*. In other examples, other connections, such as threaded, may be used to couple the outlet with the outlet line 4320*a*. The inlet 5104 may be connected to a flex pipe 4320*b* forming a portion of the outlet line 4320. The inlet 5104 may include a barbed connection sized to receive the flex pipe 4320*b*. In other examples, hose clamps, snap fittings, threaded fittings or some other disconnectable fittings may be used to couple the inlet 5104 with the flex pipe 4320*b*. The flex pipe 4320*b* may similarly be coupled with a respective pump 4302 in the sump basin 4308.

Figure 52:
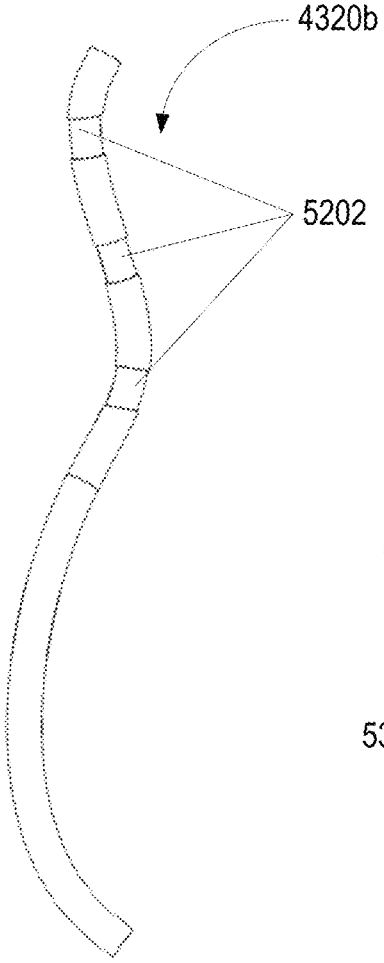
FIG. 52 is an example of a flex pipe included in the HFPA system.

In examples, at least a portion of the outlet lines 4320 may be flex pipe 4320*b* for easy replacement. The flex pipe 4320*b* may be a rigidly malleable pipe, such as a corrugated rigid plastic pipe, capable of being trained into various shapes and angles. FIG. 52 is an example of a flex pipe included in the HFPA system. Each of the pumps 4302 may be connected to a respective one of the one-way valves 4322 through flex pipe 4320*b*, which allows removal and replacement of a defective pump without significant plumbing skills. Todays sump pits don't use flex discharge pipe for the pumps. They use rigid PVC pipe. In the HFPA system 4300, flex pipe 4320*b* may be used because it makes pump repair very simple. If a pump 4302 would fail, the home owner may open an access panel included in the cover 4324 on the sump basin 4308, and pull the pump 4302 up out of the sump basin 4308 with flex pipe 4320*b* still attached to the pump 4302 and the one-way valve 4322. Thus, no disconnection of the pipe 4302 from the outline 4320 while the pump 4302 is positioned in the sump basin 4308 is necessary. Once out of the water in the sump basin 4308, a hose clamp, or other fastener, can be removed, and the pump 4302 easily replaced without the need to cut/glue/fit rigid PVC pipe. In addition, as illustrated in FIG. 52, the flex pipe 4322*b* may have pre-configured smooth severing segments 5202 where the flex pipe can be cut into shorter lengths using a cutting device such as shears. This allows onsite modification of the length of flex pipe 4322*b* to meet the needs of the specific installation. In the example of FIG. 52, the Referring to FIG. 45, a side view of an example installation of a HFPA system 4300 is illustrated. In this example, the system 4300 is installed indoors near an outside wall 4502 of a structure, such as a mechanical room in a basement of a home. One or more drain lines 4504 may provide a source of liquid draining into the sump basin 4308. One or more outlet lines 4320 may extend from the sump basin 4308 vertically along the wall 4502 to emerge from the basement and penetrate the wall 4502 above grade such that an emergency overflow outlet 4506 may be installed. The emergency overflow outlet 4506 is mountable in the outlet line 4320 external to the structure in which the sump basin 4308 is located to provide an emergency flow path for liquid in response to the respective outlet line 4320 being obstructed.

Figure 53:
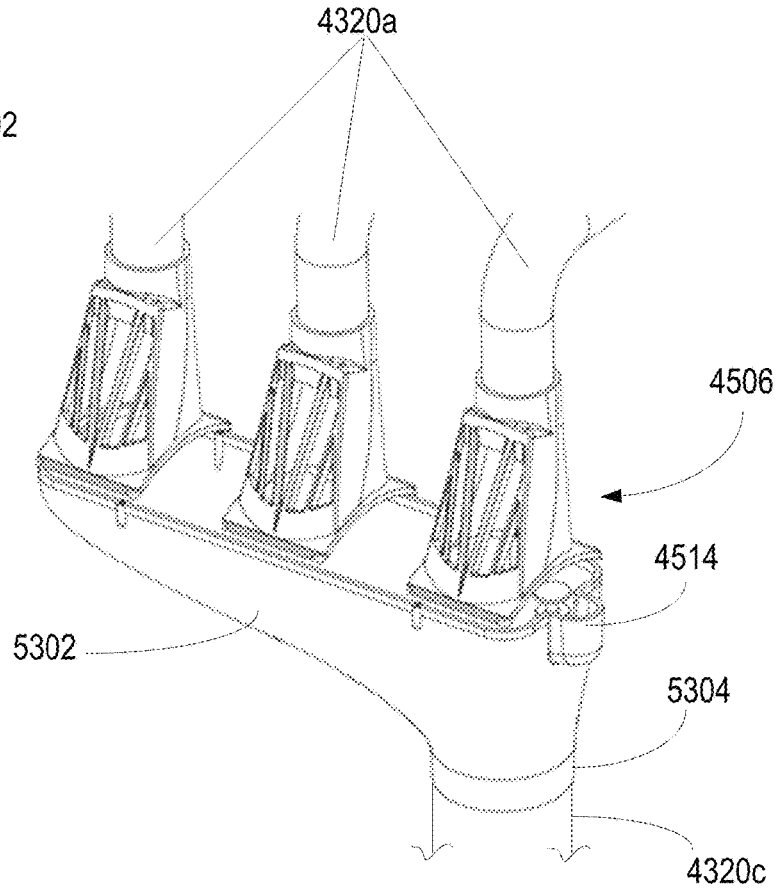
FIG. 53 is a perspective view of an example of emergency flow outlets in an HFPA system.

In an example installation, the emergency overflow outlet 4506 may be mounted above grade 4508 between the portion of the outlet line 4320*a* that extends from the one-way valve 4322 out of the structure, and an outdoors section of the outlet line 4320*c* that extends from the emergency overflow outlet 4506 to a discharge outlet 4510, which may be located in a pond, swale, ditch or other drain feature external to the structure. The emergency overflow outlet 4506 may be positioned as a vertical transition between the portion of the outlet line 4320*a* and the outdoors section of the outlet line 4320*c* such that during a blocked outlet line condition in the outdoor outlet line 4320*c* (downstream of the emergency overflow outlet 4506), when liquid is being discharged through the outdoor outlet line 4320*c*, the liquid may back up vertically and discharge from an aperture 4512 in the emergency overflow outlet 4506. In the absence of a blockage, the liquid flows by gravity through the emergency overflow outlet 4506 below grade 4508 without discharge from the aperture 4512. In an example, the system is configured with a primary pump emergency overflow outlet 4506 that protects the basement from flood if the outdoor pump outlet line 4320*c* becomes clogged, frozen, or blocked. As illustrated in FIG. 53, in other examples multiple emergency overflow outlets 4506 may be used such that each of the outlet lines is equipped with a respective emergency overflow outlet 4506.

Figure 43:
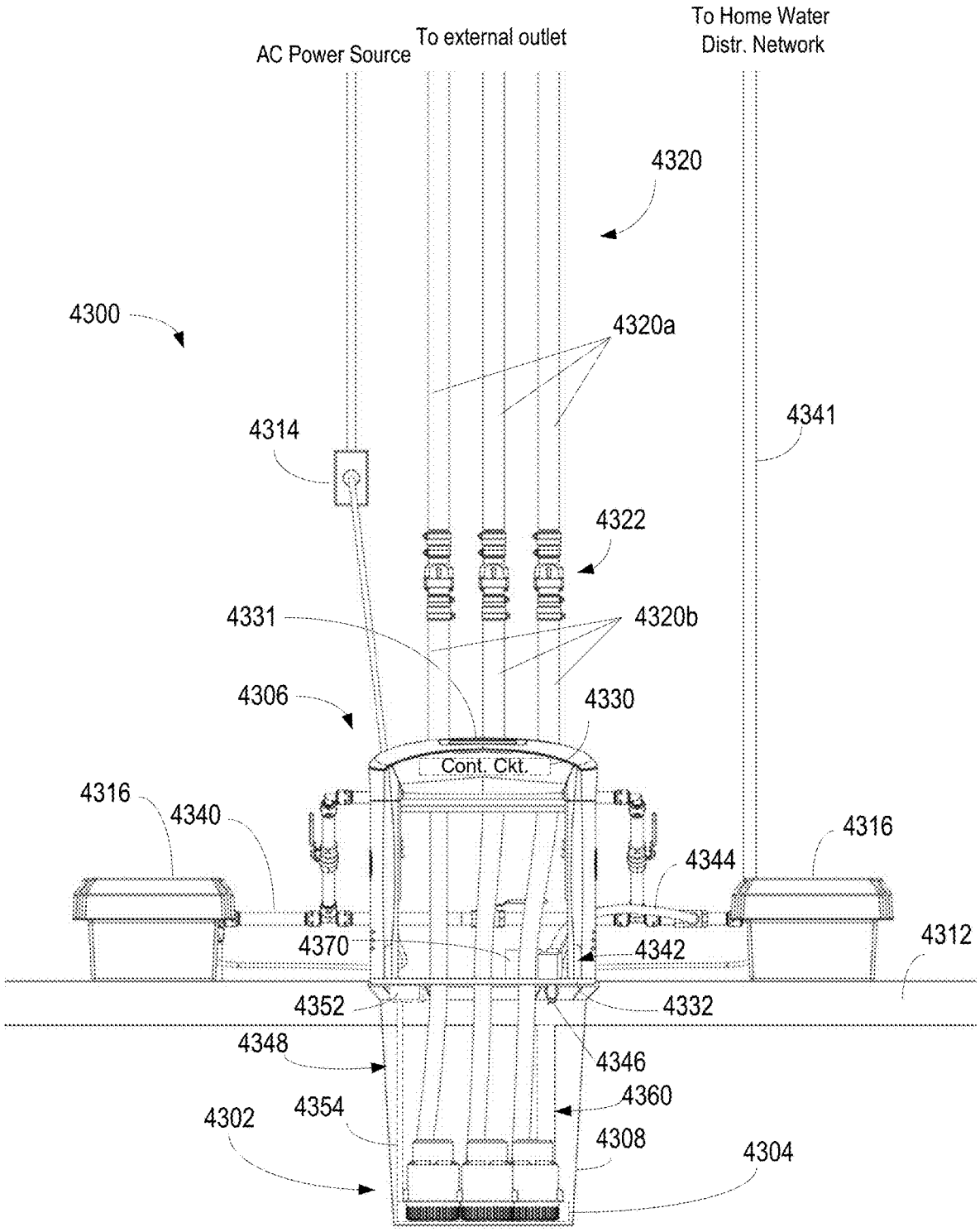
FIG. 43 is a perspective view of an example home flood prevention appliance system.
Figure 45:
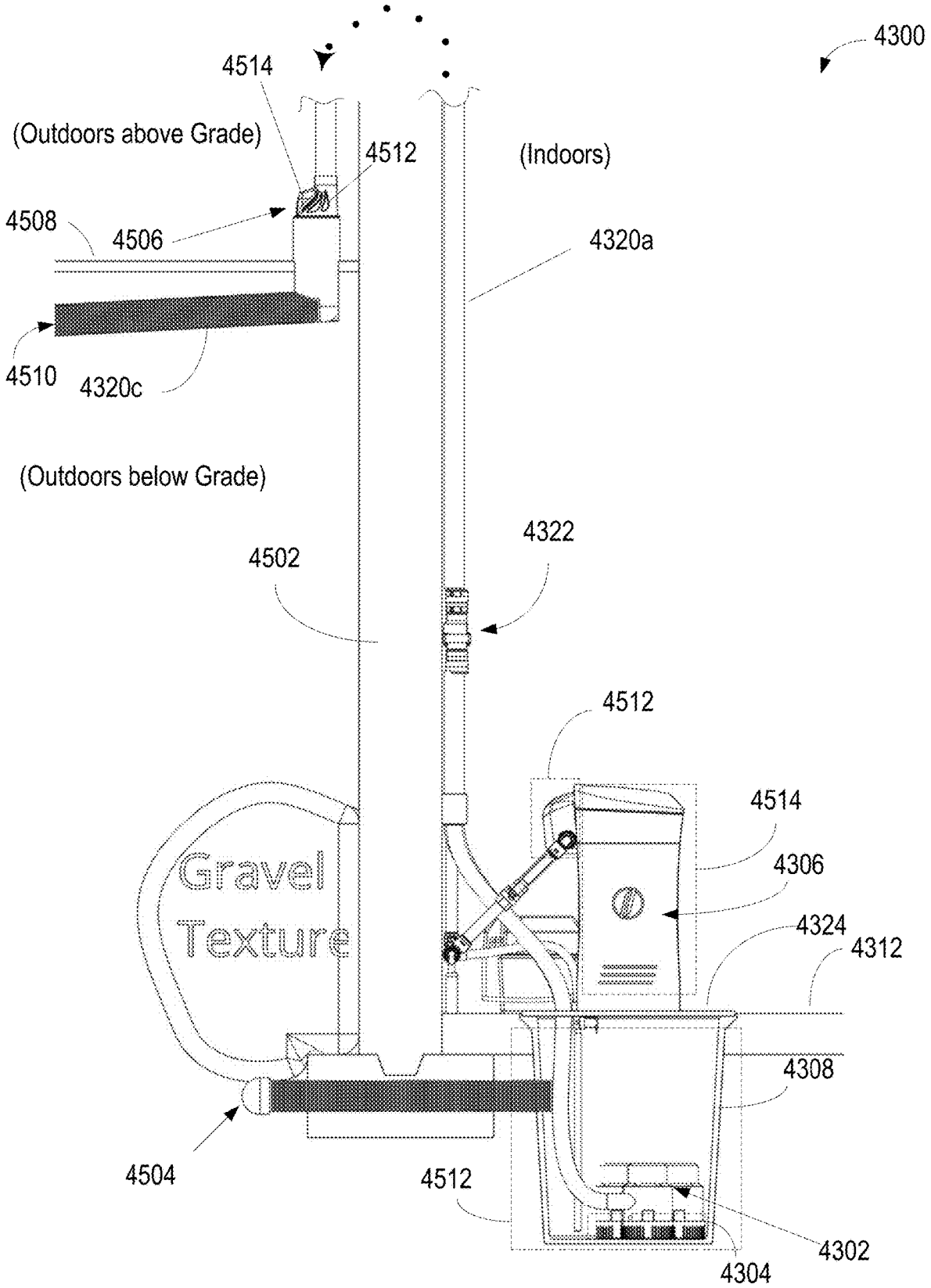
FIG. 45 is a side view of an example installation of a HFPA home flood prevention appliance system illustrated in FIG. 43.

FIG. 53 is a perspective view of an example of emergency flow outlets in an HFPA system. In FIG. 53, three emergency overflow outlets 4506 are coupled with respective portions of the outlet lines 4320*a*, and mounted on a common backflow reservoir 5302. In examples with fewer or greater numbers of emergency overflow outlets 4506, the backflow reservoir 5302 may be sized and configured accordingly. The backflow reservoir 5302 provides a flow path to a reservoir outlet 5304 of the backflow reservoir 5302 coupled with the outdoor portion of the outlet line 4320*c*. Referring to FIGS. 43, 45 and 52, the system also provides alert related functionality for the emergency overflow outlet 4506. Detection of a clogged, frozen or blocked outdoor outlet line 4320*c* may be detected with an emergency bypass sensor, detected by increased current flow of the pumps, and/or back pressure detection of the pumps. As illustrated in FIGS. 45 and 52, an emergency bypass sensor 4514 may detect the flow of liquid through the aperture 4512. In an example, the emergency bypass sensor 4514 may be a float switch inside the backflow reservoir 5302 of the emergency overflow outlet 4506 as illustrated in FIG. 52. The emergency bypass sensor 4514 may be in wireless or wired communication with the controller circuitry 4330. Upon receipt of an overflow signal from the emergency bypass sensor 4514, the controller circuitry 4330 may provide an alarm via wireless message and/or on the display screen 4331. In examples, one or more of the outdoor portion of the outlet lines 4320*c* may be coupled with the reservoir 5302 and have a respective emergency overflow outlet 4506. Thus, each of the pumps 4302 may include a respective reservoir 5302 and emergency bypass sensor 4514 providing alert messages, or common alert messages may be provided for groups of two or more of the respective outdoor portion of the outlet lines 4320*c* and/or respective pumps 4302.

Automatic Pipe Obstruction Determination

Many basements flood not because the sump pump is not operating, but because the pipe that routes pumped water away from the home is frozen or clogged, and there is nowhere for the water to go, except back into the basement, and cause a flood. In the HFPA system 4300, the controller circuitry 4330 may, for example, continuously monitor the discharge pressure of the pump discharge, and if the discharge pressure of any one or more of the pumps 4302 exceeds a predetermined threshold, the controller circuitry 4330 may create an alert message indicating a pipe clog of some type. A corresponding alarm may appear on the display screen 4331 and be transmitted wirelessly to the user. During the discharge pressure exceeding the threshold, the emergency overflow outlet 4506 may operate to allow the water to bypass the normal discharge line, and discharge outside the home in a safe place. The homeowner is alerted that the pipe is clogged via an alert message, and the flood is averted because of the emergency bypass overflow outlet 4506. This gives the homeowner time to go clean out the clogged outlet line 4320 and get operation back to normal.

Figure 44:
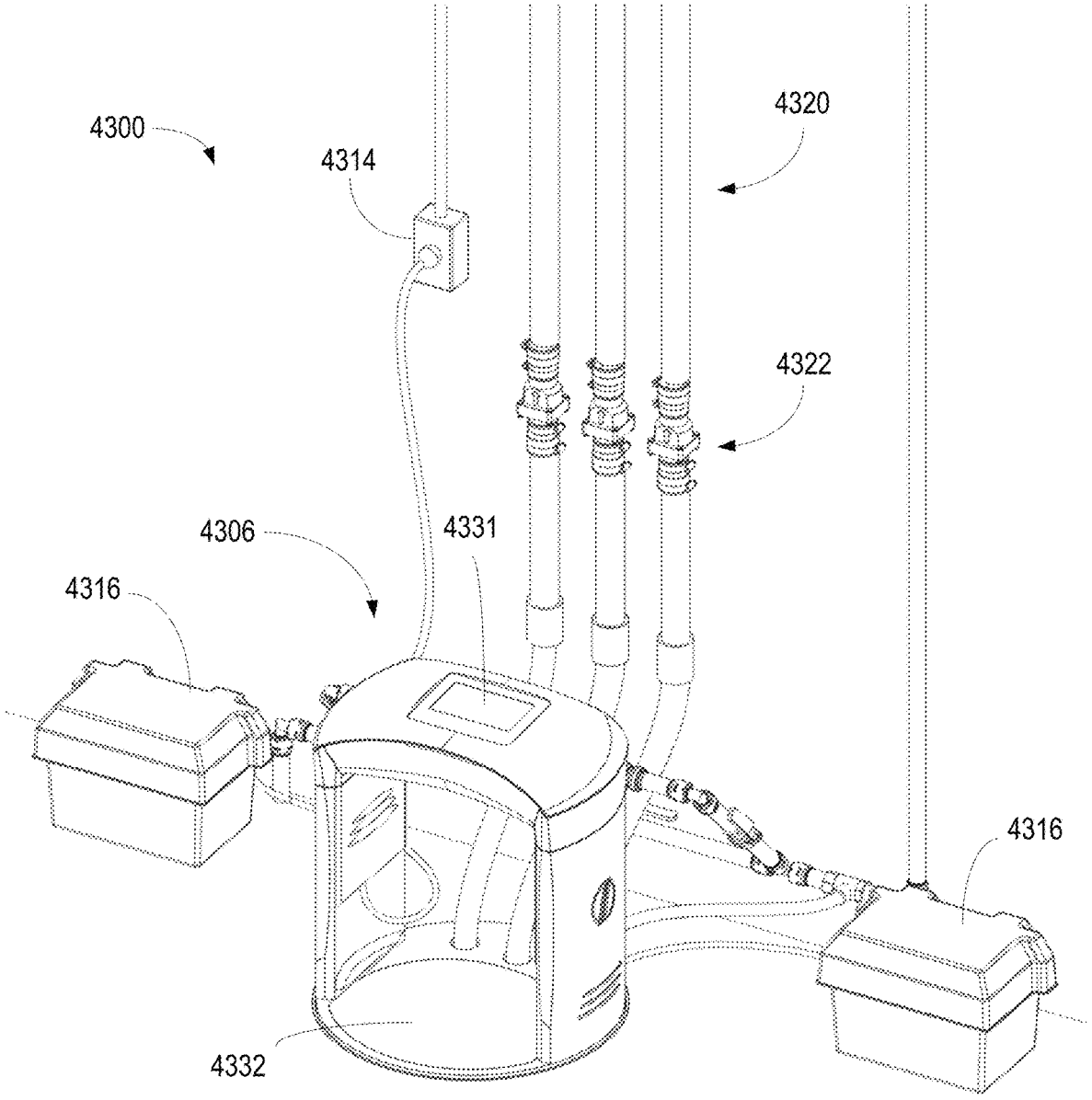
FIG. 44 is a front view of the example home flood prevention appliance system illustrated in FIG. 43.
Figure 54:
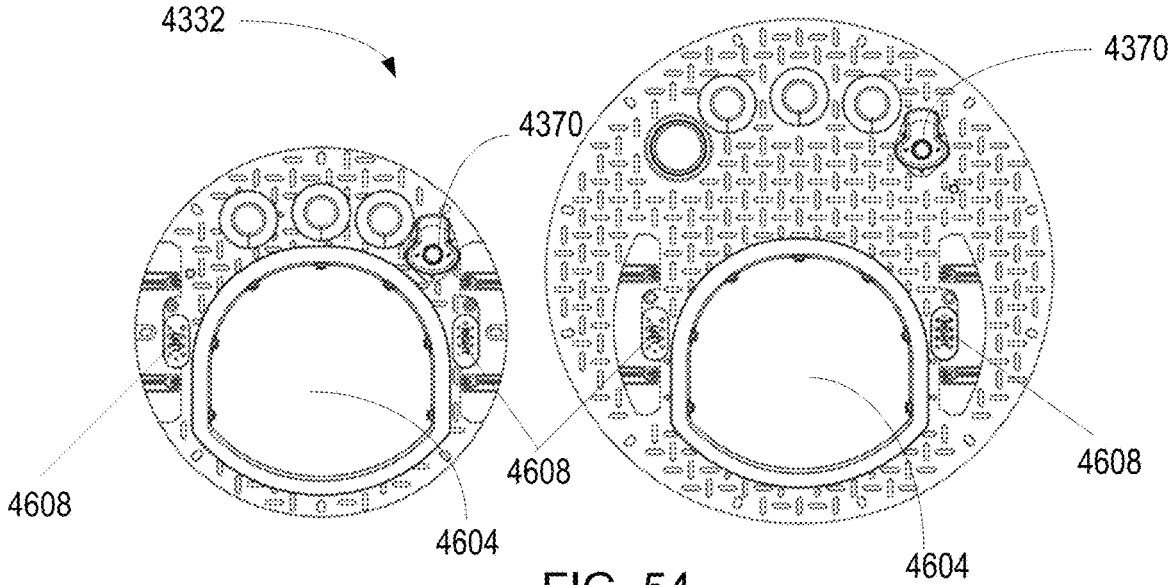
FIG. 54 illustrates examples of a cover in an HFPA system.

With reference to FIGS. 43-45, cooperative operation of the pumps 4302 to evacuate liquid from the sump basin 4308 may be controlled by controller circuitry 4330 included in the shroud 4306. A cover 4332 is configured to cover a top opening of the sump basin 4308 and provides a divider between the controller circuitry 4330 disposed in the shroud 4306 and the pumps 4302 included in the lower portion of the structural frame 4304. FIG. 54 illustrates examples of the cover in an HFPA system. In FIG. 54, the cover 4332 is illustrated as a circular flat planar structure in two different diameters to accommodate two different sized openings into the sump basin 4308.

Referring again to FIGS. 43-45, the HFPA system 4300 includes a wet component 4512 and a dry component 4514 as illustrated in FIG. 45. The wet component 4512 includes the lower portion of the structural frame 4304, which may be removably positioned on a bottom of the sump basin 4308 to maintain the pumps 4302 in a predetermined position with respect to the bottom of the sump basin 4308 and the cover 4332.

Lower Portion of Structural Frame

The lower portion of the structural frame 4304 combines many innovative features into one convenient carrying and positioning device. One feature of the lower portion of the structural frame 4304 is to keep the volute and pump intake off the bottom of the sump basin 4308. A sump pump basin frequently is a collecting point for debris, and the lower portion of the structural frame 4304 keeps the pump up and away from that debris. Another feature of the lower portion of the structural frame 4304, is its wire-frame design which allows debris or sediment present in the water to simply fall through the frame and into the bottom of the sump basin 4308, away from the intake impeller of the pumps 4302. The lower portion of the structural frame 4304 may also keep all parts organized and in place during installation and for the life of the installed system. The HFPA system 4300 has a number of different devices in the sump basin 4308 unlike a traditional sump pump. As described herein, the lower portion of the structural frame 4304 keeps three variable speed pumps 4302, pump discharge flexible hoses, submersible level transducer, and dual back-up float switches all in the correct positions inside the sump basin 4308 for compact and long-term operation. Another aspect of the lower portion of the structural frame 4304 is that it keeps the three variable speed pumps 4302 at a slight angle to help prevent air locking of the pump impeller. This slight angle allows air to escape the impeller volute.

Figure 50:
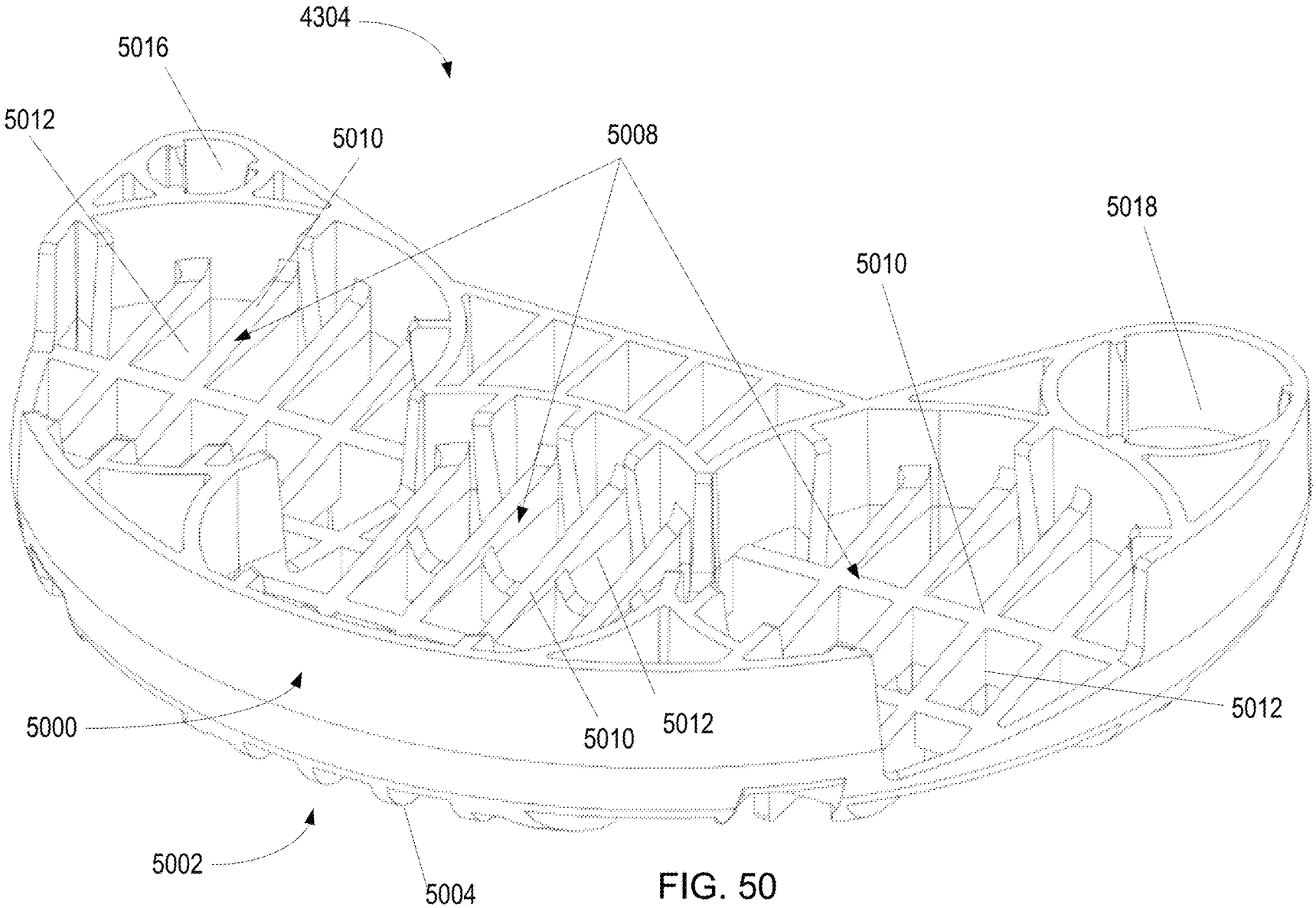
FIG. 50 is a perspective top view of an example lower portion of a structural frame included in the home flood prevention appliance system illustrated in FIG. 43.

FIG. 50 is a perspective front view of an example lower portion of the structural frame 4304. This lower portion of the structural frame 4304 may hold the three pumps in position so that they don't "walk" or otherwise change position during on/off cycles. The lower portion of the structural frame 4304 includes a body 5000 having a lower surface 5002 that includes ridges 5004 that abut the bottom of the sump basin 4308. The ridges 5004 provide channels between the body of the lower portion of the structural frame 4304 and the bottom of the sump basin through which liquid may flow. The body 5000 is formed to include apertures 5008 sized to each receive a respective pump 4302. (not shown) The pumps 4302 may be rigidly held in the respective apertures 5008 by friction fit. A floor 5010 of each of the apertures 5008 may be sloped and include a plurality of slots 5012. An intake of the pumps may be disposed in the apertures 5008, and the slope of the floor 5010 may maintain the intake of each pump angled away from the bottom of the sump basin to avoid the intake being fouled with material settled on the bottom of the sump basin. In an example, the floor 5010 may be sloped at an angle, such as between 12 and 30 degrees with respect to the bottom of the sump basin 4308. The slots 5012 may cooperatively operate with the ridges 5004 to allow the flow of liquid. The body 5000 may also include a level sense holder 5016 sized to receive and rigidly hold at least part of a liquid level system included in the HFPA system 4300. The liquid level system may perform primary level sensing in the HFPA system 4300 and provide at least one electric signal indicative of a liquid level in the sump basin 4308 to the controller circuitry 4330. In addition, the body 5000 may include a backup level system holder 5018 sized to receive and rigidly hold at least a portion of a backup level system included in the HFPA system 4300.

Figure 55:
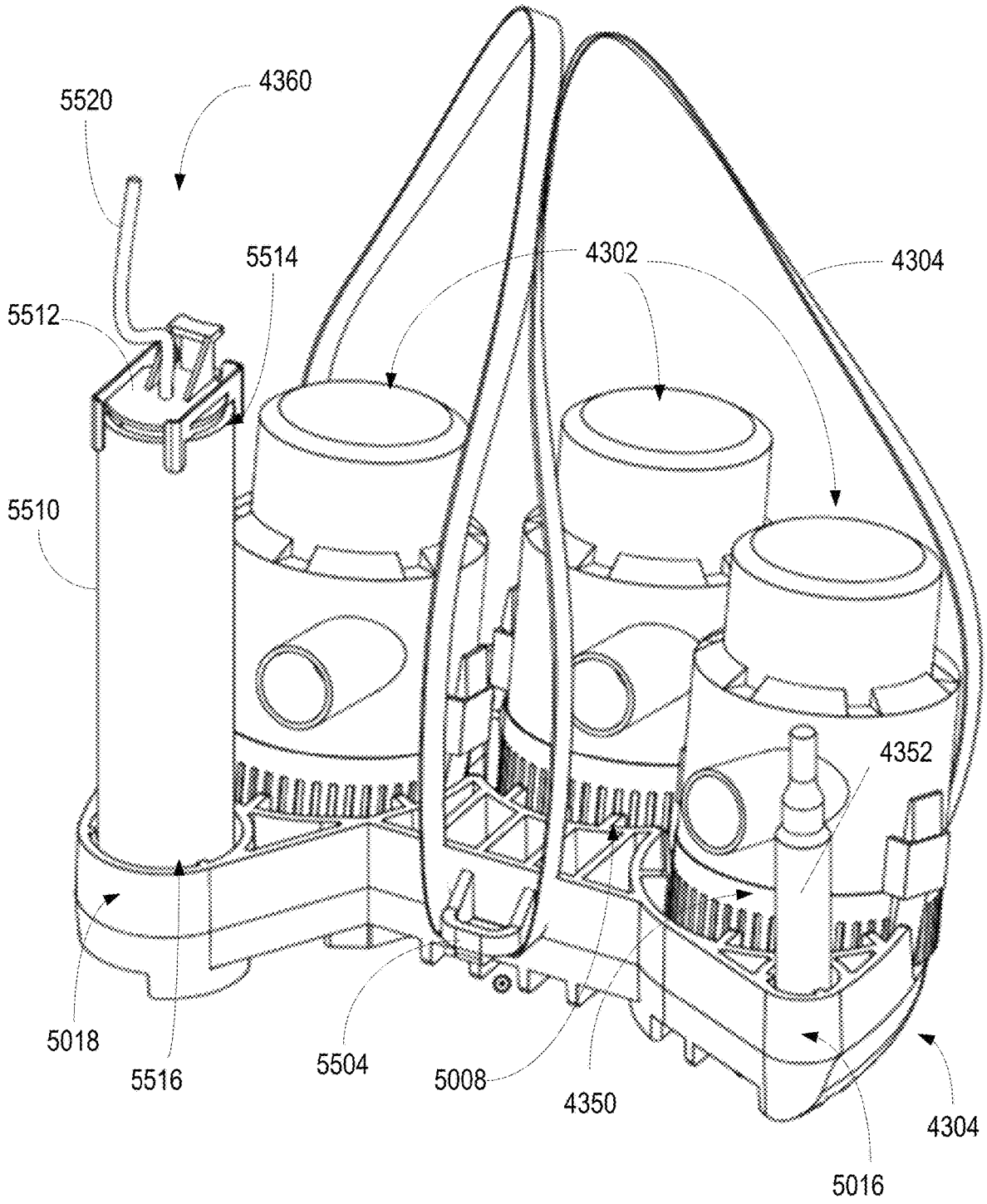
FIG. 55 is a perspective rear view of an example of a lower portion of the structural frame in an HFPA system.

FIG. 55 is a perspective rear view of an example of the lower portion of the structural frame 4304. In FIG. 55, the pumps 4302 are illustrated as positioned in the apertures 5008, at least a portion of the liquid level system 4350 is depicted as positioned in the level sense holder 5016, and at least a portion of a backup liquid level system 4360 is shown as positioned in the backup level system holder 5018 of the lower portion of the structural frame 4304. Also illustrated in FIG. 55 is a handle 5502.

The handle 5502 may be a flexible strap such as a plastic strap that may be used to hoist the lower portion of the structural frame 4304 into and out of the sump basin 4308. The handle 5502 may be detachably coupled with flanges 5504 positioned on the lower portion of the structural frame 430 to balance and maintain the lower portion of the structural frame 4304 upright when hoisted. In examples, the handle 5502 may be a continuous loop strap used at the time of installation to position the lower portion of the structural frame 4304 in the sump basin 4308. The continuous loop strap may be threaded through the flanges 5504 such that the strap may be cut and withdrawn from the flanges once positioning of the lower portion of the structural frame 4304 in the sump basin 4308 is complete.

Primary Liquid Level Sensing

The illustrated at least a portion of the liquid level system 4350 may be a primary level sensing system relied upon by the controller circuitry 4330. The liquid level system 4350 may include a pressure sensor 4352. The pressure sensor 4352 may be, for example, fully submersible in the sump basin 4308. In FIG. 55, the pressure sensor 4352 is detachable positioned in the level sense holder 5016. The pressure sensor 4352 may be an extremely sensitive pressure sensor capable of measuring a pressure differential between the vicinity of the bottom of the lower portion of the structural frame 4304 and atmospheric pressure. Thus, calibration of the pressure sensor 4352 may be accurate at any given location above sea level. A continuous dynamically changing electric signal, such as an analog 4-20 ma signal may be provided wirelessly, or via a wired connection to the controller circuitry 4330. The electric signal may be provided in a flexible wire conduit and/or wire so that removal or installation of the lower portion of the structural frame 4304 may occur with the pressure sensor 4352 electrically connect to the controller circuitry 4330 and installed in the level sense holder 5016. The controller circuitry 4330 may use the electric signal as the primary indication for the liquid level in the sump basin 4308 and control the operation of the pumps 4302 and the corresponding level of the sump basin 4308 accordingly.

In another example system 4300, with reference to FIGS. 43 and 55, the liquid level system 4350 may operate as the primary liquid level sensing system and include a level sensor 4352 and a pressure tube 4354 disposed in the sump basin 4308. The level sensor 4350 may be, for example, a pressure sensor that is not submerged in the sump basin 4308 and provides a pressure signal to the controller circuitry 4330 that is representative of a continuous and dynamic level of the liquid in the sump basin 4308. The level sensor 4352 of this example system 4350 may mounted near the cover 4332 position to monitor pressure in the pressure tube 4354. The pressure tube 4354 may extend from the level sensor 4352 to the lower portion of the structural frame 4304. The pressure tube 4354 may be detachably mounted in the level sense holder 5016. In an example, the level sensor 4352 may be an extremely sensitive pressure sensor such that the controller circuitry 4330 always knows the precise water level of the sump basin 4308 due to the pressure in the pressure tube 4352.

The controller circuitry 4330 may control the level in the sump basin 4308 based on the pressure sensed by the liquid level system 4348. When the water in the sump basin 4308 reaches predetermined start/stop points, the controller circuitry 4306 may automatically start/stop the pump(s) 4308, keeping the home dry. The liquid level system 4348 is easily field replaceable if it would ever fail. Also, the controller circuitry 4330 may automatically recalibrate the liquid level sensing system 4350, for example at predetermined intervals.

In an example, when recalibrating, the controller circuitry 4330 may energize the pumps 4302 to draw down the water level in the sump basin 4308 to a minimum level. The minimum level may be as low as the pumps 4302 can draw down the level, and/or below the bottom exit of the pressure tube 4352. While level is at minimum, such as when the pressure sensor 4352 or the end of the pressure tube 4354 is exposed to atmosphere, the controller circuitry 4330 may establish the pressure reading as a zero level thereby performing a level sensor self-calibration. For example, the controller circuitry 4330 may determine the sump basin 4308 is at a minimum level by running the pumps to a cavitation level, and detecting cavitation has been achieved by monitoring pump current (Amp) draw, Back-Up Liquid Level System The backup liquid level system 4360 may be a backup level control system that does not rely on the controller circuitry 4330 for functionality or operation. In the event that the primary liquid level system 4350, or the controller circuitry 4330 ever failed, the HFPA system 3300 may rely on the back-up liquid level system 4360 to maintain an appropriate level in the sump basin 4308. In an example, the backup liquid level system 4360 may be equipped with the previously discussed back-up float switches which include multiple floats. For peace of mind, the redundancy of the system's controls exceeds most industrial and municipal pump control systems.

Referring again to FIG. 55, an example of the backup liquid level system 4360 includes a housing 5510 detachably mounted in the backup level system holder 5018 of the lower portion of the structural frame 4304. In an example, the backup liquid level system 4360 may include dual back-up float switches positioned in the housing 5510 on a frame 5512. The frame 5512 is coupled with an upper end 5514 of housing 5510 opposite a lower end 5516 of the housing 5510 fixedly positioned in the backup level system holder 5018 by friction fit. Signal(s) indicative of level may be provided on a backup level signal line 5520.

Figure 56:
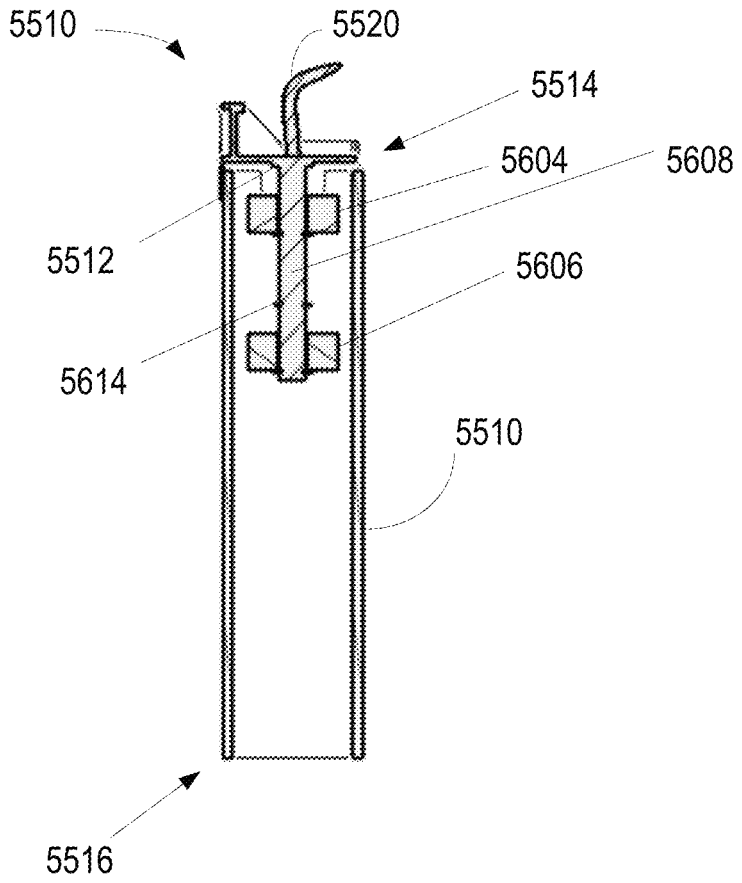
FIG. 56 is a cutaway perspective view of the housing in an HFPA system.

FIG. 56 is a cutaway perspective view of the housing in the HFPA system of FIG. 55. The housing 5510 includes dual floats 5602 in the form of a first float 5604 mounted above a second float 5606 which are slidaby vertically mounted on a post 5610. The post 5608 is coupled with the frame 5512 mount at the upper end 5514 of housing 5510. The each of the first and second floats 5604 and 5606 may float up and down the post 5608 with the level of the liquid in the housing 5510. A maximum height stop 5612 of the first float 5604 may be at the frame 5512. A maximum height stop 5614 of the second float 5606 may be also be the minimum height of the first float 5604. When either the first float 5604 or the second float 5606 reach their maximum height, or travel distance due to rising liquid in the sump basin, the respective magnets present in the first and second floats 5604 and 5606 may magnetically actuate sensors included in the post 5608. The sensors may be hall effect sensors, micro switches or some other form of sensor capable of indicating the respective first and second floats 5604 and 5606 have reached a maximum level, as previously discussed.

The level signals provided on the level signal line 5520 may directly energize a respective one of the pumps 4302 as first and second backup pumps in the event the primary pump 4302 and/or the controller circuitry 4330 fails to operate. Thus, as the level of liquid in the sump basin 4308 rises, the first backup pump and the second backup pump will be sequentially energized to run at full rated speed by the level signals provided on the level signal line 5620. The first and second backup pumps may be assigned from among the triplexed pumps 4302 by hardwiring each of the sensors to a different respective contactor or circuit breaker supplying power to a respective assigned pump. The maximum level threshold of the first and second floats 5604 and 5606 may be set based on the height of the upper end 5514 of the housing 5510 above the bottom of the sump basin 4308 when the lower portion of the structural frame 4304 containing the housing 5510 is positioned in the sump basin 4308. In an example, the housing 5510 may be a cut able material, such as PVC pipe which can be cut to an appropriate height to set the first and second level thresholds in accordance with the position of the lower portion of the structural frame 4304 in the sump basin 4308.

Algae Control System

Referring again to FIG. 43, the HFPA system 4300 may include an algae control system 4370 controlled by the controller circuitry 4330. The algae control system 4370 may be mounted outside the sump basin 4308 on the cover 4332, as also illustrated in FIG. 54.

Figure 57:
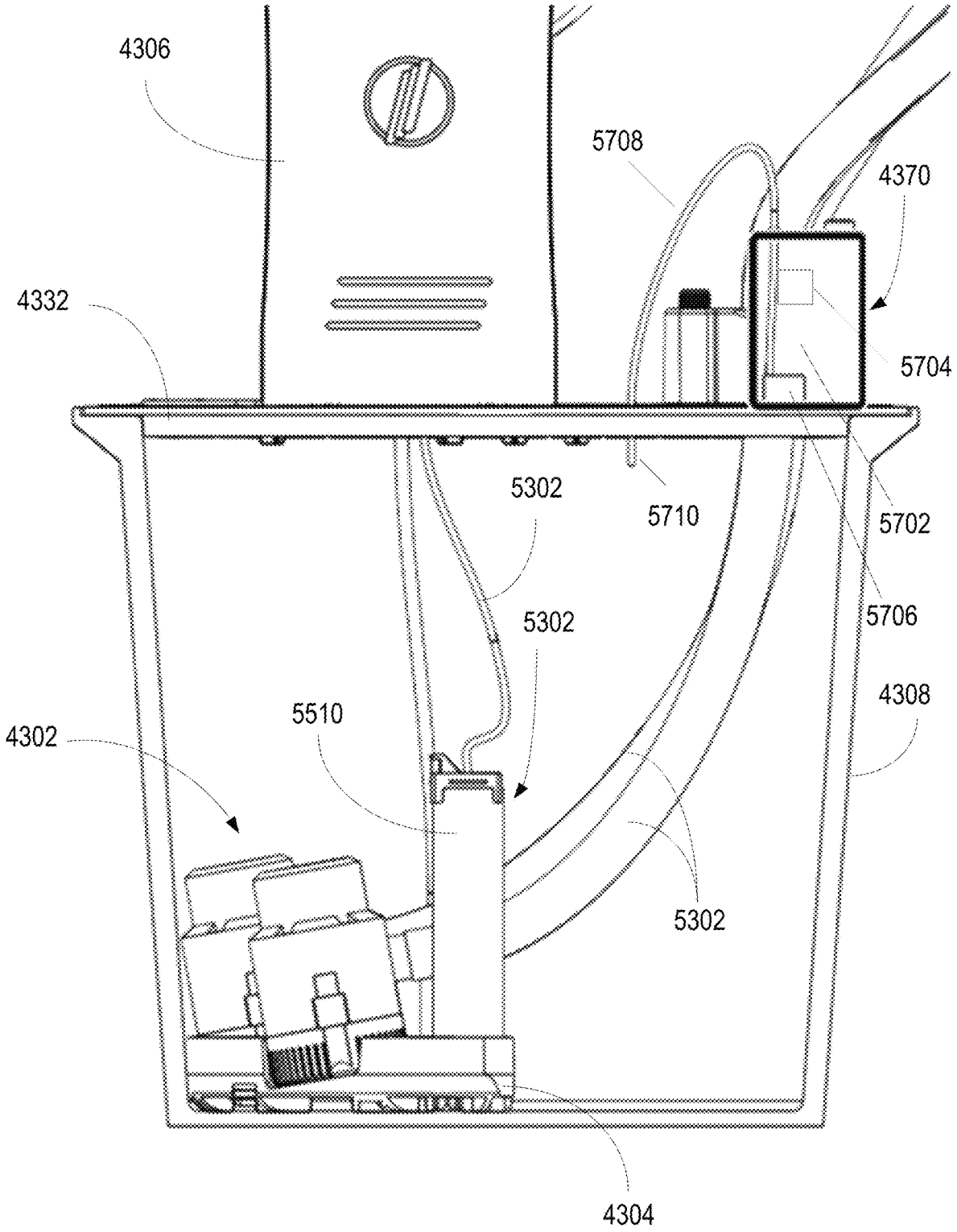
FIG. 57 is a partially cutaway side view of a HFPA system.

FIG. 57 is a partially cutaway side view of an HFPA system 4300. In FIG. 57, a portion of the shroud 4306, and a cutaway side view of the sump basin 4308, the cover 4332 and the algae control system 4370 positioned on the cover 4332. The algae control system 4370 may include a reservoir 5702A, an electrically actuated valve 5704, an injection pump 5706, an algaecide supply line 5708 and a nozzle 5710 positionable to direct an algaecide stored in the reservoir 5702 into the sump basin 4308. The algaecide supply line 5708 may be routed through the cover 4332, such that the nozzle 5710 is positioned inside the sump basin 4308. The nozzle 5710 may be a spray nozzle to direct the flow of algaecide in predetermined direction(s), or may be a drain outlet of the algaecide supply line 5708.

The controller circuitry 4330 is configured to automatically activate the algae control system 4370 to inject an algaecide, such as hydrogen peroxide into the sump basin 4308 on a predetermined schedule and/or based on a user request received via the display screen 4331. Iron algae, or iron bacteria, is a red colored, slimy substance which can build-up in the piping and basin of a sump pump system if it's located in a geography with an iron bacteria issue. This substance can create an aggressive build-up on pipes, float switches, and pumps, such that, over time this build-up can cause float, instrument, and pump malfunction if left untreated simply due to the thickness of the buildup clogging and obstructing devices. The HFPA system 4300 can combat iron algae buildup, by injecting an algaecide, such as a diluted hydrogen peroxide solution, directly into the sump basin 4308 via the nozzle 5710. Hydrogen peroxide included in the reservoir holding tank 5702 may be maintained at a user adjustable concentration and volume.

Referring to FIGS. 43 and 57, based on a user command or a predetermined schedule, such as once per month (or as needed), the controller circuitry 4330 may energize the injection pump 5706 and direct the electrically actuated valve 5704, such as a dual port solenoid valve, to open one port A which opens the reservoir 5702 to atmosphere, and another port which allows algaecide to be injected into the sump basin 4308 via the algaecide supply line 5708 and the nozzle 5710. In another example system, the injection pump 5706 may be omitted and the valve 5704, the algaecide supply line 5708 and the nozzle 5710 may be arranged to provide a gravity feed of algaecide into the sump basin 4308 when actuated. The controller circuitry 4330 may then fill the sump basin 4308 with fresh water by activating a level test actuator 4342, which introduces fresh water, such as from a domestic water supply system into the sump basin 4308. The fresh water may be supplied from the domestic water supply system via a level test supply line 4344.

The water supplied by the level test actuator 4342 is mixed with the hydrogen peroxide into a bath which covers all components in the sump basin 4308 with a diluted solution of hydrogen peroxide and water, and that solution is allowed to set for a user adjustable amount of contact time. Alternatively, or in addition, the algae control system A may activate the injection pump A to spray hydrogen peroxide into the sump basin 4308 via one or more of the nozzles A. During the contact time, the disinfecting agent in the hydrogen peroxide kills the iron algae bacteria. Following the contact time, the sump basin 4308 is pumped down by the controller circuitry 4330 energizing one or more of the pumps 4302. The controller circuitry 4330 may again energize the level test actuator 4342 to refill the sump basin 4308 with clean water only, and energize the pump(s) 4302 to evacuate the sump basin 4308 and remove trace amounts of hydrogen peroxide which can be corrosive if allowed to remain in contact with exposed metal parts. The hydrogen peroxide is direct injected via the nozzle 5710 through the cover 4332 of the sump basin 4308, and not into the level test actuator 4342 or the level test supply line 4344 to eliminate the need for an expensive backflow preventer on the level test line 4344.

Dry Component

Referring again to FIG. 45, the shroud 4306 forming the upper portion of the structural frame is included in the dry component 4514. The dry component 4514, containing the controller circuitry 4306, may be separated from the wet component 4512 by the cover 4332.

Figure 46:
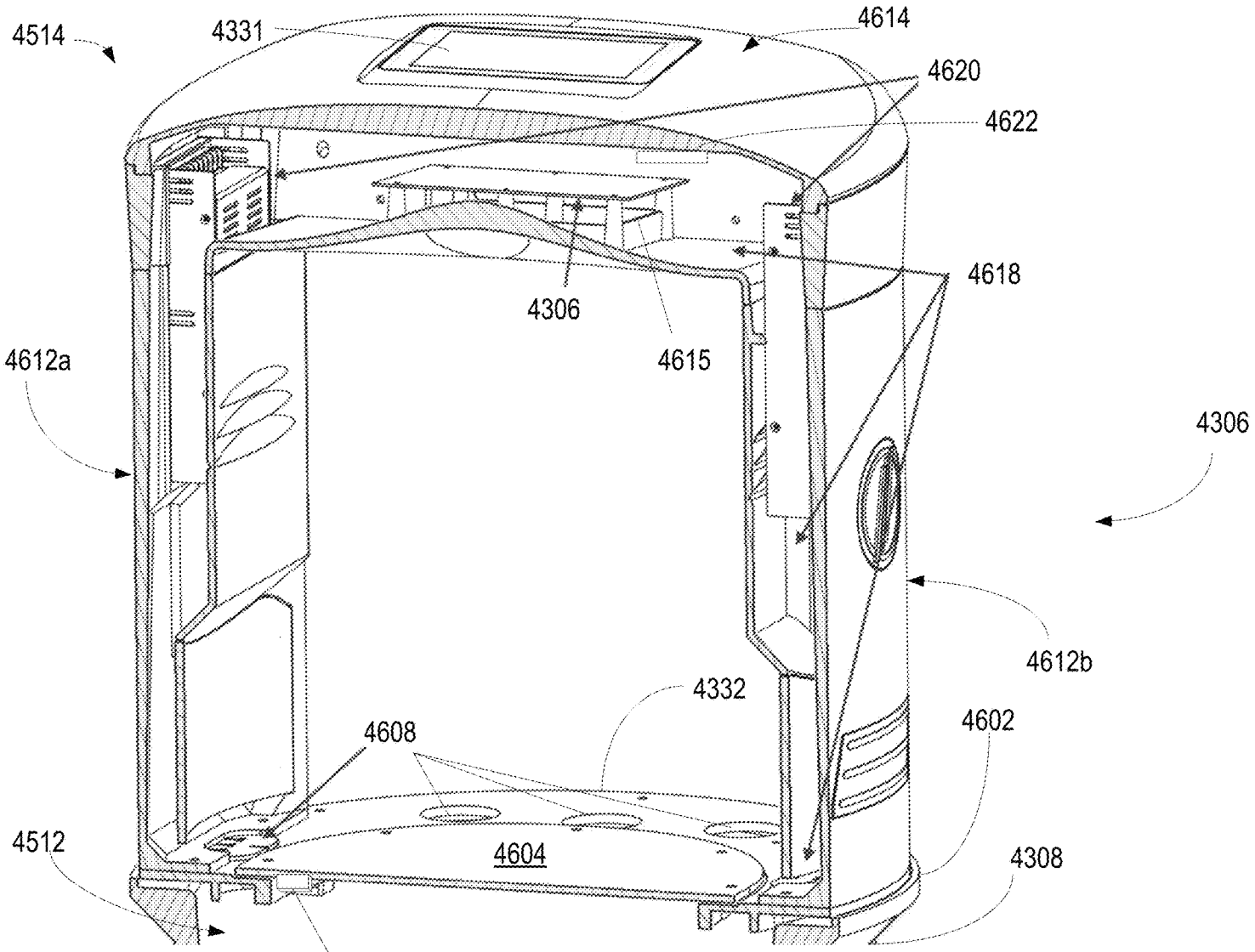
FIG. 46 is a cutaway side view of an example of a dry component of a home flood prevention appliance system.

FIG. 46 is a cutaway side view of an example of a dry component 4514 of a home flood prevention appliance system 4300. The illustrated dry component 4514 depicts the shroud 4306 positioned on the cover 4332 external to the sump basin 4308. Referring to FIGS. 43-46, the cover 4332 may have opposing planar surfaces and be sized for receipt and sealing of an opening to the sump basin 4308. In the illustrated example, cover 4332 is a circular shape that fits within a lip 4602 formed in the sump basin 4308 to form a seal therebetween. The cover 4332 may include a transparent panel 4604. The cover 4332 is therefore at least partially transparent such that at least a portion of the interior of the sump basin 4308 is viewable through the at least partially transparent cover. The cover 4332 may also include one or more seals 4608. The seals 4608 may be a flexible material that provides a liquidtight seal around conductors routed between the dry component 4514 and the wet component 4512.

The shroud 4306 includes space apart legs 4612*a* and 4612*b* abutting the planar surface of the cover 4332 at a lower end, or first end, of the legs 4612*a* and 4612*b*. The shroud 4306 also includes an electronics enclosure 4614 formed in the shroud 4306 at an upper end, or second end, of the legs 4612*a* and 4612*b*. In this configuration, the first and second legs 4612*a* and 4612*b* extend between the cover 4332 and the electronics enclosure on opposite peripheral edges of the cover 4332, and opposite ends of the transparent panel 4604, as also illustrated in FIG. 54. Thus, the electronics enclosure 4614 and the legs 4612 form an arch positioned above the cover 4332 so as to provide a vertical opening surrounded by the shroud and the cover 4332. The transparent panel 4604 is positioned in the cover 4332 such that a user positioned in from the sump basin will have a line of sight through the opening and the transparent panel 4604 into the interior of the sump basin 4308.

The controller circuitry 4306 may be included in the electronics enclosure 4614, as well as circuitry 4615 such as communication circuitry, I/O circuitry, memory, and other electronic items, electrical items and other items maintained in isolation from liquid in the dry component 4514. In addition, the display screen 4331 may be included in the dry component 4514. The display screen 4331 may be a touch screen graphical user interface mounted in the shroud 4306 to form part of the electronics enclosure 4614.

Figure 48:
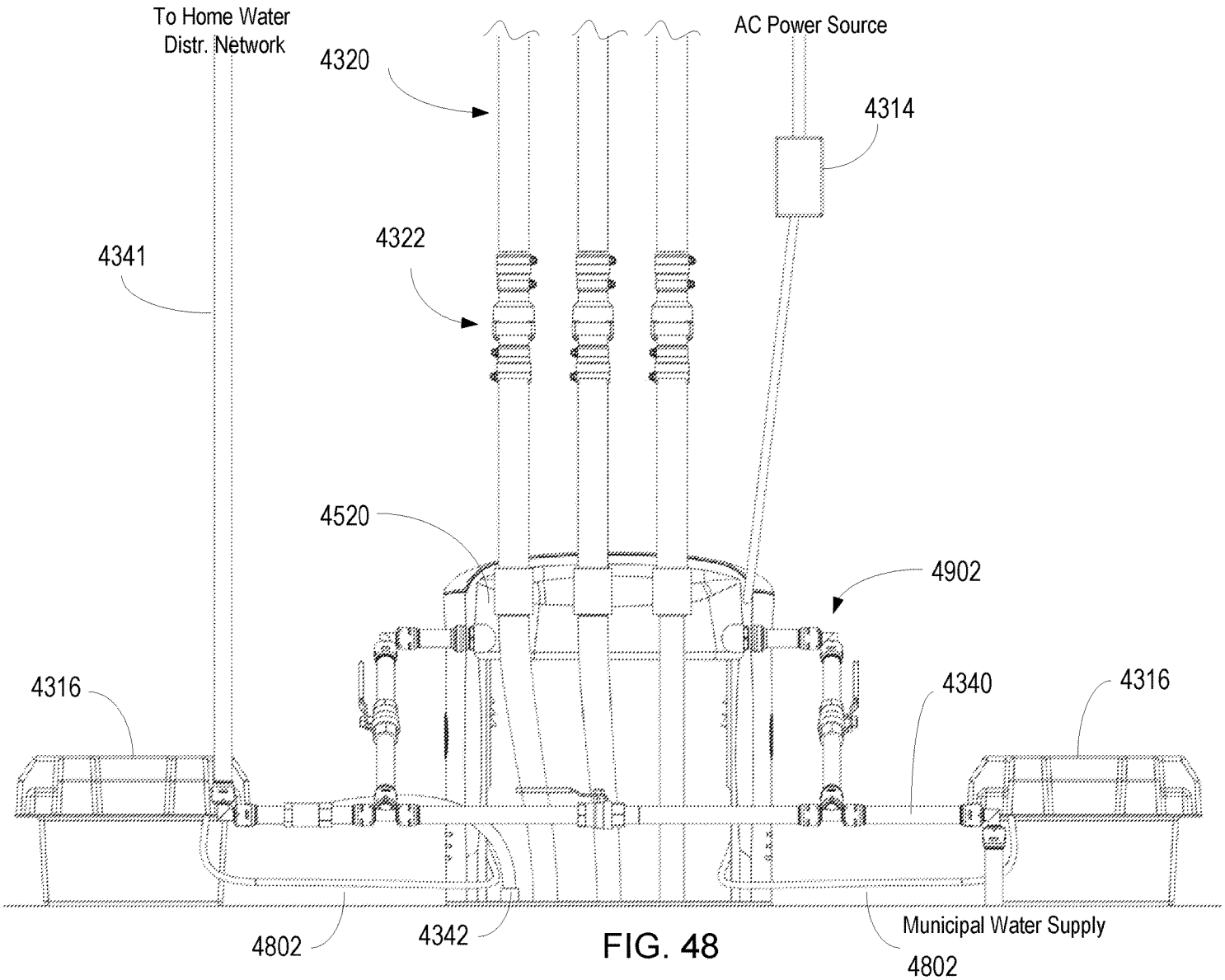
FIG. 48 is a rear view of the example home flood prevention appliance system illustrated in FIG. 43.
Figure 49:
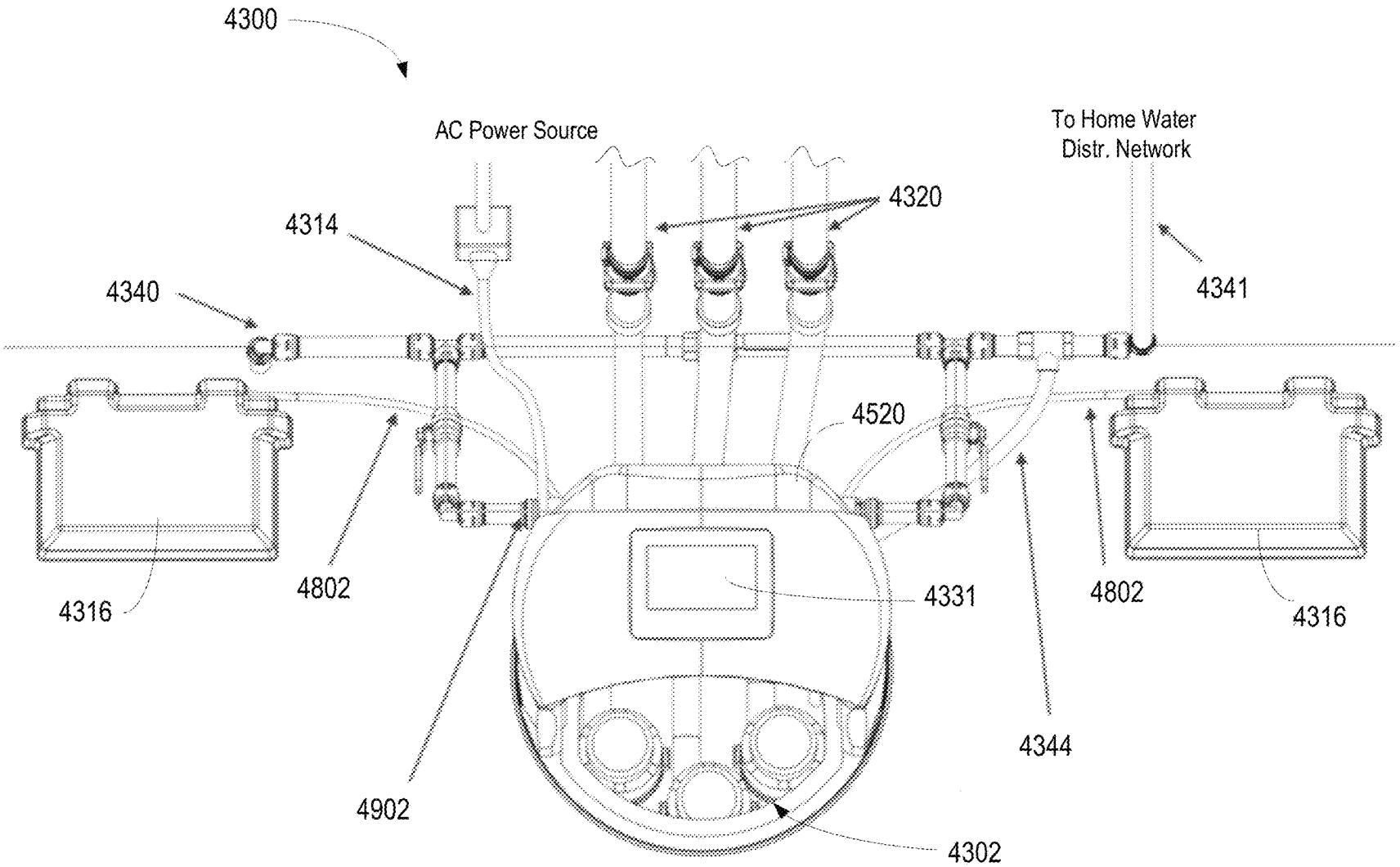
FIG. 49 is a perspective top view of the example home flood prevention appliance system illustrated in FIG. 43.

Each of the legs 4612 may include routing passages 4618 for conductors that are routed through the seals 4608 into the sump basin 4308. Such conductors may include power cables and signal cables. Referring to FIGS. 48 and 49, power cables 4802 may be routed from the DC power sources 4316 into the legs 4612. Referring again to FIG. 46, the power cables may be routed in different routing passages 4618 in the legs 4612 from signal cables. In an example system, each of the cables may be terminated in a quick disconnect connector, which is uniquely colored and/or sized for a corresponding power or signal functions. Corresponding uniquely colored and/or sized quick disconnect connectors may be coupled with corresponding power and signal cables on the lower portion of the structural frame 4304. The corresponding power and signal cables may be prerouted on the lower portion of the structural frame 4304 to devices such as the pumps 4302, portions of the liquid level system 4360 and the back-up liquid level system 4370 and the like that are on the lower portion of the structural frame 4304. During installation, the quick disconnect connectors on the lower portion of the structural frame 4304 may be fed through the seals 4608 into the legs 4612. Thus, the mated quick disconnect connectors may be stored in the routing passages 4618 in the dry component 4514, away from the liquid in the sump basin 4308.

First and second DC power supplies 4620 may also be positioned in the legs 4612. The first and second DC power supplies 4620 may be AC to DC power converters that are each independently capable of supplying regulated variable DC output power to the pumps 4302. In addition, the first and second DC power supplies 4620 may be controlled by the controller circuitry 4306 to charge the DC power source 4316. Each of the DC power supplies 4620 may, for example, be sized to be capable of independently providing full load DC power simultaneously to all the pumps 4302 and charge the DC power source 4316 so as to provide fully redundant power sources. In alternative examples, the controller circuitry 4306 may selectively power the pumps 4302 and charge the DC power source 4316 as operating conditions permit. For example, during times when all of the pumps 4302 are needed at full pumping capacity to evacuate the sump basin 4308, the controller circuitry 4306 may not provide power from the DC power supplies 4620 to recharge the DC power source 4316. In another example, during times when all of the pumps 4302 are needed at full pumping capacity to evacuate the sump basin 4308, the controller circuitry 4306 may supply power from both the DC power supplies 4620 and the DC power source 4316 to the pumps 4302 in order to operate the pumps at full rated operation.

Backup Power

Battery/power source switching/routing—the system may use two backup deep discharge batteries, such as sealed lead-acid marine batteries, as the DC power source 4316, and/or high density lithium (or other chemistry) batteries as a backup DC power source 4316 to operate the pumps 4302 and domestic water shutoff valve during AC power loss. The controller circuitry 4330 controls an intelligent backup battery switching and charging circuit that allows any of the three pumps 4302 and the smart meter 4702, including the domestic water shutoff valve 4706, to run from either of two different backup DC power sources 4316, and any of these devices can be run from either of two internal high amperage DC power supplies 4620. The advantage of this is that there is not a single point of failure. If a system DC power supply 4620 would fail, any/all pumps/valve can operate from the remaining DC power supply 4620. This same situation applies for the backup DC power source 4316. If a single DC power source 4316, such as a battery, would fail, the pumps 4302 can automatically switch and operate from the remaining DC power source 4316. When the failure is repaired, the pumps 4302 can again work from both the DC power supplies 4620 and the DC power sources 4316.

Figure 64:
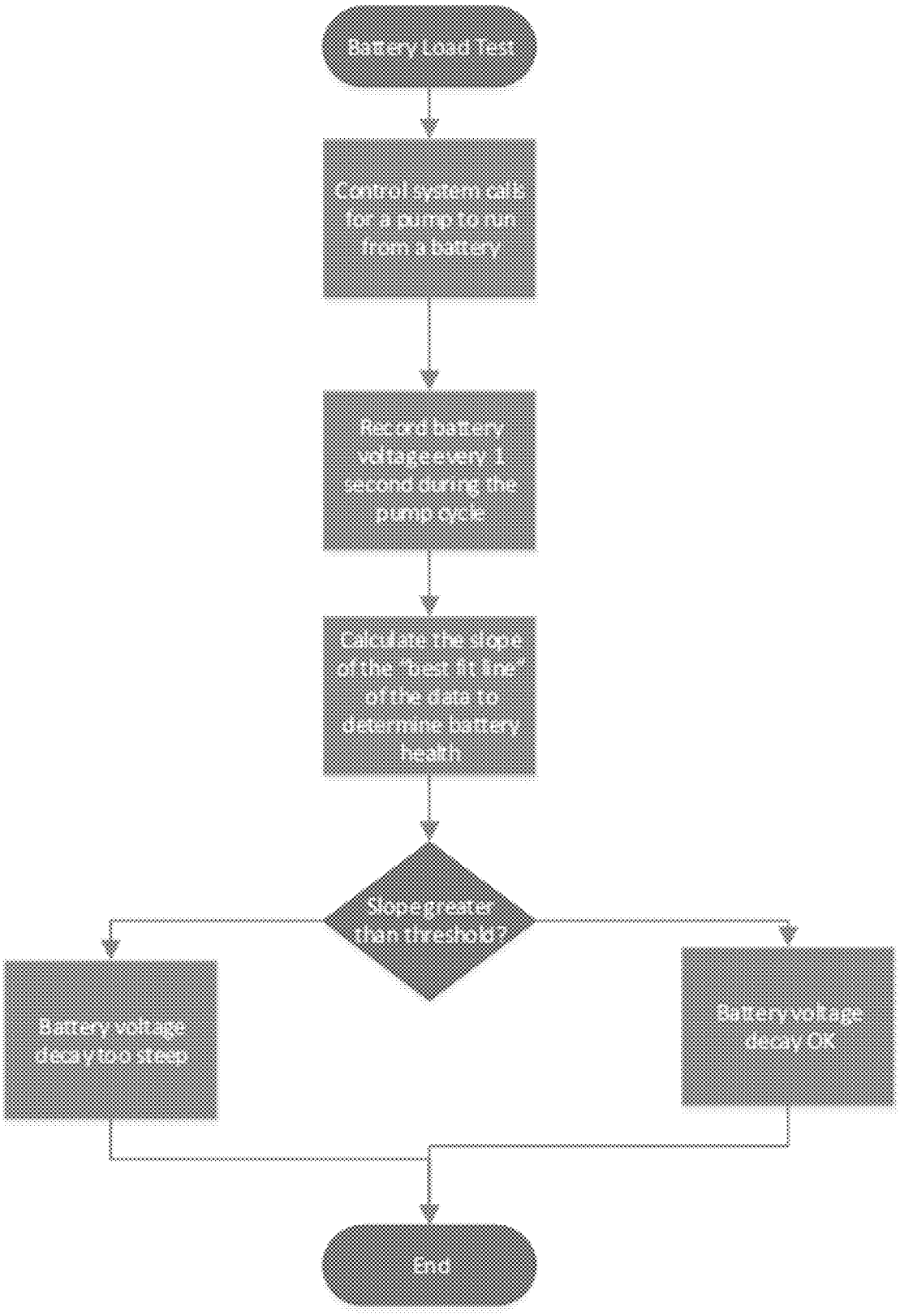
FIG. 64 is a is an operational flow diagram of an example battery loading operation in the HFPA system.

FIG. 64 is a is an operational flow diagram of an example battery loading operation in the HFPA system. The controller circuitry 4330 may perform load testing with each pump energization cycle. Unlike traditional battery backup sump pumps, the DC powered pumping system tests the load ability of the backup DC power source 4316, such as batteries, on every pump on/off cycle. If, for example, a battery is not holding a sufficient charge, the intelligent switching circuit will auto-switch to the other DC power source 4316 and the home owner is alerted via the internal cellular and/or wifi communication circuitry.

The DC power source 4316 may be designated as a back up power source or a primary power source. As illustrated in the example of FIG. 64, the controller circuitry may test the DC power source 4316 by applying known loads, and then monitor the voltage decay vs time. For example, the controller circuitry 4330 may employ a rotational scheme where only two pumps 4302 can operate from the DC power supplies 4620, and the third pump is always operating from the DC power source 4316, such as a rechargeable battery. The advantage to this scheme is that the DC power source 4316 is subject to frequent voltage load decay tests so the controller circuitry 4330 can monitor the capacity performance of the DC power source 4316. Many times, back-up or primary power sources such as the DC power source 4316 are not tested, and certainly not tested under load, and when they are needed during critical power events, they are not suitable for operation.

Pump Control

Referring to FIGS. 43-46, the pumps 4302 are controlled by the controller circuitry 4330 to operate independently or simultaneously in times of high need. The redundancy of the three pump system is unlike anything else available on the market, making floods a problem of the past. The pumps 4302 may be high efficiency, high revolutions per minute (RPM), high head, variable speed DC pumps in a triplex configuration. In some examples, the pumps 4302 may be brushless DC pumps. The controller circuitry 4306 may variably control DC power duration and magnitude supplied by the first and second DC power supplies 4620 and/or the DC power source 4316 to the pumps 4302 and the DC power source 4316. In other examples, the pumps 4302 may be AC pumps, and the DC power supplies 4620 may be DC to AC inverters supplied by the DC power source 4316.

Basements today flood today for many reasons. A primary reason is that a simple single sump pump is inserted into a basin, and that single sump pump has an integral on/off float switch, which has a non-adjustable, fixed travel distance. This single sump pump is an AC pump, and has no ability to run during an AC power failure. To combat this, the home owner may install a battery backed up sump pump, but the backup pump is usually far smaller than the size of the primary AC pump (i.e. just a fraction of the size of the AC primary pump). During an AC power failure, the backup pump has only fractional flow ability of the primary AC pump, and depending on the length of the AC power failure, this small backup pump simply cannot keep up with the ordinary basin inflow water rate.

The system incorporates three variable speed, high RPM, high head pressure DC pumps with DC power controlled by the controller circuitry 4306. In this configuration, there is no "switchover" from AC to DC power during a power loss condition. Instead, the system constantly operates as a DC pumping system from either or both of the AC power source 4314 and the DC power source 4316. During operation, the controller circuitry 4306 may control selective charging of the DC power source 4316 and running the pumps simultaneously when AC power is present, and running the pumps 4302 from battery power during AC power loss. The controller circuitry 4306 may control the triplex DC pump system to provide pumping redundancy (i.e. eliminating the single point of failure present with a single AC pump).

In addition, the variable speed control provided by the controller circuitry 4306 may eliminate water hammer noise in the system pipes, which occurs when an AC pump is started at full speed "across the line". Many homeowners do not like the water hammer noise, and the soft start capability of the pumps 4302 allows the controller circuitry 4306 to automatically and efficiently ramp up the pump speed on start by slowly and linearly increasing the magnitude of the DC voltage at a predetermined rate. In addition, the controller circuitry 4306 may control the ramp of the DC voltage to ramp the pump speed down slowly on stop to eliminate water hammer noise that may happen when pumps are stop suddenly, such as by abruptly changing from 100% to 0% flow rate. The advantage of an entire DC pumping system, as opposed to a hybrid AC/DC system, is that the system batteries and charging circuitry are constantly tested, under full load conditions, so that the home owner always knows the battery backup system is working normally, and that the batteries can run the pumps under load conditions, and not simply perform a voltage test on the battery(s) which does not determine the battery's ability to function under load.

Pump Operational Control

Pump Alternation for extended life—the three pumps are automatically alternated by the controller circuitry 4330 to equalize pump runtime and cycles, and thus extend overall pump reliability. The controller circuitry 4330 may store and monitor pump operation time so as to not run a designated "primary pump" all the time, while the pumps designated as "back-up pumps" sit stagnant. In an example, the pumps 4302 may be controlled by the controller circuitry as a lead pump, a lag pump, and a lag-lag pump. The controller circuitry 4330 may randomly, or based on operational data, dynamically change designations and corresponding functionality of the pumps 4302. A pump designated as the lead pump may be the first to be energized by the controller circuitry 4330 to evacuate the sump basin 4308. As additional pumping capacity is needed and the primary pump reaches a predetermined loading, such as 50%, the controller circuitry may energize the pump designated as the lag pump and/or the lag-lag pump.

Figure 58:
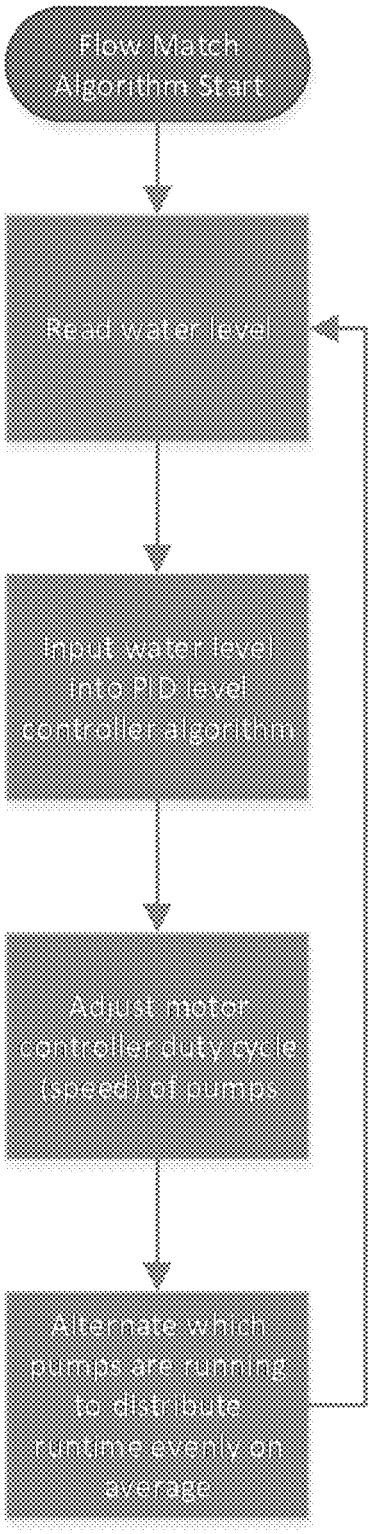
FIG. 58 is an operational flow diagram of an example flow matching operation in the HFPA system.

FIG. 58 is an operational flow diagram of an example flow matching operation in the HFPA system. The variable speed pumps allow flow matching such that the controller circuitry 4330 may continuously monitor the flow rate coming into the sump basin 4308 via a sensitive submersible level transducer. The system's three DC variable speed pumps may be speed controlled by the controller circuitry 2330 to provide flow matching. As illustrated in FIG. 58, the controller circuitry 4330 may receive a sump basin level signal, and flow match the speed of the pump(s) 4302 as needed to maintain a constant water level setpoint in the sump basin 4308. This flow matching scheme eliminates the water hammer noise heard from single speed pump starts/stops, and also greatly extends the pump life by running each pump 4302 at a fractional speed. In addition, automatically, and/or at user adjustable times, the controller circuitry 4330 may replace the running pump 4302 by one or more different pump(s) to equalize runtime across three pumps 4302, thus extending their maximum useable life in the field. If more than one pump 4302 needs to run to match flow of the incoming water, then the running pumps are slowed down to reduce system pressure on the respective outlet lines 4320, and then the next pump is started, and all pumps ramped up to speed together so that a respective check valve 4322 on the outlet line 4320 of a respective pump is not forced closed by an unequal pressure from another running pump.

Figure 59:
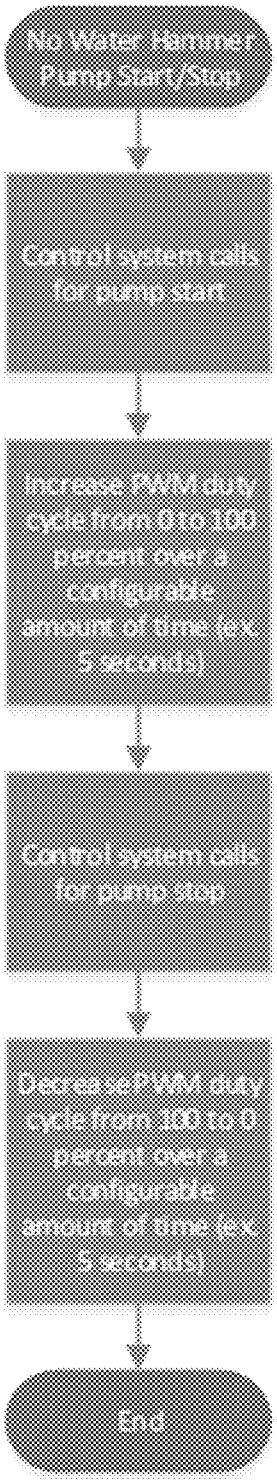
FIG. 59 is an operational flow diagram of an example water hammer elimination operation in the HFPA system.

Flow matching may also be used, for example, in homes where water is constantly or consistently flowing into the sump basin 4308. These types of homes typically have very high pump cycles/year (i.e. 1 million+ cycles/year) which lead to premature pump failure. The controller circuitry 4330 may operate 1, 2 or 3 pumps 4302 as needed in a constant flow mode, with the speed of the pumps 4302 controlled to match the incoming water flow rate, thereby eliminating 1) water hammer, 2) excessive pump cycling, 3) premature pump failure. FIG. 59 is an operational flow diagram of an example water hammer elimination operation in the HFPA system. The controller circuitry may control the variable speed pumps to eliminate water hammer as described herein and in FIG. 59.

Figure 60:
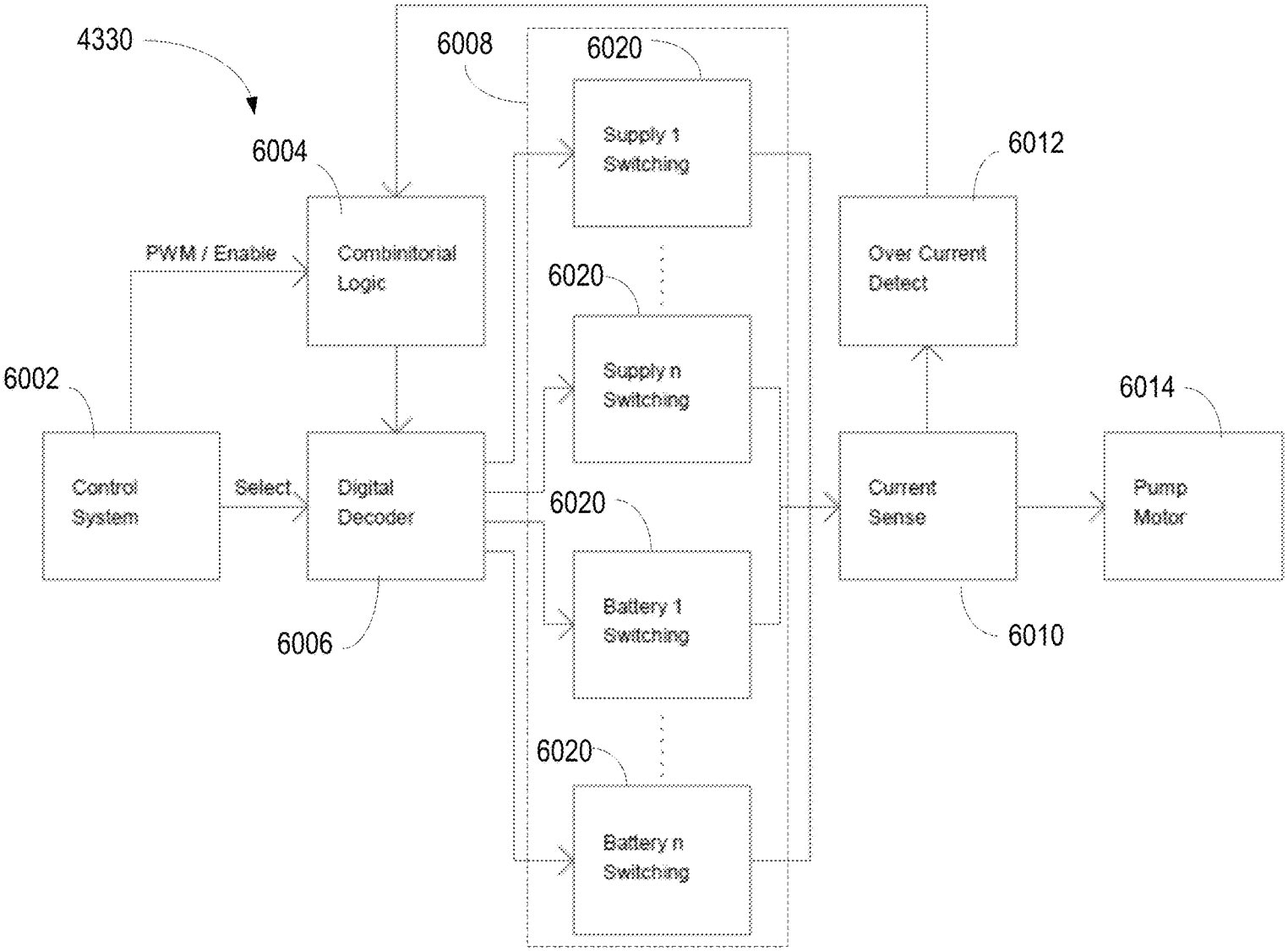
FIG. 60 is block diagram example of the controller circuitry providing pulse width modulation (PWM) steering control for a pump in the HFPA system

FIG. 60 is block diagram example of the controller circuitry providing pulse width modulation (PWM) steering control for a pump in the HFPA system. The controller circuitry 4330 include a PWM control system 6002, a combinatorial logic 6004, a digital decoder 6006, power sources 6008, current sensing circuitry 6010 and overcurrent detection circuitry 6012 supplying variable voltage and current DC power to a pump motor 6014 of a variable speed pump. During operation, the control system 6002 may select via the digital decoder 6006 any one or more of the power sources 6008 for the pump motor 6014. The power sources 6008 may include any number of switching DC power supplies 6020 (1 to n) and any number of DC storage devices 6022 (1 to n). In the example system illustrated in FIGS. 43 and 46, there are two DC power supplies 6020 identified as DC power supplies 4620 in FIG. 46, and two DC storage devices 6022 identified as DC power source 4316 in FIG. 43. In other examples additional DC power supplies 6020 and DC power sources 4316 may be present.

The current sense circuitry 6010 may include a pump current probe, or current sensor measuring the DC current draw of the pump motor 6014. The current sense circuitry 6010 may provide a dynamic current signal indicative of realtime motor current flow to the overcurrent detect circuitry 6012. The overcurrent detect circuitry 6012 may compare the actual current to predetermined maximum values, such as from the pump manufacturer to maintain the motor current below an overcurrent condition. The combinatorial logic 6004 may receive an enablement signal and/or a PWM signal from the control system 6002 providing a voltage magnitude representing a speed demand setting for the pump motor 6014. The combinatorial logic 6004 may also receive an indication of current draw of the pump motor 6014 from the over current detect circuitry 6012. Based on these inputs, the combinatorial logic 6004 may direct one or more of the power sources 6008, via the digital decoder 6006, to supply a predetermined magnitude of voltage to the power the pump motor 6014. Thus, as previously discussed, any pump may be energized by any one or more of the power sources according to operational system parameters such as power source availability, load demand of the pump being supplied, the pump's overcurrent condition, and other dynamic operational parameters.

Figure 61:
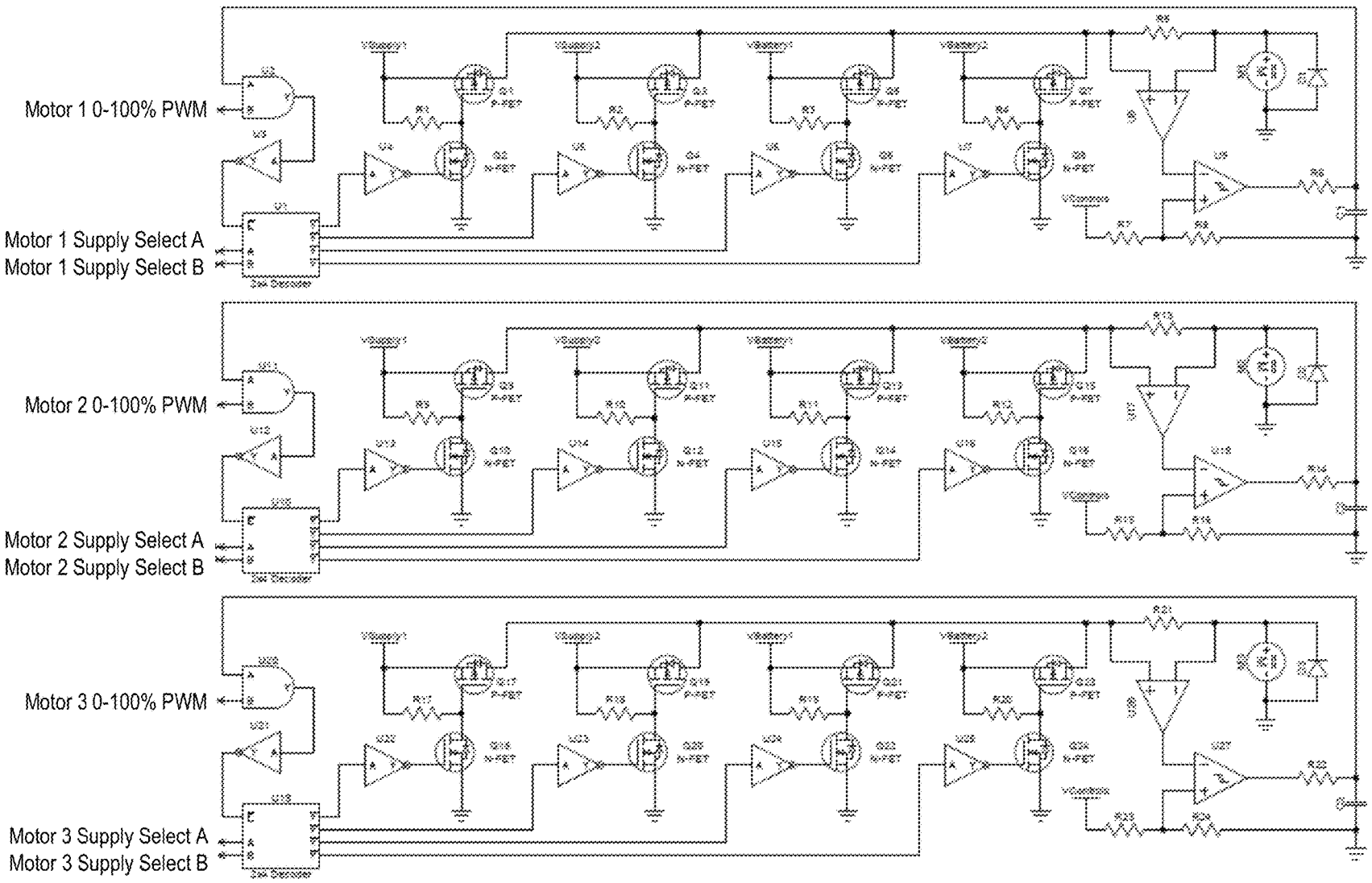
FIG. 61 is a circuit schematic illustrating an example of steering control circuitry for each respective motor of the three triplexed pumps in the HFPA system

FIG. 61 is a circuit schematic illustrating an example of steering control circuitry for each respective motor of the three triplexed pumps in the HFPA system.

System Testing

Referring again to FIGS. 43, 48 and 49, a main water source connection line 4340 supplying municipal water may be routed to the HFPA system 4300. Water from the main source water connection line 4340 may be routed to the level test actuator 4342 via the level test line 4344 and to a home water distribution network 4341. The level test actuator 4342 may be positioned at the cover 4332, for example, and controlled by the controller circuitry 4330 to open and close during testing and calibration of the HFPA system 4300. An outlet 4346 of the level test actuator 4342 provides the municipal water to the sump basin 4308 when the level test actuator 4342 is open. According to ASME a potable water line used for residential or commercial domestic water must use a back flow preventer or suitable air gap between a water supply line and potential source of contamination if there is any possibility that the water supply line could suction the contaminated fluid back into the domestic water lines, and thus contaminate the drinking water line distribution system.

Figure 62:
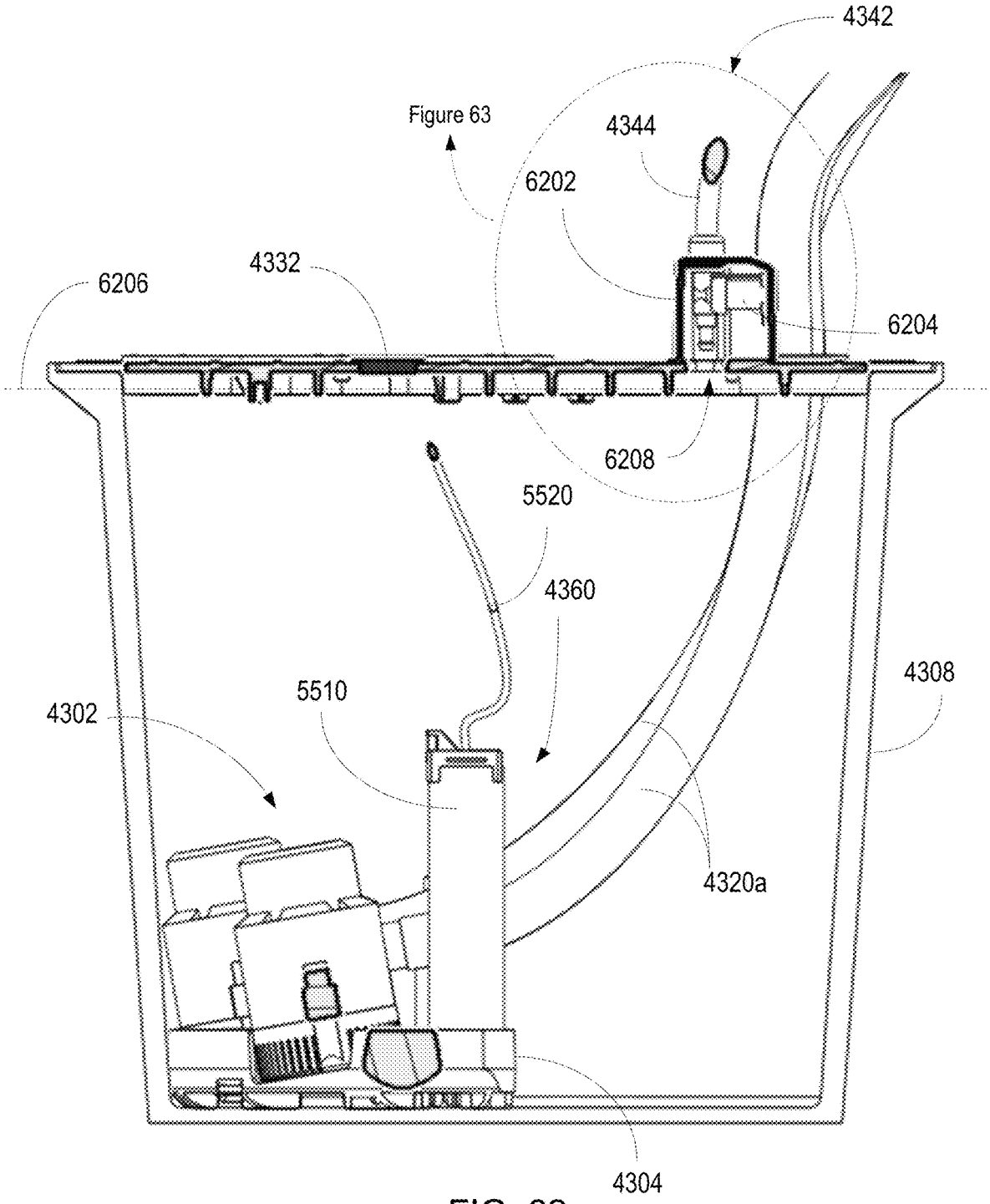
FIG. 62 is a cross-sectional side view of an example of the sump basin and the level test actuator with the shroud removed.

FIG. 62 is a cross-sectional side view of an example of the sump basin and the level test actuator with the shroud removed for purposes of explanation. The level test actuator 4342 includes a housing 6202 and valve actuator 6204, such as a solenoid valve assembly, for automatically filling the sump basin 4308 for pump and system testing. As illustrated in FIG. 62, the housing 6202 is positioned on top of the sump basin cover 4332 above a water level rim 6206. An aperture 6208 in the cover 4332 is positioned above the water level rim 6206 to provide a passageway between an airspace within the housing 6202 and the sump basin 4308. The water level rim 6206 is the maximum level that the liquid in the sump basin 4308 can reach. The valve actuator 6204 is contained inside the airspace included in the housing 6202 and supplied a supply of fresh water by the level test supply line 4344. The housing 6202 is fixedly coupled to the cover 4332 with a liquid and airtight connection, and the level test supply line 4344 is similarly coupled with the housing to form a liquid tight and air tight connection. Accordingly, the airspace inside the housing 6202 includes a volume of trapped air that is unable to escape and therefore acts as a positive pressure barrier to prevent liquid in the sump basin 4308 from entering the aperture 6208.

Figure 63:
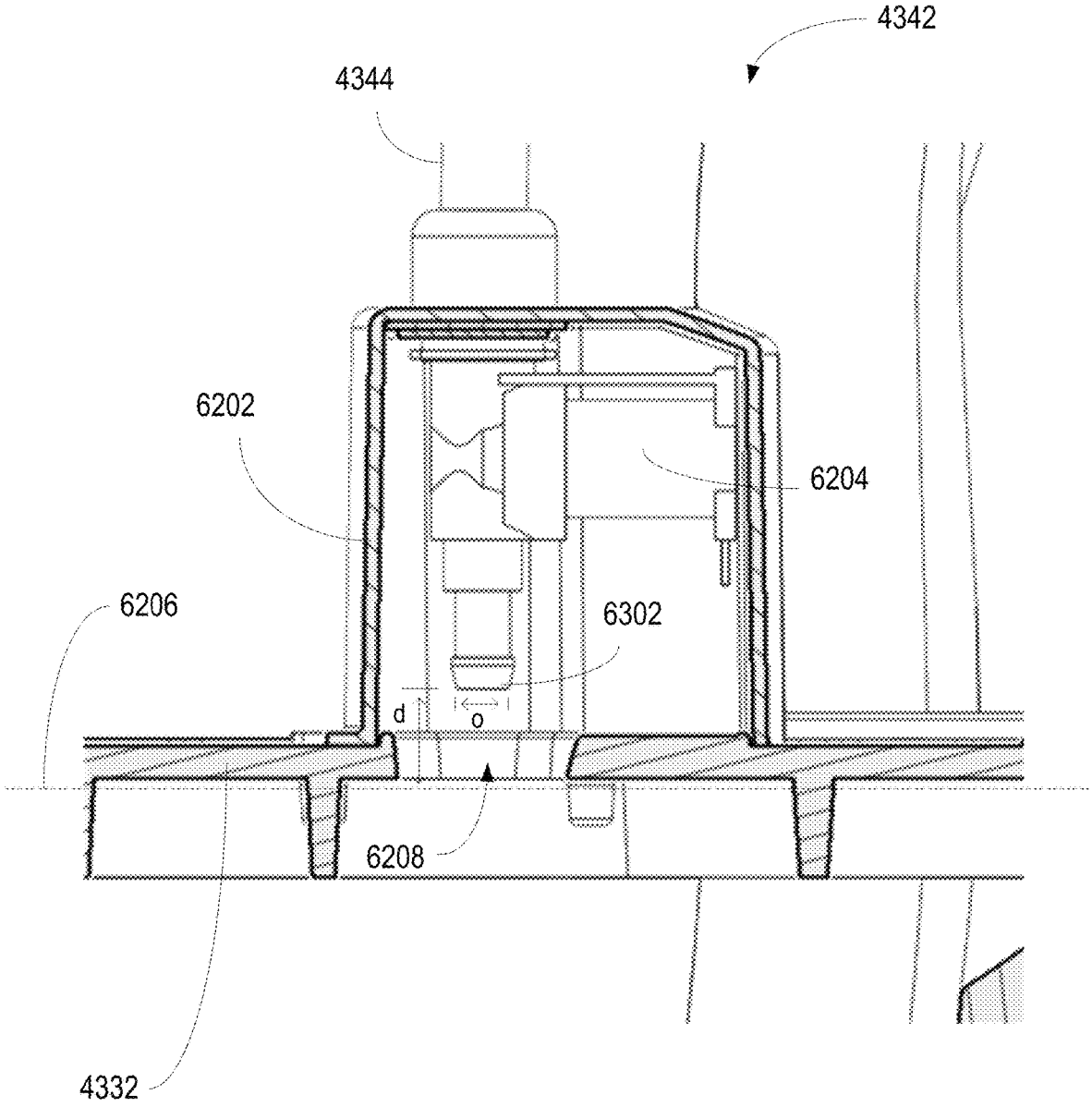
FIG. 63 is a close-up cutaway view of the level test actuator 4342 illustrated in FIG. 62.

FIG. 63 is a close-up cutaway view of the level test actuator 4342 illustrated in FIG. 62. The actuator valve 6204 includes an actuator exit port 6302. The actuator exit port 6302 is positioned at an air gap distance (d) of 3 times the orifice diameter (o) of the actuator exit port 6302 from the liquid fill line 6206. As further discussed elsewhere, on a predetermined schedule, such as monthly, or as the user desires, the controller circuitry 4330 may automatically fill the sump basin 4308 with clean water and start all pumps 4302 (one at a time) to verify pump draw down time, flow rate, and general suitability for operation. If a pump issue is detected via these timed events or via sensitive pump current probes, then the user is remotely notified via an alert message of the pump or system malfunction. The housing 6202 and air gap distance (d) surrounding the basin fill actuator valve 6204, eliminate the need for level test supply line 4344 of the level test actuator 4342 to have an expensive backflow preventer. Most backflow preventers need annual inspection to know they are in working condition, and the air gap (d) plus housing 6202 alleviates the need for such annual inspections.

During operation, the controller circuitry 4330 is configured to automatically performance test the pumps 4302 using the level test actuator 4342. The performance testing may including energizing a single pump 4302, and/or combinations of the pumps 4302. The pumps 4302 may be energized to run at full speed and/or some percentage of full speed by the controller circuitry 4330 during the testing. The controller circuitry 4330 may control the level test actuator 4342 to fill the sump basin 4308 and monitor an evacuation flow rate with a liquid level system 4350. The controller circuitry 4330 may compare the evacuation flow rate of the one or more of the pumps 4302 with a predetermined expected flow. The predetermined expected flow rate may be stored in a memory accessible by the controller circuitry 4330 or may be determined from predetermined data stored in the memory. The predetermined data stored in memory may include, for example, predetermined pump performance data, such as pump manufacturer data for the pumps 4302.

Automatic Testing

The HFPA system 4300 may also automatically run its own monthly, automatic test on the pumps, control valves, and more to ensure full functionality. Upon completion of the automatic testing, the system 4300 may generate and send test reports to a user (homeowners) phone. The user can also run a diagnostic test manually at any time with the press of a button on the display screen 4331.

Figure 65:
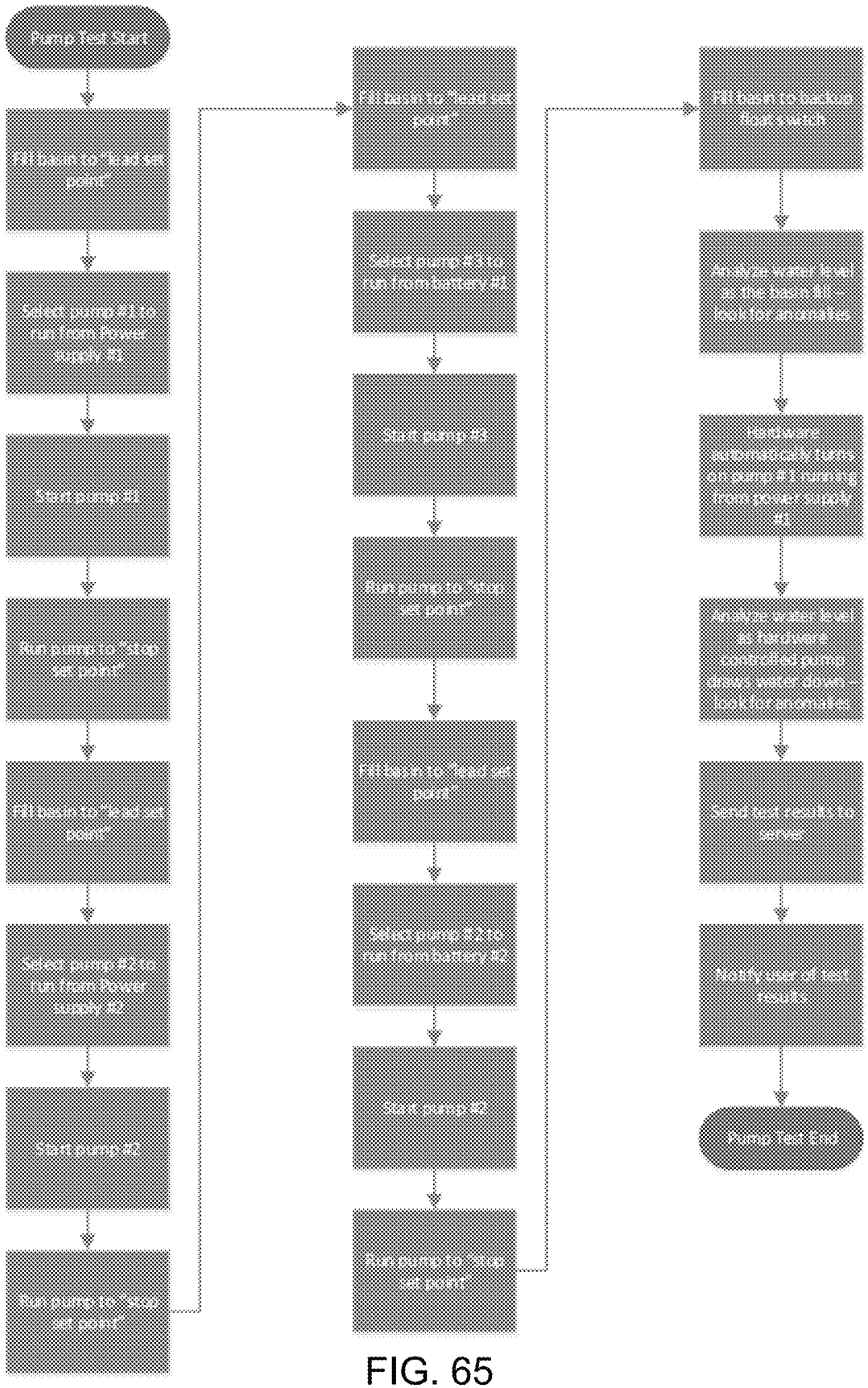
FIG. 65 is an operational flow diagram of an example automatic pump test operation in the HFPA system.

FIG. 65 is an operational flow diagram of an example automatic pump test operation in the HFPA system. In the illustrated example operation, the control circuitry 4306 may control the level test actuator 4342 to fill the sump basin 4308 with water to a predetermined height determined from the liquid level system 4350. The water fill is stopped, and one or more pumps 4302 is started. The operation of the pump(s) 4302 is measured during the water draw down event and stored into memory. The control circuitry 4306 may repeat this test for each of the pumps 4302 individual, as well as various groups and/or combinations of pumps 4302.

A failed pump is one of the primary reasons basements flood. Monitor pump runtime, start/stop cycles, start frequency, and amperage. The system is configured to compare this data against pump manufacturer specifications to determine the useful life of the pump. The system is configured to alert a user when it's time for a new pump, before it fails, via text message and/or the display screen 4331.

The controller circuitry 4330 may run self tests under certain conditions. For example, the controller circuitry 4330 may try to run the self tests when the system is in the "away mode" so as to not disturb the user when home. If the system is not connected to a home security system, and/or the system is not in the away mode for more than 30 days, then the controller circuitry 4330 may run the self-test at predetermined time, such as at 3 am on a weeknight when someone is likely not using water in the home. A user may also manually run a self-test at any time by using the touchscreen included in the shroud 4306 to select a self test button, or manually put the system into away mode from the touchscreen. A user may also change the day/time when the self-test runs, such as from the touchscreen 4616 in the shroud 4306.

Pump Health

The maintenance strategy for a typical home sump pump is inherently flawed. A sump pump is typically replaced or worked on, after it fails, which puts the home at risk of flooding. This is the same maintenance strategy that is used for a lightbulb, toaster, or television, that is, replace it after it has already failed. This is the typical homeowners strategy for repairing a sump pump. However, whereas, a lightbulb, toaster, or television can't flood a basement when it fails, this same "repair after it fails" strategy is used for most critical sump pumps, which are a last line of defense to prevent basement flooding.

Many, many basements around the world flood each year due to this flawed maintenance concept. In summary, many basements "have to flood", because the sump pump, the last line of defense, is not replaced until after it fails. This usually happens during a rain event, when it's needed most, and the basement floods. So for the insurance providers of the world, it's really not about "if the basement will flood", it's really about "when the basement will flood" because maintenance is not performed typically until after the pump fails, and the subsequent flood event occurs.

No one would consider buying a car that didn't have a working gas gauge. Nor would they consider buying gasoline after they ran out of gas each time. No one would consider buying a cell phone with a battery meter which shows the state of the cell phone battery. Why? Because it's extremely inconvenient, or even dangerous, to run out of gas, or have a dead cell phone when it's needed most. So then why do we leave a sump pump unmonitored and unmetered? The only device that can prevent a basement from flooding. A non-working sump pump can cause basement floods, and cause thousands of dollars in damage, and the loss of priceless photographs and other items, yet sump pumps are rarely monitored Sumps have a "lifetime rating" just like a charge in a cell phone battery or the amount of gasoline in a car's tank. Sump pump manufacturers have runtime ratings, on/off cycle ratings, head pressure ratings, full load amp ratings, and other ratings. The HFPA system 4300 continuously monitors the pump on/off cycles, run time, amps, well draw down time by capturing and storing such values in memory on predetermined intervals using the controller circuitry 4330. Using this stored data, the controller circuitry 4330 can determine pump health, such as pumping capacity and/or automatically predict pump health, such as the amount of expected remaining life.

The controller circuitry 4330 may continually compare the pump manufacturer's recommended maximum lifetime data to real time sensor results to predict the useful lifetime of the pumps 4302. When a pump exceeds its useful lifetime (i.e. actual exceeds manufacturers recommendations), then the controller circuitry 4330 alerts the customer via wireless message and/or the display screen 4331 that it is time to replace the pump(s). In America today, we treat a sump pump the same way we treat a light bulb, that is, we replace it after it fails. With this strategy, its simply a matter of time before a basement floods. In the HFPA system 4300, pumps are replaced before they fail, giving the homeowner the best chance of a dry and flood free basement. The controller circuitry 4330 compares stored pump runtime, on/off cycles, flow rate, and amp draw to the manufacturer's specification, and when there is a predetermined or user configured standard deviation from the manufacture's specifications, the pump is indicated by the controller circuitry 4330 as ready for replacement.

For example, the controller circuitry 4330 may confirm pumping capacity of the pumps 4302, individually or in combinations, by monitoring and storage in memory of operational parameters. The operational parameters captured and stored may include pump start frequency, run duration and sump basin level based on a measured level of liquid in the sump basin 4308, and a sump basin level setpoint of the controller circuitry 4306. The controller circuitry 4306 may automatically confirm pumping capacity of the pumps 4302 based on the stored operational parameters and predetermined pump manufacturer rating information, such as operational cycles and runtime values.

The controller circuitry 4330 may automatically make pump health predictions based upon comparison of pump performance parameters to the predetermined parameter values, such as manufacturers ratings. For example, a sump pump manufacturer may state that their model #120A sump pump is rated for four thousand hours, and eight thousand five hundred cycles, at ten feet of head, and ten full load amps. The HFPA system 4300 may continuously monitor these pump parameters with it's internal sensors, and continuously predict the remaining pump useful life, and when it should be replaced, BEFORE it actually fails simply due to operation past its normal life expectancy. In another example, the runtime and cycles of the pumps 4302 are not the only parameters monitored by the controller circuitry 4306 and compared to manufacturers ratings. The pump discharge pressure, full load amps, inrush amp draw, and sump basin draw down time, otherwise known as pump flow rate, may also be captured, stored and continuously compared to manufacturers ratings by the controller circuitry 4330. The homeowner may be alerted if these operational parameters are outside of a predetermined range, or at or below a predetermined threshold. The data may be combined with runtime and cycles data by the controller circuitry 4330 to give an overall prediction of usable life left in one or more of the pumps 4302. It's all displayed on a single gauge, like a gas gauge in a car, to provide an overall health rating for the HFPA system 4300.

Figure 66:
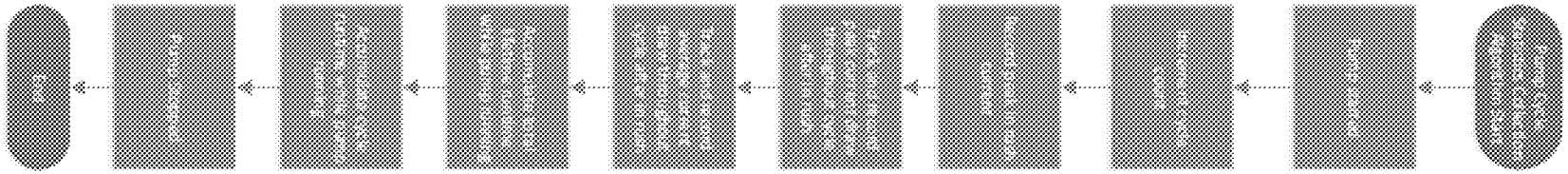
FIG. 66 is an operational flow diagram illustrating an example pump statistics collection operation in the HFPA system.

FIG. 66 is an operational flow diagram illustrating an example pump statistics collection operation in the HFPA system. The controller circuitry may control the pumps to obtain the pump statistics and track and record in memory the operational parameters as indicated in FIG. 66 and described herein.

Figure 67:
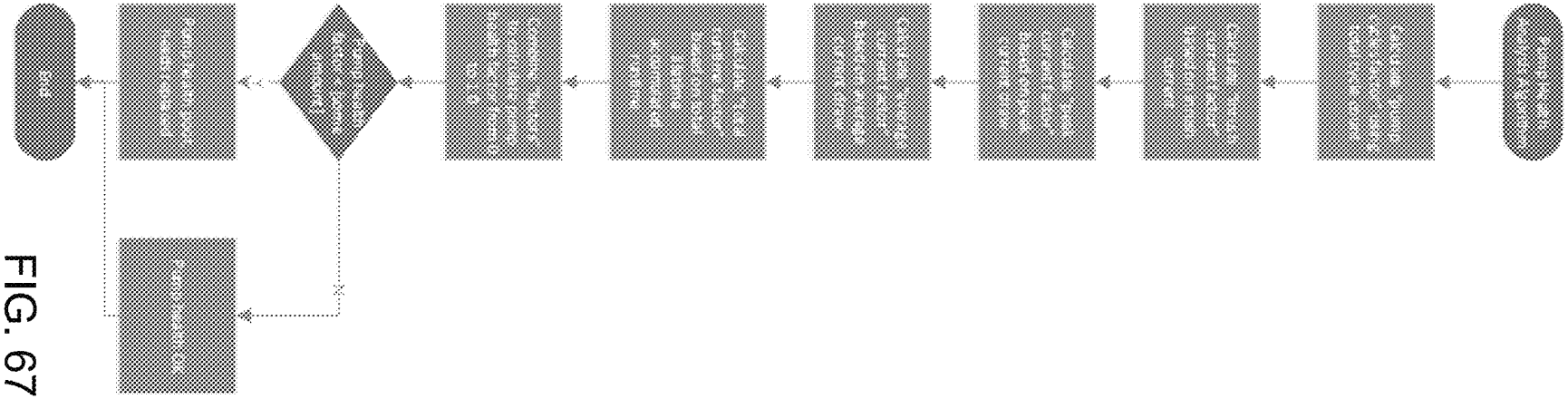
FIG. 67 is an operational flow diagram illustrating an example pump health analysis operation in the HFPA system.

FIG. 67 is an operational flow diagram illustrating an example pump health analysis operation in the HFPA system. The analysis and related calculations for the pump health analysis may be performed by the controller circuitry as described herein, and illustrated in FIG. 67.

A pump health gauge may be provided as a display on the display screen 4331, which is very visual, and the homeowner, at a glance, can see if the corresponding pump is in the good, average, poor or emergency range. This can happen from the user's cell phone, or the display screen 4331 in the front shroud 4306 of the appliance system 4300. The concept of the HFPA system 4300, is that of a next generation appliance. Thus, if the controller circuitry 4330 is in communication with the internet via communication circuitry, the system may notify the homeowner the health of their pump at adjustable, pre-specified intervals. In addition, the HFPA system 4300 may alert the homeowner when it is time to replace the pump (i.e. before it fails). In addition, a system premium subscription plan member may automatically receive a new, replacement pump in the mail when the health meter states the pump is ready to be replaced. There are no actions required on behalf of the homeowner to get their new pump. The pump health is automatically telemetered to a remote server of the HFPA system 4300, and the replacement pump shipped to the customer. The homeowner replaces the existing pump with the new pump in a couple simple steps, and the health meter is reset to restart the monitoring process. Thus, the system is a 24/7 watch guard of pump health, with a full maintenance program to ensure a functioning pump is protecting the home.

Smart Meter

Referring again to FIG. 45, a smart meter housing 4520 may be detachably coupled to the shroud 4306 and form a portion of the upper portion of the structural frame. The main water source connection line 4340 may enter the smart meter housing 4520. Thus, the smart meter housing 4520 may be included as part of the wet component 4512 and be isolated from the dry component 4514. Although illustrated as coupled to the shroud 4306, the smart meter housing 4520 may optionally be detached and located away from the shroud 4306. Relocation of the smart meter housing 4520 may be needed so that the main water source connection line 4340 may enter the smart meter housing 4520.

Figure 47:
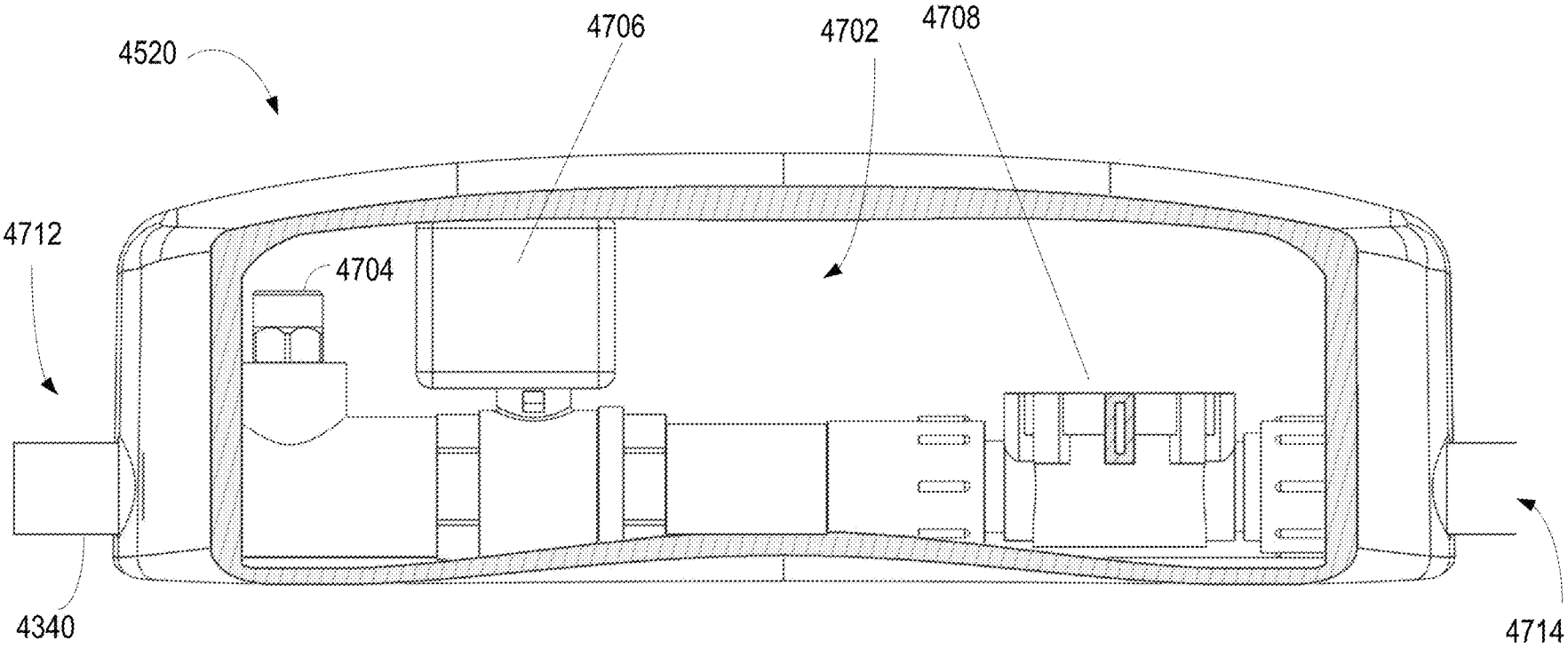
FIG. 47 is an example of cutaway view of a smart meter housing included in the home flood prevention appliance system.

FIG. 47 is an example of cutaway view of a smart meter housing 4520 included in the HFPA system 4300. The smart meter housing 4520 may include a smart meter 4702 that includes a pressure sensor 4704, an electrically operated actuator 4706, and a flow meter 4708. Water flowing from the main water source connection line 4340 may be received at an inlet 4712 of the smart meter housing 4520. As illustrated in FIGS. 48 and 49, in an example system, the water source connection line 4340 may be configured as a 3 valve bypass 4902.

Referring again to FIG. 47, the water may flow sequentially through the pressure sensor 4704, the electrically operated actuator 4706, the flow meter 4708 and an outlet 4714 of the smart meter 4702 into the domestic water distribution network when the electrically operated actuator 4706 is open. As discussed herein, the smart meter 4702 may create and use home specific water profiles to detect possible flood events. Thus, the smart meter 4702 provides leak detection and flood prevention throughout a home's domestic water distribution network as well as providing tracking, diagnostics and testing. Functionality of the smart meter 4702 may be performed by the controller circuitry included in the shroud. Alternatively, or in addition, some or all of the functionality described may be performed in the smart meter housing 4520.

Figure 68:
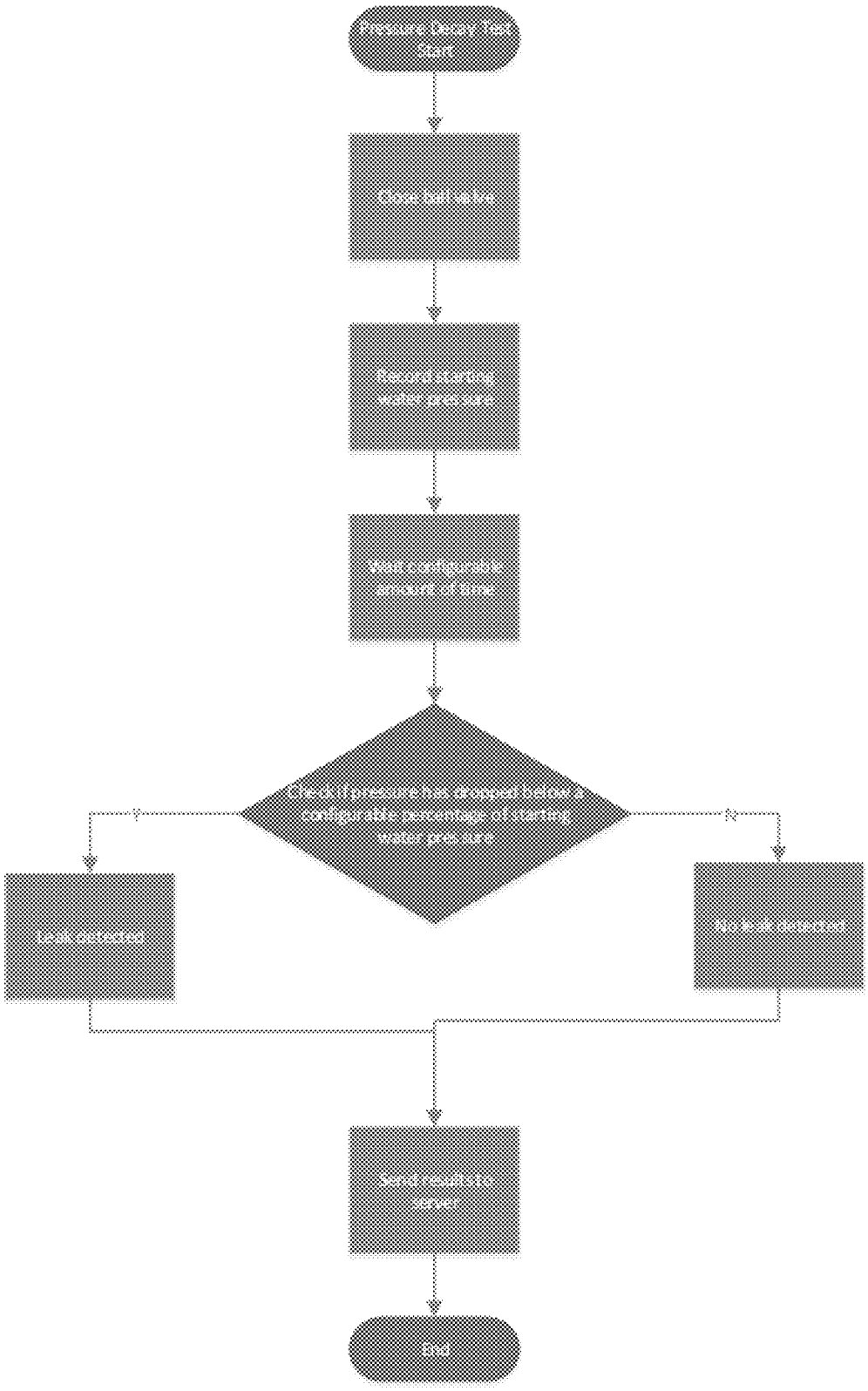
FIG. 68 is an operational flow diagram of an example leak test operation in the HFPA system.

FIG. 68 is an operational flow diagram of an example leak test operation in the HFPA system. The HFPA system may use the smart meter 4702 to perform a sensitive whole home leak test. As illustrated in FIG. 68, this is accomplished by the controller circuitry automatically closing the electrically operated domestic water shutoff valve or actuator 4706 for a predetermined time, such as two minutes. During the predetermined time, the controller circuitry may monitor for a decay rate of the system water pressure over time in the domestic water distribution network. If the decay rate exceeds a predetermined decay limit threshold, the controller circuitry may determine that there is a leak in the domestic water distribution network, and provide a wireless alarm to the user. The decay rate values may also be stored into memory by the controller circuitry to create a home specific profile, and the valve may be reopened. A pass/fail test result may be sent to the user via text message. The controller circuitry may also perform supervised learning based on feedback from the user that no leak is present to adjust the predetermined decay limit. These self tests may be automatically performed on a predetermined schedule, such as monthly.

The flow meter 4708 may be a sensitive flow meter which has the ability to detect the unique water signatures from different water users in a home, and make accurate water usage readings. At user adjustable intervals, the controller circuitry 4330 may automatically check the accuracy of the water flow meter 4708 using the liquid level system 4350. Alternatively, or in addition, the controller circuitry 4330 may check the accuracy of the liquid level system 4350 using the water flow meter 4708. Accuracy checking by the controller circuitry 4330 may be performed using the level test actuator 4342 since the flow meter 4708 measures the flow of water supplied by the level test actuator 4342 to the sump basin 4308. Thus, by comparing metering by the flow meter 4708 of xx gallons of water into the sump basin 4308 with sump basin level readings, the controller circuitry 4330 can check that both the water flow meter and water level transducer volume readings match each other.

Figure 69:
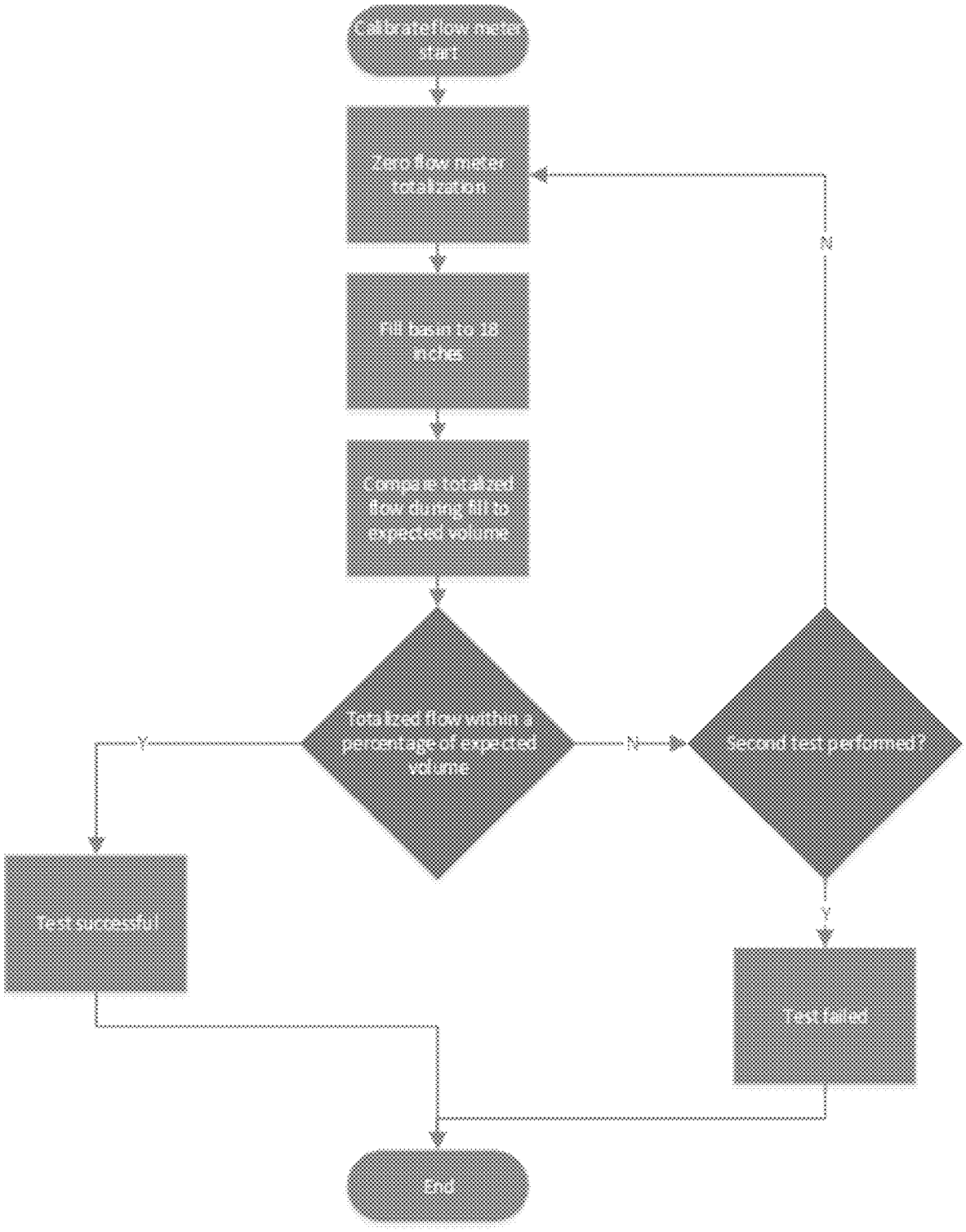
FIG. 69 is an operational flow diagram of an example flow meter calibration operation in the HFPA system.

FIG. 69 is an operational flow diagram of an example flow meter calibration operation in the HFPA system. In an example, 1) the 24"×24" sump basin holds a known volume of water, 2) the level test actuator 4342 is opened, and the sump basin 4308 is filled to a predetermined height, such as 18 inches, which equates to xx gallons, 3) this gallonage is compared to the water usage detected on the water flow meter 4708 by the controller circuitry 4330, 4) if the readings match, then the control circuitry 4330 considers both devices to be in calibration, if the readings do not match, then the test is repeated. 5) if the readings again do not match, then the user is alerted that either the water flow meter 4708 or the level test actuator 4342 may be in need of recalibration and/or repair.

Home & Away Modes

The HFPA system 4300 may include an input to the I/O circuitry which can be connected to a home alarm system such that when the home alarm system is placed in the home or away modes, the HFPA system follows the home alarm system mode. In the "away" mode the domestic water leak detection by the controller circuitry 4330 using the flow meter 4708 is much more sensitive, detecting even the smallest leaks. In the "home" mode, leak detection by the controller circuitry 4330 is less sensitive, as the home owner is home and is likely the reason for an unusual water usage pattern.

Thus, the system may be put on guard by communication with a home security system. For example, the HFPA system may receive a dry, unpowered relay contact from a home security system master control panel, which may be opened/closed as the security system is armed and disarmed, such as via a home alarm system keypad (e.g. closed contact=armed, and open contact=disarmed). When the home security system is disarmed, the HFPA system may enter a home mode, and when the home security system is enabled, the HFPA system may enter an away mode.

In the home mode, the controller circuitry 4330 may monitor the flow meter 4708 with relatively low sensitivity because if there is a leak in the house, the user is home and likely to see/be alerted to an undesirable flow of water. Also, in the home mode, a user can perform all types of "unusual" water usage patterns (i.e. filling a hot tub, etc), such that the HFPA system may be kept very unsensitive when a user is home so the controller circuitry does not misinterpret a user's intended, but not recognizable, water flow pattern, such as a user's desire to take a 60 minute shower instead of a usually occurring 10 minute shower. (See FIGS. 16 and 17).

In the away mode, when the home security system is "armed", the controller circuitry 4330 may monitor the flow meter 4708 with increased sensitivity to unrecognized water flow profiles. In this way, the system may detect small leaks. Upon detection of a unrecognized flow profile, the controller circuitry may notify a user via text message, and "ask" if the user wishes to shut down the water supply to the home with the electrically operated valve. If no response is received from the user in a predetermined time, such as within 10 minutes, the controller circuitry may activate the electric valve to close in order to shutdown the supply of water to the home. In this example, if a user sends a responsive text message, the shutdown may be canceled or reversed such that the electrically operated water valve is opened immediately. In addition, a user may send a command, such as "close valve" or "open valve" to the controller circuitry such that a leak is stopped no matter where the user is in this world when the unrecognized flow profile is identified. Further, whether the electrically operated valve is automatically closed in particular scenarios may be a user setting. (See FIGS. 16 and 17 and related discussion).

Water Usage Signature

The controller circuitry may use onboard and cloud based calculations and algorithms to automatically determine the water users in a home based on water flow measured with the water flow meter 4708. This is done to give the homeowner statistics on home water usage by different appliances, and sinks, showers, etc, but also to minimize false water leak alarms. If the homeowner is away from home, and, for example, the ice maker on a refrigerator is making ice, the controller circuitry is able to recognize this signature and ignore it, unless it continued past it's normal water usage pattern, at which time, it would be flagged as an alarm.

The controller circuitry performs day-to-day is monitoring and data capture of all the drinking water lines in a home water distribution network using the flow meter 4708. Not only for leaks, but also to record water usage habits. If a user lives in an area where water is scarce, the system can help the user understand how they are using water and identify the best ways to conserve. When home or away, the controller circuitry uses internal "learning" artificial intelligence software algorithms to predict if you have a leak. A water flow profile model is trained to recognize an individualized flow profile using unsupervised learning by recognizing structure and pattern in daily water flow usage of a particular site. Using the identified structure and patterns, the controller circuitry may tell the difference between a running toilet, a refrigerator refilling for ice cubes, and many other automatic and manual water usage functions that repetitively occur in a home. This recognition ability may be used when a user is home or away. Thus, the controller circuitry may identify different sources of water consumption and make the best decision to shut down the water supply main only when an unrecognizable water flow pattern occurs, so as to avoid irritating a user with "false alarms".

As an example, while a user is away from home, the controller circuitry identifies a water flow event as the flow profile of the refrigerator refilling to make ice cubes. The controller circuitry would not consider this an alarm event and it would be ignored. However, if the controller circuitry detected an unexpected flow pattern, such as a faucet or toilet running when you're not home (as well as many other types of leaks), then the controller circuitry may determine this is an alarm event, and provide notification via text message with an option for the user to close the electrically operated water valve present in the smart meter. In this example, if the user does not respond to the text message within a predetermined period of time, such as 10 minutes, the controller circuitry may actuate the electric valve to the closed position to shut down water supply to the home. (See FIGS. 19 and 20 and related discussion)

Software and Firmware Updates

All new software updates are available to system customers via wireless or wireline communication from a central server. When a new update is released, the central server pushes the update to the system. The controller circuitry may perform automatic updates and/or user approved updates during quiet times making it seamless for a user to keep the system current.

Figure 70:
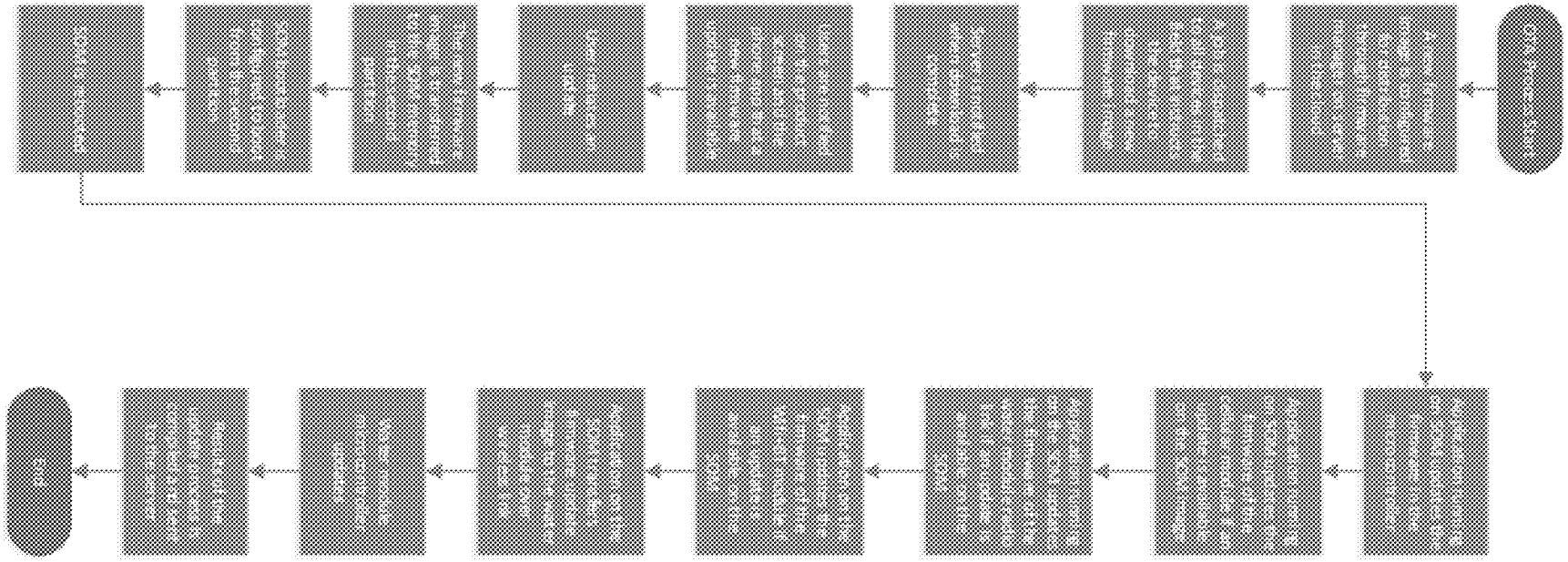
FIG. 70 is an operational flow diagram example of over the air updates in the HFPA system.

FIG. 70 is an operational flow diagram example of over the air updates in the HFPA system. In an example, a user may obtain the latest system software features by emailing a unique identifier of the system, such as the system serial number. In response, the user may receive a USB thumb-drive which can be inserted into a USB port included on the shroud to get the newest, exciting features. The thumb-drive may be plugged into the system and on-screen prompts may be followed by the user to complete the updates. Alternatively, updates may be securely downloaded from a user's device, such as a smart phone.

All programmable aspects of the HFPA system can be updated from a remote server by sending a "bundle" of software to the communications circuitry included in the system. The bundled updates may be a series of different code updates provided in a single code structure. The controller circuitry may parse the received code structure and individually update any programmable components of the system identified for receipt of an update. Programmable components in the system may include, for example, a SOM (system on module), a microcontroller, wifi and Bluetooth™ modules, and any other in-system programmable modules.

Figure 71:
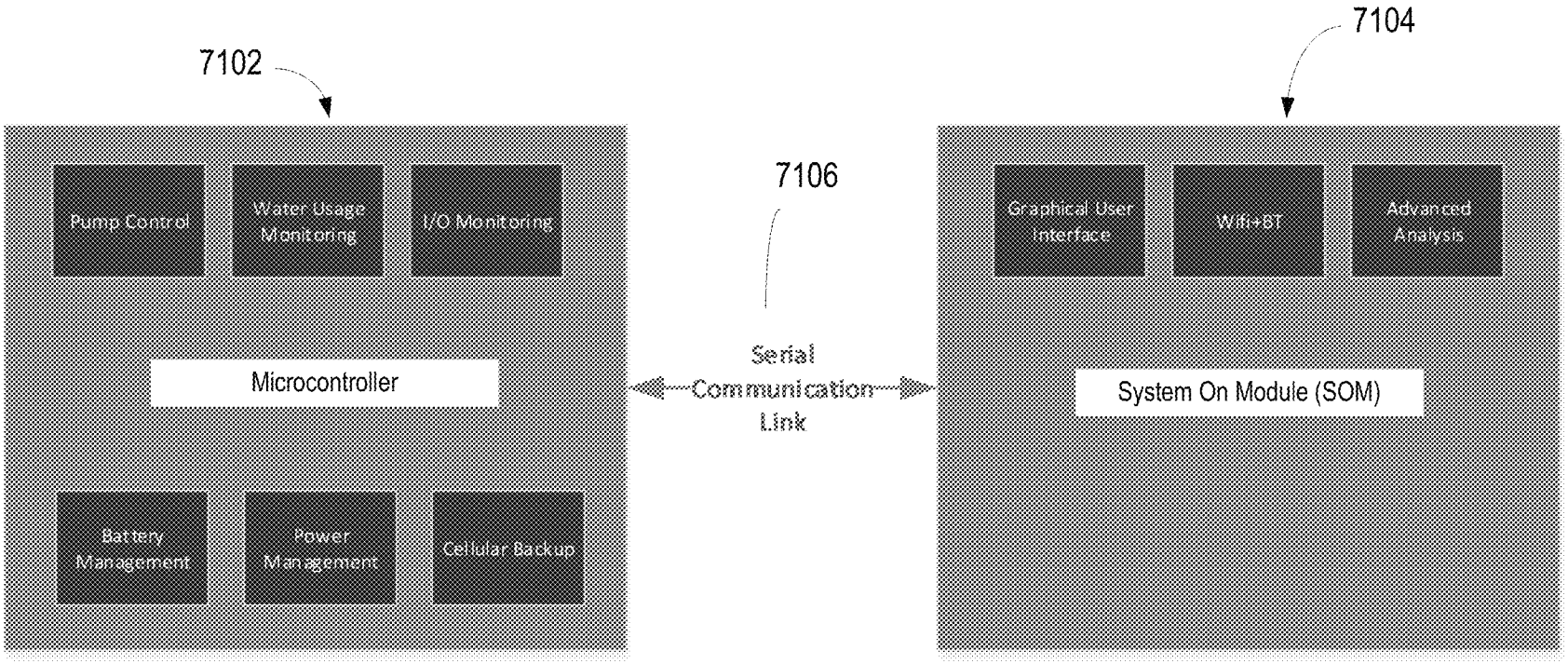
FIG. 71 is a block diagram illustrating an example operating system functionality for the HFPA system.

FIG. 71 is a block diagram illustrating an example operating system functionality for the HFPA system. The controller circuitry includes the operating system for the HFPA system. In an example, the functionality of the controller circuitry may be divided into a microcontroller 7102 and a system on a module (SOM) 7104. The micro controller 7102 may be responsible for the operational aspects of the functionality and the SOM 7104 may be responsible for user related functionality. The microcontroller 7102 and the SOM 7104 may communicate over a communication link 7106, such as a serial communication link. This division of the operating system may provide an additional layer of security by avoiding intermixing the user related functionality and the operational related functionality.

Wi-Fi Alerts With Cellular Backup

The system's remote text message capability can notify up to five cell phones. Utilizing Wi-Fi with backup cellular service in case of power loss, a user can be confident that they will always receive alerts.

Home Water Pressure Monitoring

The system is configured with a built-in city and well water pressure sensor that notifies a user if there is low pressure or high pressure (which can cause toilets and faucets to leak).

The water pressure sensor is calibrated to read both positive and negative system pressures. If the sensor detects a low pressure situation, and this situation continued to decay into a negative pressure (i.e. indicating that the home domestic water lines could become contaminated from ground water infiltration outside the home), then the controller circuitry 4330 may notify the user of the presence of a negative water line pressure situation. The user can then contact their local water company to verify that water may need to be boiled (or not). This dual check system of 1) first low pressure alarm, followed by 2) a negative pressure alarm gives redundant indication that the water line in fact could be contaminated.

Power & Home Water Usage Monitoring

The system may notify the user when power is both lost and restored. In addition, if the home is in an area where water is scarce, or the user wants to monitor and control water usage habits, the controller circuitry provides the user with access to detailed water usage charts.

Automatic Sump Basin Level Setpoint Determination

When building a new home, it's not possible to know the normal height of the water table below the basement slab, or in a crawl space. The controller circuitry can monitor how often the pump is starting, and how long it's running. This data is compared to the manufacturers ratings for cycles and runtime, and excessive numbers are detected. The controller circuitry has artificial intelligence algorithms such that if the pump is running or cycling excessively, it may be simply be due to the normal water level height in the associated water table. The controller circuitry may automatically raise the software level setpoint which controls the pump to determine if this eliminates the excessive runtime, and then saves this new setpoint if it solves the issue Water table height determination and auto adjustment—the controller circuitry constantly monitor the sump basin level, and will determine the home's groundwater water table level during all seasons and conditions. The groundwater table level may be determined by the system by the controller circuitry automatically doing setpoint calculations. A home water table may increase during the rainy season and decrease during the dry season. The system's analog basin level sensors continuously monitor the basin level, and if the local water table increases and/or decreases, the controller circuitry may automatically adjust the pumping system on/off setpoint levels to an appropriate level such that 1) the pumps do not attempt to drain the entire neighborhood water level creating excessive pump runtime, wear, and wasted energy. When the local water table is elevated, the controller circuitry elevates the on/off setpoints, and when the water table is lower, the setpoints are lowered. In all cases, the controller circuitry optimizes water table setpoints to prolong pump life by eliminating excess runtime, and save electricity.

Figure 72:
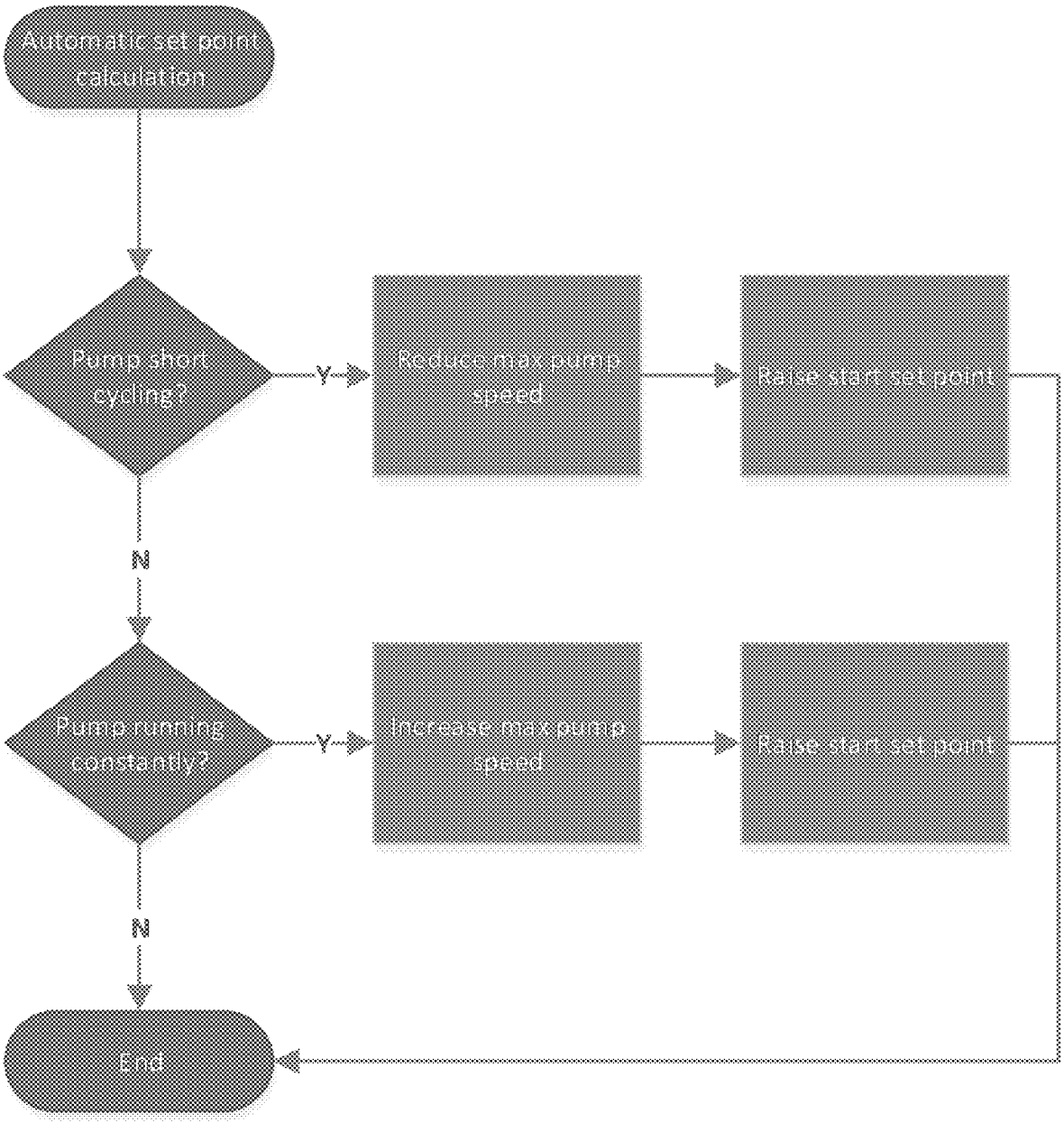
FIG. 72 is an operational flow diagram illustrating an example of automatic setpoint determination with the HFPA system.

FIG. 72 is an operational flow diagram illustrating an example of automatic setpoint determination. The automatic setpoint determination may be automatically performed by the controller circuitry as provided herein and in the flow diagram of FIG. 72.

Full Power Mode

Full flow on battery power—most homes in the USA can operate successfully from a single ⅓ Hp sump pump, and only larger homes need a ½ hp sump pump. The system employs a different strategy, it employs three ⅓ Hp pumps (size is adjustable) so that a single pump can accommodate most homes ordinary flow conditions, but pumps #2 and #3 can be brought online as flow dictates to provide full flow characteristics that exceed all ½ Hp sump pump flow rates on the market during high flow events. Many times, home sump pumps are "over-sized" to accommodate the 100 year flood levels. The downside to this is that 99% of the time this oversized pump causes other problems with 1) too short of run time/cycle, 2) excessive cycling and water hammer. The controller circuitry optimizes the flow rate and runs the right amount of pump(s) and the right speed to 1) save electricity, 2) eliminate water hammer, 3) eliminate excessive cycling. During a 100 year flood event, or an aggressive rain event, the three system pumps may be cooperatively operated together to exceed the flow of ½ hp pumps. Cooperative operation of the three pumps may occur while AC power is supplied to the system or during AC power loss when the pumps are powered from the DC power source.

Automatic Pump Sizing

When building a new home, it's not possible to know how much water will be collected by the tile or pipes running around a home's foundation which are routed to the sump pump basin. The controller circuitry can monitor how often the pump(s) are starting and how long the pump(s) are running as compare to the sump basin level setpoint. This data may compared to the manufacturers ratings for cycles and runtime by the controller circuitry, and excessive numbers may be detected, such that the controller circuitry can alert the homeowner that a different size pump is required.

The controller circuitry 4330 may determine if the supplied sump pumps are the correct size for the installation by continuously keeping tracking and storing operational parameters of the pumps 4302. The operational parameters being monitored and stored may include pump on/off cycles, frequency of on/off cycles, pump runtime, and rainfall. Based on these stored readings, the controller circuitry 4330 may determine if the pumps are suitably sized for the installation, and/or if the on/off water level setpoint should be raised to accommodate a high water table. If a pump(s) would have excessive cycles, or run constantly, then an automatic determination will be made by the controller circuitry 4330, via calculations, to raise the water level setpoint. The controller circuitry 4330 may then continue monitoring and storing the operational parameters to determine if the excessive runtime and cycles decrease. If the excessive runtime and cycles decrease, then the controller circuitry 4330 may raise the water level setpoint until it is determined if it is possible to raise the on/off pump level setpoint above the normal height of the water table in the area, and thus greatly minimize pump on/off cycles, runtime, and electrical consumption. The operational flow diagram of FIG. 72 may similarly be applied to determine appropriate pump sizing by the controller circuitry.

In some example systems, there are no actions required on behalf of the homeowner to get a new pump in a size determined by the controller circuitry 4330. In these systems, the controller circuitry 4330 may automatically telemeter the pump health to a system remote server in communication with the controller circuitry, and a replacement (different size) pump may be automatically ordered for shipment to the user (customer). The homeowner replaces the existing pump with the new pump in a couple simple steps, and the health meter is reset to restart the monitoring process. Accordingly, the system is a 24/7 watch guard of pump health, and that the pump is properly sized for the home, with a full maintenance program to ensure a functioning pump is protecting the home. Most home sump pumps are never "sized" and are just randomly selected. The controller circuitry may automatically size the pump based on run/cycle data, and then sends the right size pump to the homeowner if needed Lighted & Self-Cleaning Sump Basin Referring to FIGS. 43 and 46, the electronic enclosure 4614 may include a 360-degree motion detector 4622. The controller circuitry 4330 is configured to know when a human has entered the room, such as a mechanical room, where the system is located based on a motion signal from the motion detector 4622. Once a human is detected, the controller circuitry 4330 may energize one or more LED lights 4624 mounted on the cover 4332 of the sump basin 4308 for easy viewing of the interior of the sump basin 4308 through the sealed, clear viewing lid provided by the transparent panel 4604.

The controller circuitry 4330 may also use the internal 360 degree microwave motion detector 4622 for a wake up on motion function that may occur when a user is detected as coming within proximity to the system. When this happens, the system display screen 4331 and LED's 4624 may be controlled by the controller circuitry 4330 to slowly fade-on. When the user leaves the room, the controller circuitry 4330 may slowly fade-off the display screen 4331 and LEDs 4624. This is done to save runtime on the local LCD display screen 4331 and LEDs 4624, and also to act as a security system alerting the homeowner that someone has accessed the sump pump room/area.

If desired by the user, the motion sensor 4622 may be used in a security capacity to detect that someone has entered the home mechanical room when the homeowner is not home, and report to the homeowner's cell phone(s). This security feature may be set up by a user using the setup page on the display screen 4331.

As described, the HFPA system 4300 is equipped with an at least partially clear basin viewing lid provided by the cover 4332 which may be sealed to an upper peripheral edge of the sump basin 4308 to prevent escape from the sump basin 4308 of odor and radon. When the user approaches the system, the microwave motion detector 462 may provide a signal to the controller circuitry 4330 to wake up the LED lights 4624 which light the interior of the sump basin 4308 so the user can see inside.

Monthly, or as desired, the controller circuitry 4330 can also automatically clean the sump basin 4308 to remove debris, sediment, and iron algae buildup by automatically flooding the sump basin 4308 with fresh domestic water, and then pumping it away. This has an advantage of not allowing debris or algae to build up over time, which may eventually resulting in clogging of pumps, floats and sensors.

Structural Frame

As described herein, the three system pumps may be assembled in the lower portion of the structural frame 4304 that can be referred to as a pump "caddy" for ease of transport and installation. This lower portion of the structural frame 4304 may hold the three pumps 4302 in position so that they don't "walk" or otherwise change position during on/off cycles.

Discharge to Outlet(s)

As described herein, single, dual, or triple discharge pipes may provide outlets for the system. In an example configuration, the system may be piped with a separate discharge pipe for each pump. If any of the check valves included in each respective discharge line fails, the individual discharge line with the failed check valve is isolated from the other pumps, so that the unaffected pumps can pump at full capacity without introducing a pumping-loop due to the failed check valve. Failed check valves in a common pump discharge line may disable pumps from effective pumping by creating a pumping loop in which a pump is pumping toward the output of other pumps instead of toward the outlet.

Automatic Testing Based Upon Weather

Figure 73:
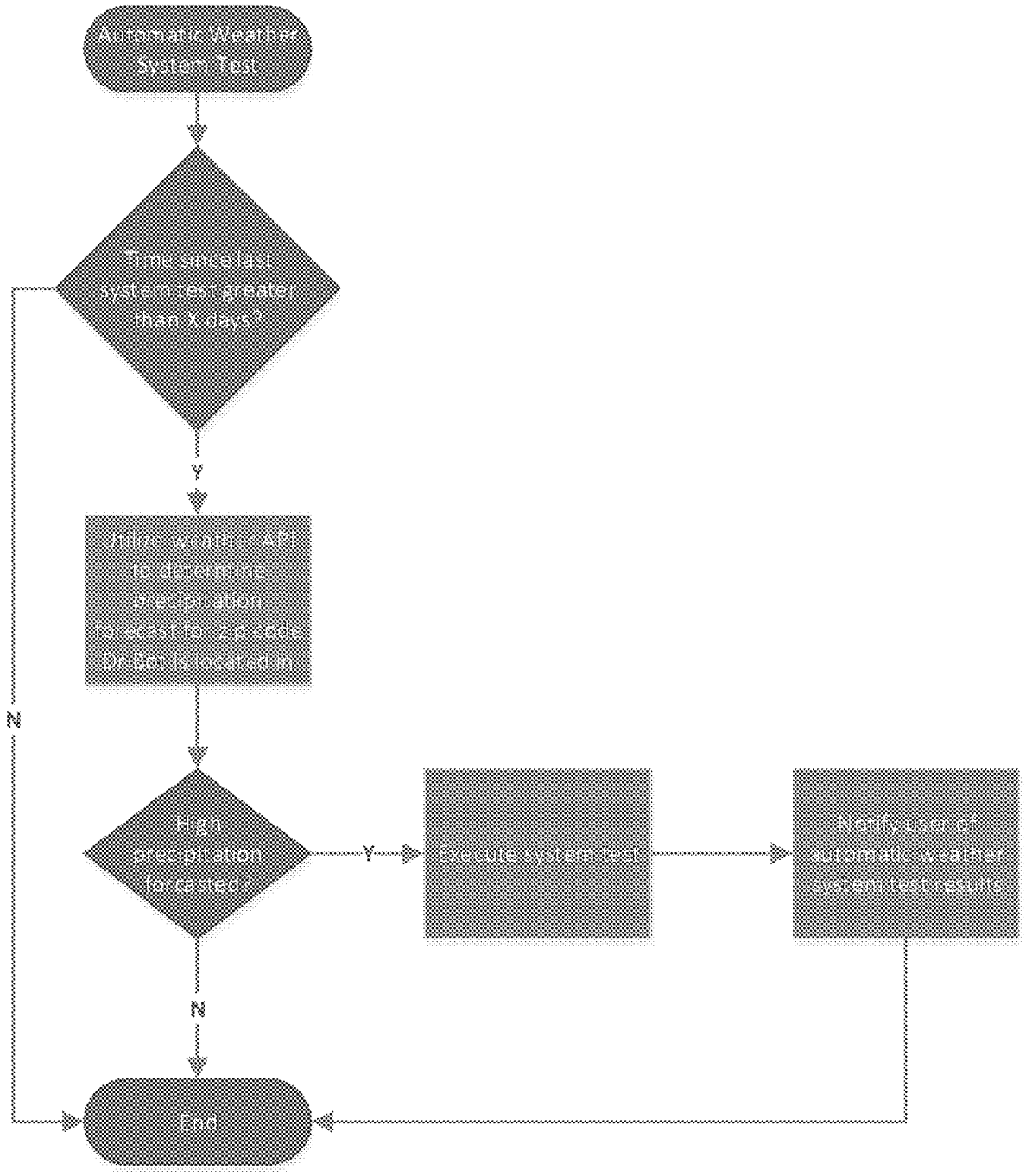
FIG. 73 is an operational flow diagram illustrating an example of automatic weather related system testing operations with the HFPA system.

The HFPA system may be an internet connected device, and as such can monitor internet based weather services to know when potential weather event, such as a big storm is moving into an area. If the controller circuitry detects a storm will be arriving in the area, the controller circuitry may automatically test the pumps, and alert the homeowner that they are functioning properly. In addition, the controller circuitry may test valves, batteries, and electronic systems, and other functionality within the system. The controller circuitry may also generate a report of test results which may be provided to the homeowner via wireless message and/or via the display screen 4331. Thereby giving the homeowner "peace of mind" that his critical systems are working when needed most. FIG. 73 is an operational flow diagram of an example operation to perform automatic testing based on weather services. The operation may be automatically performed by the controller circuitry as described herein and illustrated in FIG. 73.

Communication Circuitry

Simple wifi connect using cellular gateway—the system implements both wifi and cellular communications for redundancy in notifying the home owner of critical events. An additional advantage of this, is the convenience of setting up a connection to a home wifi router. The system convenient phone app connects to the system via the cellular modem connection, and the home wifi password is entered into the app. The cell modem/app combo then connects to the wifi router without the need to access any additional 3rd party configuration apps or additional steps. It's a super convenient way to make the home wifi connection.

External Home System Monitoring

The HFPA system may be used as a Mechanical Room Hub to Monitor all other Mechanical Room Equipment. The HFPA system includes the ability to monitor the general health of all the primary equipment in a home's mechanical room and report a problem to a user's phone, via text message, anywhere in the world.

Monitoring Home Furnace

The system may include duct mounted temperature sensors to monitor if the home furnace(s) is working normally. To use this function, a duct temperature sensor may be installed in the home furnace discharge ductwork. The duct temperature sensor may be electrically connected to the controller circuitry in the system via the I/O circuitry. Alternatively, the duct temperature sensor may wireless communicate with the controller circuitry via the communication circuitry. Once connected, the touchscreen may be used to activate home furnace monitoring from the settings page. In addition to alarms on the display screen 4331, such as threshold alarm settings, a user may also set up text message notifications.

They controller circuitry may also provide maintenance reminders such as reminding when the furnace filter(s) needs replacement, maintenance should be performed, and the like. Such maintenance reminders may be configured by a user from the setting page of the display screen 4331.

Monitoring Hot Water Heater

The system may include a temperature sensor, such as pipe mounted temperature sensors to monitor if a water heater in the home is working normally. This function, may be accomplished with, for example, a strap-on pipe temperature sensor coupled with a discharge pipe of the water heater. Wires from the temperature sensor can be extended into the system via I/O circuitry, or the sensor may wirelessly communicate via the communication circuitry with the controller circuitry. A user may enter settings, such as threshold alarm settings, via touchscreen on the settings page, including enabling text message notifications.

Monitoring Radon Fan

The system may include a duct mounted air flow sensor to monitor radon fan for proper operation. This function, may be accomplished with, for example, pressure sensors or pitot tubes installed in discharge ductwork of a radon fan. Wires from the air flow sensor can be extended into the system via I/O circuitry, or the sensor may wirelessly communicate via the communication circuitry with the controller circuitry. A user may enter settings, such as threshold alarm settings, via touchscreen on the settings page, including enabling text message notifications.

Monitoring Your Sewage Ejector Pump

The system may include a level sensor to monitor operation of a sewage ejector pit is working normally. This function, may be accomplished with, for example, a level sensor installed in the sewage ejector pit. Wires from the level sensor can be extended into the system via I/O circuitry, or the sensor may wirelessly communicate via the communication circuitry with the controller circuitry. A user may enter settings, such as threshold alarm settings, via touchscreen on the settings page, including enabling text message notifications.

Monitoring External Device Operational Status

The system may include in the I/O circuitry input channels to monitor signals such as contact inputs, analog inputs and communication channels from external devices such as a dehumidifier, humidifier, water softener and any other device capable of outputting indications of operational status. The operational status may be communicated wirelessly or via a wired connection to the I/O circuitry of the system.

Monitoring Room Temperature

HFPA system may include a temperature sensor in the electronics enclosure. An predetermined high or low temperature in the enclosure or mechanical room where the system resides may be reported as an alarm, such as reported wirelessly to a user's cell phone(s). Threshold temperatures for generating such alarms may be set by a user via a setup page on the display screen 4331.

Although specific components are described above, methods, systems, and articles of manufacture described herein may include additional, fewer, or different components. For example, controller circuitry may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same apparatus executing a same program or different programs. The components may be resident on separate hardware, such as separate removable circuit boards, or share common hardware, such as a same memory and processor for implementing instructions from the memory. Programs may be parts of a single program, separate programs, or distributed across several memories and processors.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An appliance system comprising:

a plurality of pumps included in a lower portion of a structural frame, the pumps driven by an electric power source to selectively extract a flow of liquid from a sump basin in which the lower portion of the structural frame is inserted and discharge the flow of liquid at an outlet;

a shroud positioned above the sump basin and forming an upper portion of the structural frame;

a level sensor configured to measure a level of the liquid in the sump basin;

a controller circuitry disposed in the shroud positioned above the sump basin, the controller circuitry configured to control cooperative operation of the pumps and to monitor and store in memory operational parameters comprising pump start frequency, run duration and sump basin level based on the level of liquid measured by the level sensor, and a sump basin level setpoint, the controller circuitry further configured to automatically adjust the setpoint of the sump basin level based on the operational parameters and a local water table value; and a cover configured to cover a top opening of the sump basin and provide a divider between the controller circuitry disposed in the shroud and the plurality of pumps included in the lower portion of the structural frame.

2. The appliance system of claim 1, wherein the shroud includes a controller enclosure separated away from the cover by a first leg and a second leg, the first and second legs extending between the cover and the controller enclosure on opposite peripheral edges of the cover, the controller enclosure housing the controller circuitry.

3. The appliance system of claim 2, wherein the controller enclosure comprising a display screen mounted in a wall of the controller enclosure.

4. The appliance system of claim 1, wherein the controller circuitry further comprises a first DC power supply and a second DC power supply, each of the first and second DC power supplies configured to supply DC power to the pumps.

5. The appliance system of claim 1, wherein the lower portion of the structural frame being a wet component removeably positioned on a bottom of the sump basin to maintain the pumps in a predetermined position with respect to the bottom of the sump basin, and the upper portion of the structural frame being a dry component separated from the wet component by the cover.

6. The appliance system of claim 2, wherein the cover comprises a circular member with opposing planar surfaces formed therein to include a viewing window through which the pumps are viewable, and the first leg and the second leg abut at least one of the planar surfaces of the cover on opposite ends of the viewing window.

7. The appliance system of claim 1, wherein each of the pumps is coupled with a respective outlet line, and each respective outlet line comprises a one-way valve and an emergency overflow outlet, the emergency overflow outlet mountable external to a structure in which the sump basin is located to provide an emergency flow path for liquid in response to the respective outlet line being obstructed.

8. The appliance system of claim 1, further comprising an algae control system, the controller circuitry configured to automatically activate the algae control system to inject an algaecide into the sump basin on a predetermined schedule.

9. An appliance system comprising:

a cover having opposing planar surfaces and sized for receipt and sealing of an opening to a sump basin;

a structural frame forming a shroud positioned on the cover external to the sump basin, the shroud being a housing including a controller enclosure;

a controller circuitry disposed in the controller enclosure;

a structural frame positionable in the sump basin below the cover;

a level sensor configured to measure a level of the liquid in the sump basin; and a plurality of pumps disposed in the structural frame, the pumps electrically coupled with the controller circuitry via quick disconnect cables routed internally through the structural frame and the cover into the sump basin, the pumps selectively operable by the controller circuitry to evacuate a liquid from the sump basin, and the controller circuitry is configured to monitor and store in memory operational parameters comprising pump start frequency, run duration and sump basin level based on the level of liquid measured by the level sensor, and a sump basin level setpoint, the controller circuitry further configured to automatically adjust the setpoint of the sump basin level based on the operational parameters and a local water table value.

10. The appliance system of claim 9, a wherein the level sensor is disposed on the structural frame, the level sensor comprising a pressure sensor configured to supply a pressure representative of a level of liquid in the sump basin to the controller circuitry.

11. The appliance system of claim 10, further comprising a fill valve mounted to the cover and controlled by the controller circuitry, the fill valve coupled with a municipal water supply and including an outlet providing a water source supply in the sump basin.

12. The appliance system of claim 11, wherein the controller circuitry is configured to automatically performance test one or more of the pumps by control of the fill valve to fill the sump basin and monitoring of an evacuation flow rate with the level sensor, the controller further configured to compare the evacuation flow rate of the one or more of the pumps to a predetermined expected flow rate.

13. The appliance system of claim 12, wherein the controller circuitry is configured to receive weather information and trigger performance testing of one or more pumps in response to projection of future pump activity based on the weather information.

14. The appliance system of claim 10, wherein the controller circuitry is configured to confirm pumping capacity of the pumps by monitoring and storage in memory of operational parameters comprising pump start frequency, run duration and sump basin level based on a measured level of liquid and a sump basis level setpoint, the controller circuitry further configured to automatically confirm pumping capacity of the pumps based on the stored operational parameters and predetermined pump manufacturer rating information comprising operational cycles and runtime.

15. An appliance system comprising:

a cover forming a planar surface sized to extend beyond a plurality of peripheral edges of a sump basin;

a shroud comprising a plurality of spaced apart legs abutting the planar surface of the cover at a first end of the legs, a second end of the legs respectively coupled with a controller enclosure formed in the shroud at the second end of the legs, the second end opposite the first end;

a plurality of pumps fixedly mounted in a structural frame, the structural frame positionable in the sump basin below the cover and the shroud;

a controller circuitry disposed in the controller enclosure and configured to monitor a liquid level in the sump basin and control a plurality of power sources to selectively energize one or more of the pumps with one or more of the power sources to evacuate a liquid from the sump basin in response to the liquid level; and a motion sensor configured to sense motion in an area around the appliance system, wherein the cover is at least partially transparent, and the controller circuitry is configured to receive a signal from the motion sensor indicative of motion around the appliance system and energize a light source included in the sump basin in response thereto, an interior of the sump basin viewable through the at least partially transparent cover.

16. The appliance system of claim 15, wherein the controller circuitry is further configured to selectively energize multiple pumps at a same time to match a flow rate of liquid entering the sump basin.

17. The appliance system of claim 15, wherein the controller circuitry is further configured to monitor an energy capacity of a plurality of batteries and a plurality of DC power supplies; and the controller circuitry is further configured to selectively energize one of the pumps with DC power from a respective one of the batteries or DC power supplies selected by the controller circuitry as having sufficient energy capacity available to supply the selected pump.

18. The appliance system of claim 17, wherein the controller circuitry is configured to energize all of the pumps with the DC power supplies at full pump flow to automatically perform realtime battery load testing, or in response to a rate of change of the level in the sump basin exceeding a predetermined value, or a combination thereof.

* * * * *